US011440312B2

(12) United States Patent
Jufer et al.

(10) Patent No.: US 11,440,312 B2
(45) Date of Patent: Sep. 13, 2022

(54) GRAVURE PRINTING UNITS FOR PRINTING ONTO SUBSTRATES BY A GRAVURE PRINTING METHOD

(71) Applicant: KOENIG & BAUER AG, Würzburg (DE)

(72) Inventors: Alain Jufer, L'Isle (CH); Johannes Schaede, Würzburg (DE); Volkmar Schwitzky, Würzburg (DE); Ralf Sokol, Würzburg (DE); Alain Würsch, La Tour-de-Peilz (CH); Daniel Chassot, Bienne (CH)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/057,751

(22) PCT Filed: Feb. 3, 2020

(86) PCT No.: PCT/EP2020/052579
§ 371 (c)(1),
(2) Date: Nov. 23, 2020

(87) PCT Pub. No.: WO2020/161056
PCT Pub. Date: Aug. 13, 2020

(65) Prior Publication Data

US 2021/0178748 A1 Jun. 17, 2021

(30) Foreign Application Priority Data

Feb. 5, 2019 (DE) ..... 10 2019 102 855.8
Feb. 5, 2019 (DE) ..... 10 2019 102 856.6
(Continued)

(51) Int. Cl.
*B41F 9/06* (2006.01)
*B41F 9/02* (2006.01)
*B41F 9/10* (2006.01)

(52) U.S. Cl.
CPC ..... *B41F 9/063* (2013.01); *B41F 9/021* (2013.01); *B41F 9/1009* (2013.01); *B41F 9/1045* (2013.01); *B41F 9/1081* (2013.01)

(58) Field of Classification Search
CPC ..... B41F 9/063; B41F 9/021; B41F 9/1009; B41F 9/1045; B41F 9/1081; B41F 9/065;
(Continued)

(56) References Cited

U.S. PATENT DOCUMENTS 4,552,066 A * 11/1985 Giori ..... B41F 21/00 101/152
4,604,951 A 8/1986 Ichikawa et al.
(Continued)

FOREIGN PATENT DOCUMENTS

CN 101544098 B 6/2012
DE 636641 C 10/1936
(Continued)

OTHER PUBLICATIONS

International Search Report of PCT/EP2020/052579 dated May 27, 2020.

*Primary Examiner* — Leslie J Evanisko
*Assistant Examiner* — Leo T Hinze
(74) *Attorney, Agent, or Firm* — Mattingly & Malur, PC

(57) ABSTRACT

Recess printing units are usable for printing on a substrate and using associated methods for operation. The recess printing units comprise an intaglio printing cylinder, which provides an image-forming pattern of recesses on its circumference; and an inking unit for applying ink to the pattern of recesses that are provided on the intaglio printing
(Continued)

cylinder. The inking unit comprises a first inking unit cylinder which has, in a region of its lateral surface, recesses corresponding to the recesses in the intaglio printing cylinder and to which recesses ink can be supplied by an ink application device in the region of an application point lying on the circumference of the first inking unit cylinder. A second inking unit cylinder cooperates with the first inking unit cylinder and has, in a region of the lateral surface of the second inking unit cylinder, elevations corresponding to recesses in the intaglio printing cylinder or raised regions corresponding to regions of the image-forming pattern of recesses on the intaglio printing cylinder, which regions comprise recesses. The ink application device also comprises, on at least a downstream side of the application point, with respect to the operating direction of rotation of the inking unit cylinder comprising the recesses, a retaining device in the form of a doctor blade or an ink knife. The second inking unit cylinder comprises, on a lateral surface thereof, elevations corresponding to engraving on the intaglio printing cylinder.

13 Claims, 60 Drawing Sheets

(30) Foreign Application Priority Data

| | | |
|---|---|---|
| Feb. 14, 2019 | (DE) | 10 2019 103 788.3 |
| Feb. 22, 2019 | (DE) | 10 2019 104 591.6 |
| Feb. 28, 2019 | (DE) | 10 2019 105 067.7 |
| Mar. 26, 2019 | (DE) | 10 2019 107 735.4 |
| May 7, 2019 | (DE) | 10 2019 111 806.9 |
| Jul. 8, 2019 | (DE) | 10 2019 118 435.5 |

(58) Field of Classification Search
CPC ... B41F 9/1027; B41F 31/002; B41F 33/0081
See application file for complete search history.

(56) References Cited

U.S. PATENT DOCUMENTS

| | | | | |
|---|---|---|---|---|
| 7,114,437 | B2 * | 10/2006 | Kolbe | B41F 9/1009 101/169 |
| 7,448,321 | B2 * | 11/2008 | Rugamer | B41F 13/0045 101/174 |
| 9,211,696 | B2 | 12/2015 | Schwitzky et al. | |
| 9,333,739 | B2 * | 5/2016 | Scharkus | B41F 33/10 |
| 9,533,486 | B2 | 1/2017 | Kress et al. | |
| 9,597,864 | B2 * | 3/2017 | Kersten | B41F 13/0008 |
| 2013/0042777 | A1 * | 2/2013 | Kamoda | B41F 33/02 101/367 |
| 2015/0258777 | A1 | 9/2015 | Schwitzky et al. | |
| 2016/0221325 | A1 | 8/2016 | Kress et al. | |
| 2016/0279925 | A1 * | 9/2016 | Scharkus | B41F 11/02 |

FOREIGN PATENT DOCUMENTS

| | | | |
|---|---|---|---|
| DE | 69705080 | T2 | 10/2001 |
| DE | 010126264 | A1 | 12/2002 |
| DE | 102013205860 | B4 | 10/2014 |
| DE | 102013217948 | A | 3/2015 |
| EP | 1995062 | A1 | 11/2008 |
| EP | 2909033 | B1 | 9/2017 |
| GB | 626200 | A | 7/1949 |
| WO | 2004069538 | A2 | 8/2004 |
| WO | 2005077656 | A1 | 8/2005 |
| WO | 2011077350 | A1 | 6/2011 |

* cited by examiner

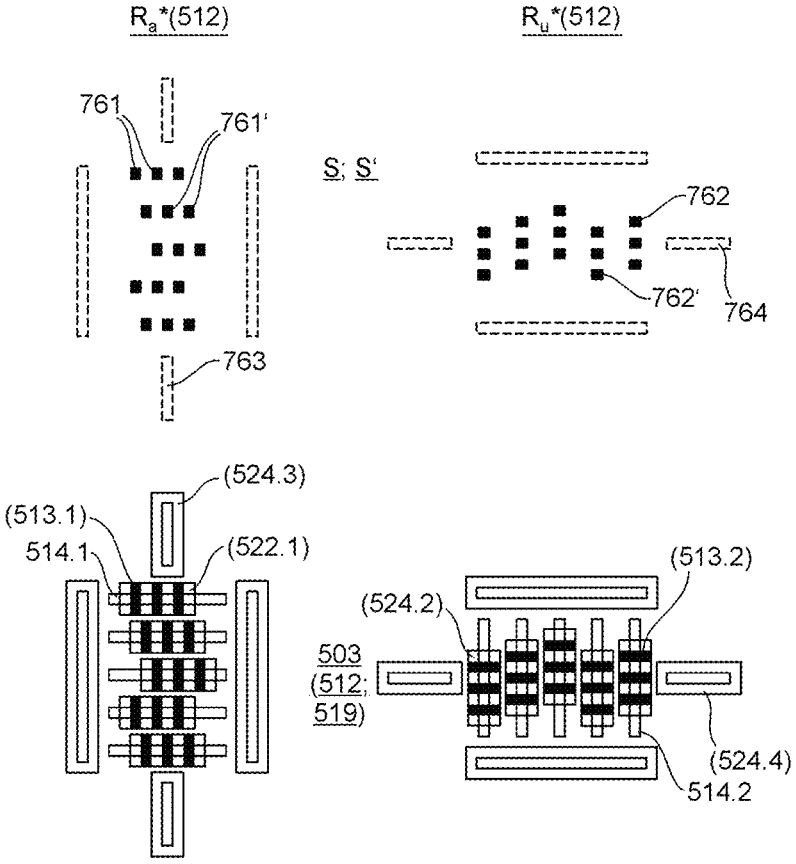
Fig. 43 a) b)
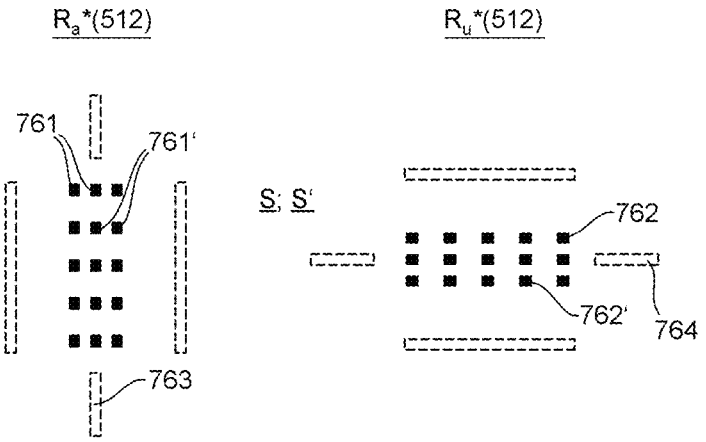
Fig. 44 a) b)

GRAVURE PRINTING UNITS FOR PRINTING ONTO SUBSTRATES BY A GRAVURE PRINTING METHOD

CROSS-REFERENCE TO RELATED APPLICATIONS

This application is the U.S. National Phase, under 35 U.S.C. § 371, of PCT/EP2020/052579, filed Feb. 3, 2020; published as WO 2020/161056 A1 on Aug. 13, 2020 and claiming priority to DE 10 2019 102 855.8, filed Feb. 5, 2019; to DE 10 2019 102 856.6; filed Feb. 5, 2019; to DE 10 2019 103 788.3, filed Feb. 14, 2019; to DE 10 2019 104 591.6, filed Feb. 22, 2019; to DE 10 2019 105 067.7, filed Feb. 28, 2019; to DE 10 2019 107 735.4, filed Mar. 26, 2019; to DE 10 2019 111 806.9, filed May 7, 2019; and to DE 10 2019 118 435.5, filed Jul. 8, 2019, the disclosure of which are expressly incorporated herein in their entireties by references.

FIELD OF THE INVENTION

The present invention relates to gravure printing units for printing onto a substrate by a gravure printing method. The gravure printing unit prints onto a substrate according to a gravure printing method. The gravure printing unit has a forme cylinder, which comprises, on its circumference, an image-forming pattern of recesses, and has an inking unit for inking the pattern of recesses provided on the forme cylinder. The inking unit comprises a first inking unit cylinder, which has, in a region of its outer cylindrical surface, recesses that correspond to recesses on the forme cylinder. An inking device is provided, by the use of which, the first inking unit cylinder is inked at an application point located on its circumference. A second inking unit cylinder cooperates with the first inking unit cylinder and has, in a region of its outer cylindrical surface, elevations that correspond to recesses on the forme cylinder or has raises areas, which correspond to areas of the image-forming pattern of recesses on the forme cylinder and which comprise the recesses. The second inking unit cylinder forms a nip point with the first inking cylinder and has, in the region of its outer cylinder surface, a plurality of ink-transferring elevations.

BACKGROUND OF THE INVENTION

EP 2 909 033 B1 discloses an intaglio printing press having a printing unit in which a plate cylinder configured as a gravure cylinder is inked indirectly via an ink collecting cylinder. Said ink collecting cylinder receives the printing ink via multiple chablon rollers, which are in turn inked by inking devices. In one embodiment, the inking is carried out by two ink application rollers, which receive the ink via a duct roller that cooperates with an ink fountain. In another embodiment, an ink transfer roller is additionally provided between duct roller and chablon roller.

U.S. Pat. No. 4,604,951 A discloses an intaglio printing press comprising a plate cylinder that carries a printing plate, an application roller that is in rolling contact with the plate cylinder and has on its circumference a structure of ink-transferring raised areas, and an inking device, which comprises a duct roller and is in rolling contact with the application roller. The duct roller has essentially the same circumference as the application roller and, on its outer circumference, has recesses of different depths that correspond to the recesses on the printing plate. During printing, a distance of 0.03 to 0.05 mm is set between the duct roller and the ink blade. Further provided is an adjustment mechanism for positioning the structured duct roller in relation to the plate cylinder in the circumferential direction and in the axial direction.

Known from WO 2005/077656 A1 is an inking system of an intaglio printing press, in one embodiment of which the gravure printing plate is inked directly by a chablon roller, which is in turn inked by a selective inking cylinder. Printing ink is applied to the circumferential surface of the latter by a spraying device, with the excess ink being removed by means of a wiping roller prior to contact with the chablon roller. In the remaining embodiments, the gravure printing plate is inked indirectly via a transfer or collecting cylinder, which is inked via one or more chablon rollers, which is or are in turn inked by a selective inking cylinder. Printing ink is applied to the circumferential surface of the latter by a spraying device or a duct roller cooperating with an ink fountain, with the excess ink once again being removed by means of a wiping roller prior to contact with the chablon roller.

CN 101544098 B relates to a duct roller, an ink transfer device, and an ink transfer system of a gravure printing press. The ink is transferred from an ink reservoir via a duct roller, which has engraving on its circumference that corresponds to the engraving on the gravure cylinder, to an elastic inking roller and from there to the gravure cylinder. During application of the ink to the duct roller, the outer surface of said roller is in physical contact with a hook-shaped scraper for scraping the ink off of the non-engraved areas. In this way, rather than a uniform layer of ink, an ink pattern of varying thickness, similar to the form of a relief, that corresponds to the pattern of engravings on the gravure cylinder is applied to the elastic inking roller. The contact pressure on the outer cylindrical surface can be adjustable via an adjustment device.

WO 2011/077350 A1 discloses an intaglio printing press comprising a print position between the forme cylinder and impression cylinder, an ink collecting cylinder, five chablon cylinders cooperating with said ink collecting cylinder, and inking units for inking the chablon cylinders; in one variant, the forme cylinder and the impression cylinder are assigned a common rotational drive, the ink collecting cylinder is assigned its own dedicated drive, the five chablon cylinders are assigned five drives, and the inking units are assigned one or more drives. The motors of the drives that rotate these cylinders or units in this embodiment, including during operation, are preferably embodied as torque motors. This embodiment is provided with a correcting and adjusting system for controlling the rotational position of the ink collecting cylinder and of the chablon cylinders, in order to ensure the proper register with respect to the forme cylinder.

WO 2004/069538 A2 relates to an intaglio printing press comprising a print position formed between the forme cylinder and impression cylinder, an ink collecting cylinder, five chablon cylinders cooperating with said ink collecting cylinder, and inking units for inking the chablon cylinders, wherein each of the chablon cylinders, referred to in this case as "selector cylinders", is driven by a drive motor independently of the ink collecting cylinder. In one embodiment, said drive motor is driven together with a duct roller of the ink fountain, and in another is driven on its own, in which case the duct roller is driven by the ink collecting cylinder via a gear train. One of the goals of this drive is to vary the relative speed between ink collecting cylinder and selector cylinder in order to compensate for any elongation of a printing plate on the forme cylinder. Elongation is detected and corrected by means of an engraving pattern on the forme cylinder based on two sets of adjacent lines, of which a middle line or a line lying further outward will be inked by the chablon cylinder and printed onto the product, depending on the presence of plate elongation.

GB 626 200 A relates to the printing of transfer paper for printing onto ceramic using a printing unit that operates by the letterpress process, in which the letterpress forme receives printing ink from an inking unit roller, which has linear recesses running in parallel on its circumference.

SUMMARY OF THE INVENTION

The object of the present invention is to create gravure printing units for printing onto substrate by a gravure printing process.

The object is attained according to the present invention by the provision of the inking device having, on at least the downstream side of the application point, in the operating direction of rotation of the inking unit cylinder that comprises the recesses, a retaining means configured at a doctor blade, which retaining means, in an operating position, is in physical contact with the outer cylindrical surface of the first inking unit cylinder. By the use of this retaining means, printing ink that is lying on, and that was previously applied to non-engaged regions of the outer cylindrical surface of the first inking unit, can be removed. The second inking unit cylinder comprises, on its outer cylindrical surface, elevations that correspond to engravings on the forme cylinder, which elevations, in a region of their smallest diameter, have a maximum width of 0.6 mm or have a width that is no more than 0.5 mm greater than a width of a corresponding engraving on the forme cylinder or which match individual engravings on the forme cylinder with a width that is a maximum of 10 times greater or which individually match engravings on the forme cylinder that are spaced by 1 mm from one another or which second inking unit comprises, on its outer cylindrical surface, areas that have at least five non-contiguous elevations over a surface area of 10 $cm^2$ or that have two or more non-continuous elevations, each of which is spaced no more than a 1000 μm from an adjacent elevation.

The advantages to be achieved with the invention consist, in particular, in that the consumption of printing ink can be reduced to a particularly low level and/or in that print images with particularly fine image structures, particularly with respect to a resolution in relation to coloration and/or with respect to an ink density or ink intensity, can be achieved reliably and in a stable process.

A gravure printing unit according to the invention for printing onto substrate by a gravure printing method comprises a forme cylinder, which has on its circumference an image-forming pattern of recesses, and an inking unit for inking the pattern of recesses provided on the forme cylinder, said inking unit comprising a first inking unit cylinder, which has recesses in the region of its outer cylindrical surface that correspond to recesses on the forme cylinder, an inking device by means of which the first inking unit cylinder can be inked at an application point located on its circumference, and a second inking unit cylinder, which cooperates with the first inking unit cylinder and has, in the region of its outer cylindrical surface, elevations, in particular ink-transferring elevations, that correspond to recesses on the forme cylinder, or raised areas that correspond to areas, comprising the recesses, of the image-forming pattern of recesses on the forme cylinder.

According to a first particularly advantageous embodiment, the inking device has, on at least the downstream side of the application point in the operating direction of rotation of the inking unit cylinder that comprises the recesses, a retaining means configured as a doctor blade, which in the operating position is in physical contact with the outer cylindrical surface of the first inking unit cylinder, and by means of which, in particular downstream of the ink application point and upstream of the first nip point with the second inking unit cylinder, as viewed in the operating direction of rotation, printing ink lying on or previously applied to non-engraved regions of the outer cylindrical surface of the first inking unit cylinder can be removed.

In this way, corruption of the print image between two image elements, for example with different coloring, and/or a blurring of the image printed on the substrate can be prevented or at least minimized.

In addition or alternatively to this, according to a second particularly advantageous embodiment, the second inking unit cylinder comprises elevations on its outer cylindrical surface that correspond to engravings on the forme cylinder and that, in the region of their smallest diameter, have a maximum width of 1.0 mm and/or a width that is no more than 0.8 mm greater than the width of a corresponding engraving on the forme cylinder and/or which match individual engravings on the forme cylinder with a width that is no more than ten times greater and/or which match individual engravings on the forme cylinder that are spaced by 1000 μm or less from one another, and/or which comprises regions on its outer cylindrical surface that have at least five, preferably at least 10 non-contiguous elevations over a surface area of 10 $cm^2$ and/or that have two or more non-contiguous elevations, each of which is spaced a maximum distance of 1000 μm from an adjacent elevation.

Such an embodiment of the relief inking cylinder, e.g. with particularly fine structures that correspond to the engravings on the forme cylinder, enables high resolution with respect to the use of multiple colors and/or with respect to intentionally varied ink density or ink intensity.

The inking device here can comprise a retaining means on at least the downstream side of the application point in the operating direction of rotation of the first inking unit cylinder comprising the recesses, by means of which, as viewed in the operating direction of rotation, printing ink applied previously to the outer cylindrical surface of the first inking unit cylinder can be removed downstream of the ink application point and upstream of the first nip point with the second inking unit cylinder. The retaining means can generally be configured as an ink blade that forms a gap with the inking unit cylinder during operation, but is advantageously configured as a doctor blade that is in physical contact with said cylinder during operation.

In addition to one of the aforementioned advantageous embodiments, in an advantageous refinement a third inking unit cylinder, preferably having an elastic and/or compressible outer cylindrical surface, can be provided between the second inking unit cylinder, which has the elevations, and the forme cylinder.

The use of such an ink collecting cylinder, for example, allows the printing forme to be inked with multiple inks simultaneously at the same nip point.

In an advantageous refinement, downstream of the doctor blade on the circumference of the first inking unit cylinder, as viewed in the operating direction of rotation, a removal device can be provided, by means of which printing ink that collects on the downstream side of the doctor blade, as viewed in the direction of rotation, is removed from the edge, or printing ink that has collected on the downstream side of the doctor blade and is carried along on the inking unit cylinder, as viewed in the direction of rotation, is prevented from entering the nip point with the second inking unit cylinder.

In an advantageous refinement, a positioning drive comprising a remotely actuable drive means can be provided, by means of which the doctor blade, an ink supply unit comprising the doctor blade and at least the parts that delimit the ink supply chamber, or the entire inking device can be set against and moved away from the outer cylindrical surface, and/or can be varied in terms of the force with which it is set against said surface, and/or which repositions the doctor blade, the ink supply unit, or the entire inking device when the operative end of the doctor blade becomes shortened due to wear. A pressurized medium-actuated actuator, in particular a pneumatic cylinder, can advantageously be provided as the drive means.

A positioning drive by means of which the retaining means, in particular embodied as a doctor blade, is repositioned automatically and/or continuously during operation, for example, contributes to constant conditions in the region of ink infeed.

In an advantageous refinement, to allow adjustment of the radial relative position of the ink supply unit, said unit can be mounted at or on a guide, configured as a guide, in particular as a rectilinear guide or as a parallelogram guide, which maintains the angle of inclination of the doctor blade and/or the ink supply unit that supports the doctor blade during positioning.

In an advantageous refinement, at least the retaining means or an ink supply unit that supports it and is mounted axially movably in the inking device can be moved axially and/or oscillated during operation in terms of its axial position relative to the inking unit cylinder that comprises the recesses, by means of a drive means.

In the removal of excess printing ink, an oscillating retaining means, for example, can effect a more even wear-conditioned removal, especially in the case of a doctor blade that is set against a cylinder during operation, and can thereby contribute to a more stable operation.

In an advantageous embodiment, said axial driving can be implemented by the drive means embodied as an electric motor acting on the retaining means or on the inking unit supporting the same via a transmission that converts the rotation of a drive means into a linear movement, preferably a transmission that comprises a rotating eccentric, in particular a transmission that comprises a drive element that is rotatable eccentrically about an axis of rotation extending, e.g. perpendicular to the desired axial direction.

In an advantageous refinement, the inking unit cylinder having the recesses can be temperature controlled and/or can be configured to allow temperature control medium to flow through it.

By controlling the temperature of the gravure inking cylinder, for example, the transport of ink is influenced, e.g. as the excess printing ink is being removed by a doctor blade.

In an advantageous refinement, the inking device can comprise an ink supply chamber, which, on the side facing the inking unit cylinder that comprises the recesses, is delimited at least partially by the outer cylindrical surface of said cylinder, and in this region forms or at least comprises the application point, wherein the inking device comprises the retaining means, on at least the downstream side of the ink supply chamber in the operating direction of rotation of the inking unit cylinder that comprises the recesses.

In an advantageous refinement, an ink distribution device having at least one ink distributor can be provided, which can be moved back and forth in the axial direction of the first inking unit cylinder by a drive means, and which comprises an end that protrudes into the ink supply chamber, at least in the working position, and/or a ink outlet of a line system provided for supplying ink, which leads into the ink supply chamber.

An ink distribution device provided in the advantageous refinement, which distributes the printing ink within the supply chamber, contributes, e.g. to stable operation by adding the freshly supplied, possibly previously temperature-controlled printing ink evenly to the ink that is already there and is possibly already mechanically stressed.

In an advantageous embodiment, the ink distributor can be arranged on a slide, which is mounted to be movable axially in a linear guide and can be moved back and forth by the drive means via a transmission that converts rotation into linear movement or in particular via a pneumatic drive, and/or a sensor device, in particular a contactless or optical sensor device or one that operates based on strain measurement, can be provided for monitoring and/or controlling the fill level of the printing ink held in the ink supply chamber, which sensor device is comprised and carried along by the ink distribution device that can be moved back and forth or, in the case of an optical or contactless sensor device, is arranged fixed to the frame.

In an advantageous refinement, the inking device and/or the retaining means for removing printing ink from the outer cylindrical surface can cooperate with and/or can be arranged for cooperation with the inking unit cylinder that has the recesses, on the side thereof that lies on the side facing the second inking unit cylinder as viewed relative to a vertical plane extending through the rotational axis of the first inking unit cylinder, in particular in the lower quadrant.

As an alternative to the latter, in another refinement the retaining means can be arranged cooperating with the first inking unit cylinder on the circumference thereof, in the region of the upper half and/or on the side thereof that rotates upward during operation, and/or in the working position, at least the operative end of the retaining means can be inclined relative to the tangent such that the tangent at the point of physical contact or at the point of the shortest distance forms an acute angle with the retaining means, on the side thereof facing the ink application point.

In an advantageous refinement, the printing unit can comprise multiple inking trains, in particular at least four, each of which comprises an inking device, a first inking unit cylinder comprising recesses, and a second inking unit cylinder, via which inking trains the forme cylinder can be indirectly or directly inked. In that case, the patterns of recesses of the first inking unit cylinders of two inking trains are preferably different from one another and/or the patterns of elevations or raised areas of the second inking unit cylinders of two inking trains are different from one another. In particular, their patterns of recesses or elevations are different from one another in the respective region of the outer cylindrical surface that corresponds to the same image element to be printed.

In an advantageous refinement, the inking device can be mounted, coupled to the first inking unit cylinder having the recesses, in or on a frame in such a way that when the first inking unit cylinder is moved radially, the inking device is moved along with it while maintaining the radial relative position between inking unit cylinder and retaining means.

Such a coupled radial bearing of the gravure inking cylinder and the inking device that inks it allows the thrown-on position of the gravure inking cylinder to be varied without simultaneously changing the supply of ink to the same.

In an advantageous embodiment, said inking unit cylinder and the side parts of the subframe supporting the inking device can be arranged on both sides on bearing rings supported eccentrically in the frame or on side parts mounted linearly movably in the frame, and/or the joint movement can be implemented by a drive means embodied as an electric motor or as a pressurized medium-actuated piston/cylinder system, and/or a stop means, in particular an adjustable stop means, which limits movement in the throwing-on direction, can be provided.

In an advantageous refinement, the first inking unit cylinder, which has the recesses, can be mounted in or on the frame such that it can be removed for replacement or for maintenance and/or makeready purposes.

In an advantageous refinement, the first inking unit cylinder, which has the recesses, can be mounted in or on a frame section that can be moved away from a frame that supports at least the forme cylinder, and/or the inking unit can be configured as separable between the first and second inking unit cylinders.

In an advantageous refinement, in a line system that supplies the inking device with printing ink a temperature control device can be provided, by means of which the temperature of the printing ink to be supplied can be controlled.

Controlling the temperature of the printing ink before it enters the ink supply chamber of the inking device, as provided for in an advantageous refinement, contributes to stable printing conditions and/or enables a short start-up time.

In an advantageous refinement, the first inking unit cylinder can comprise a cylinder body that is or can be mounted rotatably in the inking unit, on which a circumferentially closed ink transfer forme sheath that carries the recesses of the first inking unit cylinder on its outwardly facing surface is or can be detachably arranged.

Embodying the ink-delivering ink transfer forme on the gravure inking cylinder as a sheath, for example, e.g. a replaceable sheath, enables, e.g., a particularly economical and thus potentially more frequent replacement, which can serve to maintain quality and/or to simplify logistics, for example.

In an advantageous refinement, the first inking unit cylinder can be configured as removable operationally, along with its end-face cylinder journals, from the inking unit between the frame walls of the frame, along a removal path that extends in a plane perpendicular to the rotational axis, for replacement and/or for makeready purposes. The first inking unit cylinder, along with its cylinder journals arranged fixed to the end faces of the cylinder, is preferably shorter in length than the inside width between the two frame walls of the frame that support the inking unit cylinder at its end faces, or between side parts of a subframe arranged on the inner side of the frame walls of the frame. Radial bearings that accommodate end-face cylinder journals are arranged, e.g. within an inside width between the two frame walls of the frame that support the inking unit cylinder at its end faces, or between side parts of a subframe arranged on the inner side of the frame walls of the frame, and/or a coupling, e.g. a detachable coupling, in particular a coupling that is unique and/or is free of play with respect to its angular position, is provided in the drive train between a positive rotational drive and a drive-side cylinder journal.

In an advantageous refinement that is an alternative to the latter refinement, in at least one makeready situation in which the entire inking unit cylinder, the cylinder body, or an ink transfer forme sheath carried by the cylinder body is to be and/or can be removed axially, the inking unit cylinder or a cylinder body comprised by it can be supported or supportable at only one of its end faces on a first frame side on the frame, while the inking unit cylinder or the cylinder body thereof is unsupported at its other end face and does not overlap with the frame, at least in the region where the cross-sectional area of said cylinder projects axially into the frame plane, and/or is freely accessible from outside of the frame alignment. To allow the inking unit cylinder to be fitted with a new or renewed ink transfer forme, bearing means that support the inking unit cylinder on the first frame side or a frame wall element that accommodates such bearing means can be movable operationally from a working position, in which they support the inking unit cylinder to enable radial rotation, to a makeready position, in which they open up the pathway for axial removal of the inking unit cylinder or a cylinder body comprised by the inking unit cylinder from the inking unit or for axial removal of a circumferentially closed ink transfer forme sheath from the cylinder body.

In an advantageous refinement, the first inking unit cylinder can comprise a cylinder body that is or can be supported rotatably in the inking unit, which carries directly or indirectly on its outer cylindrical surface a ceramic layer, on the outwardly facing surface of which the recesses of the first inking unit cylinder are provided.

In an advantageous refinement, the forme cylinder can have, on its circumference, within the printing width and printing length to be inked but outside of a region lying image-forming pattern of recesses that provide the print image of one or more copies, at least one first linear recess for printing at least one first image element to be used for checking a relative position between the forme cylinder and the first inking unit cylinder, said first linear recess overlapping on the forme cylinder only partially with a projection, obtained by rolling, of a linear recess provided in a defined position and location on the circumference of the first inking unit cylinder for checking the relative position.

In an advantageous refinement, the first inking unit cylinder can be supported, axially movable, in a frame of the gravure printing unit, and can be movable axially by means of an axial drive having a drive means.

In an advantageous refinement, the inking unit cylinder and the inking device for inking the same can be connected to one another mechanically via side parts of a subframe, which is mounted movably in the frame, such that when the inking unit cylinder is repositioned radially, the inking device is forcibly moved along with it, so that a radial relative position between inking unit cylinder and inking device is maintained.

In an advantageous refinement, during production operation the first inking unit cylinder can be drivable and/or is driven individually by a preferably closed-loop angular position controllable drive that is mechanically independent of the drive of the second inking unit cylinder, or can be drivable and/or is driven together with the second inking unit cylinder by a preferably closed-loop angular position controllable drive that is mechanically independent of drive means for rotating the forme cylinder during production operation.

In an advantageous refinement, the drive motor can be configured as a torque motor. In a drive controller, assigned to the drive motor, of the drive that drives the first inking unit cylinder and/or of the drive that drives the second inking unit cylinder, a rule to be applied cyclically to each printing length can be implemented, by means of which a deviation from an angular position curve that is synchronous to the forme cylinder is varied and a change in length, induced by the production operation, of a printing forme provided on the circumference of the forme cylinder is at least partially corrected.

In an advantageous refinement, recesses on the second inking cylinder that correspond to recesses on the forme cylinder can comprise a supporting ridge, which interrupts the recess on the second inking cylinder that corresponds to the continuous recess on the forme cylinder, and the upper surface of which lies at the level of the undisrupted, i.e. non-engraved outer cylindrical surface of the first inking cylinder.

In a particularly advantageous embodiment of an aforementioned printing press, in addition to comprising a substrate infeed by which the substrate to be printed can be fed into the printing press on the input side, a first conveyor line by which the substrate can be fed to the at least one printing unit, a product receiving unit by which the substrate, which has been printed on at least one side, can be combined into bundles, and a second conveyor line by which the substrate can be fed directly or indirectly to the product receiving unit, said printing press can also comprise a gravure printing unit, in particular an intaglio printing unit, in an aforementioned embodiment.

For checking and/or correcting the register between gravure inking cylinder and forme cylinder, image elements provided in one advantageous refinement, for example, enable a rapid and targeted optimization of the printing result, particularly if an individual drive is used for the gravure inking cylinder alone or for the gravure inking cylinder together with the relief inking cylinder.

In an advantageous embodiment, during operation of a gravure printing unit, printing ink that has been applied to the outer cylindrical surface of the first inking unit cylinder, which has the recesses, is first removed from the outer cylindrical surface of the first inking unit cylinder by a retaining means configured as a doctor blade, which is in physical contact with said outer cylindrical surface, before said printing ink reaches a nip point with the second inking unit cylinder.

In an advantageous embodiment, the printing ink that remains in the region of the recesses is transferred at the nip point to elevations provided on the outer cylindrical surface of the second inking unit cylinder, which correspond to recesses on the forme cylinder or to regions of an image-forming pattern of recesses on the forme cylinder, and which, in the region of their smallest diameter, have a maximum width of 0.6 mm and/or a width that is no more than 0.5 mm greater than the width of the corresponding engraving on the forme cylinder, and/or which match individual engravings on the forme cylinder that are no more than ten times greater in width and/or which individually match engravings on the forme cylinder that are spaced 1 mm from one another, for example, and/or comprises on its outer cylindrical surface regions having at least five non-contiguous elevations over a surface area of 10 $cm^2$ and/or having two or more non-contiguous elevations, each of which is spaced a maximum distance of 1,000 μm from an adjacent elevation. The solution according to the invention and the various refinements thereof are particularly advantageous in connection with a recess or intaglio printing press or a recess or intaglio printing unit or in connection with a printing method that operates based on a recess or intaglio printing method, in particular for printing securities, preferably for banknote printing.

The aforementioned aspects and other aspects that may arise, e.g. in the following description can contribute, individually or in groups, to realizing a selective ink infeed of sufficient quality in the printed product and/or to stable production.

Particular advantages of an aforementioned printing unit are realized in a printing press configured as a security printing press and/or as a printing press for processing sheet-format substrate and/or as a gravure printing press operating according to the intaglio method, which comprises a substrate infeed, by which the substrate to be printed can be fed into the printing press on the input side, a first conveyor line by which the substrate can be fed to the at least one printing unit, a second conveyor line by which the substrate can be fed directly or indirectly to a product receiving unit, by means of which the substrate, which has been printed on at least one side, can be combined into bundles.

The aforementioned advantageous embodiments, variants, and refinements can each be combined individually but also in multiples, provided such combination does not involve incompatible or conflicting objects.

Further variants, refinements, and details may be found individually or in combinations in the following description and in the dependent claims.

BRIEF DESCRIPTION OF THE DRAWINGS

Exemplary embodiments of the invention are illustrated in the set of drawings and will be described in greater detail below.

The drawings show:

FIG. 43 a configuration of test fields for checking and, if necessary, adjusting or correcting the relative position of gravure inking cylinder and forme cylinder during printing via multiple inking trains a) in the axial direction and b) in the circumferential direction;

FIG. 44 a positioning of the test elements of FIG. 43 in the correct relative position, a) in the axial direction and b) in the circumferential direction;

DESCRIPTION OF PREFERRED EMBODIMENTS

Figure 1A:
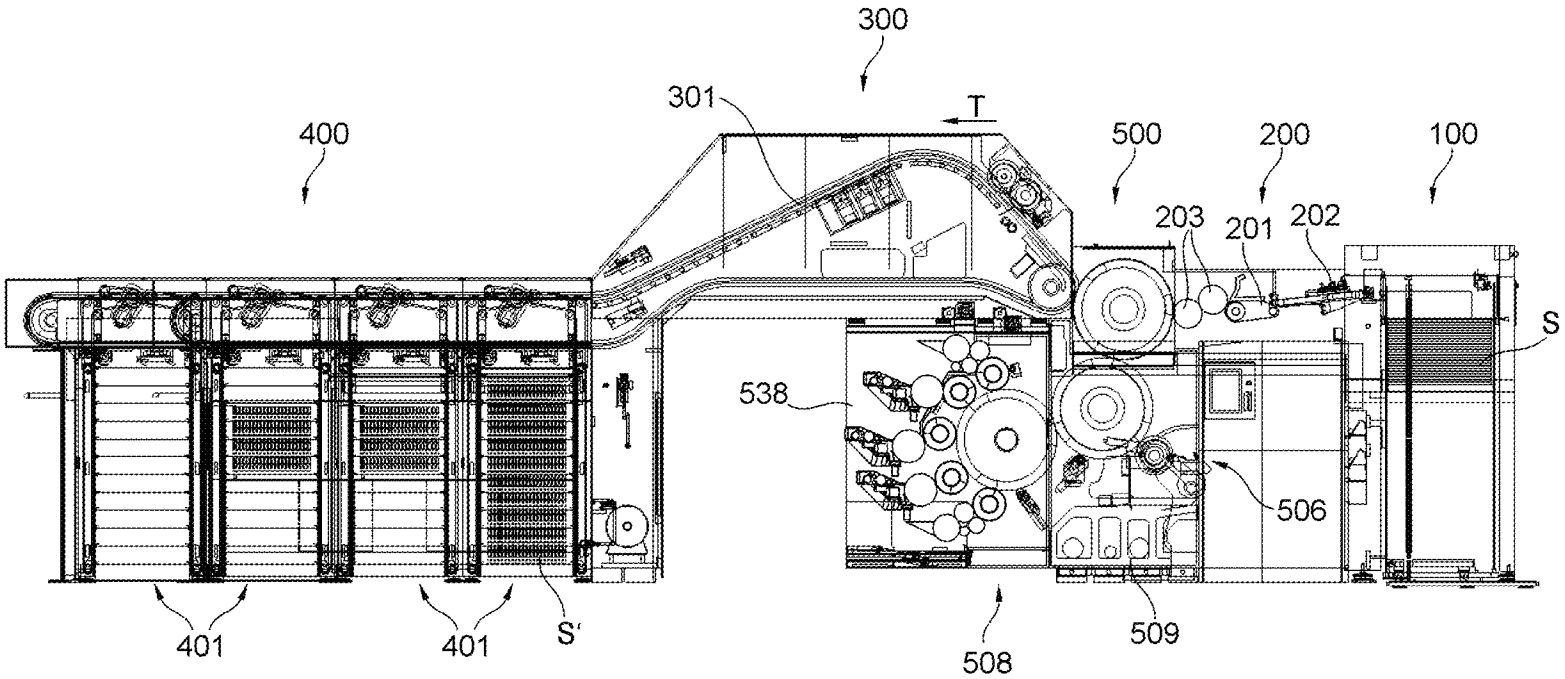
FIG. 1*a* a side view of a printing press, in particular a gravure printing press in a first embodiment.

A printing press, in particular a security printing press, comprises at least one printing unit 500, by means of which substrate S can be printed at least by a gravure printing method, a substrate infeed 100, for example, by which the substrate S to be printed can be fed to the printing press on the input side, a first conveyor line 200 by which the substrate S can be fed to the at least one printing unit 500, a product receiving unit 400 by which the substrate S' that has been printed on at least one side can be combined into bundles, and a second conveyor line 300 by which the substrate S' can be fed, optionally via additional processing units, to the product receiving unit 400.

The printing press is configured, e.g. as a sheet-fed printing press, in particular as a sheet-fed gravure printing press, preferably as a sheet-fed printing press that prints in an intaglio printing process. The intaglio printing process is a gravure printing process that is preferably used for the industrial production of banknotes, security documents, or security elements.

Figure 1B:
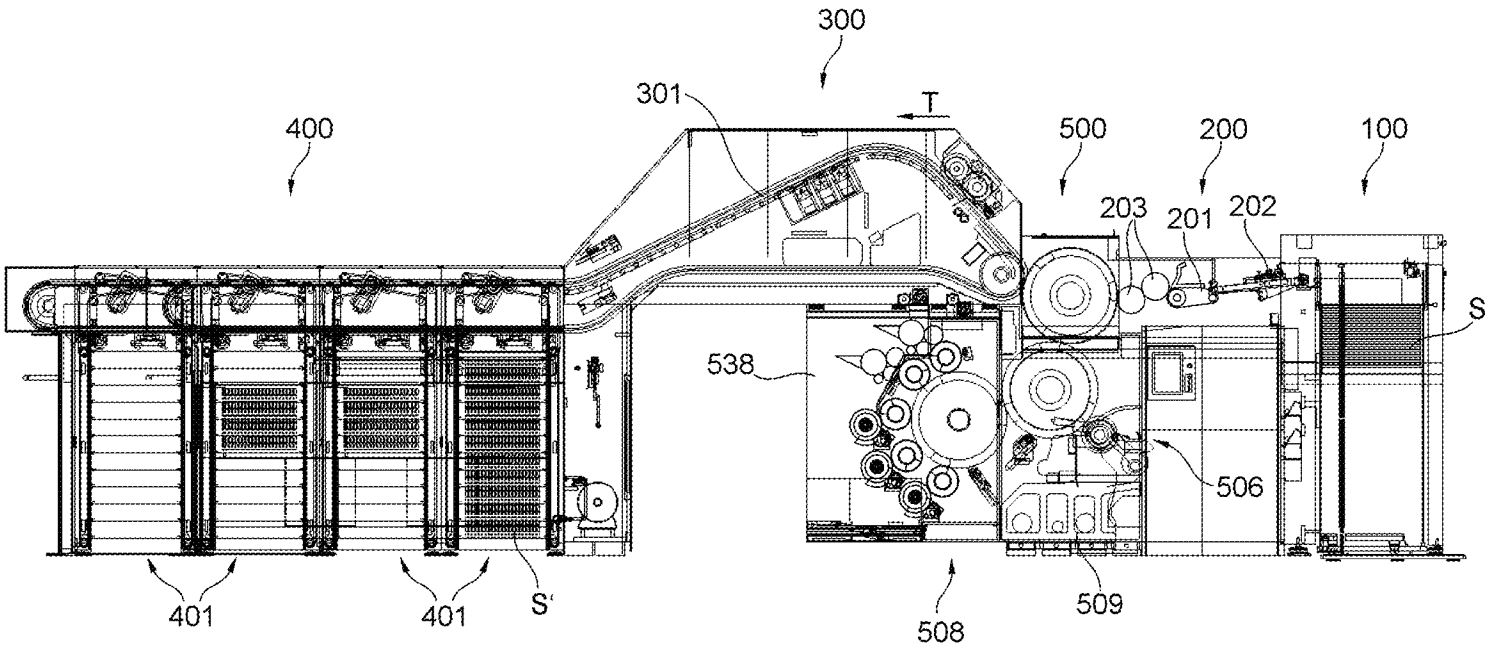
FIG. 1*b* a side view of a printing press, in particular a gravure printing press in a second embodiment.

The printing press, which preferably prints by a gravure printing process, in particular in an intaglio printing process, in a preferred embodiment as a sheet-fed printing press comprises the at least one printing unit 500 that operates according to a gravure printing process, in particular an intaglio printing process, along with preferably at least one substrate infeed 100 embodied as a sheet feeder 100, by means of which a substrate S to be printed, in the form particularly of stacked substrate sheets S, e.g. printing substrate sheets S, in particular security paper sheets S, is or at least can be provided on the input side of the printing press. The edges of the rectangular substrate sheets S measure, e.g., between 475×450 mm and 700×820 mm; the grammage of the substrate sheets S is, e.g., between 70 g/m$^2$ and 120 g/m$^2$. The printing press further comprises, as part of the first conveyor line 200, a sheet infeed 201, by means of which substrate sheets S furnished at the sheet feeder 100 are or at least can be fed, e.g. via conveying means 202 and/or one or more transfer drums 203, to the first printing unit or to a first printing unit 200 of the printing press in series, i.e. individually in succession. A rocking gripper system is preferably provided for transferring the substrate sheets S to the first transfer drum 203. Downstream of the last printing unit or a last printing unit 500, the printing press further comprises, e.g. a transport device 301 comprised by the second conveyor line 300, configured, for example, as a revolving conveyor belt or as a revolving chain system, in particular a chain gripper system, to which the substrate sheets S' that have been printed at least by the printing unit 500 are transferred directly or via at least one or more intermediate cylinders comprised, e.g., by the second conveyor line 300, wherein substrate sheets S' that have been transferred to the transport device 301 are or at least can be transported by means of said device to a processing unit downstream or to a product receiving unit 400, configured as delivery 400, in this case pile delivery 400, e.g. multi-pile delivery, where they are or at least can be deposited. In the embodiment of FIGS. 1*a* and 1*b*, the pile delivery 400 comprises, e.g., four piles or pile spaces 401 arranged one behind the other, as viewed in the direction of transport T of the substrate sheets S; S'. In the region of the transport device 301, an e.g. optoelectronic, preferably camera-based inspection system (not denoted) may be provided, by means of which the quality of the printed substrate sheets S' is or at least can be checked. The substrate sheets S' are inspected particularly to ensure that they are free of defects as compared with a designated master. Depending on the results of this inspection, the substrate sheets S' are then deposited on a designated pile in the multi-pile delivery.

In the case of a printing press configured as a web-processing press, the printed images of a certain printing length are or will be formed not as substrate sections S; S' formed by substrate sheets S; S' but as substrate sections S; S' formed by repeating lengths arranged in a row, which are then or can then be wound to form a product roll or cut into substrate sheets S; S' and stacked.

Generally, the at least one printing unit 500 operating according to a gravure printing method can be provided with one or more additional printing units operating by the same printing method or by different printing methods in the first and/or second conveyor line 200; 300.

The printing unit 500 operating by a gravure printing method, in particular an intaglio printing method, hereinafter also referred to as gravure printing unit 500, in particular as recess printing unit 500 or intaglio printing unit 500, comprises at least one printing unit cylinder 501 also acting and/or designated as impression cylinder 501 and a printing unit cylinder 503 that forms a printing nip 502 with the impression cylinder 501 and is embodied as a forme cylinder 503 for gravure printing, in particular intaglio printing cylinder 503, wherein the impression cylinder 501 and the forme cylinder 503 preferably are or at least can be thrown onto one another under high pressure. In the embodiment as a printing press for processing sheet-format substrate S; S', the impression cylinder 501 preferably comprises on its circumference one or m axially extending cylinder channels, each having a holding means, e.g. a gripper bar, by means of which the sheet-format substrate S resting on impression cylinder 501 can be conveyed through the printing nip 502. On its circumference, the forme cylinder 503 carries one or more printing formes 504 having a pattern of recesses 514 that form the basis of the print image to be printed, e.g. motif, hereinafter also referred to synonymously, where not explicitly otherwise specified, as "engravings" 514, regardless of their method of production. Unless explicitly distinguished, said printing forme 504, in particular gravure printing forme 504, is to be understood both as an outer circumferential surface of the cylinder itself that comprises the recesses 514 or engravings 514 and in a preferred embodiment as a printing forme 504 that comprises the recesses 514 or engravings 514 and is or can be detachably arranged on the forme cylinder 503, e.g. as a printing plate 504 or optionally as a printing forme sheath. Forme cylinder 503 is preferably configured as "multiple sized", e.g. m-sized, (with $m \in \mathbb{N} \leq 5$, especially $m \leq 3$), e.g. triple-sized, and is configured to accommodate m, e.g. m=3, printing formes 504 in a row and/or for printing m, e.g. m=3, print lengths, in particular for accommodating and/or printing multiple, e.g. m=3, substrate sheets S per revolution. The engravings 514 are preferably provided in an outer metal layer of the printing forme 504, which is or has been coated with a hard metallic material, in particular with chrome, after the engravings 514 are applied.

Preferably, the printing unit 500 or the printing press for printing the substrate S, in particular the substrate sheet S, is configured with multiple copies. The overall image applied to a printing length or repeat length and/or assigned to a substrate sheet S; S' or substrate section S; S' is preferably formed by the print images of a plurality of copies $N_i$, e.g. banknotes $N_i$, to be printed in multiple columns side by side and in multiple rows one after another onto the substrate S. The engraving pattern of a printing forme 504 assigned to the printing length is therefore formed by a corresponding plurality of patterns of recesses, e.g. motif engravings, in particular with the identical motif, arranged in matrix form in columns and rows. Generally, a number of first rows or columns containing a plurality of first patterns of recesses 514 of first copies $N_i$, e.g. banknotes of a first currency and/or a first value, and a number of second rows or columns containing a plurality of second patterns of recesses 514 of second copies $N_i$, e.g. banknotes of a second currency, can also be comprised on a printing length or printing forme 504.

The print image to be printed by the printing unit 500 can generally comprise a single image motif that extends, e.g. over the entire printing width and length, i.e. over one substrate section S; S'. In the case that is preferred here, however, which involves printing a plurality of copies $N_i$ per substrate section S; S', the same image motifs are printed onto each of at least a plurality of copies $N_i$, preferably onto all copies $N_i$. Such an image motif may be a spatially isolated print image region with complete image information, as is found in portraits, cultural sites, objects of daily use, landscape details, or the like. Alternatively, the image motif may be composed of alphanumeric information or of a regular or irregular pattern, e.g. without actual meaningful representational content. An image motif may also be a combination of the aforementioned characteristics. In a particularly advantageous embodiment, the image motif to be printed in the gravure or intaglio printing method can be a security feature or a portion of such a feature, which is, for example, characterized by a particularly high resolution in terms of the ink intensity and/or ink density of lines or print elements, in particular raised, that are applied in the gravure or intaglio printing process.

It is also possible for a plurality of such image motifs, spatially separated from one another, to be provided per copy $N_i$.

To remove excess ink, a removal device 506, e.g. a wiping device 506 with a wiping cylinder 507, is or at least can be set against the forme cylinder 503. The wiping cylinder 507 is coated on its outer cylindrical surface, e.g. with a plastic.

The forme cylinder 503 or a printing forme 504 provided thereon can be inked with one or preferably with multiple inks by an inking unit 508. Said inking unit 508 can be mounted such that it can be moved as a whole or in sections away from the preferably stationary printing unit part 509, which comprises the printing unit cylinders 501; 503 that form the printing nip 502, and/or can even be configured as separable therefrom.

The inking unit 508 comprises, at its upstream end as viewed in the direction of ink transport within the inking unit 508, an inking device 511, which is or can be supplied with printing ink 517 by an ink feed system, for example, and by means of which an inking unit cylinder 512, e.g. a first inking unit cylinder, can be inked. Said inking unit cylinder 512 comprises recesses 513 in the region of its outer cylindrical surface 518, hereinafter also referred to synonymously, where not explicitly specified, as "engravings" 513, regardless of their method of production, which correspond to the engravings 514 or to a portion of the engravings on the printing forme 504 of the forme cylinder 503. This does not mean that they must have the same dimensions and the same depth z as the corresponding engravings 514, but that their shape and/or depth z are in a defined relationship to one another that will be or is obtained, for example, based on regularities that are or will be established. For engravings 513 on the inking unit cylinder 512, a greater width b513, e.g. than line width b513, and/or a greater depth z is provided than for the corresponding engravings 514 on the forme cylinder 503 or the printing forme 504 comprised or carried by the same.

For at least some of the recesses 514 on the forme cylinder 503, for example, corresponding recesses 513 on the gravure inking cylinder 512 are larger on all sides of the recess 513 by at least 20 μm and/or at most 200 μm, advantageously by at least 50 μm and/or at most 150 μm, in particular by 80 to 120 μm, preferably by 100±5 μm than the corresponding recesses 513 on the forme cylinder 503. Thus, for at least some of the recesses 514 on the forme cylinder 503, a line width b513 or width b513 on the gravure inking cylinder 512 is larger, e.g. by at least 40 μm and/or at most 400 μm, advantageously by at least 100 μm and/or at most 300 μm, in particular by 160 to 240 μm, preferably by 200±10 μm, than that of the corresponding recess 514 on forme cylinder 503. Narrow line structures on the printing forme 504 can in some cases merge to form larger engraved areas, for example, on the inking unit cylinder 512 comprising the engravings 513. When there is a partial merging of engravings 513, e.g. two or more such partially contiguous recesses 513 are contiguous due to an aforementioned larger size as compared with the recesses 514 on the forme cylinder 503 and e.g. only narrow spacing, and the recesses 513 are perceptible at least on a non-merged longitudinal section, for example. There may also be areas of recesses 513 that are merged in this way, so that as a result of the larger size and due to a high line density on the forme cylinder 503, individual recesses 513, e.g. in the interior of such an area, are no longer perceptible in isolation. Nevertheless, in the following such overlapping recesses 513 on the gravure inking cylinder 512, which in this case are overlapping due to the transfer of the individual recesses 514 on the forme cylinder 503 in accordance with a regularity, are likewise regarded as corresponding to recesses 514 on the forme cylinder 503.

For the sake of simplicity, the inking unit cylinder 512 that comprises the engravings 513 is also referred to synonymously, where not explicitly specified, as "gravure inking cylinder" 512, regardless of the method by which the recesses 513 are produced.

The outer diameter of gravure inking cylinder 512 is preferably in a ratio of 1:n to the outer diameter of the forme cylinder 503, with $n \in \mathbb{N} < 10$, in particular n=1, 2 or 3.

By means of the inking device 511, the first inking unit cylinder 512, which comprises recesses 513 in the region of its outer cylindrical surface 518 that correspond to recesses 514 on the forme cylinder 503, can be inked at an application point lying on its circumference. In this context, the "application point" is also understood as a circumferential section, extending in the circumferential direction, in which ink is applied to the first inking unit cylinder 512 by the inking device and/or in which said cylinder comes into contact with a supply of ink 517. Ink can generally be applied at the application point as desired.

In a preferred embodiment, the inking device 511 for inking the gravure inking cylinder 512 comprises an ink supply chamber 516, which is delimited on the side facing the gravure inking cylinder 512 at least partially by the outer cylindrical surface 518 thereof (see, e.g., FIGS. 3*a* and 3*b*, FIGS. 5*a* and 5*b*, and FIG. 15). Leading or protruding into the ink supply chamber 516, for example, e.g. centered in the axial position thereof, is the opening of at least one stationary or axially moved ink feed line, via which the amount of printing ink 517 consumed is or can be replaced in the ink supply chamber 516. The ink supply chamber 516 is understood here, e.g. generally as the space in which the printing ink 517 to be applied and which is in contact with the outer cylindrical surface 518 is located. Depending on the embodiment, this may be an ink chamber 516 that is open toward the top, open toward the bottom, or closed at the top and bottom.

The engravings 513 or recesses 513 of the inking unit cylinder 512 are, for example, recesses having a maximum depth z (513) of, for example, 0.3 mm, in particular a maximum of 0.2 mm, in relation to the non-engraved outer cylindrical surface region.

Downstream of the gravure inking cylinder 512 in the inking unit 508, an inking unit cylinder 519, e.g. a second inking unit cylinder, to be inked by said gravure inking cylinder is provided, which has, in the region of its preferably elastic and/or compressible outer cylindrical surface 521, elevations 522; 524; 524' separated from one another by deeper points or areas, configured to cooperate in the region of these elevations 522; 524; 524' with the outer cylindrical surface of the next inking unit cylinder or printing unit cylinder 531; 503 downstream. Ink is then transferred, e.g. only in the region of these elevations 522; 524; 524'. The elevations provided for ink transport 522; 524; 524' lie with their upper surface in an outer cylindrical surface, which represents the cylinder diameter of the relief inking cylinder 519 that is used for printing.

In a first embodiment, the elevations 522; 524; 524' can be raised areas 522, which correspond to engraved areas 523 of the printing forme 504 to be inked. These engraved areas 523 are assigned, for example, to the individual image motifs and, in a first embodiment for monochrome image motifs, for example, cover the entire surface area of the image motif or the engravings 504 relating to said image on the forme cylinder 503. Such elevations 522 are, for example, areas 522 having a surface area that extends over an image motif composed of a multiplicity of engravings 504, e.g. more than 100, provided on the forme cylinder 503 and/or are elevations 522 that are spaced apart from one another and that extend over spatially separate, in particular not interwoven image motifs, as is known, for example, from the prior art.

In an embodiment that is generally advantageous on its own, but is particularly advantageous in conjunction with the gravure inking cylinder 512 and/or a multicolor printing process, the engravings 504 on the relief inking cylinder 519 for the same image motif provided on the forme cylinder 503 are assigned a raised area 522, provided on the relief inking cylinder 519, the surface area of which is smaller than that of the image motif or an elevation 522 that does not extend over all engravings 504 that relate to the same image motif. An area 522 of this type extends, for example, over an uninterrupted surface area or a closed region of recesses 514 on the forme cylinder 503 that are to be inked via the same gravure inking cylinder 512 or that belong to a part of an image motif to be inked with the same ink, in particular irrespective of the line density present there. In such an embodiment, e.g. one or more areas 522, each having a maximum diameter of less than 50 mm, are provided on a gravure inking cylinder 512.

In an advantageous embodiment, the elevations 522; 524; 524' that relate to or cover the entirety of the engravings 504 of the same image motif are provided on multiple different relief inking cylinders 519 of the printing unit 500, e.g. configured as a multicolor printing unit 500, in particular such that they cover the entirety of the engravings 514 of the image motif on the forme cylinder 503. In that case, one or a plurality of non-contiguous elevations 522; 524; 524' assigned to the same image motif may be provided on the same relief inking cylinder 519 and may ink the engravings 504 of image parts of the same color.

The aforementioned areas of elevations 522 are, e.g. areas 522 that each extend over only a part of an image motif or over only some of the recesses 514 relating to the image motif, wherein another part of the same image motif or the recesses 514 relating to the image motif is or will be covered by one or more respective elevations 522 on another gravure inking cylinder 512 of the printing unit 500. When rolled off onto the forme cylinder 503, these elevations 522 of the same image motif provided on different gravure inking cylinders 519 relate to mutually adjacent, for example at least partially interwoven and/or interpenetrating parts of the same image motif or of the associated engravings 504. Areas 522 of multiple gravure inking cylinders 519, e.g. two, three, four or even five, may be assigned to one copy $N_i$ or to one image motif provided on the surface of one copy $N_i$.

In a particularly advantageous embodiment, however, elevations 524; 524 that correspond to engravings 514, especially individual engravings (i.e., individual dot-like, area-like, or preferably line-like engravings 504, for example) of the forme cylinder 503 or the printing forme 504 are provided on the outer cylindrical surface 521, e.g. in the manner of a relief with point-like, area-like, or preferably line-like ridges 524; 524', which correlate in terms of shape and surface area, e.g. as viewed in a plan view and/or when rolled out, to the shape and/or surface area of the respective recess 514. Here again, the latter does not mean that the elevations 524; 524' must have the same dimensions in terms of surface area as the corresponding engravings 514, but that their shape has a defined relationship to the shape of the corresponding engraving 514 of the printing forme 504, which will be or is also obtained here, for example, based on regularities that are or will be determined. Ridges 524; 524' that correspond to multiple adjacent engravings 513 as set out below can then merge to form a larger structure of an elevation 524'; however, due to the underlying regularity, the periphery will correspond, e.g. to the underlying engravings 513. For the sake of simplicity, the inking unit cylinder 519 comprising the raised areas 522 and/or elevations 524; 524' is also referred to synonymously, unless explicitly otherwise specified, as "relief inking cylinder" 519, regardless of the nature and configuration of the elevations 524. Elevations 524 on the relief inking cylinder 519 that correspond to engravings 514 on the forme cylinder 503 preferably have a greater width b524 than the width b514 or line width b514 of corresponding engravings 514 on the forme cylinder 503 or the printing forme 504.

As mentioned above, for narrow line structures on the forme cylinder 503 or on the printing forme 504, for example, individual, e.g. corresponding elevations 524 on the relief inking cylinder 519 can merge partially or completely to form larger elevations 524'. If elevations 524; 524' are only partially merged, two or more partially contiguous elevations 524; 524' are connected to one another, for example, due to an aforementioned enlargement relative to the recesses 513; 514 on the gravure inking cylinder 512 or on the forme cylinder 503 and only a small spacing from one another, for example, in which case the elevations 524; 524' are still individually discernible at least on a longitudinal section that is not merged. It is also possible for entire areas of merged elevations 524; 524' to be provided, such that, as a result of the larger size and due to a high line density on the forme cylinder 503 and/or on the gravure inking cylinder 512, individual recesses 513, e.g. in the interior of such an area, become merged and are no longer individually resolved and/or discernible. Nevertheless, in the following such elevations 524; 524' on the gravure inking cylinder 512, which result from the transfer of the individual recesses 514 on the forme cylinder 503 to individual, in this case overlapping elevations (e.g., in contrast to the aforementioned rough areas 522) are likewise regarded as corresponding to recesses 514 on the forme cylinder 503, since they result, for example, based on a fixed rule, from the individual engravings 513 on the forme cylinder 503 and/or on the gravure inking cylinder 512 and/or allow at least a partial discernment of the underlying structure at the edge of the recesses 514 on the forme cylinder 503. Thus, even where merging does occur, the individual engravings 514 on the forme cylinder 503 form the basis for the pattern of corresponding elevations 524; 524', which due to the regularities applied to individual engravings 514 are also to be understood in this sense as corresponding to individual recesses 514 on the forme cylinder 503. Moreover, at least a number of actually individually resolved elevations 524, i.e. elevations 524 that correspond precisely to an engraving 513, are preferably also included on the outer cylindrical surface 521 of the relief inking cylinder 519.

Especially in the case of the aforementioned raised areas 522, the dimensions of which are greater than those of individual elevations 524, this second inking unit cylinder 519 is also referred to as a chablon cylinder 519.

Generally, all elevations 524; 524' on the relief inking cylinder 519 that are assigned to recesses 514 on the forme cylinder 503 or to recesses 514 of the same image motif on the forme cylinder 503 can be configured as correlated, corresponding elevations 524; 524', individual or merged as described above, or optionally as only some of the elevations 522; 524; 524' provided on the relief inking cylinder 519, wherein in the latter case, one or more larger raised areas 522 may also be provided.

The elevations 522; 524; 524' are, for example, elevations 522; 524; 524' having a height of between 0.03 and 2.0 mm, for example, in particular a height of between 0.5 and 1.2 mm in relation to the non-printing base. Said non-printing base is provided at the same depth, for example, so that elevations rolling in the same cylindrical shell surface produce elevations of the same height above the base. For the embodiment comprising only larger raised areas 522, the height of said areas above the base may be greater than that of the elevations 524; 524' correlated to individual engravings 514.

In a particularly preferred embodiment, the width b524 of elevations 524 on the relief inking cylinder 519 that correspond to engravings 514 on the printing forme 504 is greater than the width b513 of the engravings 513 corresponding thereto on the gravure inking cylinder 512, and the width of these engravings 513 on the gravure inking cylinder 512 is in turn greater than the width b514 of the engravings 514 corresponding thereto on the forme cylinder 503 or on the printing forme 504 (see, for example, FIG. 4).

For example, multiple individual elevations 524; 524' on the relief inking cylinder 519 are larger on all sides of the relevant elevations 524; 524', for example by at least 20 μm and/or by at most 200 μm, advantageously by at least 50 μm and/or by at most 150 μm, in particular 80 to 120 μm, preferably by 100±5 μm, than the respectively corresponding recesses 513 on the gravure inking cylinder 512 and/or are larger, e.g. by at least 40 μm and/or at most 400 μm, advantageously by at least 100 μm and/or at most 300 μm, in particular 160 to 240 μm, preferably by 200±10 μm, than the corresponding recesses 514 on the forme cylinder 503. Thus, for example, for at least some of the recesses 514 on the forme cylinder 503, a line width b524 or width b524 of the corresponding recesses 524; 524' on the relief inking cylinder 519 is larger, e.g. by at least 40 μm and/or at most 400 μm, advantageously by at least 100 μm and/or at most 300 μm, in particular 160 to 240 μm, preferably by 200±10 μm, than the corresponding recess 513 on the gravure inking cylinder 512 and/or is larger, e.g. by at least 80 μm and/or at most 800 μm, advantageously by at least 200 μm and/or at most 600 μm, in particular 320 to 480 μm, preferably by 400±20 μm, than the corresponding recess 514 on the forme cylinder 503.

In the embodiment comprising corresponding elevations 524; 524', e.g. multiple elevations 524, optionally among other things, which correspond to individual engravings 514 on the forme cylinder 503 and which are larger, e.g. on all sides, by at most 400 μm, in particular by at most 300 μm, preferably by at most 200 μm, than the corresponding recess 514 on the forme cylinder, and/or multiple contiguous elevations 524', each resulting from the areal merging of elevations 524 that correspond to a group of recesses 514 on the forme cylinder 503, are provided on the outer cylindrical surface 521 of the relief inking cylinder 519, wherein the contiguous elevations 524' preferably each occupy a contiguous surface area, which results from the overlapping of the relevant corresponding recesses 514 of the forme cylinder 503 that are enlarged on all sides by at most 400 μm, in particular by at most 300 μm, preferably by at most 200 μm, and/or which protrudes on all sides by at most 400 μm, in particular by at most 300 μm, preferably at most 200 μm, beyond the surface area resulting from the shortest envelope curve around the relevant recesses 514. On the relief inking cylinder 519, multiple such individual or merged and contiguous elevations 524; 524', e.g. at least five, are provided per copy Ni to be printed, for example.

In contrast to the aforementioned raised areas 522, in which the raised area 522 extends over the surface area of a plurality of adjacent engravings 514 on the forme cylinder 503, e.g. more than fifty, for example, regardless of the density of recesses 514 on the forme cylinder 503, and at the edge of which area no structure of elevations 524 corresponding to individual recesses 514 on the forme cylinder 503 is discernible, as elevations 524 that correspond individually to engravings 514 of the printing forme 504 elevations 524 are preferably provided that have, in the region of their smallest diameter, i.e. the shortest distance between opposing margins or edges, for example a maximum width b524 of 1 mm, in particular a maximum of 0.8 mm, and/or that have a width b524 that is at most 0.8 mm, preferably at most 0.6 mm, greater than that of the corresponding engraving 514 on forme cylinder 503 and/or that match, e.g. individual engravings 514 on the forme cylinder 503 with a greater width b524 by a maximum of a factor of ten, preferably by a maximum of a factor of three, and/or that individually match engravings 514 on the forme cylinder 503 that are spaced from one another, for example, by 1000 μm or less, preferably by at most 600 μm, in particular at most 500 μm, i.e. that ink or can ink elevations 524 that are spaced apart from one another. As merged elevations 524' produced from individual corresponding elevations 524, e.g. overlappings of elevations 524 obtained individually via a regular enlargement from corresponding recesses 514, in contrast to the aforementioned raised areas 522, and/or, e.g. elevations 524' having a maximum diameter of less than 20 mm, in particular less than 10 mm are provided. At least a number, for example, in particular a plurality of such individually resolved and/or merged elevations 524; 524' are formed or provided on the relief inking cylinder 519, in particular over a surface area corresponding to one copy Ni.

In the preferred embodiment having the aforementioned corresponding elevations 524; 524', for example, an area of corresponding elevations 524; 524' belonging to the same image motif to be printed in a first ink to be printed or on a first relief inking cylinder 519 may be surrounded on all sides by corresponding elevations 524; 524' belonging to the same image motif of a second ink or of a second relief inking cylinder 524; 524', e.g. of the same printing unit 500, and/or areas of corresponding elevations 524; 524' belonging to the same image motif to be printed in a first ink or on a first relief inking cylinder 519 and areas of corresponding elevations 524; 524' belonging to the same image motif of a second ink to be printed or on a second relief inking cylinder 519 may be interwoven or may penetrate one another when rolled out.

In a preferred embodiment having the aforementioned elevations 524; 524', e.g. more than 50, in particular more than 100, and in special configurations even more than 250 such spaced-apart, i.e. non-contiguous elevations 524; 524' are provided on the relief inking cylinder 519 and/or, e.g. at least 5, advantageously at least 10, in particular more than 25, and in special configurations even more than 50 such spaced-apart, i.e. non-contiguous, elevations 524; 524' are provided on a outer cylindrical surface area of the relief inking cylinder 519 that corresponds to one copy $N_i$.

In an embodiment that is advantageous in the case of a particularly high resolution, the relief inking cylinder 519 comprises on its outer cylindrical surface 21, e.g. elevations 524; 524' that have, in the region of their smallest diameter, a maximum width b524 of 0.6 mm and/or a width b524 that is no more than 0.3 mm greater than the width b514 of the corresponding engraving 514 on the forme cylinder 503, and/or that match individual engravings 514 on the forme cylinder 504 with a width b513 that is greater by no more than a factor of three and/or that match engravings 514 that are spaced from one another, for example, by 0.5 mm or less on the forme cylinder 503.

For example, areas having more than 20 or more than 50 (individually resolved and/or merged) non-contiguous elevations 524; 524' over a surface area of 10 $cm^2$, preferably over a surface area of 1 $cm^2$, and/or having two or more non-contiguous elevations 524; 524' are provided, which are spaced by at most 1000 μm, in particular at most 500 μm, preferably at most 300 μm from an adjacent elevation 524; 524'. For example, the relief inking cylinder 519 comprises on its outer cylindrical surface 21 a number of areas, corresponding to the number of copies Ni to be printed, which have such a surface density and/or resolution of elevations 524; 524' and which are arranged in rows and columns according to the grid of the copies Ni to be printed.

Areas that have an aforementioned surface density and/or resolution of elevations 524; 524' can have at least five elevations 524; 524' and/or can extend, e.g. over at least 1 $cm^2$, in particular over at least 2 $cm^2$. Said elevations 524; 524' are not required to be evenly distributed within such an area and/or may be part of a larger area that also comprises, e.g., elevations 524; 524' in a lower surface density and/or a greater resolution.

Independently, in general, of the presence of an area having an aforementioned number, surface density, and/or resolution, but preferably in conjunction therewith, the relief inking cylinder 519 can have areas on its outer cylindrical surface 21, the number of areas corresponding in particular to the number of copies, and said areas comprising a total of at least five, for example, preferably at least ten non-contiguous elevations 524; 524' over a surface area of 10 $cm^2$.

The embodiment of the relief inking cylinder or cylinders 519 having individual and/or merged elevations 524; 524' that correspond in the aforementioned manner, for example, enables color resolutions and/or image effects to be achieved that otherwise cannot be realized in gravure or intaglio printing. This applies not only, but especially in conjunction with an aforementioned gravure inking cylinder 512.

The engravings 513 on the gravure inking cylinder 512 are provided directly on the outer cylindrical surface 518 of the gravure inking cylinder 512, for example, which is comprised at least by the cylinder shell on the outer circumference of the gravure inking cylinder 512, or are provided on the outer circumference of an ink transfer forme embodied as a printing forme, which may be in the form of a circumferentially closed ink transfer forme sheath 637, e.g. what is known as a sleeve 637, or in the form of a finite gravure printing forme, e.g. with leading and trailing ink transfer forme ends.

In an advantageous embodiment, the raised areas 522 or elevations 524; 524' of the second inking unit cylinder 512 can likewise be provided on the surface of an ink transfer forme, which is or can be detachably arranged in the form of a circumferentially closed ink transfer forme sheath, e.g. what is known as a sleeve, on a cylinder body that is or can be rotatably mounted in the inking unit 508.

The inking device 511 comprises, on at least the side of the aforementioned downstream application point in the operating direction of rotation D of the inking unit cylinder 512 comprising the recesses 513, a retaining means 526, e.g. a doctor blade or an ink blade, by means of which, as viewed in the operating direction of rotation D, downstream of the ink application, and particularly upstream of a nip point 776 with a subsequent inking unit cylinder 519, printing ink 517 applied previously to the outer cylindrical surface 518 can be removed.

In particular, the inking device 511 has such a retaining means 526 on at least the downstream side of the ink supply chamber 516 in the operating direction of rotation D of the gravure inking cylinder 512, and by means of said retaining means, on the output side of the ink supply chamber 516 as viewed in the operating direction of rotation D, i.e. in the region of the downstream end of the ink supply chamber 516, printing ink 517 that has been carried along previously by contact with the outer cylindrical surface 518 can be removed. In this embodiment of the ink application process, the ink supply chamber 516 is delimited on its downstream side in the circumferential direction by the retaining means 526.

The inking device 511 is preferably configured without inking zones, i.e. for example without individually adjustable inking zones, and/or with a retaining means 526 that is continuous in the axial direction across the printing width and/or without individually adjustable ink blade sections.

The inking device 511 preferably also comprises a sensor device 594, by means of which a measure of the volume of ink present in the ink supply chamber 516 and/or a fill level, but at least information regarding the reaching of a critical fill level, e.g. a lower and/or an upper limit value of the fill level, can be derived.

In a first embodiment that is advantageous, e.g. in terms of a particularly low ink infeed, the inking device 511 comprises, on at least the downstream side of the application point or of the ink supply chamber 516 in the operating direction of rotation D of the inking cylinder 512, a retaining means 526 in the form of a wiping means, in particular a doctor blade, the contact force of which is preferably variable or adjustable and which is in physical contact with the preferably hard and unyielding outer cylindrical surface 518 of the gravure inking cylinder 512, in particular at least in the working or operating position, which retaining means can be used to remove, substantially completely, printing ink 517 that has been applied to non-engraved regions. In this way, an infeed of printing ink 517 at points where no printing ink 517 is required on the forme cylinder 503 can be reduced quite substantially from the outset. A complete removal of the printing ink 517 is also understood to mean that traces of printing ink 517 will remain on non-engraved regions of the outer cylindrical surface despite doctoring with physical contact. In contrast to ink blades, with which the ink layer thickness desired for operation can be adjusted, e.g. zonally, by adjusting the size of the gap between cylinder shell and ink blade, and which can be moved up to the outer cylindrical surface, e.g. to avoid an outflow of printing ink in the idle state, the retaining means 526 that is in physical contact with the preferably hard and unyielding outer cylindrical surface 518 of the gravure inking cylinder 512 is understood as one which during operation is set against the outer cylindrical surface 518 for the purpose of doctoring the ink. A doctor blade suitable for this purpose must have greater abrasion resistance and/or hardness at the end of the doctor blade that is in physical contact in the working position than would be required for an adjustable ink blade that is spaced at a distance during operation. At the same time, it must have a certain elasticity and/or resilience so that it will rest flexibly and/or across the entire width against the outer cylindrical surface 518. The retaining means 526 embodied as a doctor blade is configured, at least in a section adjoining the doctor blade edge 566, with a thickness of 0.7 to 1.3 mm, for example, in particular of 0.9 to 1.1 mm. In addition to or independently of this, the embodiment that involves physical contact during operation requires, e.g., an positioning drive 551, which moves the doctor blade not only up to the position of initial contact, but beyond that to the point of at least slight elastic deformation caused by the contact pressure against the outer cylindrical surface 518.

The retaining means 526, in particular in the form of a wiping means, e.g. a doctor blade, is advantageously configured as "positive" or is arranged correspondingly "positively" in the inking device 511, i.e. it is or can be deployed at an inclination relative to the tangent, so that the tangent at the point of contact forms an acute angle with the retaining means 526, e.g. wiping means, in particular the doctor blade, on the side of the ink supply chamber 516. This angle prevails, e.g. at least in the region of the operative end, i.e. in an end section of the retaining means 526, e.g. at least 3 mm in length, which cooperates in contact with the outer cylindrical surface 518 or without contact with the same.

Figure 4A:
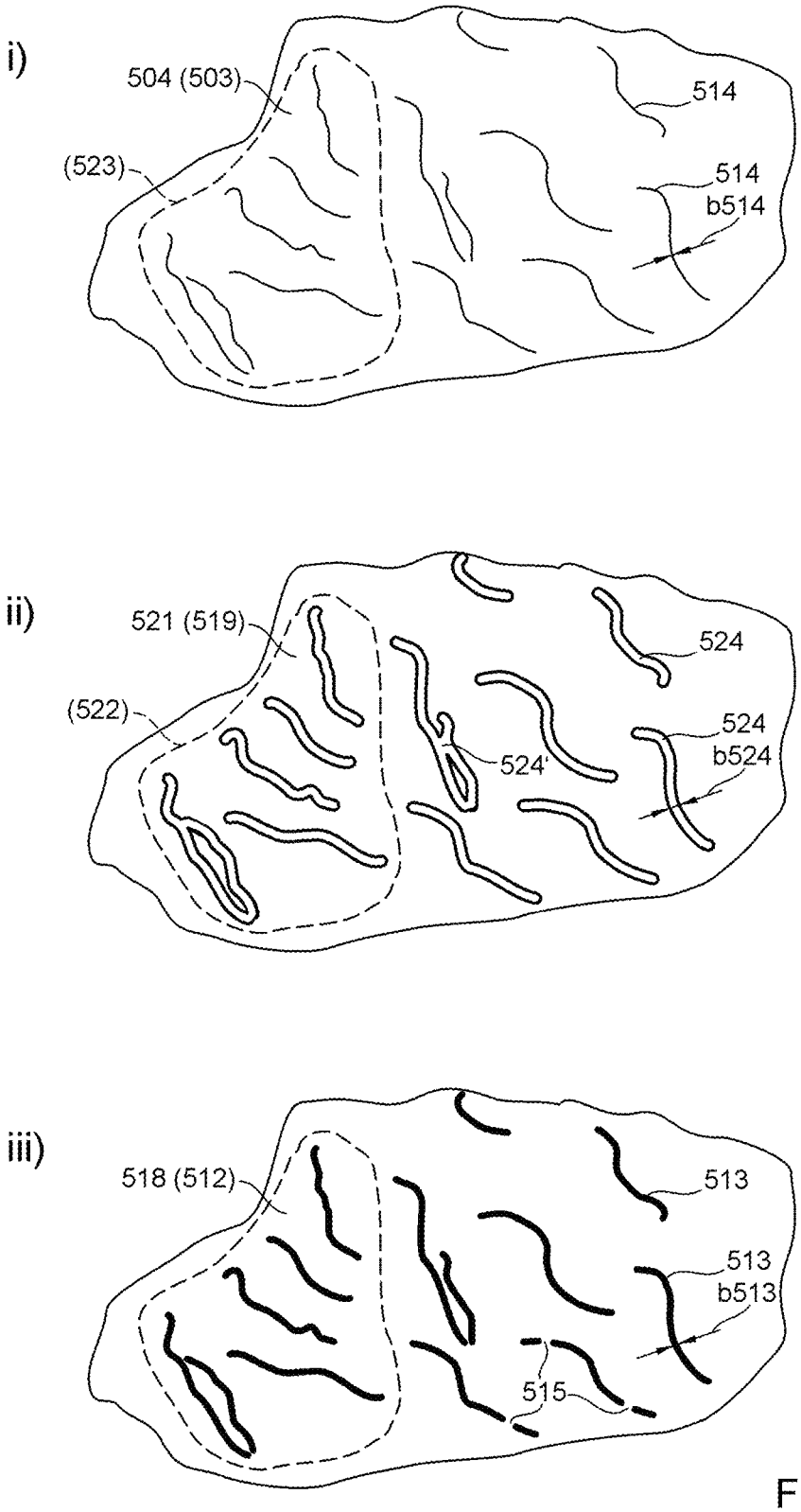
FIG. 4*a* a schematic depiction of i) a pattern of recesses on the forme cylinder, ii) a pattern of corresponding elevations on the inking unit cylinder that has the elevations, and iii) a pattern of corresponding recesses on the inking unit cylinder that has the recesses.

In an embodiment of the pattern of recesses 513 on the gravure inking cylinder 512 that is advantageous particularly in conjunction with the embodiment of the retaining means 526 as a doctor blade that is in physical contact during operation, recesses 513, in particular linear recesses, on the gravure inking cylinder 512 that correspond to recesses 514 on the forme cylinder 503 are at least not all configured as uninterrupted; instead, particularly in the case of recesses 513 of greater length, e.g. for recesses 513 measuring at least 500 μm in length, at least some have at least one supporting point 515, in particular one supporting ridge 515, which interrupts the recess 513 on the second inking cylinder 512 that corresponds to the continuous recess 514 on the forme cylinder 503 and/or which lies within the encompassing ends of a recess that corresponds in shape to a continuous recess 514 on the forme cylinder 503, and whose upper surfaces lies at the level of the uninterrupted, i.e. non-engraved, outer cylindrical surface 518 of the gravure inking cylinder 512, for the purpose of supporting the doctor blade (indicated, e.g., in FIG. 4*a*, iii, by way of example, in two engravings 513 in the lower portion of the diagram). A supporting ridge 515 of this type, the upper surface of which lies at the uninterrupted level, preferably connects two edges that lie on opposite sides of the relevant recess 513 to one another. These supporting points 515 or supporting ridges 515 prevent the doctor blade edge 566 from dipping, e.g. even very slightly, into elongated recesses 513, which can lead to irregularities in the doctor blade edge 566 and/or to erosions at the edges of recesses 513 if such dipping is repeated a large number of times.

Preferably, however, such supporting points 515 or supporting ridges 515 are not placed individually in individual recesses 513, and are instead accounted for or provided during the derivation of recesses 513 to be provided on the gravure inking cylinder 512 from image-forming recesses 514 on the forme cylinder 503, particularly during the transformation of image-forming recesses 514 present or to be provided on the forme cylinder 503 into specifications for corresponding recesses 513 to be provided on the gravure inking cylinder 512, as will be described in greater detail below, for example.

Such supporting points 515 or supporting ridges 515 can generally be provided, by means of appropriate software, for example, "randomly", i.e. in a random, non-regular arrangement, which involves advantages in terms of the avoidance of visible structures. In a solution that is advantageous in terms of the reliability of secure support, however, supporting points 515 or supporting ridges 515 are superimposed on the pattern of recesses 513 on the gravure inking cylinder 512 in a regular structure 525 (see, e.g., FIG. 4 *ii*). Said structure is preferably superimposed over the entire area of recesses 513 of the same image motif to be inked on the forme cylinder 503, e.g. over all lines or the lines of an ink segment of the image to be depicted, for example a portrait, a building, or an illustration of fauna or flora. As a result of said superposition, in places where the intended structure 525 and a recess 513 on the gravure inking cylinder 512 overlap, an elevation is or will be provided, the height of which is at the level of the uninterrupted outer cylindrical surface 518. In other words, the structure 525 is discernible only in the area of the recesses 513, at the supporting points 787 or supporting ridges 787 extending there according to the pattern 525, and continues correspondingly, e.g. in adjacent recesses 513.

Figure 4B:
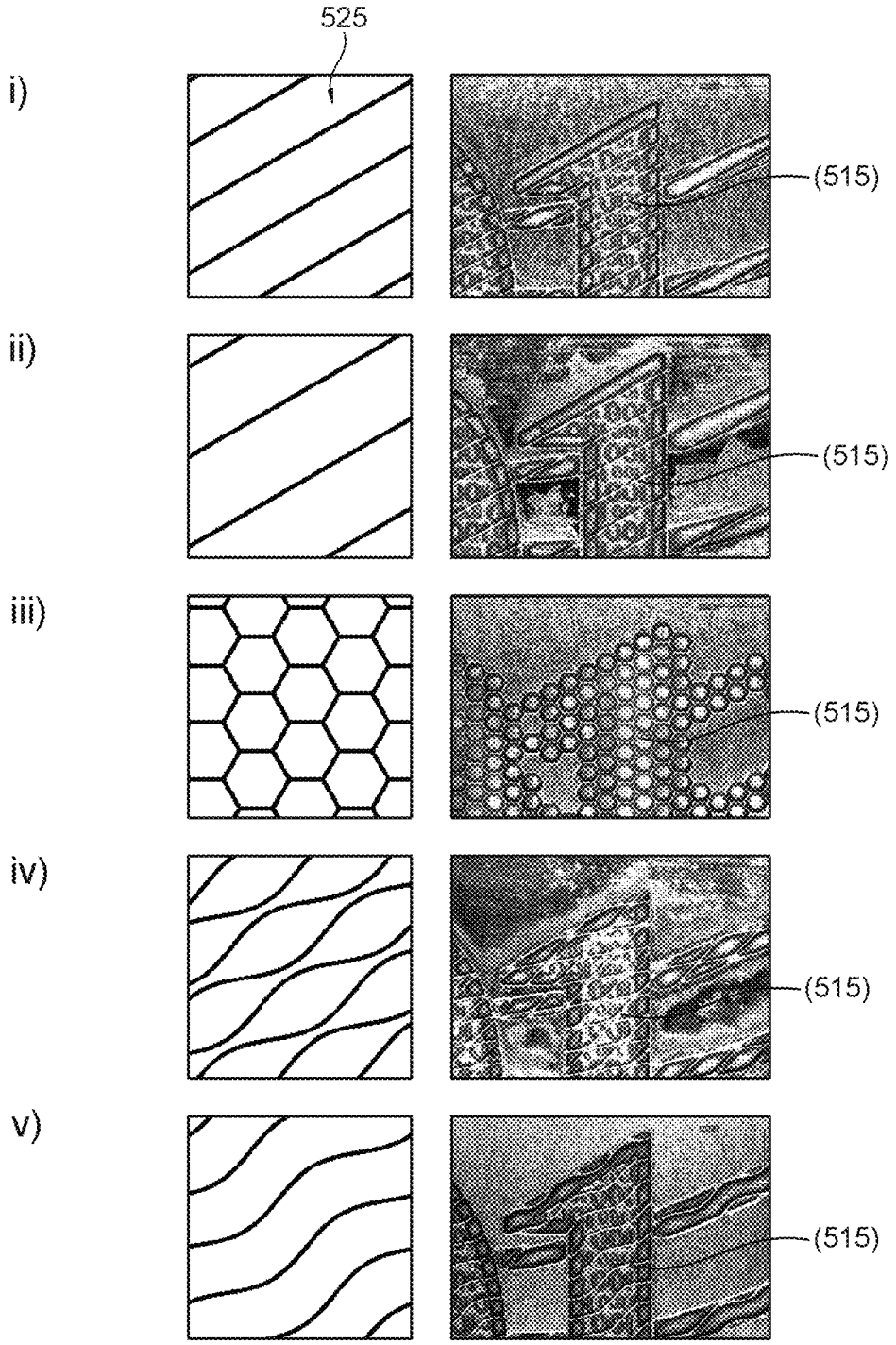
FIG. 4*b* a schematic detail illustration of advantageous embodiments of the formation of recesses on the inking unit cylinder.

Such a regular structure 525 of supporting ridges 787 can generally be configured in a variety of ways. For example, supporting ridges 787 can be provided along straight and parallel lines of an open line structure 525 (see, e.g., FIG. 4*b*, i and ii). Alternatively, supporting ridges 787 may be provided on walls of closed, circular or polygonal structures, such as honeycomb structures 525, for example (see, e.g., FIG. 4*b*, iii), or along wave structures 525 that run in opposite directions (see, e.g., FIG. 4*b*, iv) or in the same direction (see, e.g., FIG. 4*b*, v), or along structures 525 otherwise provided in an open or a closed form. In a particularly advantageous embodiment, said structure is superimposed, e.g. as a line structure 525 of rectilinear lines, onto the pattern of recesses 513, in which case the lines run rectilinearly and parallel to one another and are spaced apart from one another by 300-700 μm, for example, advantageously by 400-600 μm, and/or run at an angle of 20°-30°, for example, advantageously 25°-35°, in particular 30°±2°, from a line that runs parallel to the axis of rotation of the gravure inking cylinder 512 on the outer cylindrical surface 518, or from the doctor blade edge 566, and/or have a ridge width at the level of their surface of 30-50 μm, for example, in particular of 35-45 μm, preferably of 40±2 μm. In FIG. 4*b*, e.g. for each of the structural forms mentioned an example of the underlying structure 525 is provided, along with an illustration of an image section showing a corresponding structure. The reference number 515 for the ridges has been placed between parentheses there because they are only indirectly visible.

In a second embodiment, which is advantageous in terms of wear, for example, the inking device 511 can comprise, on at least the downstream side of the application point or the ink supply chamber 516 in the operating direction of rotation D of the gravure inking cylinder 512, a retaining means 526 configured as an ink blade, for example, preferably an adjustable ink blade, by means of which in the working or operating position, a small, preferably adjustable distance of at least 2 μm, for example, in particular at least 5 μm, and/or of at most 100 μm, for example, advantageously at most 50 μm, in particular at most 20 μm, from the outer cylindrical surface 518 of the gravure inking cylinder 512 can be produced or is produced during operation. In this way, the printing ink 517 applied to non-engraved regions is or can be limited to a thin layer thickness of at least 2 μm, for example, in particular at least 5 μm, and/or at most 100 μm, advantageously at most 50 μm, in particular at most 20 μm.

Particularly in conjunction with at least a substantial removal of the printing ink 517, i.e. a complete removal or a removal except for a thin layer, from the non-engraved outer cylindrical surface regions of the gravure inking cylinder 512, a significant ink infeed is achieved selectively at desired locations; for that reason, the inking unit cylinder 512 or gravure inking cylinder 512 that is furnished with the engravings 513 or recesses 513 is also referred to as a "selective cylinder" 512.

The relief inking cylinder 519 has, on its circumference, a preferably elastic and/or at least slightly compressible material layer, for example, the outer surface of which forms the outer cylindrical surface 521 and which comprises the raised areas 522 or elevations 524 and the recesses therebetween.

The gravure inking cylinder 512 to be inked by the inking device 511 and the relief inking cylinder 519 downstream, optionally with one or more inking unit rollers or cylinders arranged in series therebetween, make up an inking unit 529 here, hereinafter also called an inking train 529, by means of which printing ink 517 of a certain color can be fed into the printing unit 500 and is or can be conveyed in the direction of the forme cylinder 503.

Said inking train 529 can generally be arranged, in the region of its downstream end, with the outer cylindrical surface 521 of the chablon cylinder 519, for example, cooperating directly with the forme cylinder 503 or with the printing forme 504 thereof, in the printing unit 500. In an embodiment that is advantageous in terms of multicolor printing, multiple such inking trains 529, e.g. at least two, can also be arranged around the forme cylinder 503. It is also possible for the forme cylinder 503 to be assigned one or more inking trains 529 configured as having a gravure inking cylinder 512, as described above, and one or more inking units 532, e.g. inking trains 532, configured differently, e.g. configured conventionally without a gravure inking cylinder, and having an ink fountain comprising an ink blade, for example, and an ink fountain roller with a smooth surface.

When multiple inking trains 532 are provided, each of these inks up one "color segment" of the print image, for example, i.e. one print image segment assigned to this color to be applied. The pattern of recesses 513 and/or elevations 524; 524' or raised areas 522 on the relevant inking unit cylinders 512; 519 of two inking trains 529 are therefore different from one another, at least to a large extent. In particular, the relevant inking unit cylinders 512; 519 have different patterns of recesses in the respective region of the outer cylindrical surface 518 that corresponds to the same image motif to be printed at the printing nip 502.

In a preferred embodiment, particularly with regard to multicolor printing, the inking train 529 is arranged in the region of its downstream end, e.g. in the region of the relief inking cylinder 519, cooperating with another inking unit cylinder 531, e.g. acting as a transfer cylinder 531. Said cylinder is in turn arranged cooperating with the forme cylinder 503 in the printing unit 500 and preferably has an elastic and/or compressible outer cylindrical surface.

Figure 2A:
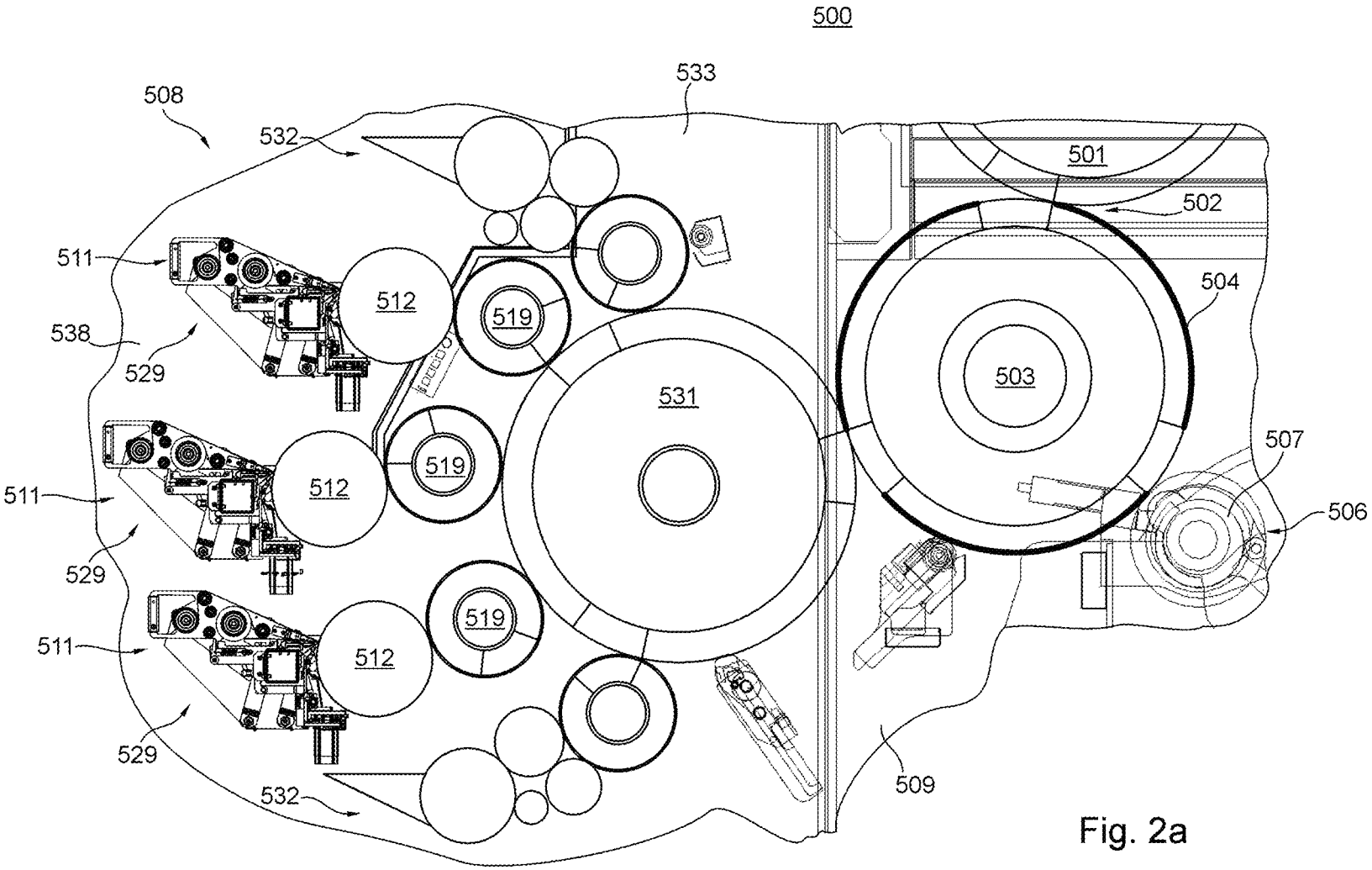
FIG. 2*a* an enlarged illustration of the printing unit of FIG. 1*a;*
Figure 2B:
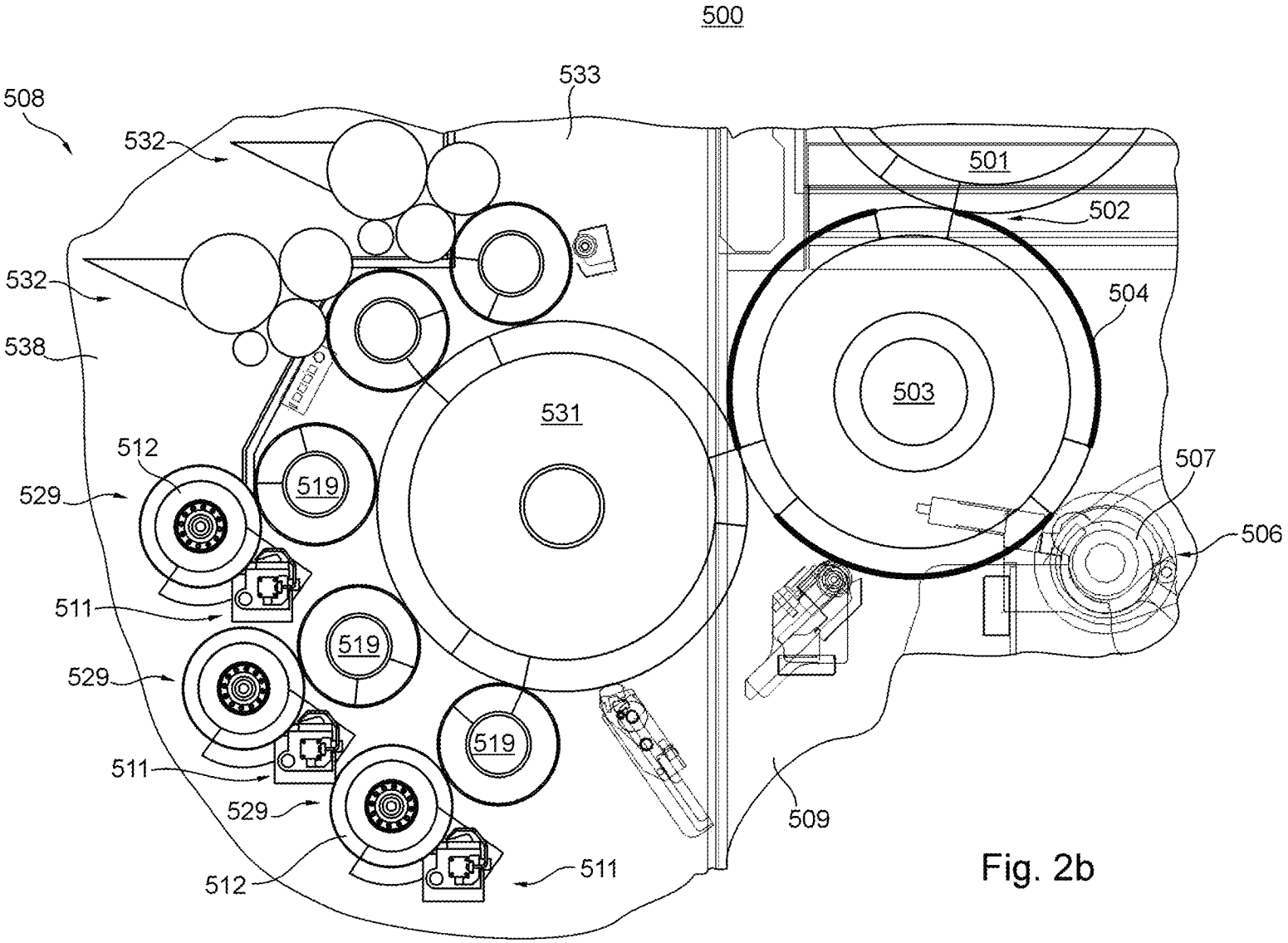
FIG. 2*b* an enlarged illustration of the printing unit of FIG. 1*b;*

In a particularly preferred embodiment of the printing unit 500 as a multicolor printing unit 500, in particular configured for simultaneous multicolor printing at the printing nip 502, the additional inking unit cylinder 531 is embodied or acting as an ink collecting cylinder 531. In that case multiple inking trains 529, e.g. at least two, configured as described above as having a gravure inking cylinder 512, or a combination of one or more inking trains 529 configured as described above as having a gravure inking cylinder 512 and one or more inking trains 532 that are configured differently, e.g. conventionally, without a gravure inking cylinder, for example with an ink fountain comprising an ink blade and an ink fountain roller with a smooth surface, can be arranged on the circumference of the ink collecting cylinder 531. For example, a total of five inking trains 529; 532 may be provided, of which, for example, three, e.g. lower, inking trains 529 are configured as inking trains 529 that feed in printing ink 517 selectively (i.e., selective inking trains 529) while the other two, e.g. upper, inking trains 532 are conventionally configured (see, e.g. FIG. 2*b*). However, it is also generally possible for another heterogeneous breakdown and/or positioning of selective and conventional inking trains 529; 532 to be provided, e.g. one lower and one upper inking train 532 of five conventionally configured inking trains 529; 532 with three selective inking trains 529 therebetween, or for a homogeneous embodiment with exclusively selective inking trains 529 to be provided.

Generally, the inking device 511 can be arranged as desired, cooperating with the outer cylindrical surface 518 on the open circumference, i.e. on the circumference that is not covered by the nip point 776 with the relief inking cylinder 519 or by any other components.

In a first embodiment, however (see, inter alia, FIGS. 1*a*, 2*a* and 3*a*), the inking device 511 can be arranged on the side of the gravure inking cylinder 512 that faces away from the relief inking cylinder 519. In that case, the aforementioned line of contact or line of the shortest distance is on the side that faces away from the relief inking cylinder 519, for example.

Thus a line of contact that, if the retaining means 526 is embodied as a wiping means, in particular a doctor blade, is formed between said means and the outer cylindrical surface 518 of the gravure inking cylinder 512, or if the retaining means 526 is embodied as an ink blade, the line of the shortest distance on the circumference of the gravure inking cylinder 512, lies in this first embodiment of the positioning of the inking device 511 on a circumferential section of the gravure inking cylinder 512 that is on the side facing the relief inking cylinder 519, in particular upstream of the line of intersection with the aforementioned vertical plane, as viewed in the operating direction of rotation D. A line of contact is also understood, of course, as a point of physical contact that, as viewed in the circumferential direction, has an actual width not equal to zero, e.g. a width of up to 2 mm. In the case of physical contact, this may be caused by a "grinding in" of the doctor blade edge through contact with the outer cylindrical surface 518 and/or may be desirable to create a better seal.

In an alternative second embodiment, which is especially advantageous particularly with respect to ink supply and ink metering (see, inter alia, FIGS. 1*b*, 2*b* and 3*b*), the inking device 511 is arranged on the side of the gravure inking cylinder 512 that faces the relief inking cylinder 519. A side of the gravure inking cylinder 512 is understood as a hemisphere that lies on one side of a vertical plane running through the axis of rotation R512 of the gravure inking cylinder 512.

In that case, both for the first and for the alternative embodiment, an arrangement of the gravure inking cylinder (s) and associated relief inking cylinder(s) 512; 519 in the printing unit 500 is provided, such that, in the print-on position, the plane connecting the rotational axes R512; 519 of the gravure inking cylinder and the associated relief inking cylinder 512; 519 of all, some, or at least one gravure inking cylinder 512, e.g. a third of five, comprised by the printing unit 500, forms a maximum angle of 60°, preferably a maximum angle of 45°, with the horizontal. An arrangement of this type represents an arrangement of the main components of the inking unit aligned predominantly in the horizontal direction, namely from the infeed of ink, through the selective transfer and optionally the collection of ink, to the inking of the forme cylinder 503. Where the two aforementioned embodiments functionally involve the same components or component groups, no differentiation is made in the reference symbols used for this purpose.

The inking unit cylinders 512; 519; 531 and the inking device 511 may be provided, together with the printing unit cylinders 501; 503, in a common frame, or may be arranged in a separate frame 533; 538, e.g. frame section 533; 538, which is different from the frame supporting the printing unit cylinders 501; 503, for example.

Generally independently of the specific position and/or specific configuration of the inking device 511, but advantageously in conjunction with one of the aforementioned positions and/or embodiments, the inking unit frame 533, 538 is configured as separable. Said frame comprises a frame 538, which included e.g. a frame section 538, that supports, e.g. at least the inking device 511 and the gravure inking cylinder 512 and which has frame walls provided on both sides, which frame section 538 can be separated from a frame part that supports the relief inking cylinder(s) 519 and optionally the transfer cylinders 531 and can be moved away or backed out radially, in particular horizontally, in order to form therebetween, for example in the open state, an operating and/or maintenance space for operating technicians. Said frame part may be a frame part that also supports the printing unit cylinders 501; 503, but is preferably embodied as a frame section 533 assigned solely to the inking unit 508, which can, in turn, be moved away from a preferably spatially fixed frame section supporting the printing unit cylinders 501; 503, i.e. which can be moved radially of the printing unit part 509, in particular horizontally, in order to form therebetween, for example in the open state, an operating and/or maintenance space for operating technicians.

Generally independently of the specific position and/or specific configuration of the inking device 511, but advantageously in conjunction with one of the aforementioned positions and/or embodiments, the inking device 511, but at least the retaining means 526, e.g. wiping means or doctor blade, or the ink blade, and if applicable the boundaries of the ink supply chamber 516 on the sides of the inking device 511, is adjustable with respect to its radial position relative to the gravure inking cylinder 512, for example it can be moved further or closer to the outer cylindrical surface 518 and less or further away from the outer cylindrical surface 518 (as indicated, e.g., schematically by double arrow 534). Positioning is implemented by means of a positioning drive 551, e.g. via a transmission 527 comprised by the positioning drive 551, and/or is preferably implemented by a remotely actuable drive means 536 comprised by the positioning drive 551. The positioning drive 551, in particular for the embodiment of the retaining means 526 as a doctor blade that is in contact during operation, is preferably configured such that if the doctor blade becomes shortened due to wear, the doctor blade will be repositioned toward or against the outer cylindrical surface 518. This can generally be accomplished by means of a control loop having a sensor that registers the shortening and a drive motor 536 as the drive means, or by means of a drive motor 536 as the drive means, which is controlled with respect to the applied torque. In a particularly advantageous embodiment, the drive means 536 is configured as a force-based drive means 536, preferably in the form of a pressurized medium-actuated actuator 536, e.g. working cylinder 536, in particular pneumatic cylinder 536. Particularly if the retaining means 526 is configured as a doctor blade, this enables a level of contact force to be ensured and/or to be varied selectively by choosing the pressure level. If the retaining means 526 is configured as an ink blade, the distance of which is adjustable, for example, such a force-based drive means 536 can be positioned against a preferably adjustable stop means, for example. This positioning movement preferably takes place in a region at least close to the cylinder, i.e. in at least the last 3 mm before reaching the outer cylindrical surface 518, for example, linearly or at least approximately linearly. The conditions at the outer cylindrical surface 518 are thus maintained, e.g. even with repositioning or with changing lengths of the retaining means, such as, for example, in the case of a pivoting movement about a pivot axis, preferably with a radius of curvature that corresponds to at least twice the diameter of the gravure inking cylinder. Particularly advantageous is a movement, or a guidance that forces said movement, for which the angle of inclination of the retaining means 526 or of the entire moving assembly, e.g. in relation to horizontal or to the tangent of the gravure inking cylinder 512 at the point of contact, is maintained within the positioning range in the case of repositioning induced by wear and/or with activation and deactivation of the retaining means. Said movement preferably extends linearly in the doctor blade plane, i.e. in the direction of the extension thereof running from the mount to the first physical contact with the gravure inking cylinder 512. Said movement can be defined via a guide 576, which defines the movement path and which is included in the drive train between drive means 536 and the component to be moved, or which, parallel to the drive train acting on the component, forces the component that is to be moved onto the movement path. The guide 576 that maintains the angle of inclination of the retaining means 526 or of the parts that delimit the ink supply chamber 516 on the sides of the inking device 511, e.g. with respect to the horizontal, may be provided, in particular, as a straight linear guide 576, for example, or as a parallelogram guide 576. For this purpose, the inking device 511 or at least the retaining means 526 and the parts that form the ink supply chamber 516 on the sides of the inking device 511 are mounted, accordingly movably, for example directly or indirectly on a side part 537, e.g. side frame part 537, in particular side panels 537, which side part is in turn mounted, immovably fixed, on a frame 538 of the inking unit 508 or preferably on holding means 539 that are fixed with respect to the axis of rotation R512 of the gravure inking cylinder 512, e.g. end-face side parts 539 of a subframe that is moved along with the gravure inking cylinder 512. For the preferred case in which the gravure inking cylinder 512 is mounted movably in the frame 538 of the inking unit 508, e.g. for alignment purposes or for throwing-on and throwing-off in the radial direction, mounting the inking device 511 or the frame part 537 that supports the inking device 511 in a manner fixed to the cylinder, i.e. coupled to the gravure inking cylinder 512, ensures a constant relative position of retaining means 526 and outer cylindrical surface 518, even when the gravure inking cylinder 512 changes position. The end-face side parts 539 can be arranged fixed, for example, to an outer, non-rotating but, e.g. itself eccentrically mounted bearing ring of a radial bearing 672; 691, which receives an end-face cylinder journal 559 or to an end-face ends 559 of a shaft supporting the inking unit cylinder 512. In the following, where not explicitly distinguished, such a shaft end is also referred to as journal 559 or cylinder journal 559 of the gravure inking cylinder 512. Said bearing ring, embodied as eccentric, for example, or an outer ring that accommodates said bearing ring eccentrically, is mounted, e.g. in a frame bore and is configured, for example, as an eccentric ring 733, in particular as an eccentric bushing 733.

Figure 5A:
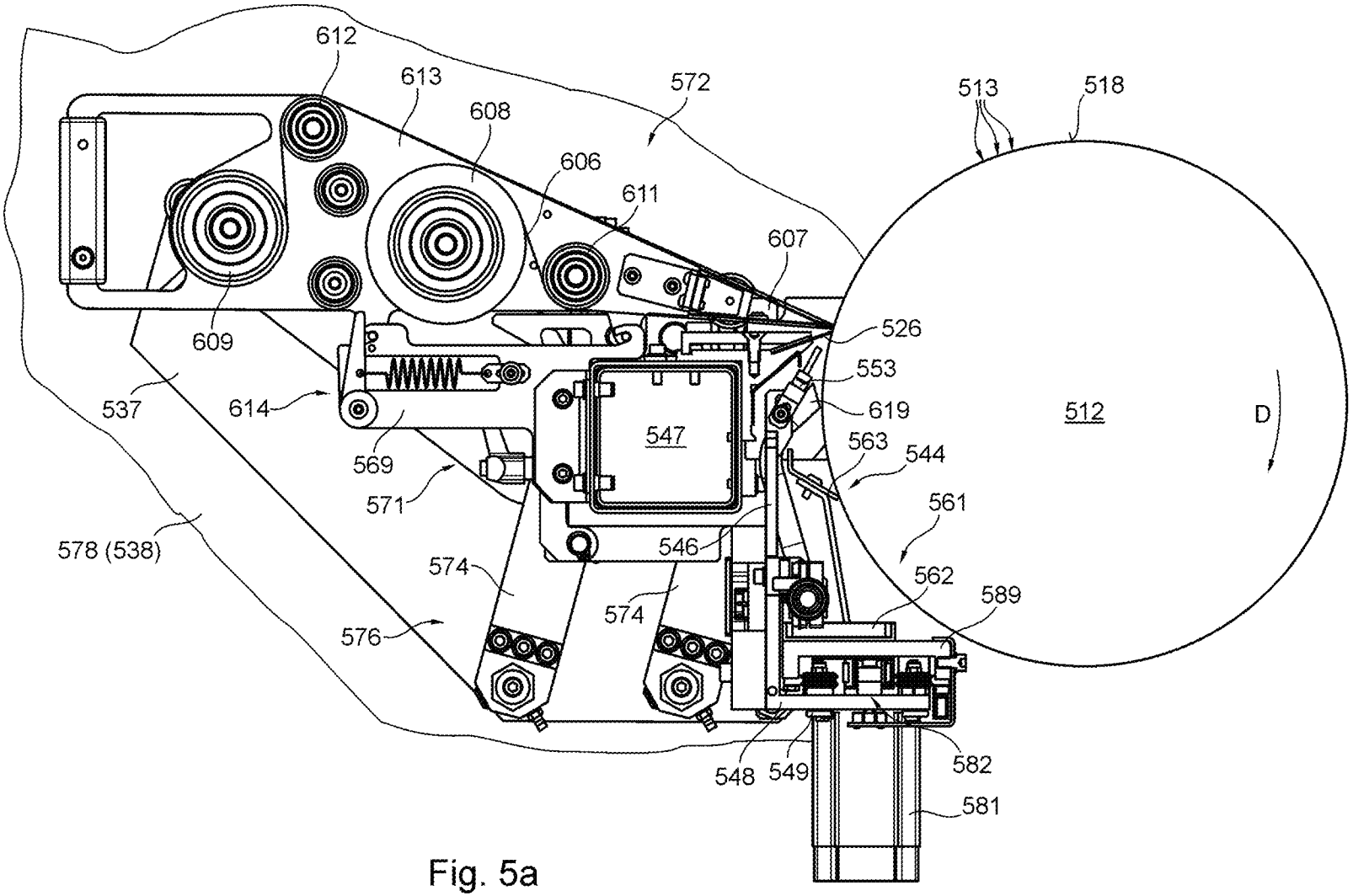
FIG. 5*a* a side view of a first embodiment of the inking unit cylinder comprising the recesses, with an inking device.
Figure 5B:
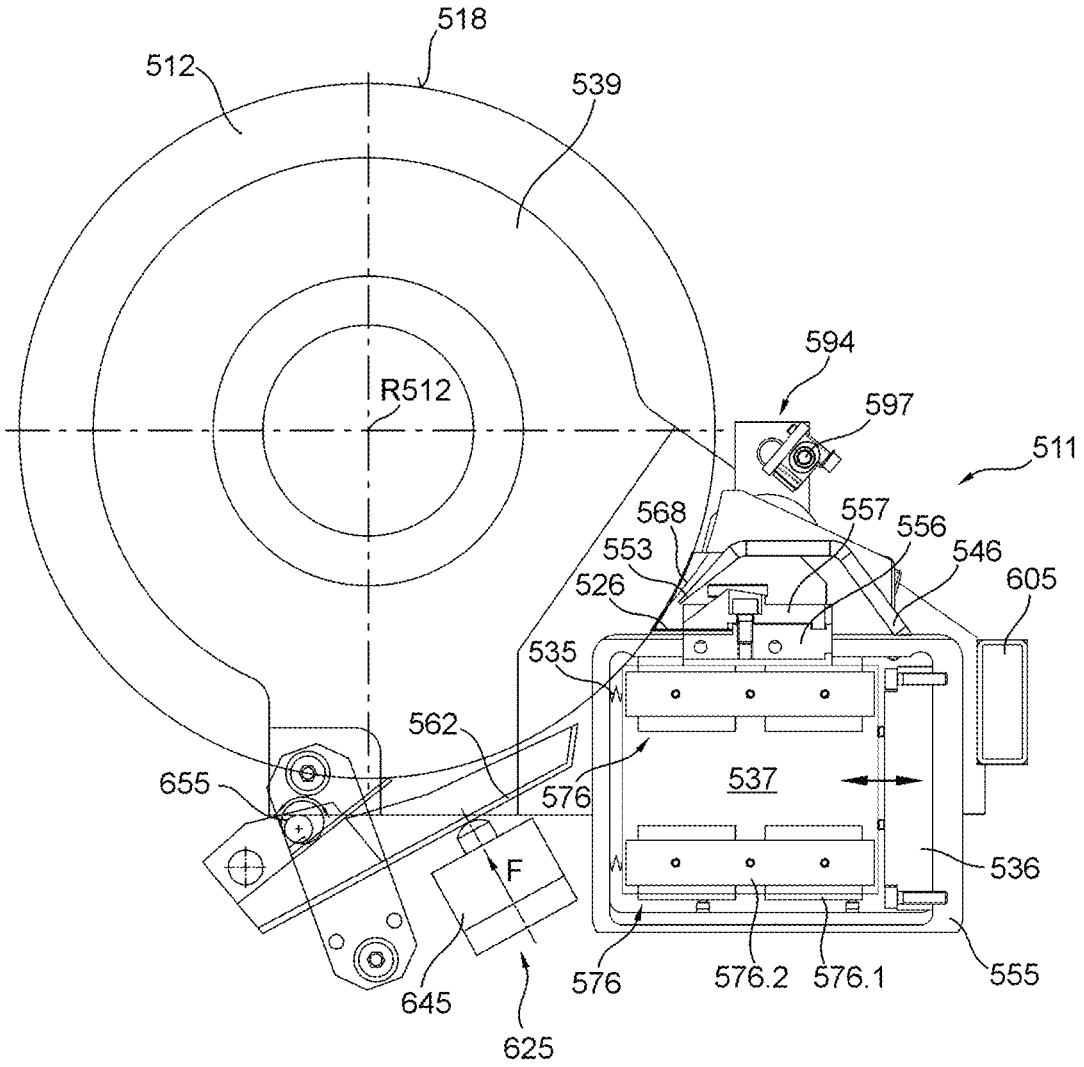
FIG. 5*b* a side view of a second embodiment of the inking unit cylinder comprising the recesses, with inking devices.
Figure 10A:
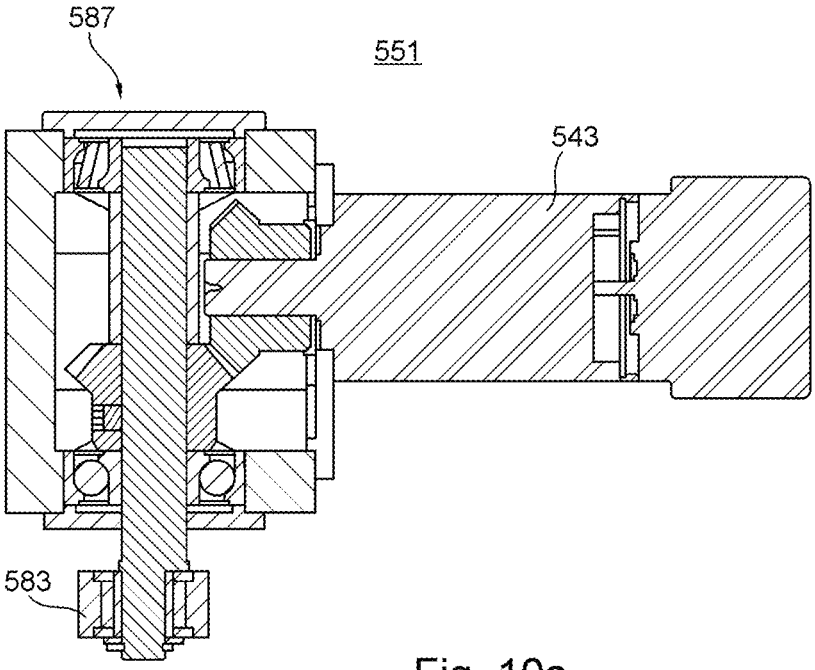
FIG. 10*a* a detail sectional view of the axial drive of FIG. 9 from a different direction.
Figure 10B:
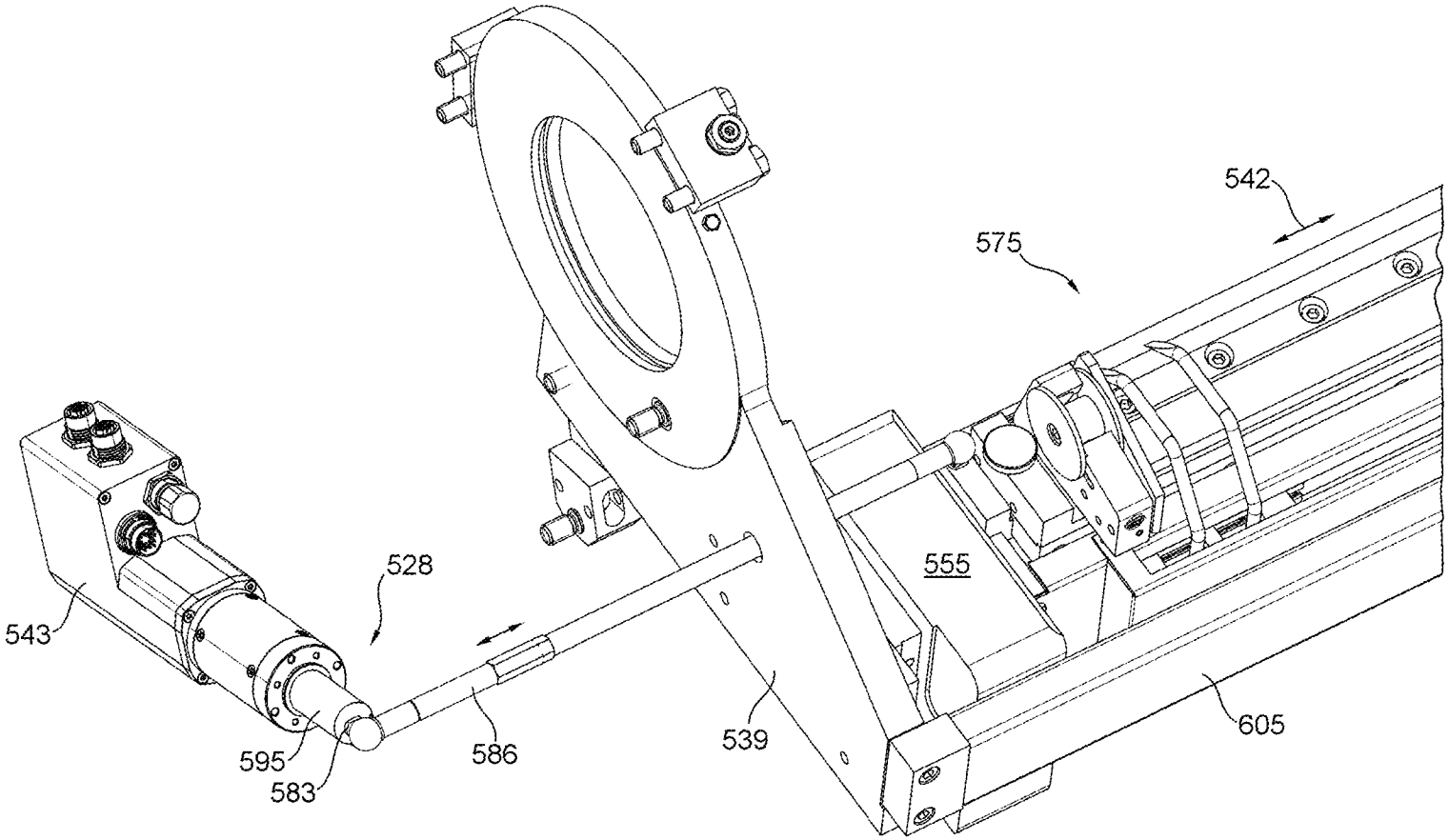
FIG. 10*b* a detail view of a bearing of the inking device with an axial drive, according to the embodiment of FIG. 6*b;*

To reinforce the subframe, the two side parts 539 can be reinforced, e.g. in an end region lying remotely from the axis of rotation R512 (insertion of the gravure inking cylinder 512 in FIG. 5*b*), by a cross member 605, in particular a crossbar 605 (see, e.g. as indicated by way of example in FIGS. 5*b* and 10*b*).

The positioning mechanism and its drive can generally be configured such that, in addition to adjusting the position and/or the contact force or the distance of the retaining means 526, it is also possible to back the inking device 511 away over a long positioning path, e.g. at least 50 mm, in particular 100 mm, which is necessary for maintenance or makeready purposes, for example. In an advantageous embodiment, however, the inking device 511 is mounted, e.g. on frame part 537, such that it can be moved away from the gravure inking cylinder 512, for example such that it is pivotable about an axis 541 provided on the frame part 537. Movement toward and away from the cylinder can be implemented manually or by a remotely actuable drive means.

Generally independently of the specific position and/or specific configuration of the inking device 511, but advantageously in conjunction with one of the aforementioned positions and/or embodiments, the inking device 511, but at least the retaining means 526, e.g. in the form of a wiping means or doctor blade or as an ink blade, and optionally the boundaries of the ink supply chamber 516 on the sides of the inking device 511, is mounted such that it is movable, in particular can oscillate, in its axial position relative to the gravure inking cylinder 512, for example such that it is movable back and forth between a right end position and a left end position. This movement corresponds, e.g. in FIG. 3*a* and FIG. 3*b*, to a movement into and out of the plane of the sheet and is therefore indicated only by a slightly inclined double arrow 542 and by the symbols representing an arrow end and an arrow tip. This oscillating movement is preferably carried out over a total traversing distance of at least 2 mm, e.g. a distance of between 3 and 8 mm, preferably between 4 and 6 mm. The mounting of the inking device 511 or at least of the retaining means 526, e.g. in the form of a wiping means or doctor blade or an ink blade, and optionally of the boundaries of the ink supply chamber 516 on the sides of the inking device 511, is configured to enable an axial oscillation over a traversing distance of at least 2 mm, e.g. a distance of between 3 and 8 mm, preferably between 4 and 6 mm. The axial movement is implemented via an axial drive 552, for example oscillating drive 552, e.g. via a transmission 528 comprised by the oscillating drive 552 and/or preferably by a remotely actuable drive means 543, in particular an electric motor 543, which is comprised by the oscillating drive 552. For this purpose, the inking device 511 or at least the retaining means 526, in particular the doctor blade, and the parts that form the ink supply chamber 516 on the sides of the inking device 511, are mounted such that they are correspondingly axially movable on the frame part 537, for example, or on the frame, frame part, or frame section 538 that supports the gravure inking cylinder 512. This mounting to enable the axial relative movement may be provided, as described above, directly or indirectly on the frame 538 of the inking unit 508 or preferably on a holding means 539 that is fixed to the cylinder. The frequency for axial oscillation is between 0.05 and 1.00 Hz, for example, preferably within the range of 0.1 to 0.3 Hz.

Figure 11:
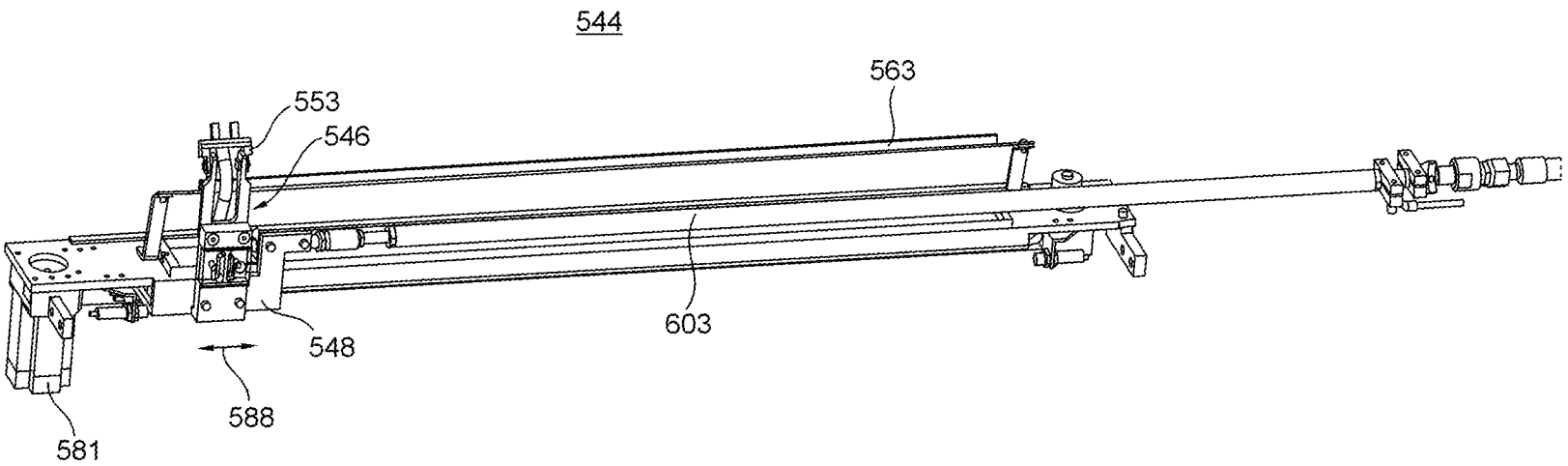
FIG. 11 an individual view of the ink distribution device according to a first embodiment.
Figure 12A:
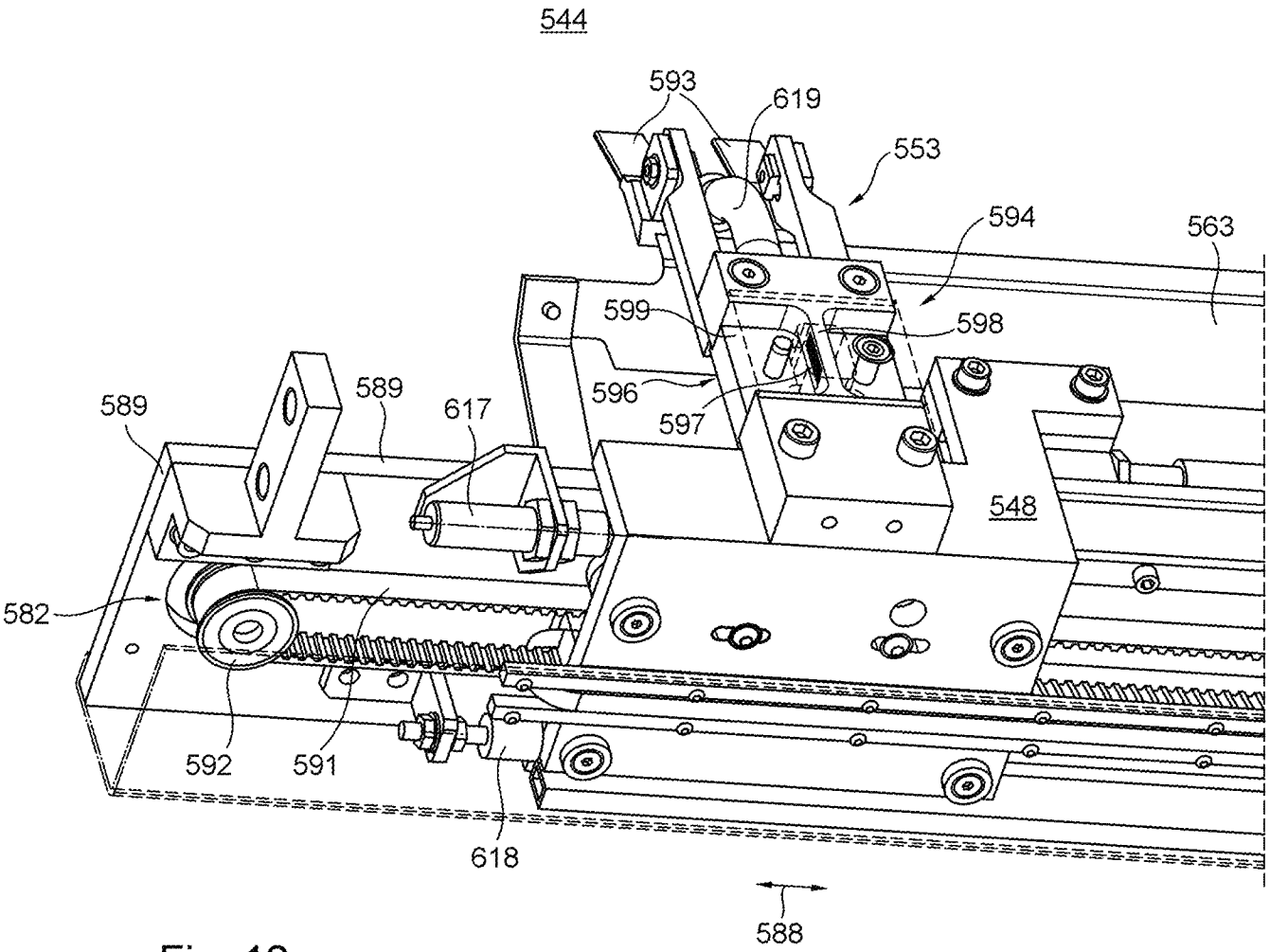
FIG. 12*a* a detail view of the ink distribution device of FIG. 11, obliquely from below.
Figure 12B:
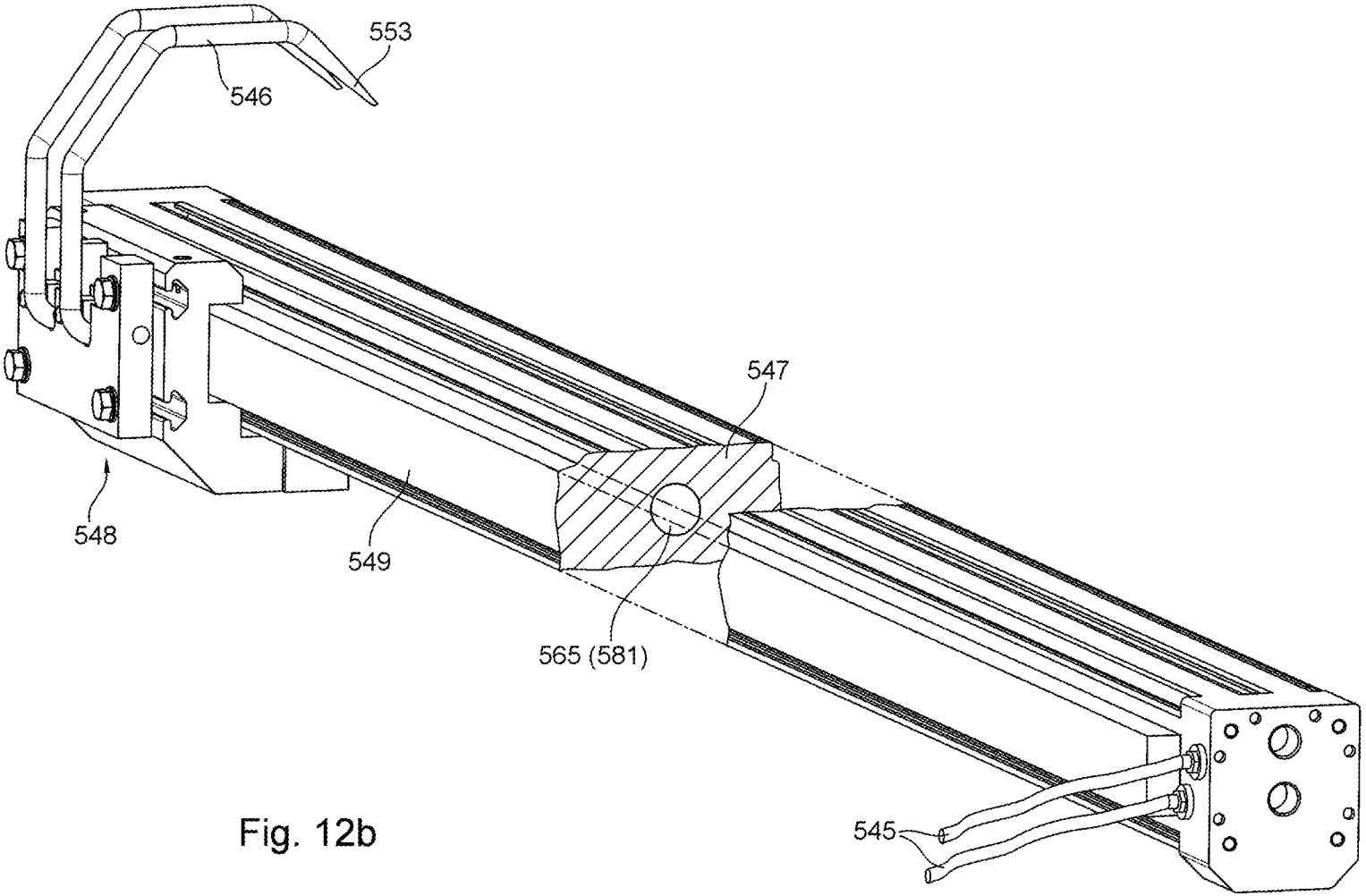
FIG. 12*b* an individual view of the ink distribution device according to a second embodiment.
Figure 13:
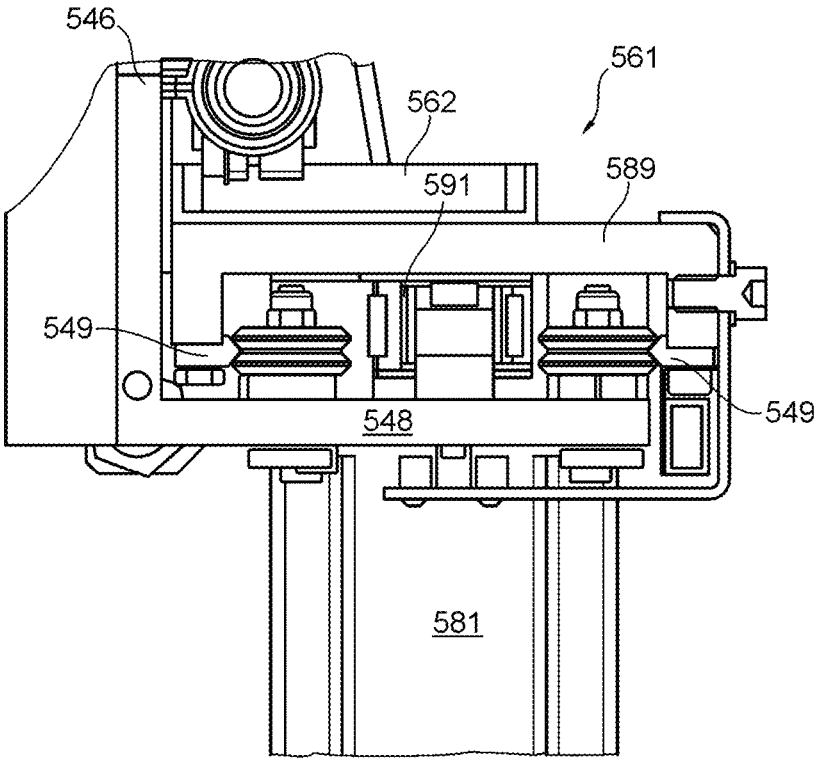
FIG. 13 a detail view of the linear guidance from the inking device according to FIG. 5*a;*
Figure 14:
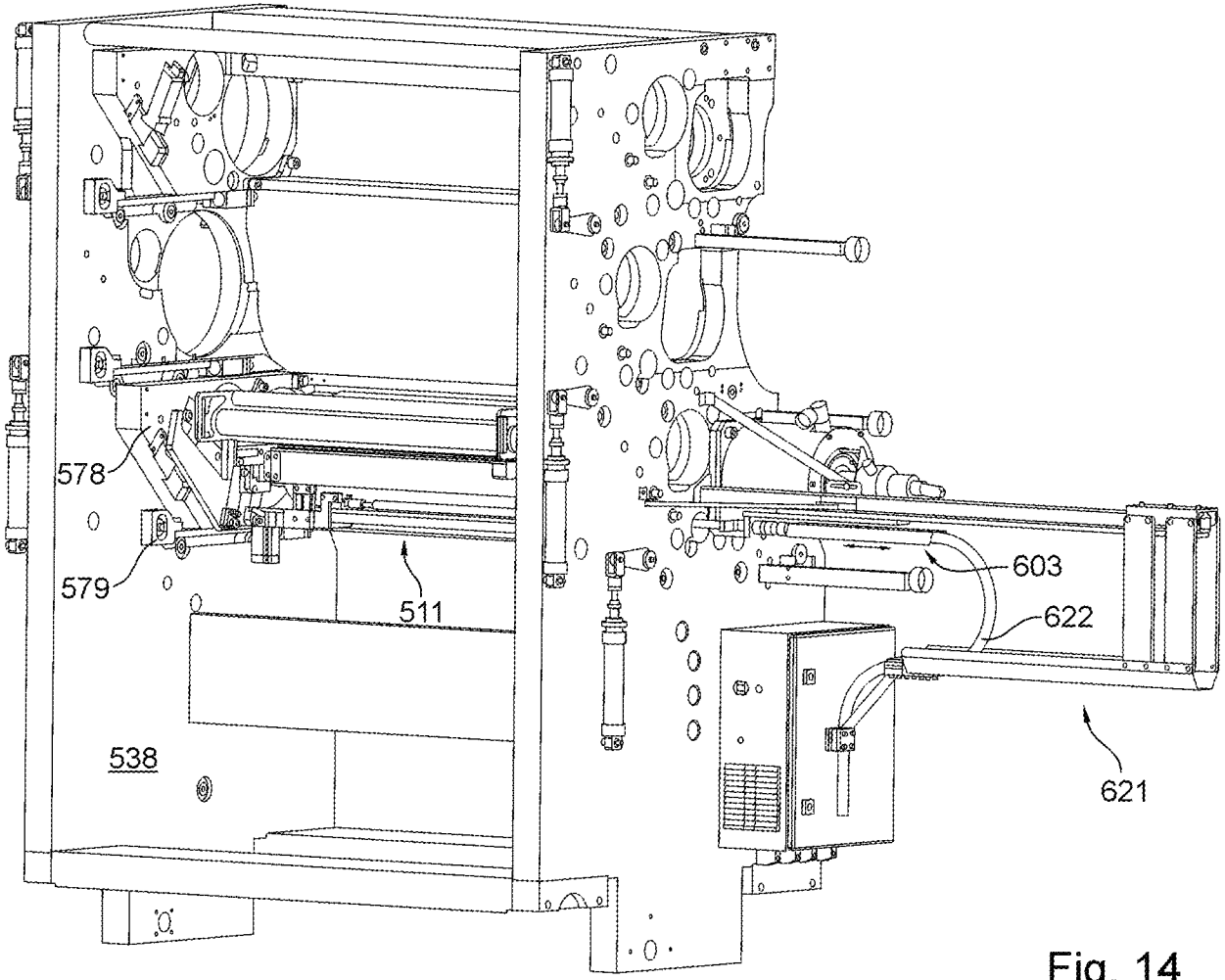
FIG. 14 an overall view of the inking device arranged in the frame.

Generally independently of the specific position and/or specific configuration of the inking device 511, but advantageously in conjunction with one of the aforementioned positions and/or embodiments, a device 544 for axially equalizing the ink level in the ink supply chamber 516, e.g. an ink distribution device 544, in particular an ink stirring device 544, is provided. Said device comprises at least one ink distributor 546, for example, acting as a distributor finger 546 or, in particular, an ink stirrer 546, which protrudes with a leading end 553, at least in the working position, into the ink supply chamber 516, in particular far enough that one end 553 of it is or can be immersed into the fill level located operationally upstream of the retaining means 526 or the doctor blade. In place of the immersed end 553 or preferably additionally thereto, the ink distributor 546 of the ink distribution device 544 can comprise an ink outlet 619, which is or can be moved axially back and forth on the ink distributor 546 in the ink supply chamber 516, thereby distributing the printing ink 517 to be fed in. During operation, the printing ink 517, in particular viscous, which is held in reserve in the ink supply chamber 516, forms a so-called ink roll, which forms directly upstream of the retaining means 526 as a result of contact with the outer cylindrical surface 518 as it moves past. The at least one ink distributor 546 is mounted, axially movable for example, directly or indirectly on the frame 533; 538 that supports the inking device 511, or preferably on a side part 537; 558 of the inking device 511 or directly on an optionally provided cross member 547, e.g. crossbeam 547. For example, it is arranged on a slide 548, which is mounted such that it is axially movable in or on a linear guide 549 and is movable back and forth by a drive means 581, e.g. an electric motor 581. For instance, in an advantageous first embodiment (see, by way of example, e.g., the first embodiment of the arrangement and/or embodiment of the inking device 511 as depicted in FIGS. 11 and 12*a*), it can be moved back and forth by a drive means 581 configured as an electric motor 581, via a transmission that converts rotation into linear movement, for example. In a second advantageous embodiment (see, by way of example, e.g., the second embodiment of the arrangement and/or configuration of the inking device 511, as depicted in FIG. 12*b*) it can be moved back and forth, by a drive means 581 configured as a pressurized medium-actuated piston/cylinder system 581. In that case, for example, a piston connected to the slide 548 carrying the ink distributor 546 is moved back and forth in an axially extending pressurized medium chamber 565, e.g. cylinder 565. In a preferred embodiment, the pressurized medium chamber 565 extends in a crossbar, in particular in the aforementioned crossbar 547 carrying the doctor blade mount 554 or the slide 548 with the doctor blade mount 554. The two chambers at the two ends of the piston can be supplied with pressurized fluid, in particular pressurized compressed air, through two separate pressurized fluid lines 545, or through such a pressurized fluid line 545 via a controlled switching valve.

Advantageously, the ink distributor 546 is moved back and forth at a frequency of at least 0.3 Hz, preferably at least 0.5 Hz.

Generally independently of the specific position and/or specific configuration of the inking device 511, but advantageously in conjunction with one of the aforementioned positions and/or embodiments, the gravure inking cylinder 512 is mounted in the inking unit 08 or in the frame 533; 538 thereof such that it is removable operationally, i.e. for example for replacement or for maintenance and/or makeready purposes, and/or without dismantling additional inking unit components, for example. In one embodiment, this may be a removal in the axial direction of the inking unit cylinder 512, or in another embodiment, it may be a removal in the radial direction.

Generally independently of the specific position and/or specific configuration of the inking device 511, but advantageously in conjunction with one of the aforementioned positions and/or embodiments, the gravure inking cylinder 512 is configured as temperature-controllable, in particular such that temperature control fluid can flow through it.

Generally independently of the specific position and/or specific configuration of the inking device 511, but advantageously in conjunction with one of the aforementioned positions and/or embodiments, the temperature of the printing ink 517 to be supplied to the ink supply chamber 516 can be controlled in the line path upstream of an outlet into the ink supply chamber 516. For this purpose, a temperature control device 604, in particular a heating device 604, is provided in the ink supply line path, for example.

Generally independently of the specific position and/or specific configuration of the inking device 511, but advantageously in conjunction with one of the aforementioned positions and/or embodiments, in a preferred embodiment the gravure inking cylinder 512 can be rotationally driven by its own drive means 616, e.g. drive motor 616, which is mechanically independent of the drive of the other inking unit cylinders 519; 531 and/or printing unit cylinders 501; 503.

Without restriction of the above-described embodiments and variants, in the following a first advantageous exemplary embodiment (see, e.g., FIGS. 5*a*, 6*a*, 7, 8*a*, 9, 10*a*, 11, 12*a*, 13, 14, 15, 16 and 17) and a second advantageous exemplary embodiment (see, e.g., FIGS. 5*b*, 6*b*, 8*b*, 10*b* and 12*b*) of the configuration and/or arrangement of the inking device 511 will be described in greater detail, wherein in the first exemplary embodiment, the inking device 511 is arranged on the side of the gravure inking cylinder 512 that faces away from the relief inking cylinder 519, and in the second exemplary embodiment is provided on the side of the gravure inking cylinder 512 that faces towards the relief inking cylinder 519. In the first exemplary embodiment, the retaining means 526, e.g., for example in the form of an ink blade or in particular a doctor blade, cooperates with the gravure inking cylinder 512 on the side thereof that rotates upward during operation, and in the second exemplary embodiment said cooperation occurs on the side of the gravure inking cylinder 512 that rotates downward during operation. The latter applies in particular to the embodiment of inking unit 508 that comprises the additional transfer cylinder 531, in particular ink collecting cylinder 531.

The inking device 511 comprises, at least on the downstream side of the aforementioned application point or ink supply chamber 516 in the operating direction of rotation D of the inking unit cylinder 512 comprising the recesses 513, the retaining means 526, e.g. a doctor blade or an ink blade, by means of which, as viewed in the operating direction of rotation D, after the ink has been applied and especially before it passes through a nip point 776 with a subsequent inking unit cylinder 519, printing ink 517 previously applied to the outer cylindrical surface 518 can be removed. In this embodiment, the retaining means 526 is preferably configured as a doctor blade and removes completely, as defined above, printing ink 517 applied previously to the outer cylindrical surface 518 from non-engraved regions.

In the first embodiment, the line of contact or, if the retaining means 526 is embodied as an ink blade, the line of the shortest distance on the circumference of the gravure inking cylinder 512 preferably lies in the region of the upper half of the gravure inking cylinder 512, e.g. in the range of 10° to 30° above the horizontal line running through the axis of rotation R512 of said cylinder, and for the second embodiment, it preferably lies in the region of the lower half, e.g. in the range of 70° to 89° below the horizontal line that divides the gravure inking cylinder 512 at the center. The retaining means 526, preferably configured here as a doctor blade, is held, in particular clamped, in a two-part retaining means mount 554, in particular a doctor blade mount 554, which comprises a holding bar 556 that supports the retaining means, in the first embodiment e.g. on the ink chamber side and in the second embodiment, e.g. on the outside, and on the other side comprises a clamping or cover strip 557, which is detachably connected, e.g. screwed, to the former. The retaining means mount 554 or the holding bar 556 can be embodied as self-supporting, for example, and can be mounted immediately, e.g. directly on side parts 537; 558, e.g. side frame parts 537; 558, for example, side panels 537; 558, but is preferably arranged at or on a cross member 547, e.g. the crossbar 547, which is mounted, e.g. at both ends on the end-face frame parts 537; 558. In the first embodiment of the arrangement of the inking device 511, a part of the holding bar 556 that continues downward, alone or together with the optionally provided crossbar 547 or an optionally provided additional component, forms the rear boundary of the ink supply chamber 516, i.e. the boundary opposite the gravure inking cylinder 512. In a first variant of this first embodiment, the ink supply chamber 516 is open toward the bottom, except for an ink distributor 546 of an optionally provided ink distribution device 544 optionally projecting into the space from below and/or an ink collecting device 561 provided therebeneath, for example, for printing ink 517 that may drip off during operation or after operation. In that case, for example, a guide device 563, e.g. a single-part or multi-part guide plate 563 that just touches or only nearly touches the outer cylindrical surface 518 is provided, which guides the printing ink 517 up to the outer cylindrical surface 518, to be transported along by the same in the direction of rotation back to the retaining means 526. Below this, a collecting receptacle 562, e.g. a collecting trough 562, for receiving printing ink 517 that drains out of the ink supply chamber 516 in an idle mode, for example, can be provided.

Spaced from the active-side edge 566 of the retaining means 526, e.g. the doctor blade edge 566, of the holding bar 556, on the ink supply chamber side for the first embodiment of the arrangement of the inking device 511, a barrier 564, e.g. a drip barrier 564 rising into the ink supply chamber 516 is provided, for example, by means of which barrier a runoff of printing ink 517 at the rearward boundary is counteracted. Said barrier 564 may be formed by the shaping of the holding bar 556 or by a separate, angled bar 564.

Regardless of whether the inking device 511 is arranged in the first or the second embodiment, the retaining means mount 554, in particular the holding bar 556, is configured to accommodate retaining means 526 of different lengths and/or to accommodate retaining means 526 of different unobstructed lengths, i.e. the length of the part of the retaining means 526 that is not clamped in the retaining means mount 554 or supported by the holding bar 556. The length of the retaining means 526 or of said part is understood as its extension from the front edge facing the gravure inking cylinder 512 to the rear edge remote from the cylinder or to its clamping point or point of support. The axial extension of the retaining means 526 is understood here as its width. In addition to or in place of this, the retaining means mount 554 is configured to accommodate retaining means 526 of different thicknesses and/or, in addition to a retaining means 526 that acts to remove printing ink 517, to accommodate a support element (not shown), which compensates for a height difference in the case of thinner retaining means 526 and/or which protrudes from the retaining means mount 554 on the side close to the cylinder and supports the retaining means 526, particularly for the embodiment of said retaining means as a doctor blade intended for physical contact, on the side that forms an obtuse angle with the cylinder tangent in the line of contact.

In an advantageous configuration of the inking device 511, retaining means 526 of different thicknesses and/or rigidities may be kept on hand and/or usable in the retaining means mount 554.

Regardless of whether the inking device 511 is arranged in the first or the second embodiment, the ink supply chamber 516 is delimited at its end faces by side parts 567, e.g. side panels 567. These side parts 567, also called side seals, enclose the ink supply chamber 516 laterally and, on the side 568 that faces the gravure inking cylinder 512, e.g. the sealing side 568, have a profile complementary to the cooperating section of the cylinder circumference. Thus this side can be placed against the relevant section of the cylinder circumference nearly without a gap. The side parts 567 may be made of an at least slightly compressible and/or elastic material or may have a layer made of a flexible, e.g. compressible and/or elastic material on the side 568 that forms the seal. The side parts 567 are arranged, in particular detachably fastened, e.g. at the end faces of the holding bar 556 of the retaining means mount 554 and/or on the cross member 547 that supports said holding bar. Said parts can be mounted movably in the direction of the gravure inking cylinder 512 and can be preloaded, e.g. by spring means, e.g. compression springs, in the direction of the gravure inking cylinder 512. In the activated position, the two side parts 567 cooperate directly with the outer cylindrical surface 518 having the engravings 513 or, if the gravure inking cylinder 512 carries an ink transfer forme that has the engravings, said side parts preferably cooperate with edge regions of said ink transfer forme.

In an advantageous embodiment, in addition to the retaining means 526 delimiting the ink supply chamber 616 downstream in the direction of rotation, in particular in addition to the retaining means 526 configured as a doctor blade, a removal device 572 can be provided behind the retaining means 526 in the direction of rotation, by means of which printing ink 517 that accumulates at the downstream edge of the retaining means 526 as viewed in the direction of rotation can be removed from the edge before it can be released and carried along on the outer cylindrical surface 518, or in another embodiment, printing ink 517 that has accumulated and been carried along can be prevented from entering the nip point 776 with the second inking unit cylinder 519.

For this purpose, a holding device 569 can be connected to the holding bar 556 of the retaining means mount 554 and/or to the cross member 547 supporting said bar and/or to the frame 538 or side parts 539 of an aforementioned subframe, and an optionally provided removal device 572, which will be described in greater detail below, is arranged, in particular can be detachably arranged, on said holding device, preferably in conjunction with the arrangement of the inking device 511 in the first embodiment.

The components immediately surrounding the ink supply chamber 516 on the side of the inking device 511, e.g. at least the retaining means mount 554 including retaining means 526, the cross member 547 if applicable, the side parts 567 if applicable, an optionally provided removal device 572 or holding device 569 for a removal device 572, and optionally, additional components, e.g. additional retaining means and/or optionally provided ink blade drives, arranged fixed to said former components but detachably, e.g. for maintenance or makeready purposes, will also be referred to in the following collectively as an ink supply unit 571, and, particularly in conjunction with a retaining means 526 configured as an ink blade, as an ink fountain 571.

Figure 3A:
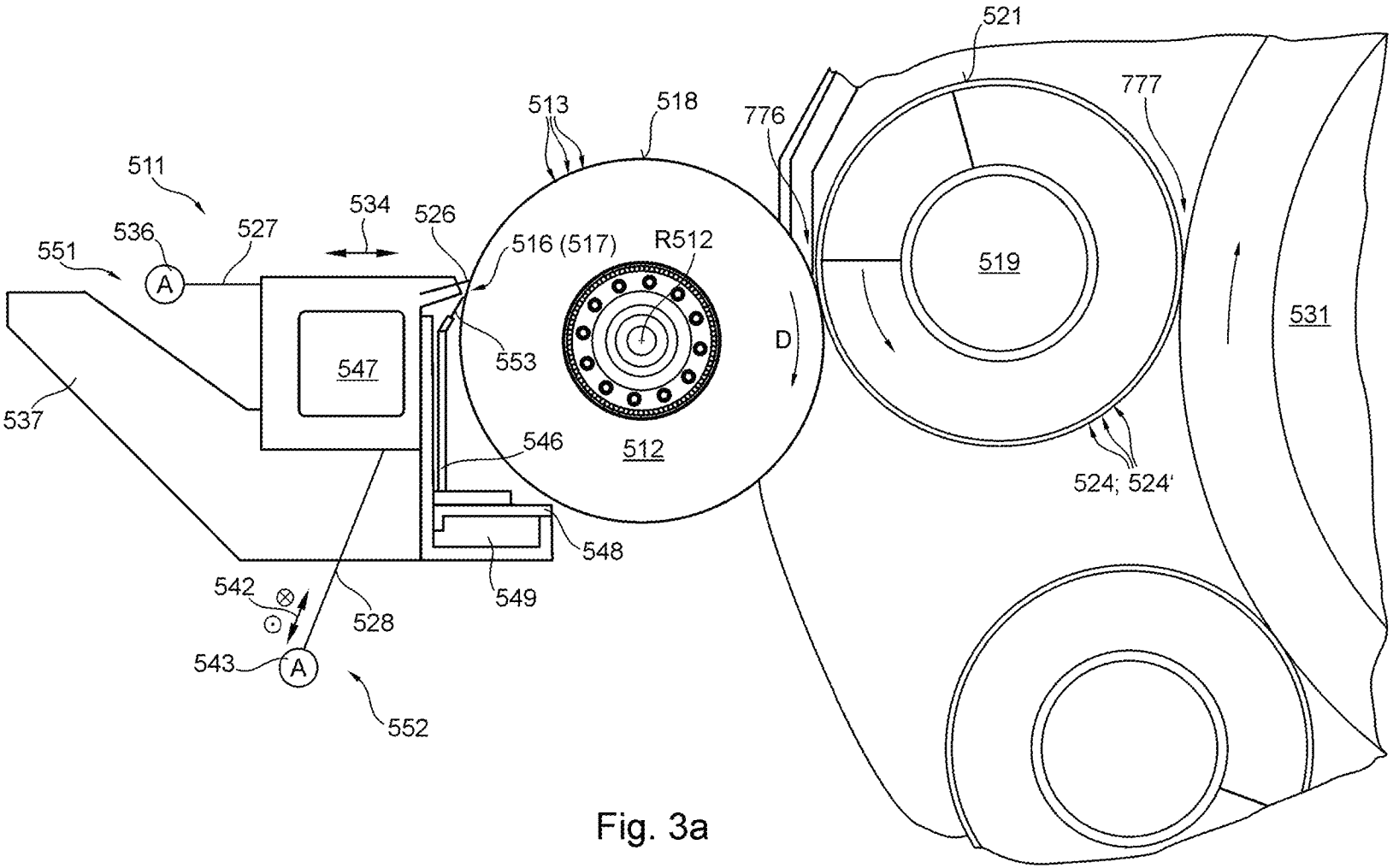
FIG. 3*a* an enlarged detail of the printing unit of FIG. 2*a;*

Said ink supply unit 571 can preferably be removed in its entirety from the inking device 511 (see, e.g., as indicated by way of example in FIG. 6*b*, based on the second embodiment of the arrangement of the inking device 511, but shown here rotated 180° around a vertical center axis to provide a view from the other side), but advantageously can at least be moved away within the inking device 511 from a working position to a maintenance or makeready position spaced a greater distance from the gravure inking cylinder 512. For this purpose, the ink supply unit 571, as illustrated, e.g. in the example of the embodiment according to FIG. 3*a* and FIG. 5*a*, is mounted, e.g. to be movable, in particular linearly movable, directly on the frame, frame part, or subframe 538 that supports the gravure inking cylinder 512, or preferably on a side part 537; 558, e.g. frame part 537; 558, in particular a side panel 537; 558, which is in turn supported indirectly or directly, and movably or rigid, on the frame, frame part, or frame section 538 that supports the gravure inking cylinder 512. The linearly movable mounting is preferably accomplished via a linear guide 573, e.g. dovetail guide 573. As illustrated by way of example, e.g., in FIG. 6*b*, for the embodiment according to FIG. 3*b* and FIG. 5*b*, for example, the ink supply unit 571 comprising the retaining means mount 554 and the retaining means 526 can be embodied as removable in its entirety from the inking device 511, in particular as detachable from the cross member 547 that remains in the inking device 511 and directly or indirectly supports the retaining means mount 554. In that case, the ink supply unit 571 can be secured directly or indirectly to the cross member 547 via fastening means not specifically designated in the figures, e.g. via screws or a lock.

The embodiments and configurations of details presented "by way of example" above and in the following for one of the embodiments and/or arrangements of the inking device 511 can be applied logically to the general approach to the solution or alternately to the other embodiment, unless this is explicitly contradicted or is clearly not applicable.

In an advantageous embodiment already mentioned above, the retaining means 526, in particular the ink supply unit 571 comprising the retaining means 526 and/or delimiting the ink supply chamber 516, is configured as adjustable in terms of its radial position relative to the gravure inking cylinder 512, in particular as movable up to and away from said cylinder, by means of a positioning drive 551 that has, e.g., a drive means 536 and/or a transmission 527. Particularly if the removal means 526 is intended for physical contact, the positioning drive 551 is preferably configured to reposition the retaining means 526 if the active edge of the same should become worn resulting in a shortening of the retaining means 526, such that the desired and/or existing contact, in particular contact force and/or contact position, of the doctor blade edge on the outer cylindrical surface 518 is maintained. For this purpose, for example, a sensor-based determination, by means of appropriate sensors, of the shortening or easing caused by wear can be provided or carried out, along with a corresponding motorized repositioning by a motorized drive means. Alternatively, however, in a particularly advantageous embodiment, the drive means 536 may be configured as a force-based drive means 536, preferably as a pressurized medium-actuated working cylinder 536, in particular pneumatic cylinder 536. The force, in this case the pressure, can preferably be varied within at least a positioning range. Particularly if the retaining means 526 is configured as a doctor blade, this enables a certain contact force to be ensured and/or to be varied selectively by choosing the pressure level. If the retaining means 526 is embodied as an ink blade, the spacing of which is adjustable, for example, such a force-based drive means 536 can be used to adjust the retaining means 526 or the ink supply unit 571 or the retaining means mount 554 supporting the retaining means 526 against a preferably adjustable stop means, for example.

Although the adjustment can generally also be achieved by pivoting about a pivot axis, in a first embodiment, which is advantageous particularly in connection with a possible oscillating movement and/or with an inking device 511 located on the side of the gravure inking cylinder 512 that faces away from the relief inking cylinder 519, a guide 576 configured as a parallelogram guide 576 may be provided for the radially movable mounting. In that case, the ink supply unit 571 comprising at least the retaining means 526 is mounted on both sides, or each side part 558 that supports the ink supply unit 571 or the retaining means 526 to enable relative movement as described above is mounted on two rocker arms 574, in particular extending in the manner of two opposite sides of a parallelogram. These two rocker arms 574 act on the ink supply unit 571 carrying the retaining means 526 or on the retaining means mount 554 at two points that are spaced different distances from the gravure inking cylinder 512 and that are pivotable about correspondingly spaced pivot axes. On the frame side, they can pivot about respective pivot axes at the same distance from one another stated above, the distance between the pivot axes on a respective rocker arm 574 being the same for both rocker arms 574.

Particularly if the guide is embodied as a parallelogram guide 576, if the retaining means 526 or the ink supply unit 571 comprising it is embodied as axially movable or oscillatable, for example, the rocker arms 574 are preferably configured as elastically deformable rocker arms 574, e.g. as sheet metal strips.

On the frame side, the rocker arms 574 can be mounted directly on the frame, frame part, or frame section 538 that supports the gravure inking cylinder 512, or on a single-part or multi-part side part or frame part 537 indirectly connected to such a frame, frame part, or frame section 538. On the frame side, the rocker arms 574 are preferably mounted on the single-part or multi-part side part or frame part 537 on which the drive means 536 that effects the positioning movement also engages on the frame side. As drive means 536, an electric motor may be provided, however in this case a pressurized medium-actuated working cylinder 536, in particular a pneumatic cylinder 536, is preferably provided. If an aforementioned axial mobility or oscillation is provided, the drive-side coupling of the drive means 536 to the ink supply unit 571 or to the retaining means mount 554 is implemented via a coupling that absorbs the relative movement, for example, as illustrated by way of example for the first embodiment of the inking device 511, via an articulated connection 577, e.g. via a ball joint 577, or as is provided by way of example, e.g., for the second embodiment of the inking device 511, on a non-oscillating part of the inking device 511, e.g. the non-oscillating cross member 547 here.

In an alternative embodiment of the guide 576 as a linear guide 576, which is advantageous, e.g., in terms of rigidity, the inking device 511 is mounted, supported for radial movement, on both sides in or on pairs of guide elements 576.1; 576.2 that are linearly movable relative to one another (see, e.g., as illustrated by way of example in FIG. 5*b* for the second embodiment of the arrangement and/or embodiment of the inking device 511), one of which is arranged fixed to the inking unit frame 533, 538 or to the aforementioned frame section 538, with the guide element 576.2 that is movable relative thereto being connected directly or indirectly to the retaining means 526 of the inking device 511. In that case, activation is preferably implemented via a pressurized medium-actuated actuator 536, which preferably works against a resilient element 535, e.g. at least one compression spring 535. On the side of the activated position, the positioning path may be limited by an adjustable stop.

The guide elements 576.1 provided fixed to the frame are arranged, for example, together with the drive means 536 and the optionally provided resilient element 535, in a housing 555, e.g. bearing housing 555, which is correspondingly arranged directly or indirectly on the inking unit frame 533, 538 or on the aforementioned frame section 538.

Particularly if the guide 576 is embodied as a linear guide 576, and/or for example, if the retaining means 526 or an ink supply unit 571 comprising said retaining means is embodied as axially movable or oscillatable, the guide elements 576.2 assigned to the inking device 511 are not connected rigidly and directly to the retaining means 526, but rather to a component that supports the retaining means 526, e.g. to a or to the aforementioned cross-member 547, preferably such that the retaining means is axially movable. In that case, the retaining means 526 is arranged, for example, on a slide 575, e.g. carriage 575, which is mounted to be axially movable in one or more axially extending guides 585 (see, e.g., the example of the second embodiment for the arrangement of the inking device 511 in FIG. 8*b*). If the ink supply unit 571 is removable, it is or should be arranged detachably on the slide 575, for example.

The gravure inking cylinder 512 and the inking device 511 can be arranged directly on the printing unit frame or on the relevant frame section 538 (533). In an advantageous refinement, they are mounted on side parts 578 of a subframe that supports the gravure inking cylinder 512 and the inking device 511 and that can be moved, for example displaced, via plain bearings or particularly roller bearings, as a unit, in particular along a horizontal direction, on guides 579, in particular such that the gravure inking cylinder 512 can be thrown onto or thrown off of the inking unit cylinder 519 that follows downstream.

In an advantageous embodiment that comprises an oscillatable or oscillating retaining means 526 or an oscillatable or oscillating ink supply unit 571, an axially acting linear drive, e.g. a spindle drive rotated by an electric motor and reversible in terms of its direction of rotation, in particular a reciprocating ball spindle drive, or a linear motor that is reversible in terms of its direction of movement can be provided. In an embodiment that is preferred here, axial driving is implemented via a transmission 528 that converts the rotation of a drive means 543 embodied as an electric motor 543 into linear movement.

Figure 9:
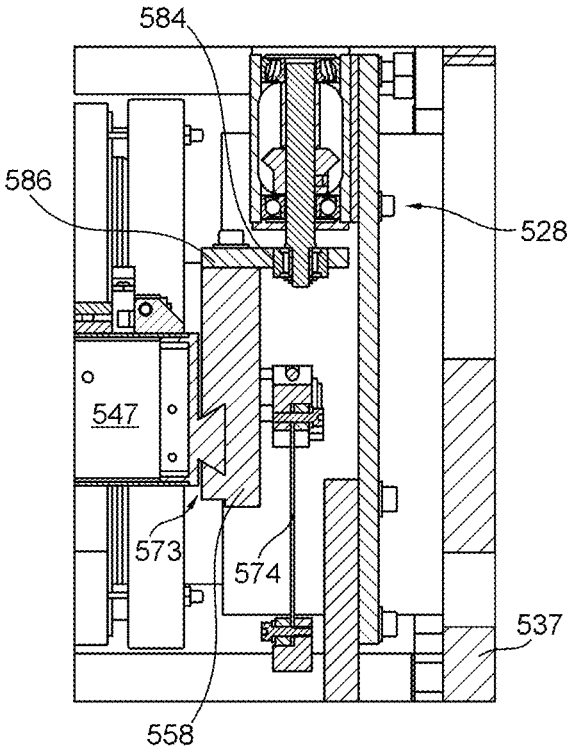
FIG. 9 a detail view of a bearing of the cross member that supports the retaining means with an axial drive, according to the embodiment of FIG. 6*a;*

In a first embodiment (see, e.g., the example relating to the second embodiment for the configuration and/or the arrangement of the inking device 511 in FIG. 9 and FIG. 10*a*), said transmission 528 comprises a drive element 583, for example, which is rotatable eccentrically about an axis of rotation extending, e.g., perpendicular to the desired axial direction, in particular an eccentric disk 583, the axis of rotation of which extends, e.g., perpendicular to the desired axial direction, and which engages in a recess 584 that is provided on single-part or multi-part transmitting means 586, which are connected fixedly or at least rigidly in the transverse direction to the retaining means mount 554. Said transmitting means may be, for example, an extension 586, e.g. a lug 586, which is arranged directly on the ink supply unit 571 or, in the case of an aforementioned removability, on the side part 558 that supports the ink supply unit 571 such that it is radially movable. The inside width of said recess 584, as viewed in the axial direction, corresponds to or is slightly larger than the outside diameter of the eccentric disk 583. Perpendicular to this, for example, a greater inside width is provided, which corresponds at least to the diameter of the eccentric disk 583 plus twice the eccentricity. The eccentric disk 583 can be driven by the electric motor 543 directly, or via a transmission 587, e.g. here an angle gear 587.

Figure 6A:
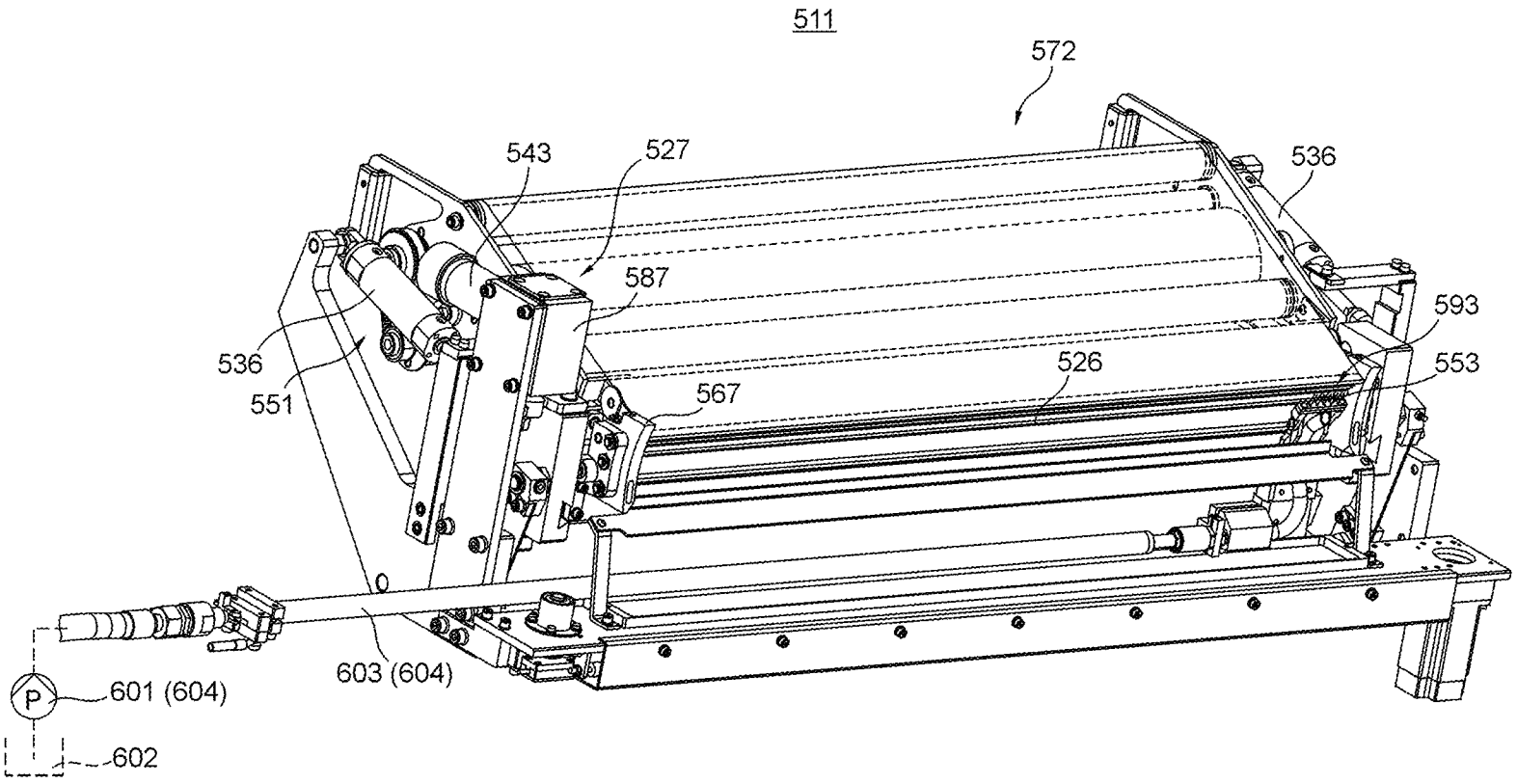
FIG. 6*a* an oblique view of the inking device of FIG. 5*a;*
Figure 6B:
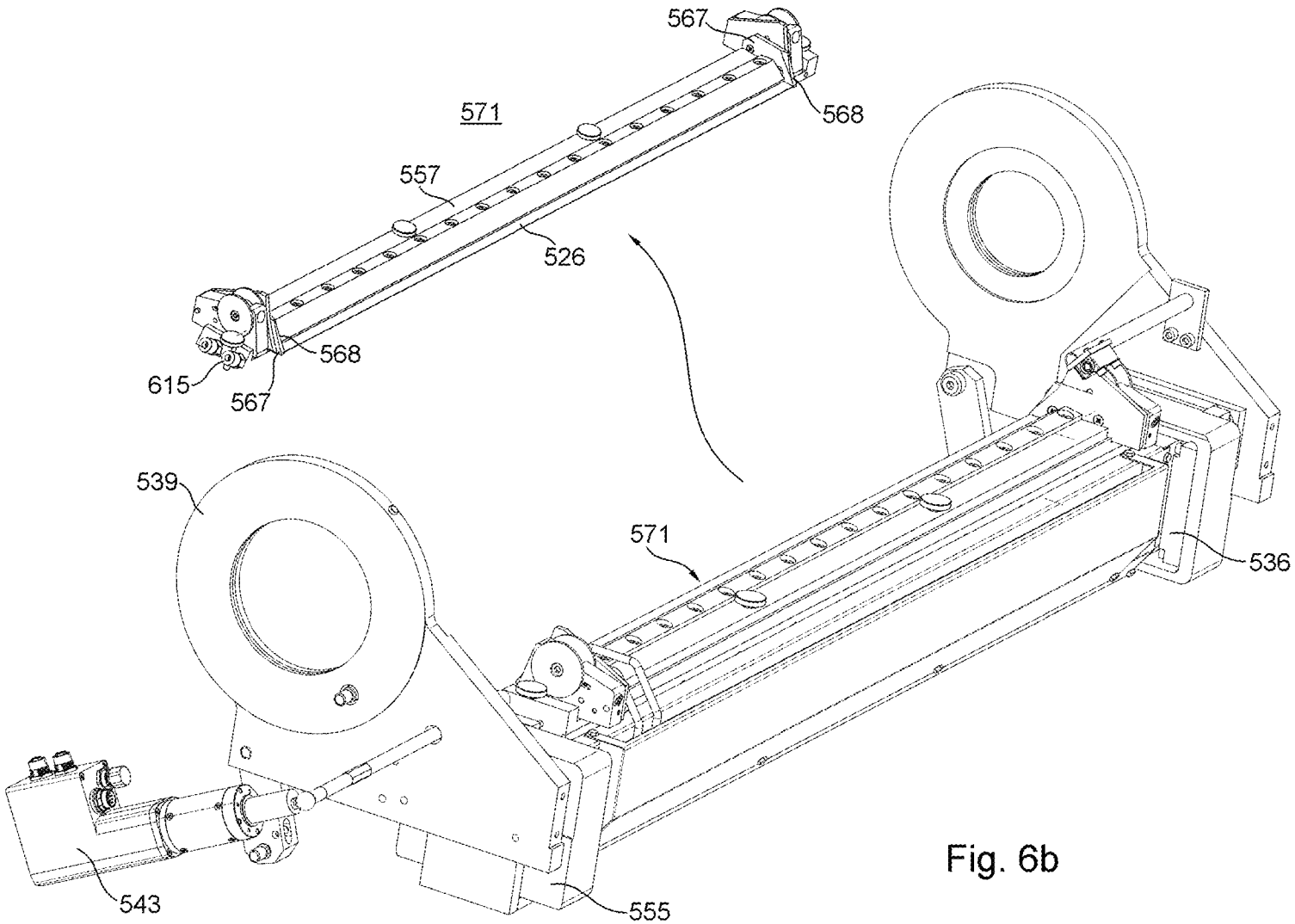
FIG. 6*b* an oblique view of the inking device of FIG. 5*b;*
Figure 7:
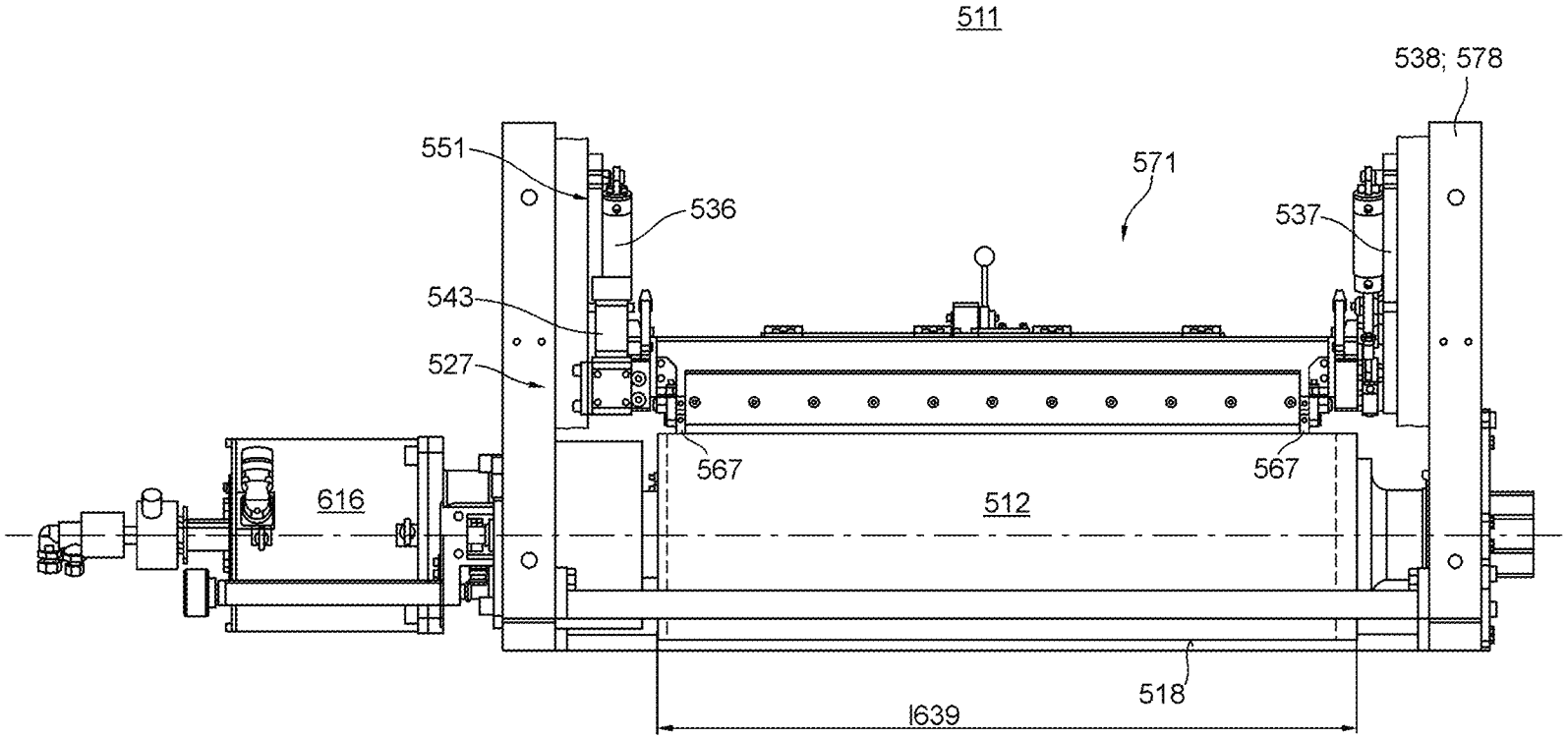
FIG. 7 a plan view of an inking device according to FIG. 5*a;*
Figure 8A:
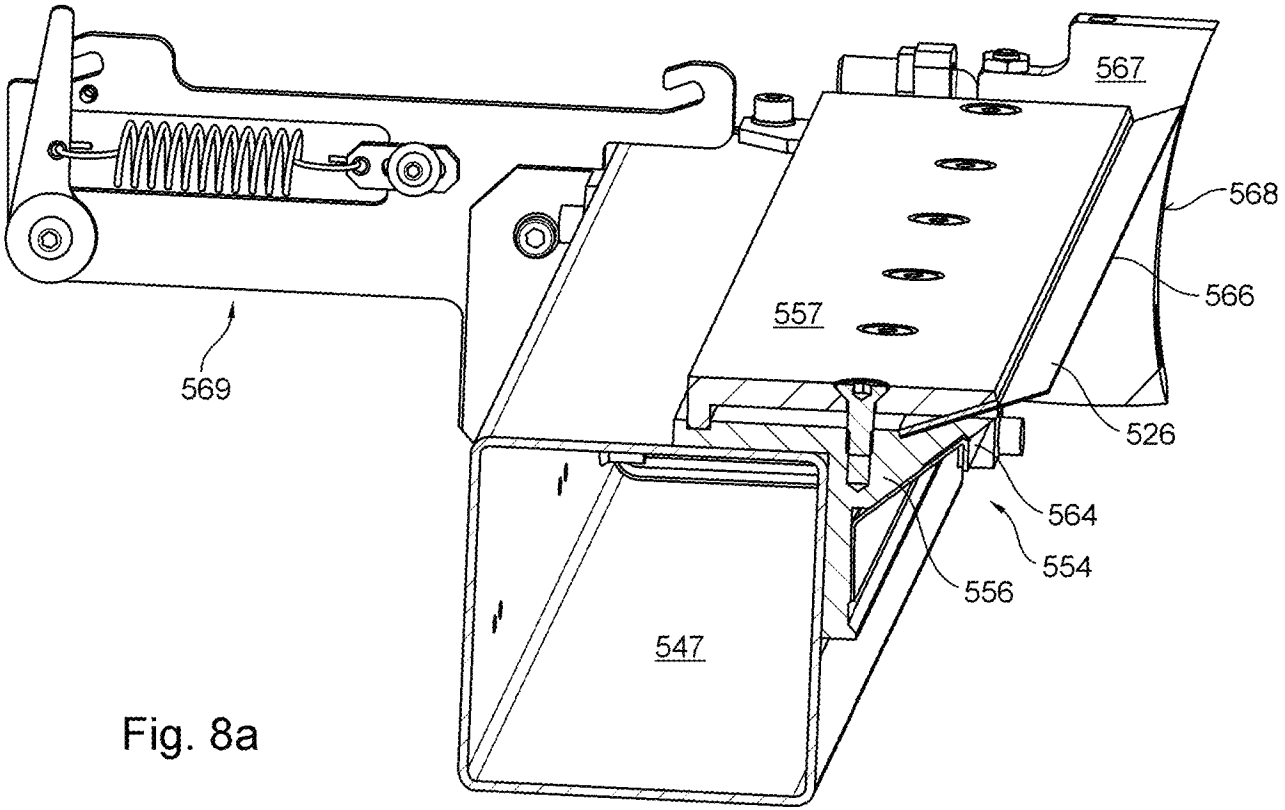
FIG. 8*a* a detail view from the inking device of FIG. 5*a;*
Figure 8B:
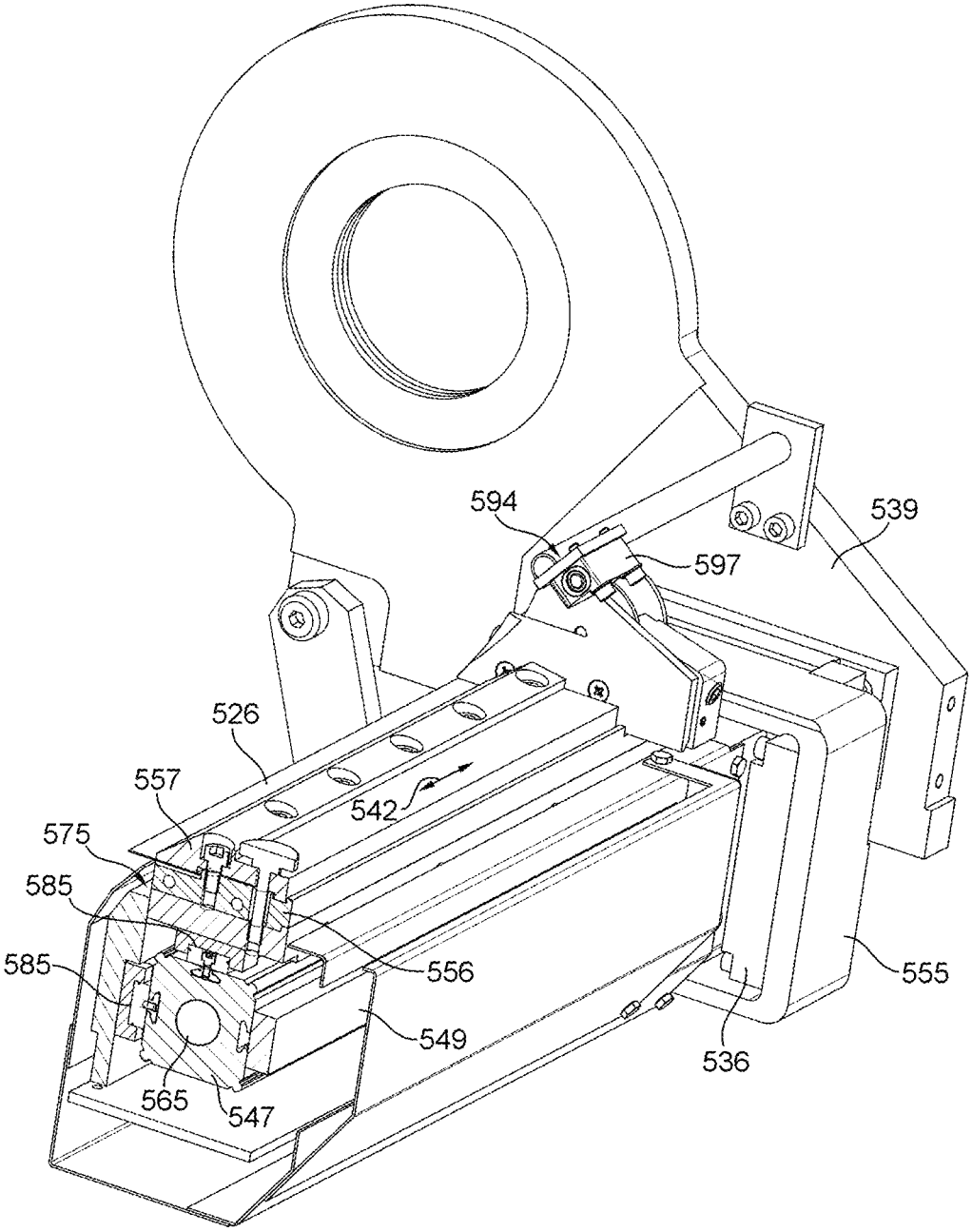
FIG. 8*b* a detail view from the inking device of FIG. 5*b;*

In a second embodiment (see, e.g., the example relating to the second embodiment for the configuration and/or the arrangement of the inking device 511 in FIG. 6*b* and FIG. 10*b*), said transmission 528 likewise comprises a drive element 583, for example, which is rotatable eccentrically about an axis of rotation extending, e.g., perpendicular to the desired axial direction, here in particular a coupling 583 arranged eccentrically at the end face of a shaft 595 driven by the electric motor 543, e.g. with its axis of rotation extending perpendicular to the desired axial direction, of the transmitting means 586 configured here, e.g., as a single-element or multi-element coupling 586, e.g. a single-part or multi-part linkage 586. The shaft 595 may be formed, for example, by the axle 595 of the electric motor 543 itself or by a shaft 595 that is a continuation of said axle and/or is driven by the same. The single-element or multi-element coupling can act indirectly or directly on the ink supply unit 571, which is axially displaceable in its entirety, or on an axially displaceable slide 575. The inside width of said recess 584, as viewed in the axial direction, corresponds to or is slightly larger than the outside diameter of the eccentric disk 583. Perpendicular to this, for example, a greater inside width is provided, which corresponds at least to the diameter of the eccentric disk 583 plus twice the eccentricity.

In an advantageous embodiment, the parts that determine the axial traversing distance by means of the eccentricity, e.g. the eccentric disk 583 or the shaft 595 having the eccentric coupling 583, can be exchangeable.

In an advantageous embodiment having an aforementioned ink distribution device 544, the inking device 511 comprises an aforementioned device 544 for axial ink distribution and/or equalization, with an ink distributor 546 mounted so as to be axially movable, as viewed in the axial direction of the gravure inking cylinder 512 (see, for example, double arrow 588). The at least one ink distributor 546, e.g. distributor finger 546, is mounted in this case for axial movement, for example, via a slide 548, on a cross member 589 other than the aforementioned crossbar 547, e.g. another crossbar 589, which is in turn mounted directly or indirectly at each end face on the frame 533; 538 that supports the inking device 511, or preferably on a side part 537; 558 of the inking device 511. In place of the immersed end 553, or preferably in addition thereto, the ink distributor 546 of the ink distribution device 544 may comprise an ink outlet 619, which is or can be moved axially back and forth in the ink supply chamber 516 on the ink distributor 546, thereby evenly distributing axially the printing ink 517 that is to be supplied.

The ink distributor 546, in this case, e.g., the sole ink distributor, is arranged on a slide 548, which is mounted for axial movement in or on a linear guide 549 and can be moved back and forth, for example via a transmission 582 that converts rotation into linear movement, by a drive means 581, e.g. an electric motor 581. The transmission 582 in this case is preferably embodied as a transmission 582 that converts rotation into linear movement, in particular a traction drive 582. Said transmission comprises a traction means 591, preferably revolving, e.g. a toothed belt 591, on which the slide 548 mounted in or on the guide 549, in particular the linear guide 549, is fastened in such a way that said slide follows the axially moved traction means 591 or the run of a revolving traction means 591 on which it is fixed, preferably detachably fixed. The traction means 591 is clamped, for example, to a block that is fixed to the slide. On the slide 548, rollers are provided, for example, which work together with lateral, axially extending guides. The traction means 591 is or can be driven, for example, by a drive wheel 592, e.g. belt pulley 592, which is partially wrapped, e.g. by the traction means 591. Said drive wheel is or can be driven by the electric motor 581 directly or via a transmission.

The motion reversal can be controlled, for example, via a contactless sensor 617, e.g. a proximity switch 617. In addition, an emergency shut-off circuit element 618 may be provided, e.g. in the form of a mechanically actuatable emergency shut-off switch 618, which is provided at the end face of the slide 548 or of a component that is moved along axially with said slide 548 in the movement path thereof.

In the region of its front end 553, which performs the distribution, the distributor finger 546 may comprise, e.g., a stirring head 553, multiple stirring elements 593, which may be configured as a type of paddles, for example, or as an arrangement, e.g. multiple rows, of tines.

In an advantageous inking device 511 comprising an embodiment of an aforementioned ink distribution device 544, said inking device comprises a sensor device 594, by means of which a measure of the volume of ink present in the ink supply chamber 516 and/or the fill level can be derived, but at least information about the reaching of a critical fill level, e.g. for a lower and/or an upper limit value of the fill level.

In a first advantageous embodiment (see, e.g., the example shown in FIG. 12*a* relating to the second embodiment for the configuration and/or the arrangement of the inking device 511), an arm lying between the slide 548 and the stirring head 553 comprises for this purpose a section 596, which is embodied as having lower transverse rigidity in the axial direction than other arm sections. In particular, this section 596 is embodied as having reduced rigidity in the transverse direction such that in the operating position, with axial movement at operating speed and with a sufficiently filled ink supply chamber 516, the arm undergoes significant elastic deflection in this section 596, at least in the axially central segment of movement and/or at the maximum axial speed. In this section 596, on at least one side that faces in the axial direction, preferably on both sides, a sensor 597 for detecting extension and/or compression, e.g. strain gauge 597, is provided, extending in the longitudinal direction of the arm. The section 596 that supports the strain gauge(s) 597 can comprise mutually opposing arm sections connected to one another by a bridge-like tapered section 598. The region of the tapered section 598 may be filled in with compressible and/or elastic filler pieces 599. Generally, in a simple embodiment the arrangement of one or more such sensors 597 can also be provided on an arm that is homogeneous in cross section, potentially with losses in terms of accuracy.

In a second advantageous embodiment (see, e.g., FIG. 8*b* in the example of the second embodiment for the configuration and/or arrangement of the inking device 511), the sensor device 594 operates without contact and/or comprises an optical sensor 597, which is directed toward a location in the ink supply chamber 516 and picks up radiation reflected from there. The measuring principle can be based on a reflection measurement with or without a dedicated illumination source. Alternatively, the sensor 597 may be an acoustic sensor 597 that picks up acoustic signals reflected by the printing ink 517.

The sensor device 594 or the strain gauge(s) 597 or other types of sensors 597 is or are functionally connected in terms of signals to evaluation and/or control means (not shown).

During normal operation, i.e. at a sufficient fill level, the printing ink 517 present in the ink supply chamber 516 supplies a certain resistance to the ink distributor 546, which is in the working position and oscillating at the operating speed, resulting in a certain, operationally desirable deflection and thus a certain signal. If there is insufficient printing ink 517 in the ink supply chamber 516, the resistance is decreased and the signal representing the extension will change accordingly. A minimum threshold can be determined empirically, for example. Although it is conceivable to evaluate the current fill level by correlating the signals with the fill level over a given range, in a simpler embodiment the reaching of a limit value is monitored, and when said limit value is reached, a warning is issued and/or preferably, the printing ink 517 is refilled to a certain volume. For that purpose, the evaluation and/or control means relating to the fill level can be functionally connected to a positioning and/or conveyor device 601, e.g. a valve or preferably a pump 601, by means of which printing ink 517 can be conveyed from an ink reservoir 602, e.g. an ink tank 602, into the ink supply chamber 516. Said conveyance is accomplished, e.g. via a line system having at least one flexible and/or at least one rigid line section 603.

The printing ink 517 can generally be fed into the ink supply chamber 516 stationarily at a central location, for example, or at multiple axially spaced locations. This is the case, for example, particularly if no aforementioned ink distribution device 544 is provided. In an advantageous embodiment, the ink is supplied by means of the line system via an ink outlet 619, which opens into the ink supply chamber 516 and which is or can be moved back and forth axially within the ink supply chamber 516. In the embodiment having an ink distribution device 544, the ink outlet 619 is preferably moved along with the ink distributor 553 and in particular is arranged on the ink distributor 553. The line section 603 leading to the ink outlet 619 or at least to a connection point on the slide 548 may be flexible or, as set out here, rigid. With the rigid embodiment of at least one oscillating part of the line system, in particular of the aforementioned line section 603, a frame structure 621 can be provided to the side of the frame 538, for routing of an upstream flexible line section 622 and/or to offer protection for press operators from collision.

In an advantageous embodiment, the infeed system, particularly in the line system, comprises a temperature control device 604, by means of which the temperature of the printing ink 517 can be controlled to a constant and/or desired operating temperature. Said temperature control device can generally be provided anywhere in the conveyor path between ink reservoir 602 and ink outlet point, e.g. ink outlet 619, in the ink supply chamber 516 and can generally be of any desired embodiment. Preferably, however, it is configured here as a heating device 604 based on electrical resistance or a heating device 604 based on electromagnetic induction and/or is integrated into a line section 603, preferably a rigid line section, e.g. into the cable sheathing thereof. An advantageous embodiment comprises, for example, a tubular sleeve made of ferrous material, which can be excited by a coil winding and which forms the actual line itself or encases such a line, directly or via a non-magnetic and/or thermally highly conductive coaxially arranged sleeve, e.g. a copper sleeve. The line section 603 and/or an end of the temperature control device 604 near the outlet side is preferably provided near the ink outlet in the infeed system, e.g. less than twice the length 1639 of a cylinder barrel 639 of the gravure inking cylinder 512 away.

In addition to or instead of providing a heating device 604 in the line section 603, a heating device 604 may be provided in the pump 601, e.g. within the housing thereof, in particular in the region of the transmission.

In an advantageous embodiment, the inking device 511 comprises, particularly in the region of the ink supply unit 571 that delimits the ink supply chamber 526, e.g. in the region of the retaining means mount 554, means by which the temperature of the printing ink 517 located in the ink supply chamber 526 can be controlled. For this purpose, e.g. in a wall of the parts delimiting the ink supply chamber 526 or even in the ink supply chamber 526 itself, at least one fluid path, e.g. a channel or a line, is preferably provided, through which temperature control fluid can flow. For this purpose, temperature control fluid can be fed to this fluid path at an intake point 615, e.g. a releasable coupling piece 615, e.g. a valve coupling 615, and, after flowing through the inking device 511, in particular the ink supply unit 571, e.g. the retaining means mount 554, leaves the inking device 511 or ink supply unit 571, e.g. the retaining means mount 554, via an outlet.

Particularly advantageously for an embodiment in which the retaining means 526 cooperates with the gravure inking cylinder 512 on the upwardly rotating side thereof during operation, but not only for such an embodiment, measures are taken to prevent a volume or at least a significant volume of printing ink 517 from collecting on the downstream side of the edge 566 of the retaining means 526, e.g. the doctor blade edge 566. This may be a measure, for example, in which the retaining means 526 has an ink repelling, e.g. oleophobic surface layer, e.g. coating, on its downstream side, at least in a region close to the edge.

In place of or in addition to this, for example in a first embodiment, a removal device 572 is provided, by means of which any printing ink 517 that collects on the downstream side of the edge 566 of the retaining means 526, e.g. the doctor blade edge 566, can be cleared, in particular removed therefrom. Due to the highly viscous nature of the printing ink 517, it can gradually pass through beneath the edge 566 and collect on the opposite side, e.g. even when the retaining means 526 is engaged as a doctor blade. This can also result from the conveyance in the engravings 513. In principle, this removal from the downstream side of the edge 566 can be accomplished in a different way. For example, the removal device 572 may comprise a blower device directed toward the downstream edge region, e.g. what is known as an air blade, by means of which printing ink 517 that would otherwise accumulate is blown continuously or in cycles onto the outer cylindrical surface 518 and is thereby continually transported away in small quantities.

In an advantageous embodiment, e.g. depicted in FIG. 5*a* and FIG. 6*a*, the removal device 572 comprises as a removal means 606; 606' a cleaning tape 606, the width of which in the axial direction of the gravure inking cylinder 512 preferably extends over at least the entire width of the retaining means 526 and/or the entire width of the ink supply chamber 516 delimited at the end faces by the side parts 567, and which, adjacent to the downstream edge 566 of the retaining means 526, is or can be guided past the outer cylindrical surface 518 of the gravure inking cylinder 512 spaced at a short distance therefrom, e.g. less than 10 mm, e.g. less than 5 mm, preferably less than 3 mm. Said cleaning tape 606 is or will be guided, e.g., around a deflecting element 607 that runs in the axial direction of the gravure inking cylinder 512 and in particular extends over at least the width of the cleaning tape 606. The distance from the edge 566, as viewed in the direction of rotation, is e.g. likewise less than 10 mm, e.g. less than 5 mm, preferably less than 3 mm. Preferably, fresh cleaning tape 606 is drawn from a supply 608, e.g. unwound from a roll 608, and is routed, optionally via one or more deflection elements 611, e.g. deflection rollers 611, into the angle between the outer cylindrical surface 518 and the downstream side of the retaining means 526, where it is deflected by a deflection element 607, e.g. guide wedge 607, which preferably dips like a wedge into the angle, and is collected, optionally via one or more deflection elements 612, e.g. deflection rollers 612, in a receptacle 609, e.g. is wound onto a roll 609. An at least slightly absorbent cleaning tape 606, in particular a paper web 606, is preferably provided as the cleaning tape 606. The aforementioned elements of the removal device 572 are preferably arranged in a common frame 613 which can be removed, for example in its entirety, from the inking device 511, e.g. from the aforementioned holding device 569, for example it can be removed once an optionally provided securing and/or locking device 614 is opened.

In an alternative embodiment to the first embodiment of the removal device 572, a doctor blade 606', e.g. capturing doctor blade 606', may be provided as the removal means 606; 606' downstream between the retaining means 526 and the nip point 776, and can be set against the outer cylindrical surface 518 in physical contact therewith or forming a preferably variable distance, e.g. of less than 0.5 mm, in particular at a distance of less than 100 μm. In an advantageous embodiment, said doctor blade can optionally be set against the outer cylindrical surface 518 in physical contact therewith or forming an aforementioned, preferably variable distance. The removal device 572 preferably comprises a positioning drive 625, by means of which the capturing doctor blade 606' can be moved into the working position and/or can be varied in its working position with respect to its distance from the outer cylindrical surface 518. Said positioning drive 625 can generally be embodied as a manually controllable mechanism, but is preferably controllable via a remotely actuable drive means 645, e.g. a drive motor 645, or preferably by a drive means 645 that is adjustable with respect to the force F, e.g. a pressurized medium-actuated piston/cylinder system 645. In an advantageous embodiment, an adjustable stop means 655 is provided, which limits the positioning path of the capturing doctor blade 606' or of a mount carrying the capturing doctor blade 606' for the working position thereof, and against which the positioning drive 625 places the capturing doctor blade 606' or a mount carrying the capturing doctor blade 606'. A contact force, e.g. caused by elastic deformation, of a capturing doctor blade 606' set against the outer cylindrical surface 518, or in another variant, a distance from the outer cylindrical surface 518, can thus be adjusted. The stop means 655 may be an eccentric, for example, and/or may be controllable manually or via an additional remotely actuable drive means.

In an advantageous embodiment, the capturing doctor blade 606' and a collecting receptacle 562 provided therebeneath, e.g. a collecting trough 562, are arranged on the holding device 569 such that they are positionable jointly, e.g. are connected to one another and positionable, e.g. pivotable, jointly by the positioning drive 625. In an advantageous embodiment, the collecting trough 562 together with the capturing doctor blade 606' are arranged detachably on the holding device 569 so that they can be removed for cleaning or maintenance purposes without costly dismantling.

In one variant of the inking device 511, shown by way of example and particularly advantageously in the first exemplary embodiment, but not only for said embodiment, during operation, i.e. when the downstream-side retaining means 526 is in the activated position, the ink supply chamber 516 is also essentially completely closed on the upstream side by at least one additional retaining means 623, preferably configured as a doctor blade. If the additional retaining means 623 is embodied as a wiping device or doctor blade, there can preferably be physical contact, or a short distance, e.g. less than 50 μm, may be present or provided.

Figure 15:
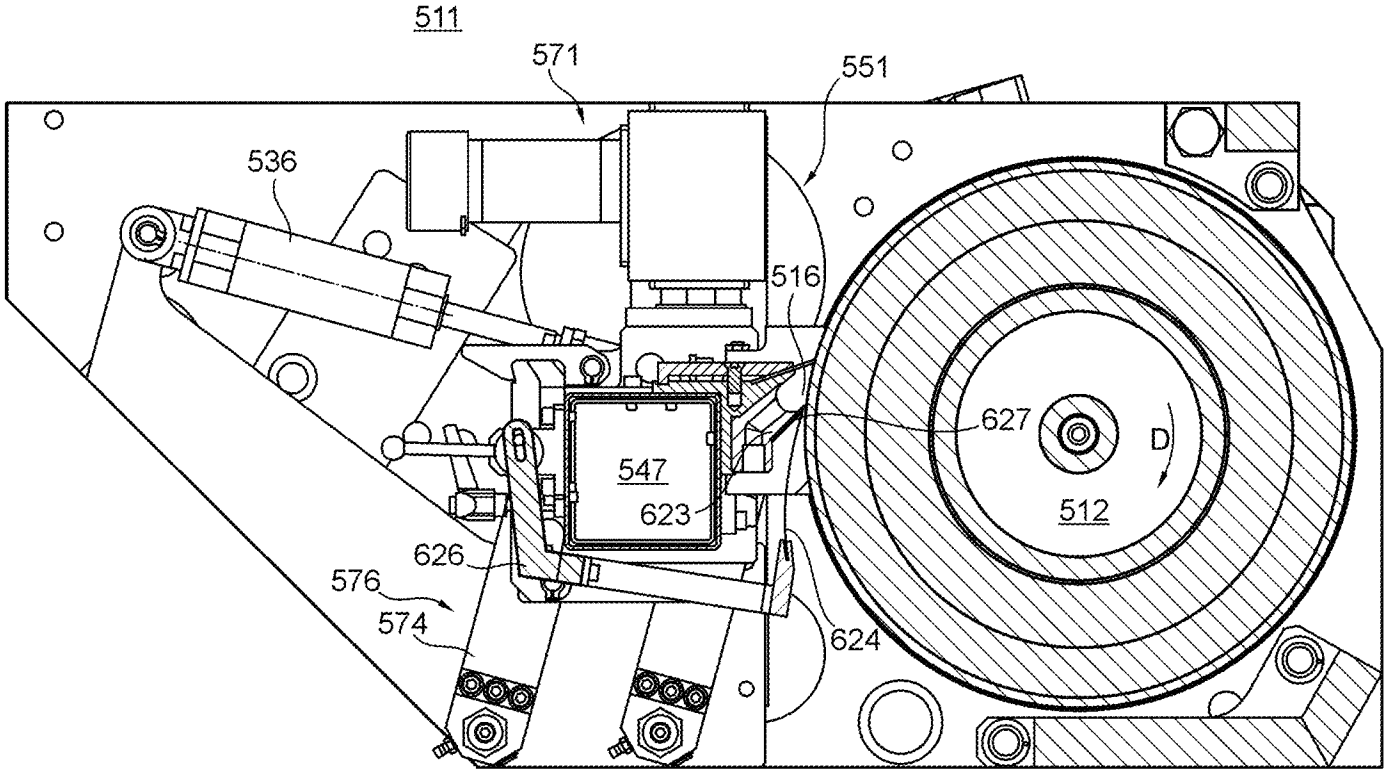
FIG. 15 an embodiment of the inking device with an alternative configuration of the ink supply chamber.
Figure 17:
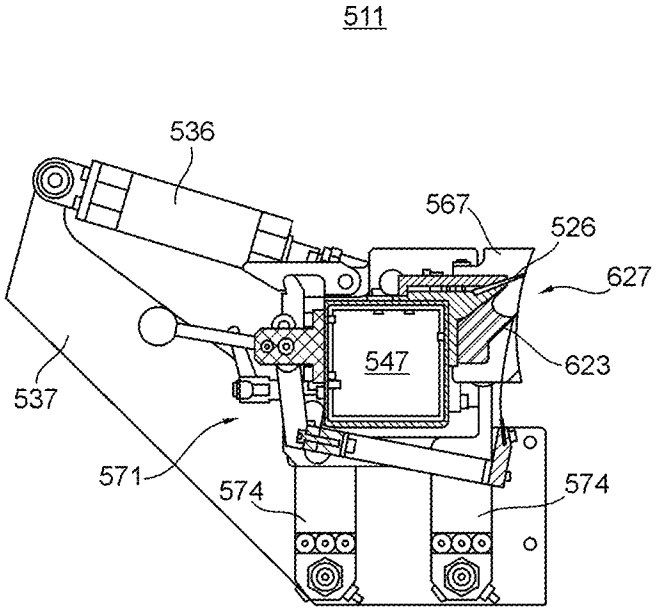
FIG. 17 a side view in cross-section of the inking device of FIG. 16.
Figure 16:
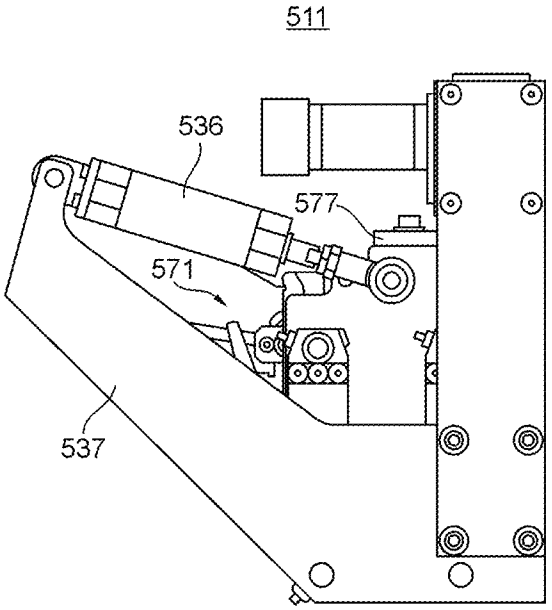
FIG. 16 a side view of the inking device with a positioning drive.

In an embodiment in which the ink supply chamber 526 is closed on both sides, it can be configured as a chamber in a chamber doctor blade 627 between the downstream retaining means 526, e.g. as a working doctor blade, and the upstream retaining means 623, e.g. as a final doctor blade (see, e.g. FIG. 15). This chamber doctor blade 627 may be embodied as self-supporting, for example, and may be mounted immediately, e.g. directly on side parts 537; 558, e.g. side frame parts 537; 558, for example side panels 537; 558, but is preferably arranged at or on an aforementioned cross member 547, e.g. crossbar 547, which is mounted, e.g. at both ends on the end-face frame parts 537; 558.

In addition, upstream of the upstream retaining means 623, a guide device 624, e.g. a guide plate 624, may be set or settable against the outer cylindrical surface 518. Said guide plate serves, for example, to capture and divert printing ink 517 that is located in the chamber after the chamber doctor blade 627 has been moved away, and can itself be set against and moved away from the outer cylindrical surface 518, for example via a positioning mechanism 626.

Generally independently of the specific embodiment of the printing press or the printing unit 500, the specific position and/or specific configuration of the inking device 511, or the embodiments and variants thereof, but preferably in conjunction with one of the stated embodiments, configurations, and variants, as has already been mentioned, in a first embodiment that is particularly advantageous, e.g. in terms of easy handling, the engravings 513 are provided on the gravure inking cylinder 512, for example directly on the outwardly active outer cylindrical surface 518 of the prepared gravure inking cylinder 512, in particular are produced or engraved directly on this outer cylindrical surface 518 and/or are arranged inseparably on the same.

Figure 18:
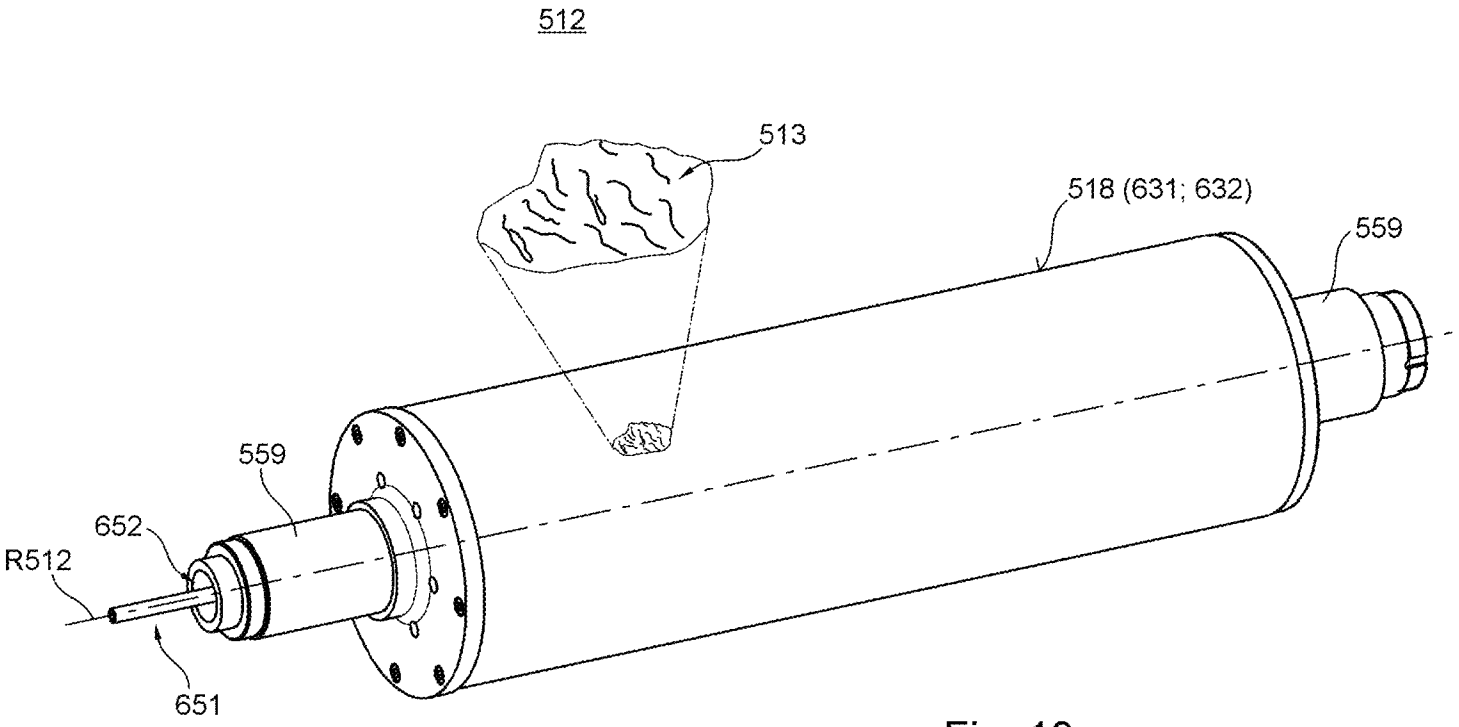
FIG. 18 a perspective view of a gravure inking cylinder bearing the engravings directly on its outer cylindrical surface.

Said engravings 513 can generally be produced directly in the region of a cylinder outer surface 631, e.g. metallic, of a cylinder body 628, e.g. a supporting cylinder body, made of a metallic material, e.g. a steel, for example the outer cylinder surface 631 of a cylinder body 628 embodied as a solid cylinder 628, in particular made of a metallic material, preferably of steel, or of a single or outer cylinder wall 629, in particular made of a metallic material, preferably of steel, of a cylinder body 628 configured, e.g. as a single-part or multi-part hollow cylinder 628. In this embodiment, the aforementioned outer cylindrical surface 518 that carries the recesses 513 or engravings 513 and/or is active for ink transfer is thus formed by the outer, e.g. metallic outer cylinder surface 631 of the cylinder body 628 itself (see, e.g., FIG. 18). Such an outer cylinder surface 631 made of metallic material can be engraved in the same way, for example, that is used to produce gravure printing formes 504 for the forme cylinder 503, which are preferably formed with a metallic surface.

A metal or metallic material, unless otherwise specifically defined, is generally understood here as any metal or metal alloy, e.g. steel, in particular cast steel, structural steel, or possibly tool steel, that is suitable for producing such cylinder bodies 628.

Figure 19:
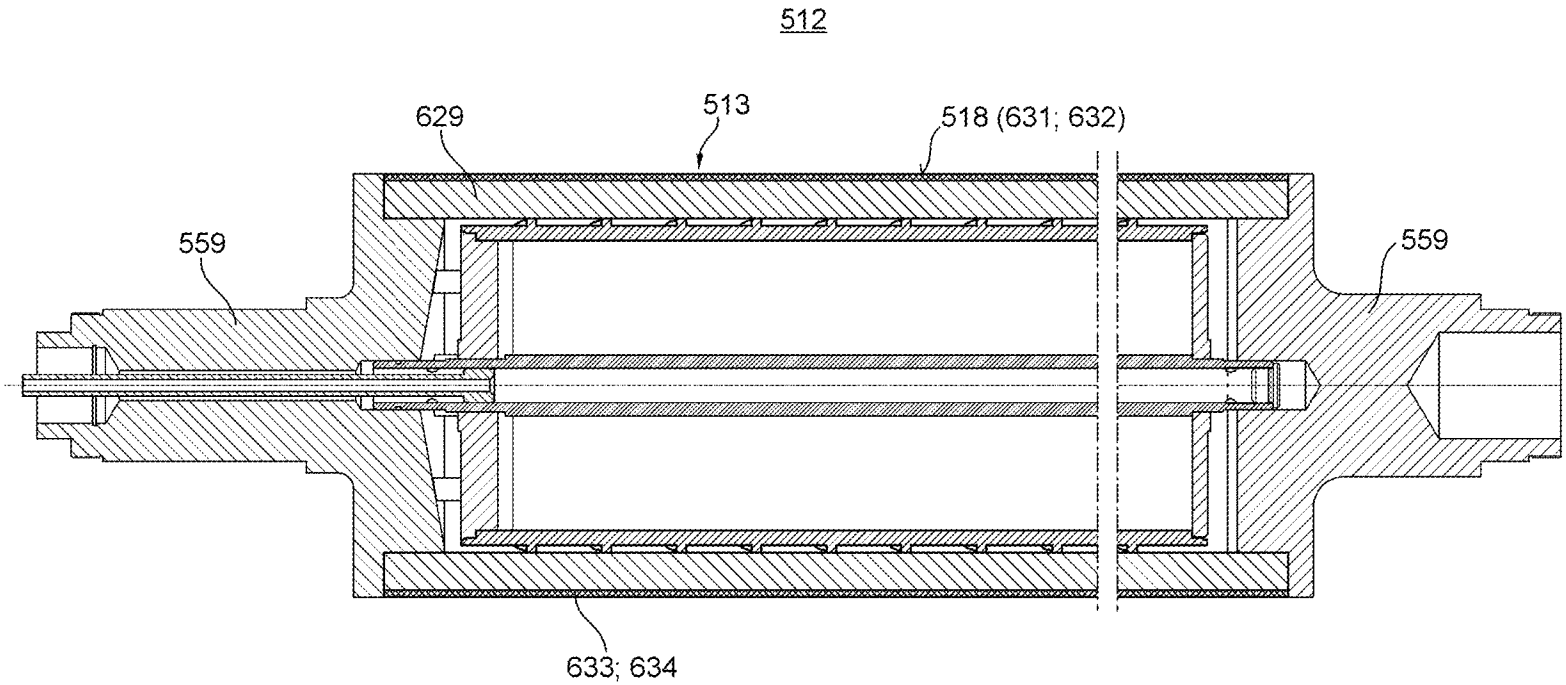
FIG. 19 a longitudinal section through a gravure inking cylinder of FIG. 18 in an embodiment, by way of example, that has flow channels through which temperature control fluid can flow.
Figure 20:
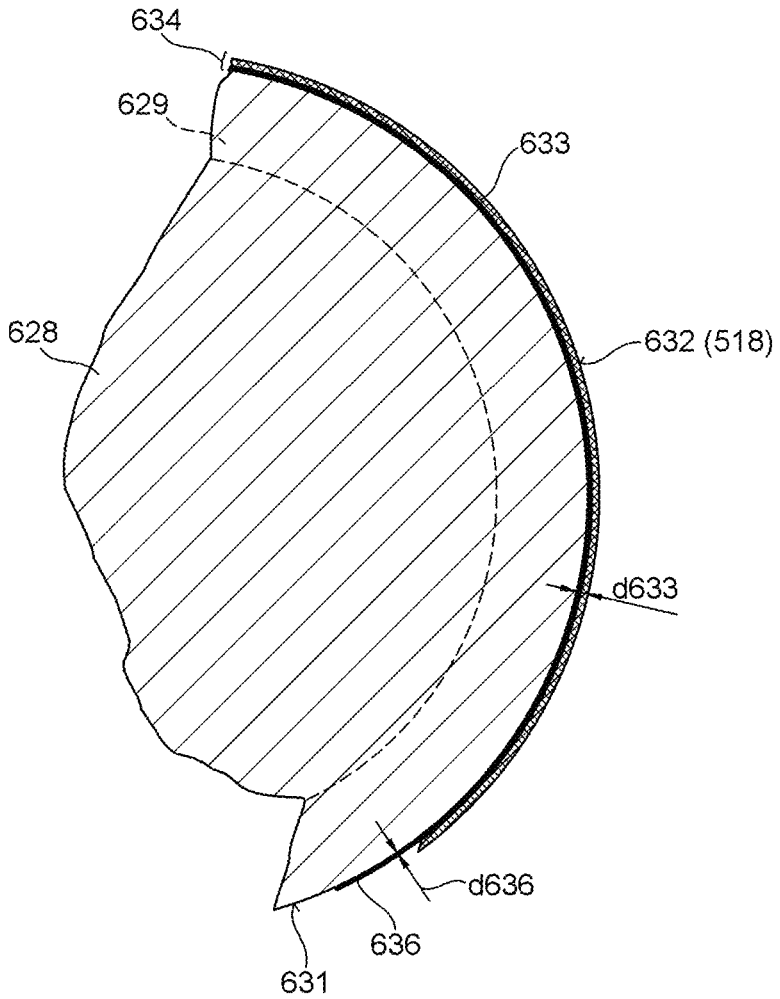
FIG. 20 a partial cross section of a gravure inking cylinder with a multilayered structure, configured as a solid cylinder or, as indicated by dashed lines, as a hollow cylinder.

Preferably, however, rather than being provided directly on the metal outer cylinder surface 631, for example, the engravings 513 are provided in an outwardly directed surface 632 of a layer 633, hereinafter also referred to, e.g., as the active or cover layer 633, which is or can be provided directly or indirectly on the cylinder body 628, e.g. as the cylinder main body 628. Said layer 633 is preferably arranged fixedly, i.e. not operationally detachably, e.g. via an adhesive bond, on the outer cylinder surface 631, or simply outer cylindrical surface 631, for example is connected to the same via firm bonding. It extends on the gravure inking cylinder 512, e.g. axially at least over the maximum width to be printed by the printing unit 500, i.e. the maximum printing width, and/or over the maximum width provided for inking by the gravure inking cylinder 512, e.g. over a width of 750 to 1,000 mm, in particular between 800 mm and 950 mm, and in the circumferential direction over at least one printing length, preferably over the entire circumference. Thus, in this embodiment the aforementioned outer cylindrical surface 518 bearing the recesses 513 or engravings 513 and/or active for the ink transfer is or will be formed by the outwardly directed surface 632, e.g. outer cylindrical surface 632, of the layer 633 provided on the cylinder main body 628 (see, e.g., FIGS. 18, 19 and 20).

The layer 633 can generally be made of any material or mix of materials, provided it is sufficiently hard and/or wear resistant. These may be, e.g., layers 633 of preferably coated metal or of a ceramic material. As the metal layer 633, e.g. a chrome-plated nickel layer or a brass layer may be provided.

The layer 633 preferably has a hard surface having, e.g. a Vickers hardness VH of at least 800 HV 10, advantageously more than 1000 HV 10, preferably at least 1100 HV 10, and/or a low porosity, e.g. a maximum porosity of 5%, preferably less than 3%, in particular less than 2%, and/or an elasticity according to Young of between 30 and 70 GPa, for example, preferably of 40 to 60 GPa, and/or a Poisson number of 0.20 to 0.30 Poisson, for example, and/or a fracture toughness of 4.0 to 5.0 $MPa*m^{1/2}$ and/or a tear resistance of at least 40 MPa, preferably at least 45 MPa.

Preferably, the layer 633 is a ceramic layer 633, i.e. made of a ceramic material, in particular having one or more of the aforementioned properties. An embodiment of the ceramic material as technical ceramic is advantageous. Preferably, the ceramic is embodied as oxide ceramic, particularly advantageously as chromium oxide ($Cr_2O_3$). The ceramic layer 633 preferably is or will be applied as a coating 633 by means of a plasma spraying process or a flame spraying process to the outer cylinder surface 631 or to an intermediate layer 636 that may be provided on the same.

The thickness d633, e.g. layer thickness d633, of the layer 633, in particular ceramic, that is formed amounts in non-engraved regions or regions without recesses 513 or engravings 513 to a maximum of 350 μm, for example, advantageously to a maximum of 200 μm, preferably to 160±20 μm The layer 633 can be arranged directly on the outer cylinder surface 631, in particular applied thereto, or can optionally be provided as an outer layer 633, i.e. the active layer or cover layer 633, which is active for the transfer of ink, of a multilayer structure 634.

If advantageous, an intermediate layer 636, e.g. a substrate 636 that serves to improve adhesion, i.e. an adhesive substrate 636 for short, may be provided between the outer cylinder surface 631 and the cover layer or active layer 633 having the recesses 513 or engravings 513. As such an intermediate layer 636, in particular at least if the layer 633 is formed directly on the cylinder body 628, a CrNi or Al layer 636 for example, e.g. having a layer thickness d636 of 0.03 to 0.08 mm, may be provided.

Figure 21:
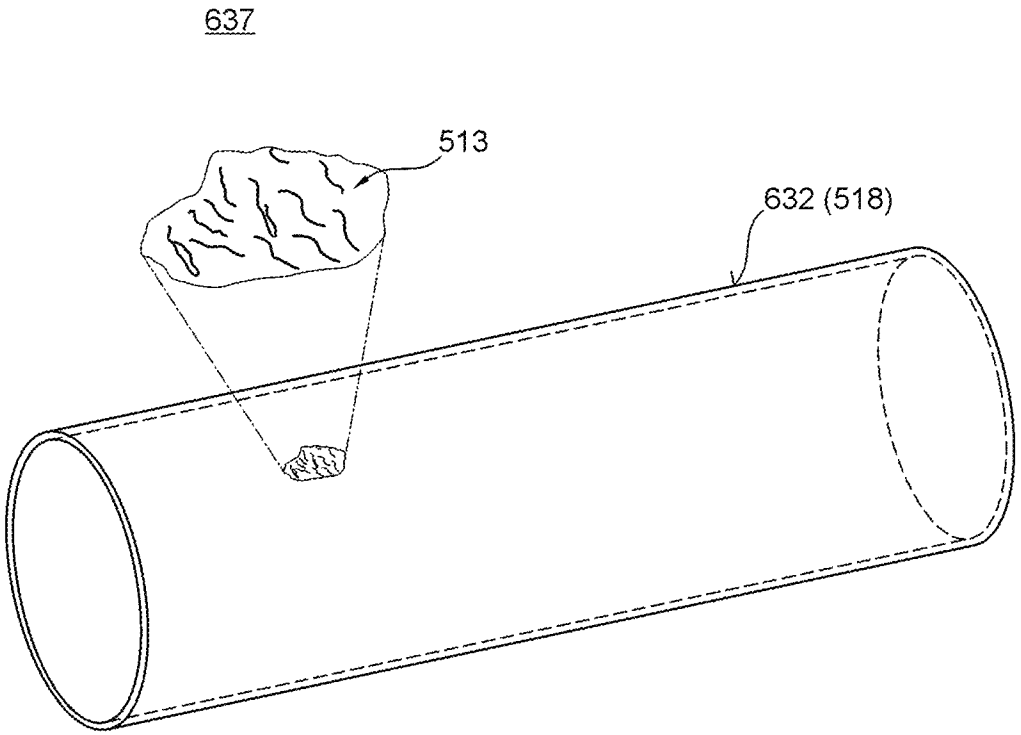
FIG. 21 an ink transfer forme configured as an ink transfer forme sheath or sleeve.
Figure 23:
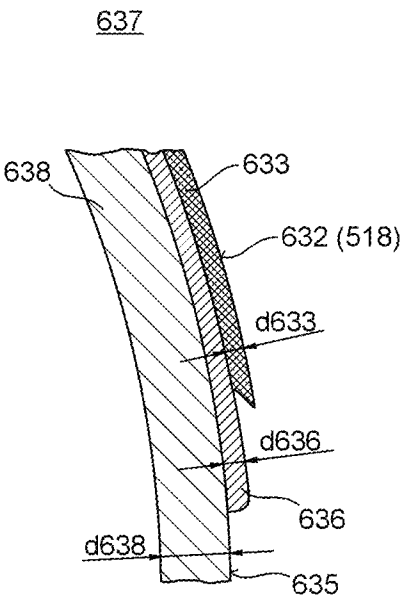
FIG. 23 a partial cross section of a multilayered sleeve wall.
Figure 22:
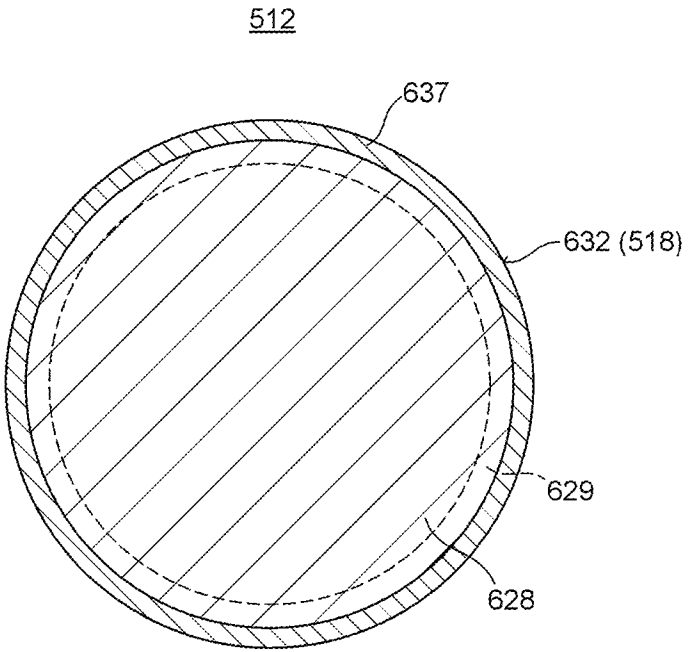
FIG. 22 a partial cross section of a gravure inking cylinder with sleeve, configured as a solid cylinder or, as indicated by dashed lines, as a hollow cylinder.
Figure 24:
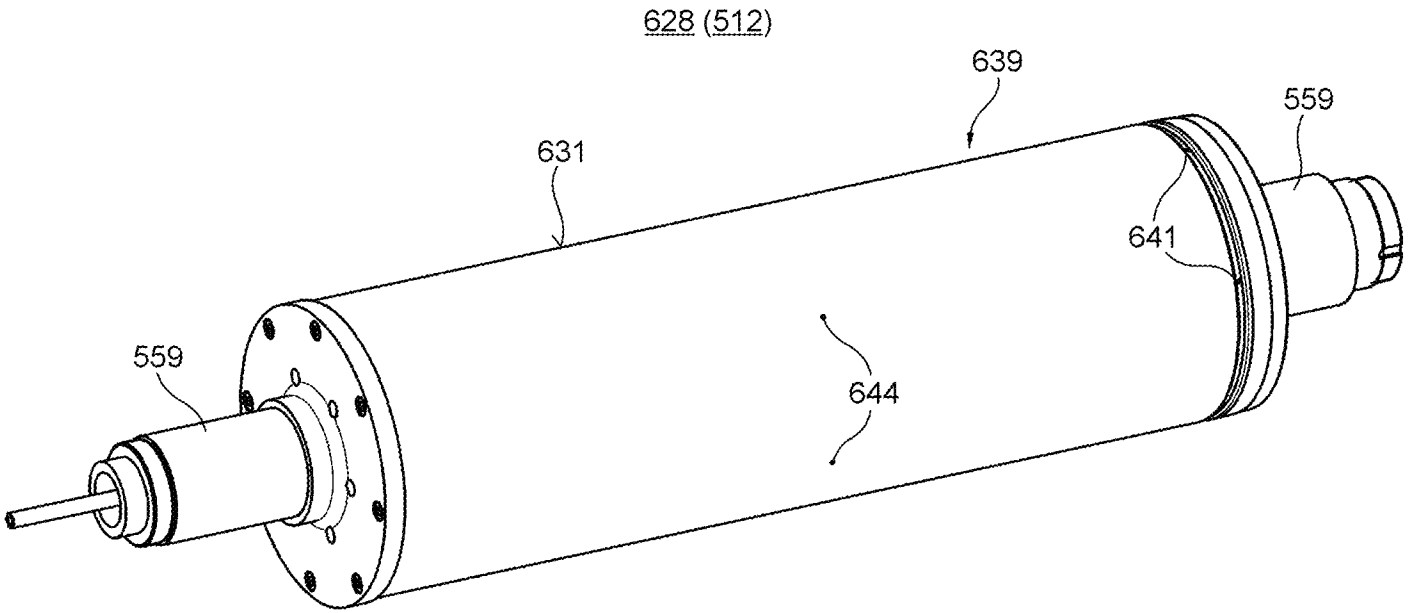
FIG. 24 an oblique view of an exemplary embodiment of a cylinder body to be fitted with a sleeve.

In a second embodiment, likewise already mentioned, which is especially advantageous, e.g. in terms of the use of materials and/or the costs, and independently, in principle, of the specific embodiment of the printing press or of the printing unit 500, the specific position and/or specific configuration of the inking device 511, or the embodiments and variants thereof, but preferably in conjunction with one of the stated embodiments, forms, and variants, the engravings 513 or recesses 513 are provided on the outwardly facing surface 632 of an ink transfer forme 637, which is in the form of an ink transfer forme sheath 637 that is closed in the circumferential direction, hereinafter also referred to synonymously simply as a sleeve 637, and which can be arranged on the outer cylinder surface 631 of the cylinder main body 628 (see, e.g., FIGS. 21, 22, and 23). Such a sleeve 637 can generally be configured as comprising a single layer, in which case the cylindrical wall is formed solely by the layer 633 that includes the recesses 513 or engravings 513 on the outwardly facing surface 632, e.g. outer cylindrical surface 632, and/or is active for the transfer of ink. Said layer 633 can generally be made of any desired material, but is preferably made of a wear-resistant material, e.g. a metallic or preferably a ceramic material.

Particularly preferred, however, is a multilayer embodiment of the sleeve 637, for example having a substrate layer 638, which supports, directly or indirectly, on its outer circumference, in particular on its outwardly facing outer cylindrical surface 635, the layer 633, preferably ceramic, which includes the recesses 513 or engravings 513 and/or is active in the transfer of ink, e.g. the cover layer or active layer 633. The substrate layer 638 can form the inner layer of the sleeve 637 or can optionally be furnished with a layer disposed further toward the inside, e.g. a protective layer or slip layer.

The layer 633 that has the recesses 513 or engravings 513 on its outwardly facing surface 632, e.g. outer cylindrical surface 632, and/or is active in the transfer of ink is preferably configured comparably to the layer 633 already specified in greater detail above. It preferably has a hard surface having, e.g. a Vickers hardness VH of at least 800 HV 10, advantageously more than 1000 HV 10, preferably at least 1100 HV 10, and/or a low porosity, e.g. a maximum porosity of 5%, preferably less than 3%, in particular less than 2%, and/or an elasticity according to Young of between 30 and 70 GPa, for example, preferably of 40 to 60 GPa, and/or a Poisson number of 0.20 to 0.30 Poisson, for example, and/or a fracture toughness of 4.0 to 5.0 $MPa*m^{1/2}$ and/or a tear resistance of at least 40 MPa, preferably at least 45 MPa.

In this case as well, the layer 633 is preferably configured as a ceramic layer 633, i.e. made of a ceramic material, in particular having one or more of the aforementioned properties. An embodiment of the ceramic material as technical ceramic is advantageous. Preferably, the ceramic is embodied as oxide ceramic, particularly advantageously as chromium oxide ($Cr_2O_3$). The ceramic layer 633 preferably is or will be applied as a coating 633 by means of a plasma spraying process or a flame spraying process to the outer cylindrical surface 632 of the substrate layer 638 or to an intermediate layer 636 that may be provided on the same.

The thickness d633, e.g. layer thickness d633, of the layer 633, which is particularly ceramic, amounts in non-engraved regions or regions without recesses 513 or engravings 513 to a maximum of 350 μm, for example, advantageously to a maximum of 200 μm, preferably to 160±20 μm.

The substrate layer 638 can generally be made of any material, e.g. in an embodiment that is advantageous with respect to thermal conductivity it may be made of a metallic material, but in an embodiment that is advantageous with respect to and/or handling is made of a carbon fiber material, in particular a carbon fiber composite material such as CFRP. The layer thickness d638 in that case is advantageously less than 5 mm, in particular less than 4 mm, advantageously within a range of 2.0 mm to 3.5 mm, preferably of 2.5 mm to 3.0 mm. The substrate layer 638 preferably has a modulus of elasticity in the circumferential direction of less than 65 GPa, in particular less than 45 GPa, preferably less than 30 GPa.

A backing 636, preferably metallic, e.g. which serves to improve adhesion, is preferably provided between the substrate layer 638, which is made of a carbon fiber material, for example, and the intermediate layer 636, preferably metallic, which has the recesses 513 or engravings 513 and/or is active in the transfer of ink. In an advantageous embodiment, said intermediate layer 636 is formed by a layer 636 of aluminum, e.g. having a layer thickness d636 of 0.10 mm to 0.35 mm, particularly of 0.20 mm to 0.25 mm.

The total thickness of the sleeve 637 is preferably 3.0 to 5 mm, in particular 4.0±0.2 mm.

In an alternative embodiment of the sleeve 637 that is advantageous, e.g. with respect to thermal conductivity, the substrate layer 638 is made of a metallic material on which the preferably ceramic layer 633, which has the recesses 513 or engravings 513 on its outwardly facing surface 632, e.g. outer cylindrical surface 632, and/or which is active in the transfer of ink, is provided directly or optionally indirectly via an intermediate layer 636, e.g. a CrNi or Al layer.

To produce a cylinder body 628 that is furnished directly or indirectly in the aforementioned manner with a ceramic layer 633, or to produce a sleeve 637 that comprises a substrate layer 638, the cylinder body 628 or a sleeve-shaped cylindrical substrate layer 638, e.g. in the form of a blank formed by a sleeve-shaped body, optionally after an aforementioned intermediate layer 636 has first been applied, is furnished, in particular coated, for example by means of a plasma spraying process or a flame spraying process, with a ceramic layer 633, e.g. having a layer thickness d633 that is greater than the aforementioned thickness d633 to be provided for the operationally ready state. The blank that is optionally coated to oversized dimensions, e.g. the coated cylinder body 628 or sleeve blank, is then cylindrically ground to the desired outside diameter. Such an outside diameter is between 260 and 300 mm, for example, in particular from 270 to 290 mm. The coated cylinder body 628 or sleeve 637, which has optionally been cylindrically ground to the desired diameter, is then furnished with the recesses 513 or engravings 513. This is preferably done using a laser. This is advantageously a laser having a maximum radiation lying in the near infrared range, in particular the short-wave infrared range, e.g. between 950 and 1,200 nm, preferably at 1,064±20 nm. It is configured, for example, to produce a preferably pulsed beam having a preferably adjustable beam cross section of 10 to 15 μm in the focal range and/or a focal length of 70 to 90 μm and/or having a repetition rate of 400 to 600 kHz.

Once the recesses 513 or engravings 513 have been produced, the cylinder body 628 furnished with the layer 633, e.g. together with end-face journals 559 optionally already comprised by said cylinder body or to be provided thereon, forms the ready-to-use gravure inking cylinder 512 with the recesses 513 or engravings 513 provided on its outer cylindrical surface 518. In the embodiment already mentioned above, in which the gravure inking cylinder 512 is mounted in the inking unit 508 or the frame 533; 538 thereof such that it is operationally removable, the gravure inking cylinder 512 can be replaced with a new gravure inking cylinder 512, e.g. an entirely new or a refurbished gravure inking cylinder, for example for a new print job or to replace a gravure inking cylinder 512 that is worn in the region of the layer 633, or can be removed after completion of a production run.

In the second embodiment, according to which the layer 633 that has the recesses 513 or engravings 513 is comprised by an ink transfer forme 637 configured as an ink transfer forme sheath 637, e.g. sleeve 637, the cylinder body 628, which is preferably made of steel, or the cylinder wall 629 thereof, which is preferably made of steel, is to be fitted with the sleeve 637 comprising the recesses 513 or engravings 513 on its outer cylindrical surface 518 to form a gravure inking cylinder 512 ready for use, or is to be freed of such a sleeve upon completion of the production run or for a change in production.

In an embodiment mentioned above, in which the gravure inking cylinder 512 is mounted in the inking unit 508 or in the frame 533; 538 thereof such that it is operationally removable, the gravure inking cylinder 512 or the as yet unloaded cylinder body 628 can be removed from the inking unit 508, for example to set up a new print job or to replace a worn sleeve 637. To fit the gravure inking cylinder 512 with a new sleeve 637 or to mount such a new sleeve, the gravure inking cylinder, e.g. on the 508 inking unit, is removed. Once a previously worn sleeve 637 has been removed from the cylinder main body 628, the new sleeve 637 is optionally mounted on the cylinder main body 628. For this purpose, means for assisting with mounting a sleeve 637 are preferably provided.

In a first embodiment, as means for assisting with mounting a sleeve 637 the cylinder body 628 comprises one or more outlet openings 641; 644, e.g. blower openings 641; 644, in the region of the outer cylinder surface 631, to which a pressurized fluid, in particular pressurized air, can be applied from the inside via a line system, at least for the removal or mounting of a sleeve 637. In that case, in at least one section of the cylinder main body 628 that is near one end face, at least one first outlet opening 641 or first group of circumferentially distributed or spaced apart outlet openings 641 preferably lying on the same circumferential line, said opening(s) particularly lying near the end face, is/are preferably provided, by means of which, e.g. for mounting a new sleeve 637, an ink transfer forme sleeve 637, the leading end of which has been pushed over the at least one first outlet opening 641 or first group of outlet openings 641, is or can be acted upon by a radially outwardly directed force when pressure is applied from the inside. This first outlet opening 641 or group of openings, as viewed in the axial direction, for example, is spaced no more than ±10 mm from the lateral edge of the maximum cylinder section of a constant cylinder body diameter D628 that can be used for inking. Said section may begin, at least on the side from which the sleeve 637 is to be mounted, directly in the region of the end-face edge of the cylinder barrel 639 or immediately next to an end cap 662.

Preferably, however, the length 1639 of the cylinder barrel 639 is configured as greater than the maximum length provided for inking and/or greater than the maximum printing width and is grasped in the region of its barrel edge on the side from which sleeves 637 are to be mounted. For this purpose, on this side, in the region of the end-face end, its diameter is preferably smaller than the aforementioned nominal diameter, and increases steadily to the full desired diameter over an axial section 642 extending from the end-face end to, at the longest, the beginning of a maximum width intended to be used for inking. The increase can occur linearly with increasing axial distance from the end-face edge and can be inclined, e.g. at an angle of 0.5° to 2°, from the section of constant nominal diameter. This facilitates placement of the sleeve 637 on the outer cylinder surface 631 at the end thereof. The first outlet opening 641 or group of outlet openings 641 is preferably arranged in the transition region between the axial section 642 with an increasing diameter and the constant nominal diameter. As an assistive measure, a groove 643 running in the circumferential direction may be provided, into which the first outlet opening 641 or the outlet openings 641 of the first group lead(s). This promotes a flushing from beneath of the sleeve end that is to be attached, resulting in a widening of the sleeve 637, or at least a slight widening.

Spaced apart in the axial direction from the first outlet opening 641 or first group of openings, e.g. in a central region of the barrel, e.g. in the region between one-fourth and three-fourths of the barrel length, in particular between two-fifths and three-fifths of the barrel length, at least one second outlet opening 644 or preferably at least one second group of multiple circumferentially distributed or spaced apart outlet openings 644, preferably lying on the same circumferential line, is preferably provided.

In an advantageous refinement, in the region of the side opposite the side from which the sleeve 637 is mounted, a stop means 649 can be provided, which protrudes radially beyond the aforementioned section of constant cylinder body diameter D628. Said stop means 649 is formed, for example, by a circumferential shoulder 649 that rises above the outer cylindrical surface of the constant cylinder body diameter D628 in the region of the end face.

The first outlet opening 641 or group of outlet openings 641 and the advantageously provided second outlet opening 644 or group of outlet openings 644 can be supplied with pressurized fluid, in particular pressurized air, by means of at least one supply line 646; 647 extending in the cylinder main body 628, e.g. axially. A single, respective, or common intake point 648 into the cylinder body 628 for supplying the outlet openings 641; 644 with pressurized fluid is preferably provided in the region of the end face or in the region of the one journal 559. A coupling piece 646, for example, for pressurized air, for example in the form of a valve coupling 648, is provided as the intake point 648. In the case of a first and a second outlet opening 641; 644 or a first and a second group of outlet openings 641; 644, separate axially extending supply lines 646; 647 are provided for these, for example, which can be supplied via the same intake point 648 leading into the cylinder main body 628.

Figure 25:
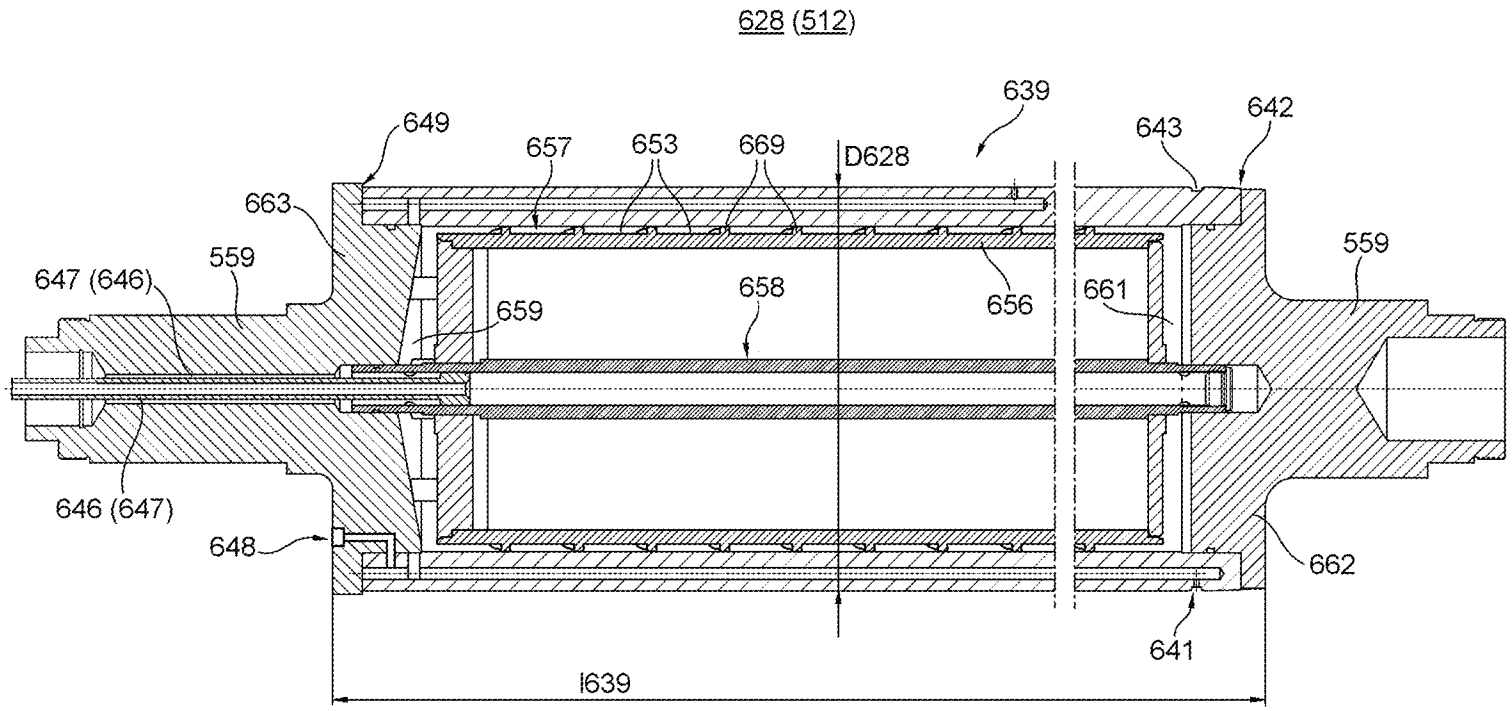
FIG. 25 a longitudinal section through a cylinder body according to FIG. 24 in a first embodiment as a hollow cylinder, by way of example in an embodiment with outlet openings that serve to assist with a sleeve change and with flow channels through which temperature control fluid can flow.
Figure 26:
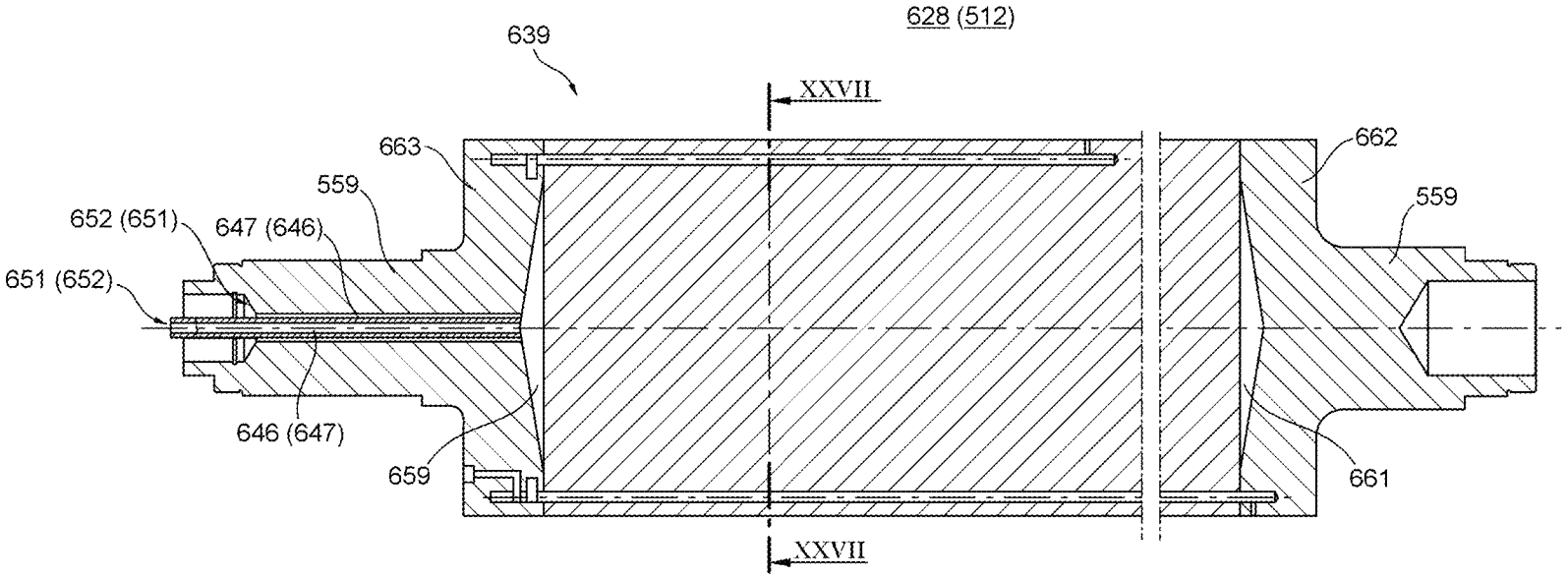
FIG. 26 a longitudinal section through a cylinder body according to FIG. 24 in a second embodiment as a solid cylinder, by way of example in an embodiment with outlet openings that serve to assist with a sleeve change.

Such outlet openings 641; 644 and supply lines 646; 647 may be provided in the outer cylinder wall 629 of a cylinder body 628 configured as a hollow cylinder 628 (see, e.g. FIG. 25) or in the region near the surface, e.g. lying closer to the circumference than to the cylinder axle of a cylinder body 628 configured as a solid cylinder 628 (see, e.g. FIG. 26).

In the embodiment comprising means for assisting with the mounting of a sleeve 637, as a sleeve 637 is being mounted, pressurized fluid, in particular pressurized air, is supplied to the outlet opening 641 or group of outlet openings 641 near the end face, and the sleeve 637 is pushed with one end leading over the end-face end onto the cylinder body 628, wherein the pressurized air flowing out of the outlet opening 641 or group of outlet openings 641 forms an air cushion beneath the sleeve 637 and/or expands the sleeve 637 slightly in diameter, e.g. by at least 5 μm, in particular by at least 10 μm, at least in the circumferential section lying above the outlet opening 641 or group of outlet openings 641. If, as in an advantageous embodiment, a second, e.g. aforementioned outlet opening 644 or group of outlet openings 644 is provided, then pressurized fluid is also supplied to said opening or group of openings simultaneously or subsequently to the first, wherein the cushion of fluid beneath the sleeve 637, which has already been pushed on axially up to said outlet opening 644 or group of outlet openings 644, is restored and/or another slight expansion takes place.

Previously, the cylinder main body 628 is or has been removed from the inking unit 508, for example, fixed at its other end-face end, e.g. at the cylinder journal 559, on a holding device such that the sleeve 637 can be pushed unimpeded up to its end position onto the cylinder body 628. A connection between a pressurized fluid source, e.g. pressurized air source, and the intake point 648 into the cylinder body 628 is also established.

If prior to loading, a sleeve 637 to be removed has already been pulled up, this sleeve 637 will be pulled off of the cylinder body 628, which is fixed in the aforementioned holding device, for example, while pressurized fluid, preferably pressurized air, is applied to at least one outlet opening 644; 641, in particular to at least the outlet opening lying in the central region, preferably to all of the outlet openings 641; 644.

Once the cylinder body 628 is or has been loaded with a (new) sleeve 637, the gravure inking cylinder 512 that was removed for this purpose is inserted back into the inking unit 508.

In an embodiment having alternative means to the outlet openings 641; 644 for assisting with mounting a sleeve 637, the cylinder body 628 embodied as a hollow cylinder 628 comprises as assisting means, in the interior of the outer cylinder wall 629, at least one first, preferably rotationally symmetrical body 664, for example a first sleeve 664, e.g. first tubular sleeve 664, the outer surface of which is supported indirectly or directly on the inner surface of the cylinder wall 629. In a preferred embodiment, its inner surface is supported directly or indirectly inwardly on the outer surface of a second, preferably rotationally symmetrical body 666, e.g. a second sheath 666, for example a second tubular sheath 666. In an advantageous embodiment, the first body 664 is arranged between the outer wall and the second body 666 such that it is movable axially relative to the outer cylinder wall 629. In an advantageous embodiment, the first body 664, in particular configured as a sheath 664, is operatively connected at each of its two end faces to a chamber 667; 668 to which pressurized fluid can be applied, e.g. pressure chamber 667; 558, by means of which an axial movement in one or the opposite direction is or can be effected by the alternating application of pressurized fluid, in the manner of a two-chamber piston system.

At least one side of the first, in particular rotationally symmetrical body 666 and the side of the adjacent component facing this side, specifically preferably of the cylinder wall 629 or of the optionally provided second, in particular rotationally symmetrical body 664, are configured as conical in opposite directions on the mutually facing sides, i.e. each having a continuously varying radius in the axial direction, and, when they are moved axially toward one another, they cooperate in the manner of a wedge drive with a resulting movement component and/or application of force in the radial direction. With appropriate dimensioning of the wall thicknesses of the inner body 664 and of a relatively thinner cylinder wall 629, the latter is elastically and radially expanded, at least slightly, when pressurized fluid is applied to the pressure chamber 668, causing the two conical surfaces to be moved toward one another, in particular pushed into one another. Conversely, when the conical surfaces are moved apart by the pressurization of the pressure chamber 667 that effects this separating movement, the force acting radially on the cylinder wall 629 is reduced, causing the previously elastically expanded cylinder wall 629 to return to its less strained or even unstrained radius.

In an advantageous embodiment, the inner surface of the cylinder wall 629 and the outer surface of the first sheath 664 are configured with conical outer cylindrical surfaces running in opposite directions. With a correspondingly rigid first sheath 664, the fixed mounting of this sheath 664 on a first end face-side end cap 662; 663, the fixed mounting of the cylinder wall 629 on the other end cap 663; 662, and a positioning of the pressure chamber 668 related to the first end face as cooperating with the outer cylinder wall 629 from said end face, the second sheath 666 can be omitted.

In a preferred embodiment, a fluid under positive pressure, in particular an oil under positive pressure, and/or a pressurized fluid source that can be connected to the cylinder body 628 via corresponding lines and a connector may be provided as the pressurized fluid. The relevant components are displaced relative to one another axially by hydraulic means.

A sleeve 637 is mounted, for example, in the same way as has been described in conjunction with the assisting means configured as outlet opening(s) 641; 644, if applicable with the prior removal of a previously carried sleeve 637, but with the difference that, for mounting and for removal, pressurized fluid, in particular oil under positive pressure, is applied to the pressure chamber 667 that effects a pulling apart of the bodies, and for securing the mounted sleeve 637, said pressurized fluid is applied to the pressure chamber 668 that effects the movement of the bodies toward one another. For this purpose, the pressure chambers 667; 668 are connected in advance to a pressurized fluid source, in particular an oil hydraulic pump.

Generally independently of the specific embodiment of the printing press or the printing unit 500, the specific position and/or specific configuration of the inking device 511, the forms and variants thereof, and/or the embodiments, forms, and variants set out above for the nature of the arrangement of the recesses 513 or engravings 513 on the gravure inking cylinder 512 and/or the means for assisting with mounting a sleeve 637, but preferably in conjunction with one of the stated embodiments, forms, and variants, the gravure inking cylinder 512, in particular the cylinder body 628 thereof, is configured in a particularly advantageous embodiment as temperature-controllable, in particular such that temperature-control fluid can flow through it.

For this purpose, said cylinder has a temperature control medium inflow 651 at one of its end faces, in particular running coaxially to the axis of rotation R512, and a temperature control medium return flow 652 at the other or preferably at the same end face, in particular running coaxially to the axis of rotation R512. Inflow and return flow take place here in line sections 651; 652 that are coaxial with one another, for example, and/or via a rotary inlet.

Inside the cylinder barrel 639 of the gravure inking cylinder 512 or cylinder body 628, the temperature control fluid can be conducted in various ways, e.g. depending on the structure of the cylinder body 628. For example, if the cylinder body 628 is configured as a hollow cylinder 628, temperature control fluid can flow through a wide space between a cylinder wall 629 and an optionally central line 658, e.g. pipeline 658. Any temperature control fluid to be supplied can be conveyed through the pipeline 658 into the opposite end-face region, from which it flows back via the cavity, or vice versa.

In an embodiment that is advantageous, e.g. in terms of better guidance of the temperature control fluid flow, specifically, for the flow preferably close to the outer cylinder surface, one or preferably multiple flow channels 653; 654 are provided, e.g. with each having a small flow cross-section (viewed perpendicular to the respective direction of flow) in relation to the maximum cylinder body cross-sectional area perpendicular to the cylinder axle, for example at most one-tenth, in particular at most one-twentieth of the maximum cylinder body cross-sectional area. To ensure a sufficiently rapid exchange of fluid, the total flow area is less than one-fourth, for example, preferably less than one-eighth, in particular less than one-twentieth, of the maximum cylinder body cross-sectional area.

In the embodiment of a cylinder body 628 configured as a hollow cylinder 628, said cylinder may have, for example concentrically to the outer cylinder wall 629, a cylindrical wall 656, lying further inward, of a cylindrical body 657, e.g. known as a displacement body 657, which is also closed at its end face, in which case, in a simple embodiment, a flow channel 653 configured as an annular gap can be provided between the outer cylinder wall 629 and the wall 656 of the displacement body 657. In a further refinement, multiple axially extending annular gap segments can be provided as flow channel 653 in that, for example, axially extending dividing elements 669, e.g. ridges or ribs, are provided between the inner surface of the cylinder wall 629 and the outer surface of the wall 656 lying further toward the inside.

In a particularly advantageous embodiment of the cylinder body 628 configured as a hollow cylinder 628, in particular in the embodiment having a wall 656 that lies further toward the inside, one or preferably multiple flow channels 653 are provided, running helically on the inner surface of the outer cylinder wall 629. Said flow channel(s) may be formed by channels placed on the inside. In a preferred embodiment having a wall 656 or displacement body 657 lying further toward the inside, said flow channel (s) is or are formed by one or more helically extending dividing elements 669, e.g. ridges or ribs, which are provided between the inner surface of the cylinder wall 629 and the outer surface of the wall 656 lying further toward the inside. In a preferred embodiment, the temperature control medium guidance provided helically on the inner surface of the cylinder wall 629 is embodied as multi-threaded, i.e. as having multiple flow channels 653 running side by side helically around the cylinder axis. For a multi-threaded arrangement of helically extending flow channels 653, said flow channels begin in an end-face distribution chamber 659 at one end of the cylinder, extending spaced apart in the circumferential direction, for example, and lead at the other end of the cylinder into a collecting chamber 661 on the return flow side, after which the collected temperature control fluid is discharged back to the outside via the temperature control medium return flow 652.

Figure 27:
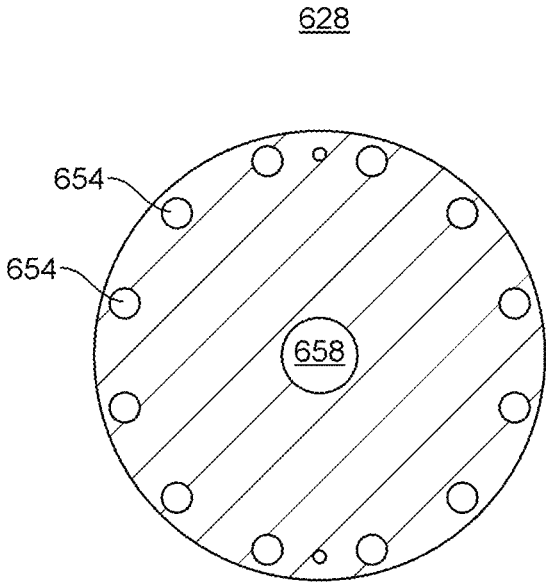
FIG. 27 a cross section of the hollow cylinder of FIG. 26, by way of example in an embodiment with outlet openings that serve to assist with a sleeve change and with flow channels through which temperature control fluid can flow.
Figure 28:
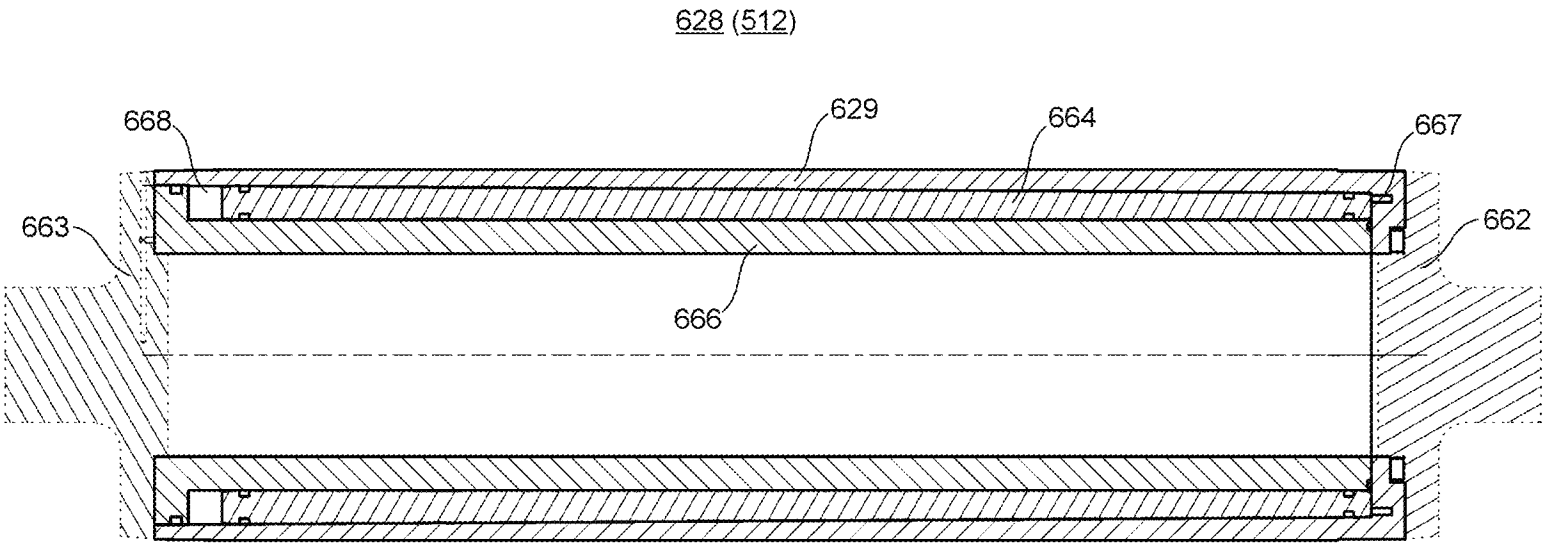
FIG. 28 a second embodiment of a cylinder body configured as a hollow cylinder having two component surfaces tapered in opposite directions to assist with a sleeve change.

In an embodiment of a cylinder body 628 configured, e.g. as a solid cylinder 628 (see, e.g., FIGS. 26 and 27), said cylinder is embodied as a single piece, at least in a region of the cylinder barrel 639 lying between end caps 662; 663, for example. As flow channels 654, it has a plurality of bores 654 spaced apart in the circumferential direction, spaced radially from the cylinder center axis, and extending in the axial direction, which are preferably spaced from the central axis in the region near the cylinder, i.e. more than one-half, in particular at least two-thirds of the radius from the same. In the embodiment in which intake and outlet are on the same side, an additional central bore 658 is provided for the fluid forward flow or return.

The optionally provided end caps 662; 663 can each be formed integrally with the relevant journal 559.

If temperature control medium inflow and return flow are on the same side 651; 652, the infed temperature control fluid is first conducted, for example via the distribution chamber 659, through one or more flow channels 653; 654 in a region near the outer cylinder surface, into the collecting chamber 661 lying on the other side and from there via a central line 658, for example, in particular pipeline 658, to the temperature control medium return flow 652, or conversely, is first conducted through the line 658 and then back via the flow channel(s) 653; 654 in the region near the outer cylinder surface.

In an advantageous embodiment of the cylinder body 628 configured, e.g. in one of the above embodiments and variants, the cylinder body 628 is configured as temperature controllable, e.g. in an aforementioned manner, and comprises, as alternative or additional means to assist with mounting or removal, one or more flow channels 653; 654 through which temperature control medium can flow.

A temperature control device that supplies the temperature control medium, e.g. a temperature control medium reservoir with integrated temperature control means, e.g. a cooling device and/or a heating device, is preferably configured to supply temperature control fluid at a fluid temperature below the ambient temperature, in particular below 20° C., preferably below 17° C. In addition, the temperature control device is preferably also configured to supply temperature control fluid at a temperature above the ambient temperature, in particular above 25° C., preferably 40° C. The temperature control device is advantageously configured to set a desired temperature for the temperature control fluid and/or to keep it constant via regulation.

Then to assist with mounting or removal of a sleeve 637, the cylinder body 628 of the gravure inking cylinder 512 is first cooled to below the ambient temperature, for example to below 20° C., in particular to below 17° C., preferably to a temperature of 15±1° C.

At 20°, for example, the open inside diameter of the sleeve 637 is consistent with or advantageously is slightly smaller, e.g. by 10 to 70 μm, in particular by 20 to 60 μm, than the outside diameter of the cylinder body 628 in the longitudinal section thereof that accommodates the sleeve 637. In other words, at a temperature of 20° C., in the first case the sleeve 637 would be seated without pre-tensioning, and in the second, advantageous case the sleeve would rest with pre-tensioning on the cylinder jacket surface 631 of the 20° C. cylinder body 628.

After cooling to below 17° C., for example, preferably to a temperature of 15±1° C., the cooled cylinder body 628 has the same outside diameter, for example, as the open inside diameter of the, e.g., 20° C. sleeve 637, or advantageously has a smaller size, e.g. by 1 to 40 μm, i.e. an outside diameter that is smaller, e.g. by around 1 to 40 μm, than the open inside diameter of the uncooled, e.g. 20° C. sleeve 637. This enables the sleeve 637 to be pushed more easily onto the cylinder body 628, particularly if the outside diameter of the cylinder body 628 is smaller in size.

In an advantageous refinement comprising additional assistance means, this can be accomplished by means of one or more outlet openings 641; 644 to which pressurized medium is or can be applied, e.g. as described above.

After the sleeve 637 has been pushed on, the cylinder body 628 is heated, for example, with heat that is generated during operation and/or preferably by temperature control fluid flowing through it at a temperature that is increased to above the ambient temperature, e.g., greater than 30° C., preferably to 40±3° C., whereby the heating of the cylinder body 628 increases its diameter, stretching the sleeve 637 on its outer cylindrical surface 631. The larger size of the cylinder body 638 in relation to the sleeve 637 resting on it that results during operation at an operating temperature of 40±3° C., for example, and the associated pre-tensioning of the sleeve 637 on the outer cylinder surface 631 is between 70 and 140 μm, for example, preferably between 80 and 120 μm. This ensures a secure fit and a hindrance to twisting of the sleeve 637 on the cylinder body 628.

For the cylinder body 628, at least in the region of its outer wall, and for the sleeve 637, it is particularly preferable to choose materials that have respective associated coefficients of expansion such that, at least within the range of heating of 20° C. to 40° C., for example, the cylinder body 628 will experience a greater change in diameter in the region of its outside diameter than the sleeve 637 experiences in its open inside diameter.

Mounting a sleeve 637, optionally with the prior removal of a previously carried sleeve 637, is performed in the same way, for example, as has been described in connection with the means of assistance, configured as outlet opening(s) 641; 644, but with the difference that for mounting and for removing the sleeve 637, the cylinder body 628 is cooled, for example, to below 20° C., in particular to below 17° C., preferably to a temperature of 15±1° C. The sleeve 637, which is at the ambient temperature, for example, or at least 20° C., can then be pushed on, or a sleeve 637 to be removed can be pulled off. Once the sleeve has been pushed on, the cylinder body 628 is heated by the surrounding environment, by the heat generated during operation, and/or by the temperature control device via the heated temperature control fluid, thereby tensioning the sleeve 637 on the outer cylindrical surface 631.

In a particularly advantageous refinement, the cylinder body 628 is configured as temperature-controllable and also comprises on its outer cylindrical surface 631 at least one outlet opening 641; 644 to which pressurized fluid, in particular pressurized air, can be applied.

Mounting a sleeve 637, optionally with the prior removal of a previously carried sleeve 637, is then performed in the same way, for example, as has been described above in connection with the means of assistance, configured as outlet opening(s) 641; 644, but with the difference that the cylinder body 628 is or has been cooled in advance to below 20° C., for example, in particular to below 17° C., preferably to a temperature of 15±1° C.

Generally independently of the specific embodiment of the printing press or printing unit 500, the specific position and/or specific configuration of the inking device 511 or the embodiments and variants thereof, and/or the configuration of the cylinder body 628, the gravure inking cylinder 512, or the arrangement of the engravings 513 or recesses 513, but preferably in conjunction with one of the stated embodiments, forms, and variants, the gravure inking cylinder 512 carrying the ink transfer forme 637 either fixedly or via a detachable sleeve 637 can be removed operationally, i.e. for example for replacement or for maintenance and/or makeready purposes, in its entirety from the inking unit 508, or preferably, only the ink transfer forme 637 configured as a sleeve 637 can be removed, without removal of the cylinder body 628.

In an advantageous first embodiment, the gravure inking cylinder 512 as a whole or a sleeve 637 arranged thereon can be removed from the inking unit 508 or inserted into the same in the opposite direction toward the side, i.e. in the axial direction of the gravure inking cylinder 512 arranged in the inking unit 508. Without restricting the embodiment to this application, this axial removal is of particular advantage in conjunction with an aforementioned arrangement of the inking device 511 on the side facing away from the relief inking cylinder 519.

For this purpose, the inking unit cylinder 512 or a cylinder body 628 comprised by it, in at least one makeready position in which the entire inking unit cylinder 512, the cylinder body 628, or an ink transfer forme sleeve 637 carried by the cylinder body 628 is to be and/or can be axially removed, is mounted only at one of its end faces on the frame 538; 533, while said inking unit cylinder 512 or the cylinder body 628 thereof is unsupported at its other end face and is freely accessible at least in the region of the axial projection of its cross-sectional area into the plane of the frame without overlap with the frame 538; 533, or from outside of the frame alignment. At least in this region, for example, the inking unit frame 538, 533 has a recess or an opening, for example. For the preferred case of a frame 538, 533 that can be divided between the first and second inking unit cylinders 512; 519, the aforementioned uncovered region or the region of free axial accessibility exists at least when the frame 538; 533 is opened, for example.

In one variant, the first inking unit cylinder 512 can generally be mounted, i.e. including during operation, at one end, in a manner also referred to as flying or cantilevered, and can be freely accessible in the region of its other end.

However, in an embodiment that is advantageous in terms of stability, for example, bearing means 671 that support the gravure inking cylinder 512 at one end face, e.g. a bearing device comprising the outer ring and the inner ring of a radial bearing 672 with roller bodies 673 preferably arranged therebetween, or optionally a wall element that accommodates such a bearing means 671, can be transferred operationally, for setting up or for changing the gravure inking cylinder 512 or in particular the sleeve 637, from a working position, in which the gravure inking cylinder 512 is mounted by the bearing means 671 fixedly and ready for operation on the frame 533; 538, to a makeready position. Said makeready position can generally involve any position of the bearing means 671 in which the axial pathway for removal of the gravure inking cylinder 512 or in particular the sleeve 637 is opened up, i.e. is no longer obstructed by the bearing means 671 or by a wall element supporting the same.

In a first embodiment, the bearing means 671 on one of the two frame sides, preferably on what is known as the operating side, are mounted fully releasably on the wall of the frame 533; 538 or on an aforementioned side part 578, in particular slide 578, which is mounted movably on the frame 533; 538 of a subframe that supports the gravure inking cylinder 512 together with the inking device 511, such that, once corresponding holding means, e.g. screw connections and/or clamping devices, have been released from the gravure inking cylinder 512, the journal 559 or cylinder barrel 639 thereof can be removed completely from the frame 533; 538 in the axial direction.

Figure 30:
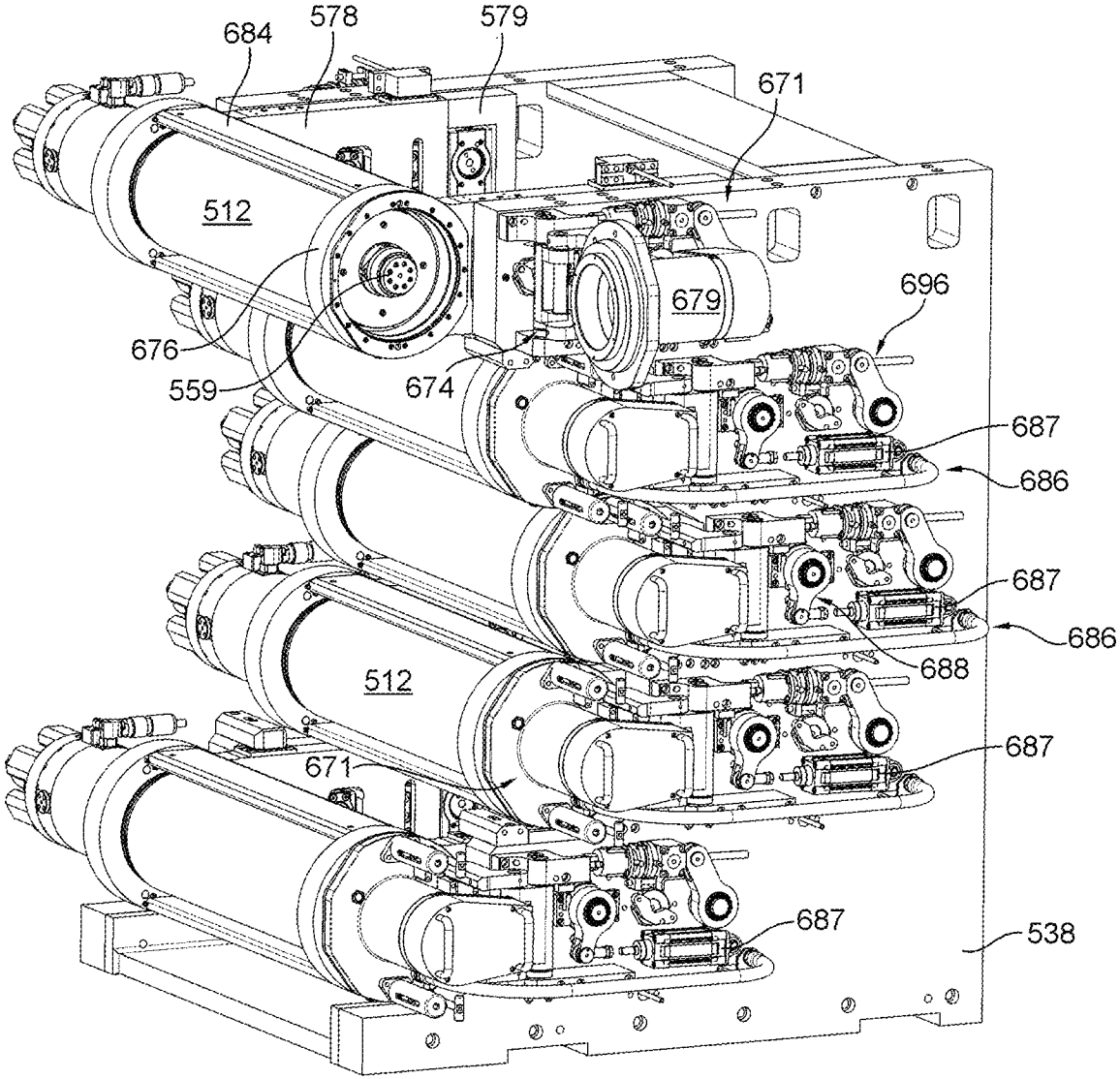
FIG. 30 a perspective view of an inking unit of FIG. 29 with a bearing cap pivoted away, by way of example.

In a preferred embodiment, however, the bearing means 671 on one of the two frame sides, preferably on what is known as the operating side, are mounted pivotably, indirectly or directly on the wall of the frame 533; 538, i.e. directly on the wall of the frame 533; 538 or on an aforementioned side part 578 of a subframe that supports the gravure inking cylinder 512 together with inking device 511, which side part is in turn mounted movably on the frame 533; 538, so that once corresponding holding means, e.g. screw connections and/or clamping devices, have been released from the gravure inking cylinder 512, the journal 559 thereof, or the cylinder barrel 639 thereof, said bearing means can be moved away, in particular pivoted away, while remaining held on the frame 533; 538 via a connection 674, in particular a movable connection, for example via an articulated connection 674 (e.g. shown by way of example in FIG. 30 for the upper gravure inking cylinder 512).

Provided the radial bearing 672 has a correspondingly small outside diameter and/or provided only the sleeve 637 will be changed, for example, the removable or pivotable bearing means 671 can comprise a bearing block, e.g. bearing ring, which accommodates the outer ring, and optionally a cover for protection against soiling, in which case the radial bearing 672 remains connected to the gravure inking cylinder 512 or the cylinder barrel 639 thereof.

In an advantageous embodiment, however, at least the radial bearing 672, i.e. at least the bearing means 671 thereof comprising the outer and inner bearings, can be separated in the axial direction from the cylinder journal 559 and moved away from the same, e.g. can be removed completely or preferably can be pivoted away. In the latter case, said bearing means 671 preferably remain held at least indirectly on the frame 533; 538.

In the embodiment that is preferred here, when the gravure inking cylinder 512 is in its operationally ready, installed state, the end-face cylinder journal 559 is detachably connected to a shaft section 677 that supports the radial bearing 672, in particular on its outer side, said connection being effected, e.g., via an axially releasable connection 678 configured as a clamping seat 678 and/or particularly as a conical seat 678, with or without an additional, circumferentially acting positive connection, for example. This connection 678 is not required to be suitable for the transmission of higher torques, but should accommodate the journal 559 without play in the radial direction in the operationally ready, installed state. The shaft section 677 is mounted via the radial bearing 672 in a bearing housing 679, which at the same time supports, on its inner side, for example, the outer ring-side supporting surface, e.g. contact surface. Thus, in this embodiment, the radial bearing 672, the axially detachably connected or connectable shaft section 677, and the bearing housing 679 are encompassed by the bearing means 671 that can be moved into a makeready position, in which the axial pathway for removal of the gravure inking cylinder 512 or particularly of the sleeve 637 is opened up, i.e. will not be or is not obstructed by the bearing means 671 or by a wall element supporting the same. In the interest of brevity, the bearing means 671, which preferably comprises the radial bearing 672, the axially detachably connected or connectable shaft section 677, and the bearing housing 679 and which can be moved into the makeready position, is also referred to in the following simply as the bearing cap 671, which can especially at least be backed away.

Figure 3B:
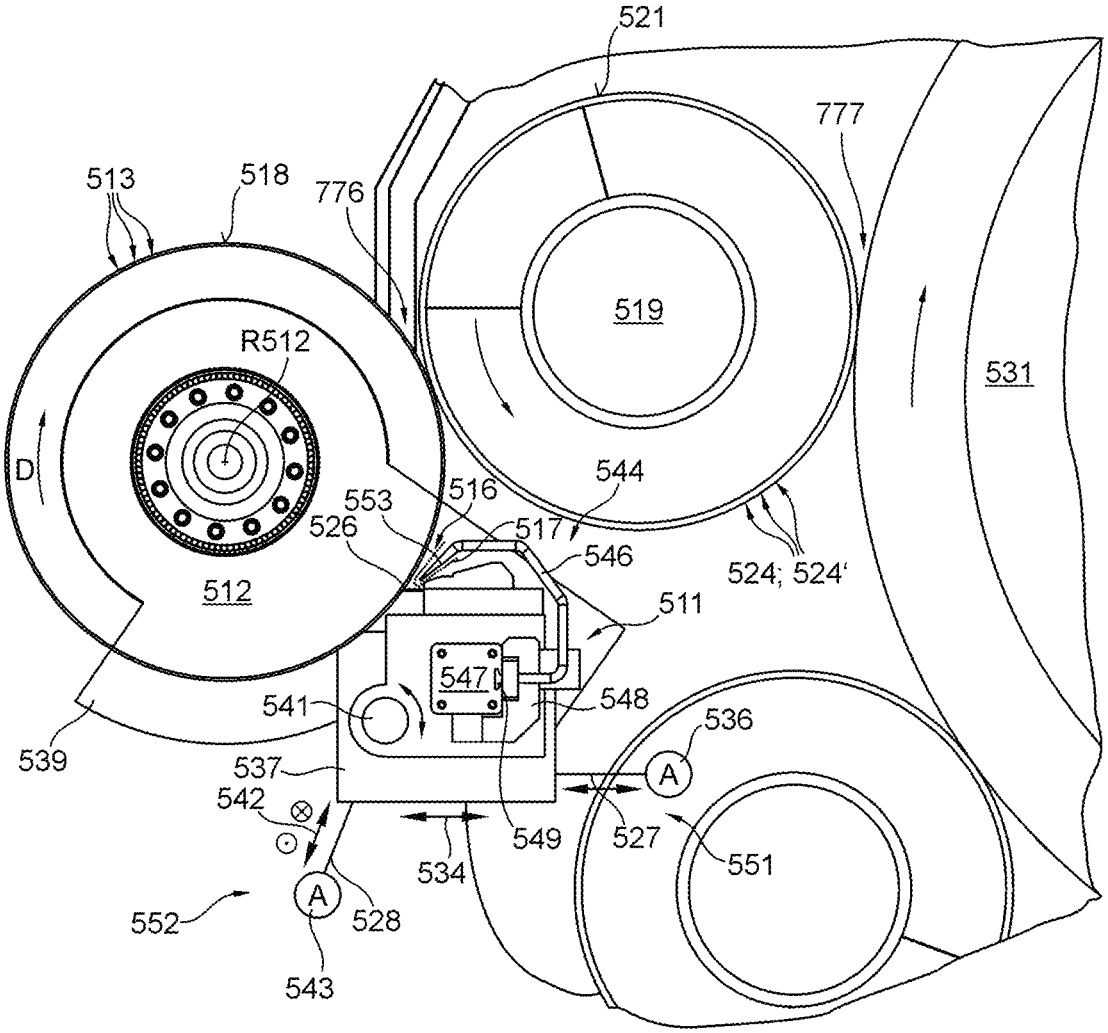
FIG. 3*b* an enlarged detail of the printing unit of FIG. 2*b;*

The bearing cap 671 or the bearing housing 679 that can be separated and removed from the cylinder journal 559 can then generally be fastened, e.g. screwed, together with radial bearing 672 and shaft section 677, directly to a frame 533; 538 or frame section 533; 538 of the inking unit 508 in the operationally ready installed state of the gravure inking cylinder 512. However, in a preferred embodiment having a gravure inking cylinder 512 that is adjustable radially in the frame 533; 538 or frame section 533; 538, in the operationally ready, installed state the bearing cap 671 or the bearing housing 679 is mounted, in particular is detachably attached via appropriate connecting elements, e.g. is screwed and/or clamped, on a side part 539; 578, which, in the case of a radially movable gravure inking cylinder 512, moves along with said cylinder, for example on a side part 539 of a subframe that moves along with the gravure inking cylinder 512, which is mounted via an eccentric (as shown in FIG. 3*b*, for example), or on a lever not shown here, or on a linearly movable side part 578 (see, e.g., FIG. 29) of the aforementioned subframe that supports, e.g., both the gravure inking cylinder 512 and the inking device 511.

Through the proper fastening of the bearing cap 671 on the frame 533; 538, together with the gravure inking cylinder 512 on an eccentrically mounted bearing ring or side part 539, on a lever, or on the linearly movable side part 578, via connecting elements of a preferably positive connection 681, for example screws 682 of a screw connection 681, the cylinder journal 559 and the radially mounted shaft section 677 are connected rigidly to one another, in particular via a conical seat 678, to prevent radial relative movement, so that the cylinder journal 559 is mounted radially on the frame 533; 538, on the eccentrically mounted bearing ring or side part 539, on a lever, or on the preferably provided side part 578, indirectly via the shaft section 677.

As mentioned above, the bearing cap 671 may be removable in its entirety for setup once it has been released. In a preferred embodiment, however, it is mounted on the frame 533; 538, the eccentrically mounted bearing ring or side part 539, the lever, or the side part 578 such that, after the connecting elements have been released, it can be pivoted away for the axial separation of cylinder journal 559 and shaft section 677 and to open up the cylinder end face. In the latter, preferred embodiment, in the installed, operationally ready state the bearing cap 671 is attached, in particular screwed, together with the bearing housing 679, for example, to e.g. an annular end section 676 of the side part 578.

For example, the bearing cap 671 can be mounted pivotably via a side mechanism, e.g. an articulated connector 674, on the bearing ring or side part 539, lever, or side part 578 that is mounted movably in relation to the frame 533; 538 to allow the radial movement of the operationally ready gravure inking cylinder 512, in that the mechanism penetrates the wall of the frame 533; 538 in a corresponding recess, for example, and is thereby moved along with the gravure inking cylinder 512.

In the solution that is preferred here, however, the connector 674 is attached to the frame 533; 538 via a coupling that accommodates a positioning path of the gravure inking cylinder 512, wherein the coupling accommodates the relative movement between frame 533; 538 and gravure inking cylinder 512 or bearing cap 671 that results from the radial positioning.

In the preferred embodiment having a radially positionable gravure inking cylinder 512, the two end-face bearing means that enable the positioning movement of the gravure inking cylinder 512 together with the inking device 511, e.g. eccentrically mounted bearing rings or side parts 539, pivotable levers, or preferably linearly movable side parts 578, are connected with one another by one or more cross members 684, for example, to the subframe, in particular braced. In or on the subframe, the inking device 511 is then attached directly to the side parts 578, for example, or to e.g. a stronger cross member that connects said side parts.

The aforementioned operational transfer of the bearing means 671 or the bearing cap 671 differs from a disassembly or partial disassembly of a bearing, e.g. in that with the operational transfer, no readjustment of the bearing play and/or no withdrawal of a radial bearing 672 and/or no separate removal of a bearing housing 679 and/or no withdrawal or insertion of a bearing ring from or into a frame 538; 533 or from or into a frame wall is required; instead, a unit forming, e.g. at least the radial bearing 672, a shaft section 677, and the entire radial housing 679 supporting the radial bearing 672, as the bearing cap 671, for example, can be transferred between the working position and the makeready position.

Figure 29:
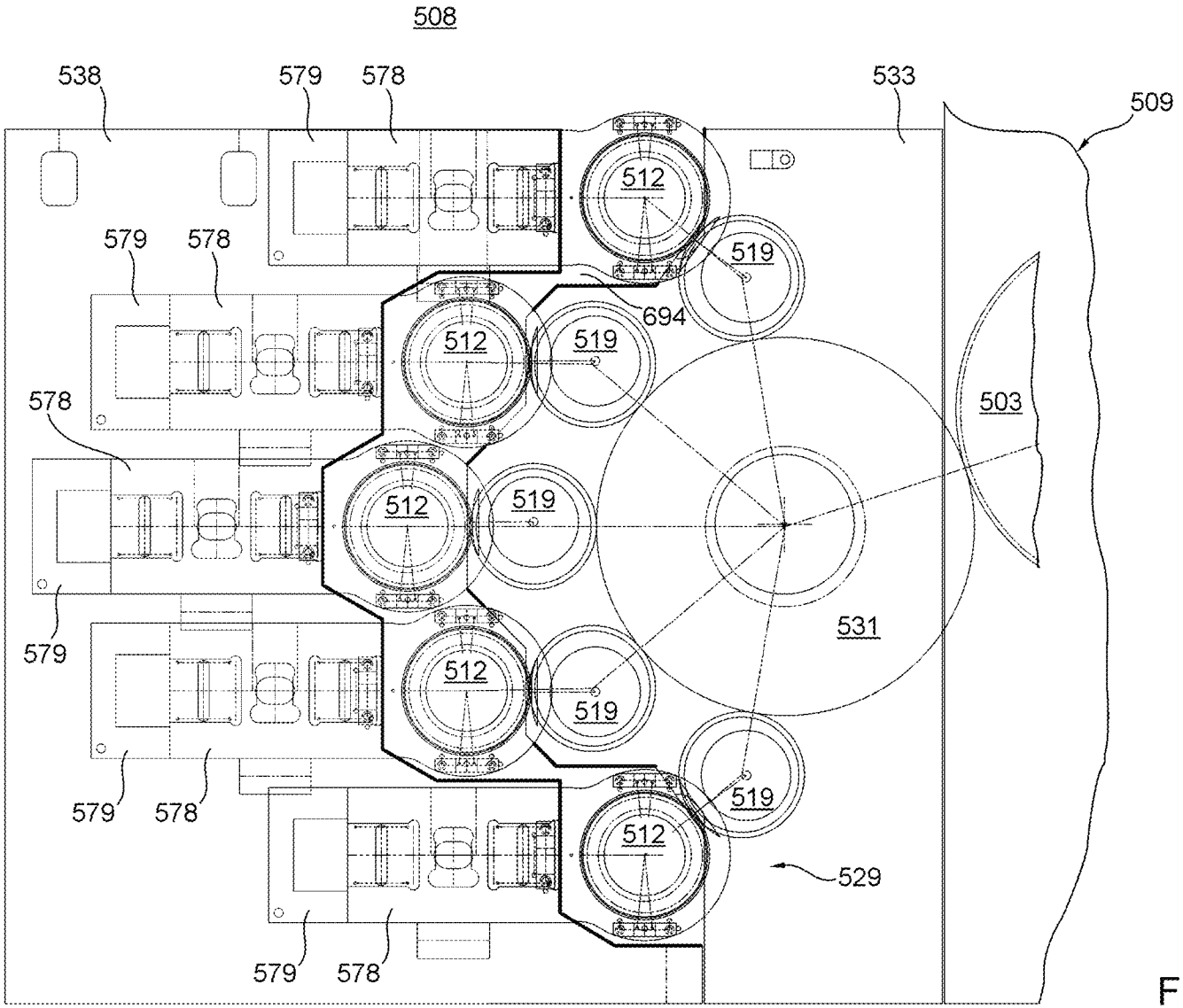
FIG. 29 a side view of an example of an inking unit with a linearly movable bearing of the gravure inking cylinder.
Figure 31:
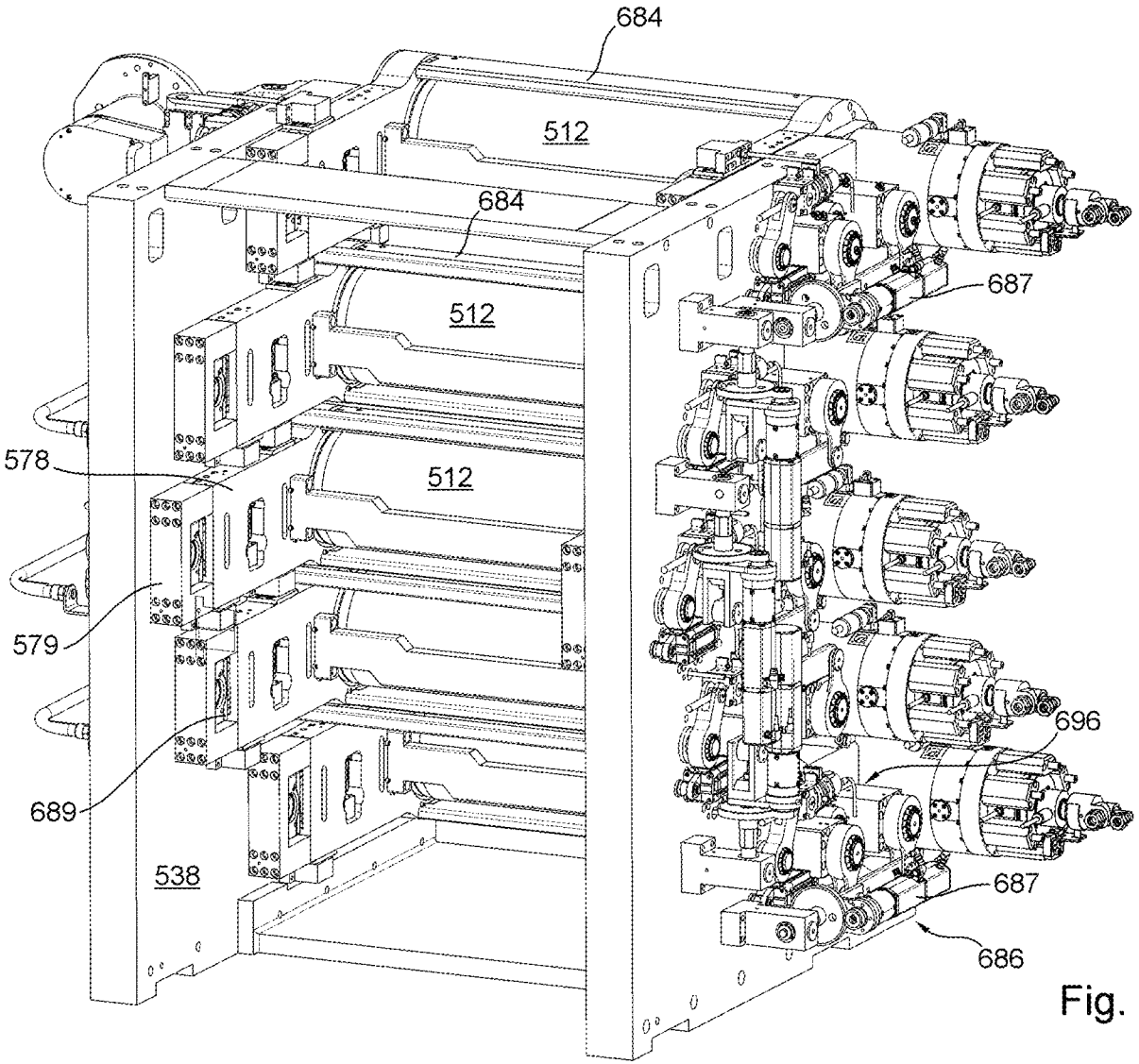
FIG. 31 a perspective view of the inking unit of FIG. 30, obliquely from behind.

The gravure inking cylinder 512 is preferably thrown onto or off of the second or relief inking cylinder 519 in this case via a joint positioning of gravure inking cylinder 512 and inking device 511 by positioning the bearing means that enable the radial positioning movement, for example the eccentric ring that positions the gravure inking cylinder 512 together with the side part 539, or by pivoting a lever that supports the gravure inking cylinder 512 and the inking device 511, or by the linear movement of the side part 578 that supports the gravure inking cylinder 512 and the inking device 511. The joint positioning is of very particular advantage, for example, if during production, a pressing, i.e. the contact force between the gravure inking cylinder 512 and the next inking unit cylinder 519 downstream is to be modified, or if the gravure inking cylinder 512 in reaction to a movement of the next inking unit cylinder 519 downstream is to be tracked. In FIGS. 29, 30 and 31, the inking devices 511 embodied, for example, according to the first embodiment of the inking device 511 (see, e.g. FIG. 1*a*, FIG. 2*a*, FIG. 3*a* or FIG. 5*a*, inter alia) or according to the second embodiment of the inking device 511 (see, e.g., FIG. 1*b*, FIG. 2*b* and FIG. 3*b*, inter alia) are not shown, but are preferably arranged, for example, on a respective cross member 547; 684 in an above embodiment, e.g. on the side facing toward or facing away from the relief inking cylinder 519.

The positioning of the bearing means that enables the radial positioning movement, e.g. the positioning of the aforementioned eccentric rings or side parts 539 or the aforementioned lever or the linearly movable side parts 578, is carried out by means of positioning drives 686, preferably provided on both sides in each case, which comprise, for example, a drive means 687, e.g. an electric motor 687 or preferably a pressurized medium-actuated piston/cylinder system 687, e.g. pneumatic cylinder 687, by means of which, via a transmission 688, e.g. via a transmission 688 comprising a lever, the bearing means, e.g. the aforementioned eccentric rings or side parts 539 or the aforementioned lever or the linearly movable side parts 578, can be repositioned and thus the gravure inking cylinder 512, in particular together with the inking device 511, can be displaced radially.

In the embodiment of the drive means 687 as a pressurized medium-actuated piston/cylinder system 687, the positioning drive 686 used for activation works, e.g. against a stop means 689, embodied here, e.g., as an eccentric or eccentrically mounted stop bolt, which is advantageously adjustable in terms of its radial distance from the second or relief inking cylinder 519 disposed in the operating position. This can preferably be accomplished by another. This may comprise, for example, a drive means embodied as an electric motor, which adjusts the stop means 689 via a transmission, for example via a spindle drive.

At the end face opposite the separable bearing means 671, the gravure inking cylinder 512 in the embodiment of the cylinder body 628 that is or can be loaded with a sleeve 637 is mounted operationally fixed to the frame 533; 538 or to the bearing means that enable the radial positioning movement, e.g. to the aforementioned eccentric ring or side part 539 or to the aforementioned lever or to the linearly movable side part 578. This is accomplished here via a fixedly provided radial bearing 691. If the gravure inking cylinder 512 is configured as temperature-controllable, an interface 692, in particular rotary feedthrough 692, by means of which the cylinder-side temperature control medium inflow and return flow 651; 652 can be connected to corresponding external line sections, may be provided at the end face.

Spaced axially from the radial bearing 691, another radial bearing 693, e.g. spaced at least 50 mm from the former, may be provided, which axially has a degree of play between the stationary outer ring and the rotating inner ring when the gravure inking cylinder 512 is ready for operation, but which is capable of supporting the gravure inking cylinder 512 when the bearing cap 671 is separated, by absorbing at least part of the torque. In the flying or cantilevered bearing described above as an alternative, the additional radial bearing 693 is embodied without bearing play, for example.

The drive motor 616, which in an advantageous embodiment of the gravure inking cylinder 512 is mechanically independent, may be embodied here as a torque motor and/or as a hollow shaft motor 616, and may be configured as encompassing the end-face cylinder journal 559.

In the preferred embodiment, e.g. in a form described above, the gravure inking cylinder 512 is embodied as temperature controllable.

Although not explicitly shown, in an advantageous embodiment aforementioned means for assisting with the mounting of a sleeve 637, in particular one or more aforementioned outlet openings 641; 644 or groups of such outlet openings 641; 644 are provided.

In an advantageous refinement, the gravure inking cylinder 512 is mounted such that it is adjustable on both sides with respect to its height relative to the frame 533; 538. This can be implemented, for example, in the region of the coupling, e.g. eccentrically mounted guide bolt, acting between the guides 579 that are fixed to the frame and the guided side parts 578.

Figure 32:
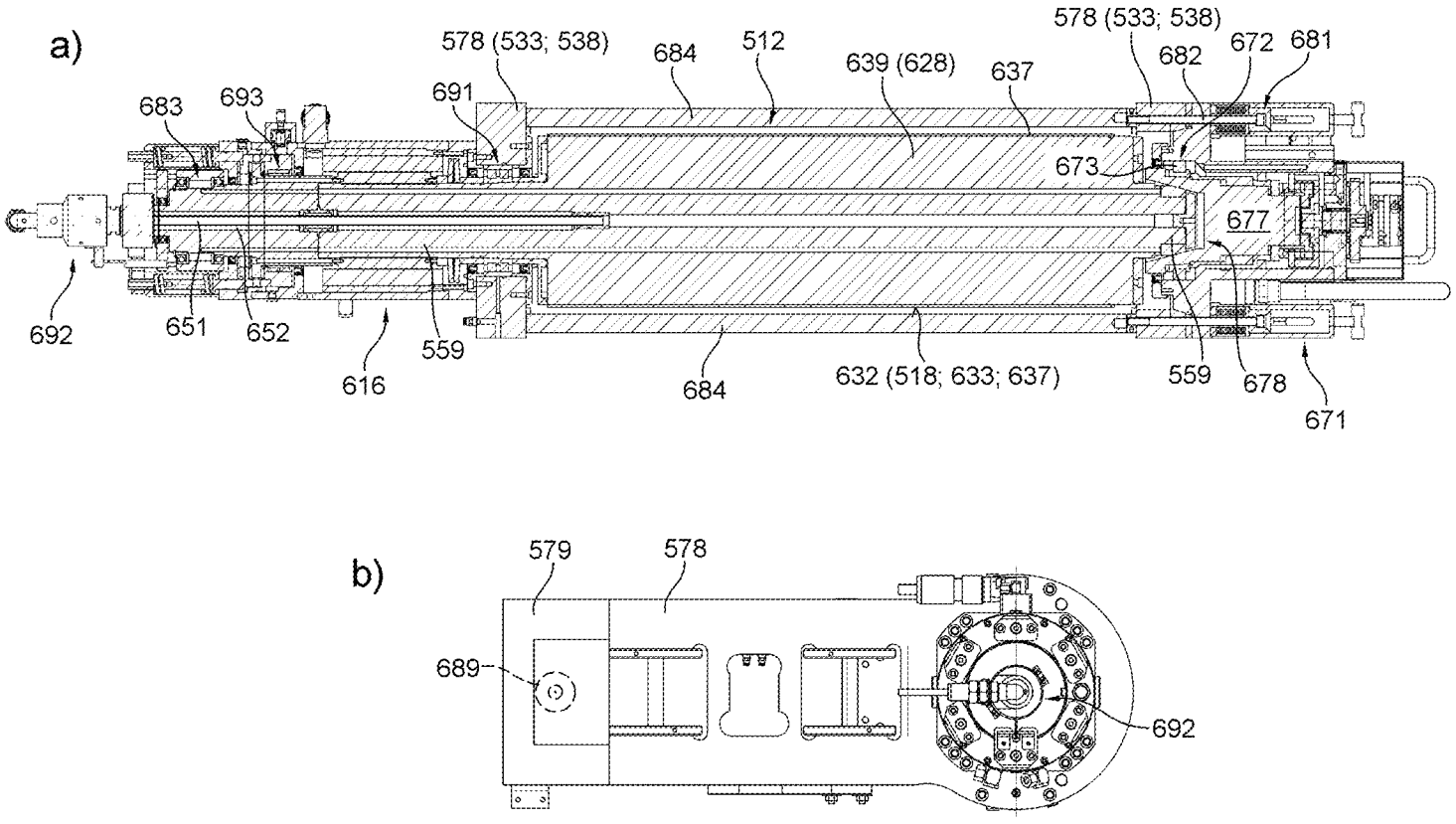
FIG. 32 a longitudinal section (a) and a cross-sectional view (b) of a gravure inking cylinder as is or can be used, for example, in an inking unit according to FIGS. 30 and 31.

In the embodiment shown in FIGS. 30, 31 and 32 having a gravure inking cylinder 512 or cylinder body 628 mounted on one side, the gravure inking cylinder 512 or the unloaded cylinder body 628 is removed axially for fitting with or for mounting a new sleeve 637 after the bearing cap 671 has previously been released and moved, in particular pivoted, into the makeready position. The new sleeve 637 is then mounted onto the cylinder main body 628, e.g. in a manner set out above with or without the aid of means for assisting with the exchange, if applicable after a previously carried sleeve 637 has been removed from the cylinder main body 628. Afterward, the bearing cap 671 is refastened to the frame 538; 533 or to the movable bearing means that enable the radial positioning movement, thereby ensuring that the journal 559 of the gravure inking cylinder 512 is or will be supported again radially on this frame side as well, via the connection to the shaft section 677.

In an embodiment shown, for example, in FIGS. 30, 31 and 32, the bearing of the gravure inking cylinder 512 on the side of the frame opposite the bearing cap 671 is operationally fixed, i.e. the gravure inking cylinder 512 or the cylinder body 628 thereof cannot be readily removed from the frame 538; 533 axially, and is instead held to prevent any uncontrolled axial movement via an axial bearing 683 that engages directly or indirectly on the cylinder journal 559, which on this side of the frame is not operationally separable axially, for example. In an advantageous embodiment, said bearing is also embodied as having the aforementioned second radial bearing 693, which absorbs tilting moment.

In an alternative embodiment in which, for example, the engravings 513 are comprised, as described above, directly by the outer cylindrical surface 631 of the cylinder body 628 or by the outer cylindrical surface 632 of a layer 633 carried by said cylinder body, the bearing opposite the bearing cap 671 is also configured such that the gravure inking cylinder 512 or at least the cylinder body 628 thereof can be removed from the inking unit 508 axially toward the machine side lying on the bearing cap 671 side. This can be accomplished, for example, by means of a separable connection between cylinder journal 559 and a shaft section that remains in the frame 533; 538, for example comparable to the solution on the bearing cap 671 side. If temperature control fluid is to be introduced and discharged, a sealing coupling between the subsections of the corresponding line sections 651; 652 must be provided, for example.

In this alternative embodiment having a removable gravure inking cylinder 512 or cylinder body 628, the gravure inking cylinder 512 or the cylinder body 628 is removed axially to be loaded with a new or renewed ink transfer forme 637, after the bearing cap 671 has previously been released and moved, in particular pivoted, into the makeready position. A cylinder body 628 carrying a new or renewed ink transfer forme 637 is then inserted with the one journal 559 on the opposite side of the frame, and the bearing flap 671 located on the removal or loading side is attached and fastened.

In one embodiment variant, a cylinder body 628 that can be or is to be loaded with sleeve 637 can be removed in the manner of the alternative embodiment to enable its loading with a sleeve 637 or a sleeve change, and can then be loaded, and reinserted with sleeve 637.

Figure 33:
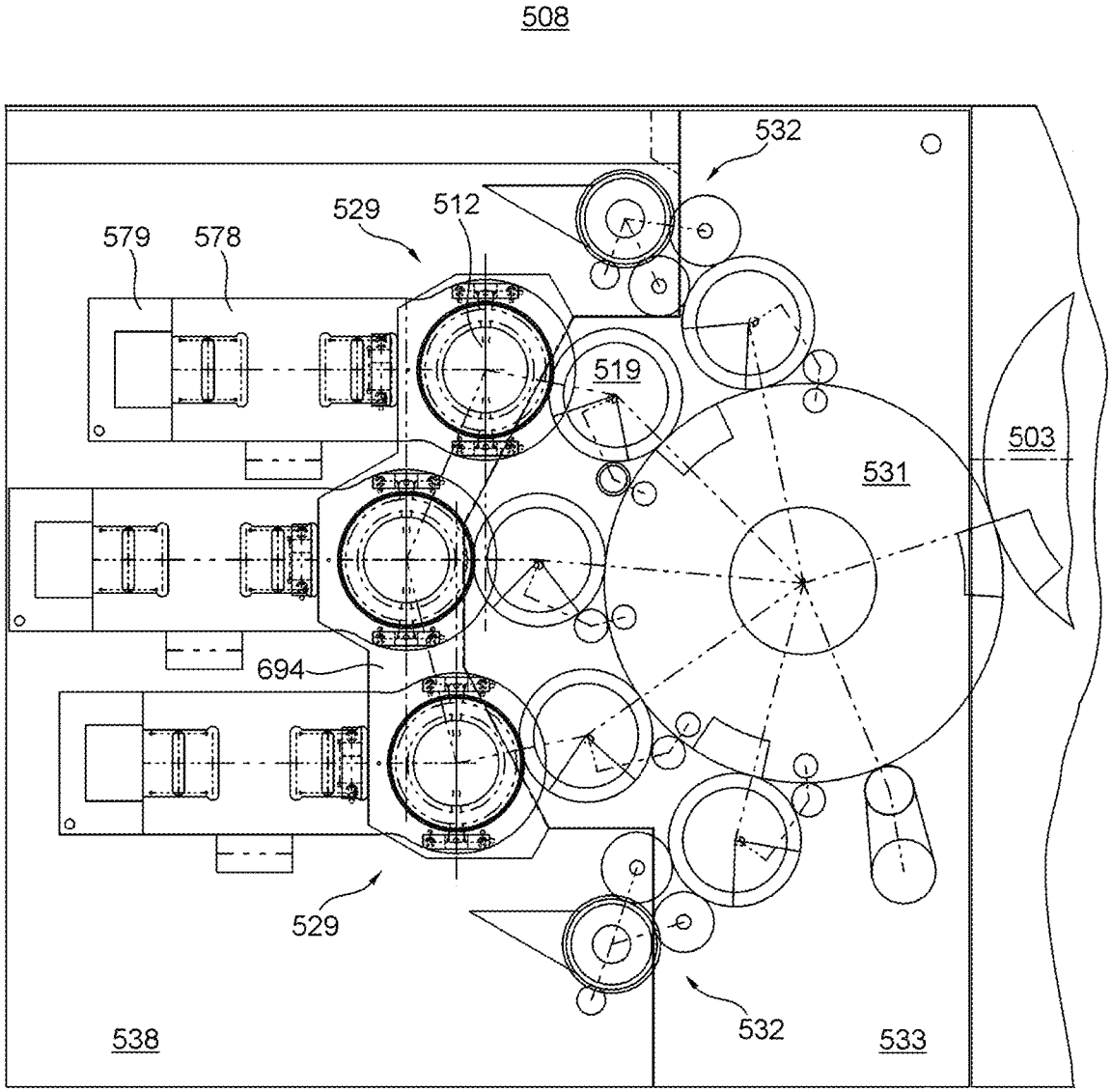
FIG. 33 a side view of a further example of an inking unit with linearly movable bearing of the gravure inking cylinder.

In the embodiment of the inking unit 508 shown by way of example, e.g. in FIG. 29, e.g. all, e.g. five, inking trains 529 are configured as selective, i.e. with an aforementioned gravure inking cylinder 512. Generally, however, other, e.g. combined configurations are also possible, for example three middle, for example, of five inking trains 529; 532 being selective and two, for example the first and the last inking train 529 being conventional (see, e.g. FIG. 33).

At the level of the respective gravure inking cylinder 512 having an axially removable cylinder main body 628 or a sleeve 637 that can be removed or mounted axially, the inking unit frame 533, 538, preferably configured as separable, between gravure inking cylinder 512 and relief inking cylinder 519, is not closed at the height of the respective gravure inking cylinder 512, even in the operational state, for example, and instead forms, at least at the height of the respective gravure inking cylinder 512, a wall opening 694, optionally extending across the height of multiple adjacent selective printing trains 629, between the frame section 538 that supports the gravure inking cylinder 512 and the frame section 533 that supports the relief inking cylinder 519.

In an advantageous second embodiment of the gravure inking cylinder 512 that can be removed for a replacement or for maintenance and/or makeready purposes, said gravure inking cylinder can be removed in its entirety, optionally with a sleeve 637 arranged thereon, from the inking unit 508 or the frame 538; 533 in the radial direction of the gravure inking cylinder 512 arranged in the inking unit 508, or can be inserted into said frame in the opposite direction. Without restricting the embodiment to this application, this radial removal is of particular advantage in conjunction with an aforementioned arrangement of the inking device 511 on the side facing the relief inking cylinder 519. Here, a removal in the radial direction, in contrast to the removal in the axial direction, means a removal along a removal pathway that extends in a plane perpendicular to the axis of rotation R512, e.g. at least up to the exit from the frame alignment, which is bounded on both sides. Said removal pathway may extend in a straight line, a curved line, or with any change of direction in this plane, for example.

In that case, the length 1512 of the gravure inking cylinder 512, including the journal 559 fixed to the cylinder, is shorter than the inside width w538 of the frame 538 or of a subframe supported by the frame 538, at least along the removal path extending in the plane that is perpendicular to the axis of rotation R512, for example. This inside width w538 is also provided in the embodiment in which, rather than being determined directly by the frame walls, the inside width w538 is determined by the distance between the side parts 539 of an aforementioned subframe that supports the inking device 511, for example. In that case, the inside width w538 is formed, at least along a removal path leading from the bearing point to the frame edge, with an inside width w538 that is greater than the journal diameter. In an advantageous embodiment of the frame 538; 533, each respective frame wall is configured, e.g. cast, on its inwardly facing side as having a predominantly planar surface, except for any attachments and/or cast fittings and/or recesses and/or boreholes that may be provided, wherein for the aforementioned purpose, the distance between these planar surfaces is to be regarded as the inside width w538.

Figure 34:
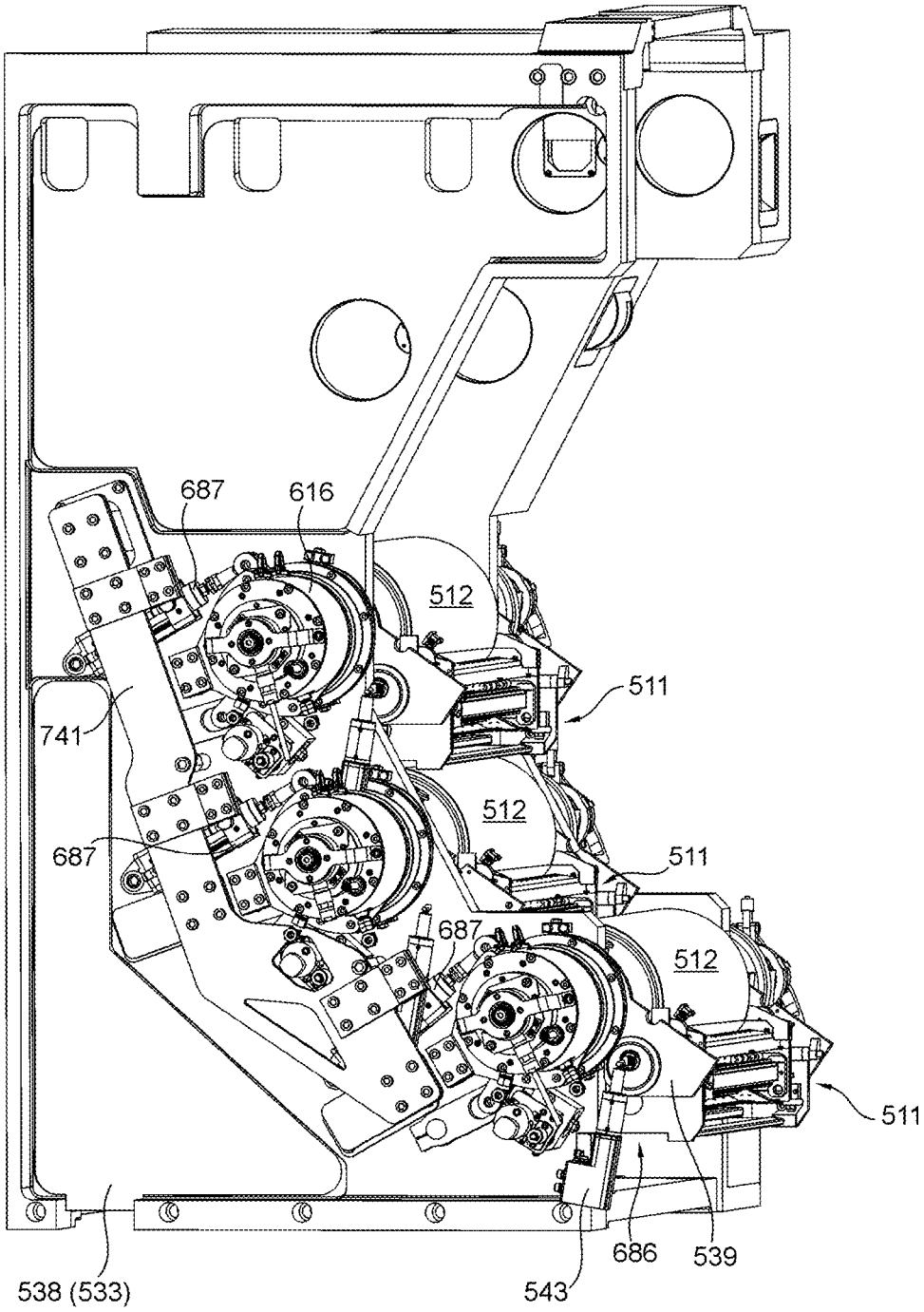
FIG. 34 a perspective view of a frame section comprising three gravure inking cylinders.
Figure 35:
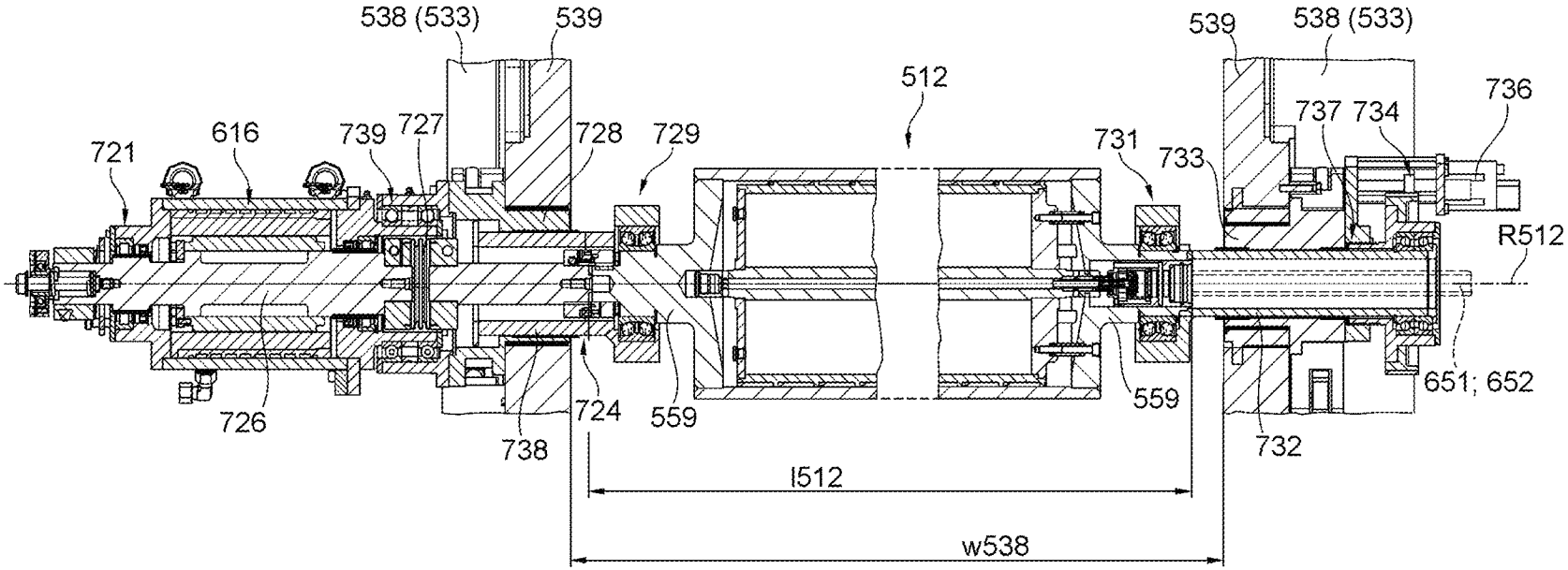
FIG. 35 a sectional view of an embodiment of a radially removable gravure inking cylinder.

On one side, e.g. the drive side of the gravure inking cylinder 512, on which it is rotationally driven via a gearwheel, for example, by one of the other inking unit cylinders or printing unit cylinders 519; 531; 503; 501 or, as is preferred, by its own drive motor 616, the journal 559 is or can be detachably connected to a shaft 726, e.g. drive shaft 726, e.g. by means of a preferably unique coupling 724, embodied as a claw coupling or star coupling, for example, and as free of play with respect to its angle of rotation (see, e.g., FIG. 34 and FIG. 35). In one advantageous embodiment, said shaft is configured as a split shaft 726 having between the two shaft pieces a non-rotatable coupling 727, e.g. a metal bellows coupling 727, which accommodates an axial angular offset. The shaft 726 is mounted, in a section or shaft piece that is closer to the cylinder, for example, directly or indirectly in a bore or recess of the frame 538; 533 via a radial bearing 691. The radial bearing 691 is preferably seated in an eccentric ring 728 configured as eccentric bushing 728, for example, for a radial positioning of the gravure inking cylinder 512. Radial positioning is preferably carried out, for example, by a pivoting of the eccentric bushing 728 by the drive means 687, e.g. an electric motor 687 or preferably a pressurized medium-actuated piston/cylinder system 687, e.g. pneumatic cylinder 687. In an advantageous embodiment, the journal 559, which is coupled via the coupling 727, is supported by a radial bearing 729, in particular lying within the inside width w538, which is arranged on a bushing 738 seated, e.g., in the eccentric bushing 728, and is preferably configured as separable for the removal of the gravure inking cylinder 512, with a removable, e.g. upper bearing segment, in particular upper bearing half-shell, and a frame-mounted, e.g. lower bearing segment, in particular lower bearing half-shell.

Although the shaft 726 might also be driven by a drive motor 616 via gearwheels, in this case the drive motor 616 is arranged with its motor rotor coaxially with the gravure inking cylinder 512 and with its motor rotor connected, in particular detachably, directly or indirectly to the cylinder journal 559. To this end, for example, the motor rotor, which is encompassed by the motor stator, is supported directly on the circumference of the shaft 726, for example in a section or shaft piece further away from the cylinder. In that case, the motor stator is attached directly or indirectly fixed to the frame, e.g. to the eccentric bushing 728. To prevent the motor stator from rotating relative to the motor rotor, arranged, e.g., on the shaft 726, a further radial bearing 739 is provided, e.g., between a motor housing that supports the motor stator and the eccentric bushing 728. To prevent the motor housing from rotating with the motor stator, the motor housing is coupled to what is known as a torque support 741, which absorbs the throwing-on and throwing-off movement, thereby securing the motor housing against rotation.

On the opposite side of the gravure inking cylinder 512, its journal 559 is supported in the inserted state by a radial bearing 731, which is configured as separable, having a removable, in particular upper bearing half-shell, to allow removal of the gravure inking cylinder 512. In an advantageous temperature controllable embodiment of the gravure inking cylinder 512, a temperature control medium inlet and a temperature control medium outlet 651; 652 are provided on this side, for example. Between the parts of the temperature control medium inlet and the temperature control medium outlet 651; 652 that are fixed to the cylinder and those that are fixed to the frame, a self-locking valve is provided in each case, for example. The radial bearing 731 is arranged on a bushing 732, which is mounted in the frame 538, e.g. likewise via an eccentric ring 733 configured as an eccentric bushing 733. The radial bearing 731 is particularly arranged within the inside width w538. The eccentric bushing 733 can be pivoted by its own dedicated drive means or jointly via a synchronous spindle by means of the aforementioned drive means 687.

In a preferred embodiment, the bushing 732 is mounted together with the radial bearing 731 axially movably in the frame 538 and/or in the eccentric bushing 733, and can be moved axially by an axial drive 734, e.g. to decouple the already opened coupling 724 and/or to correct the axial position of the gravure inking cylinder 512, i.e. the lateral register. Said axial drive 734 comprises a drive means 736, e.g. a drive motor 736, by means of which the bushing 732 is movable axially via a transmission, e.g. a transmission that converts rotation into linear movement. The transmission in this case comprises, e.g., a screw drive 737.

The relief inking cylinder 519 is mounted in the same frame 538; 533 as the gravure inking cylinder 512, or preferably in a frame section 533, from which the frame section 538 that supports the gravure inking cylinder 512 can be moved away. In the embodiment of the relief inking cylinder 519 in which it is likewise removable in its entirety from the frame 533; 538, it can be configured or mounted such that it can be removed axially in an embodiment corresponding to the manner set out above, or radially in an embodiment corresponding to the manner set out above.

Figure 36:
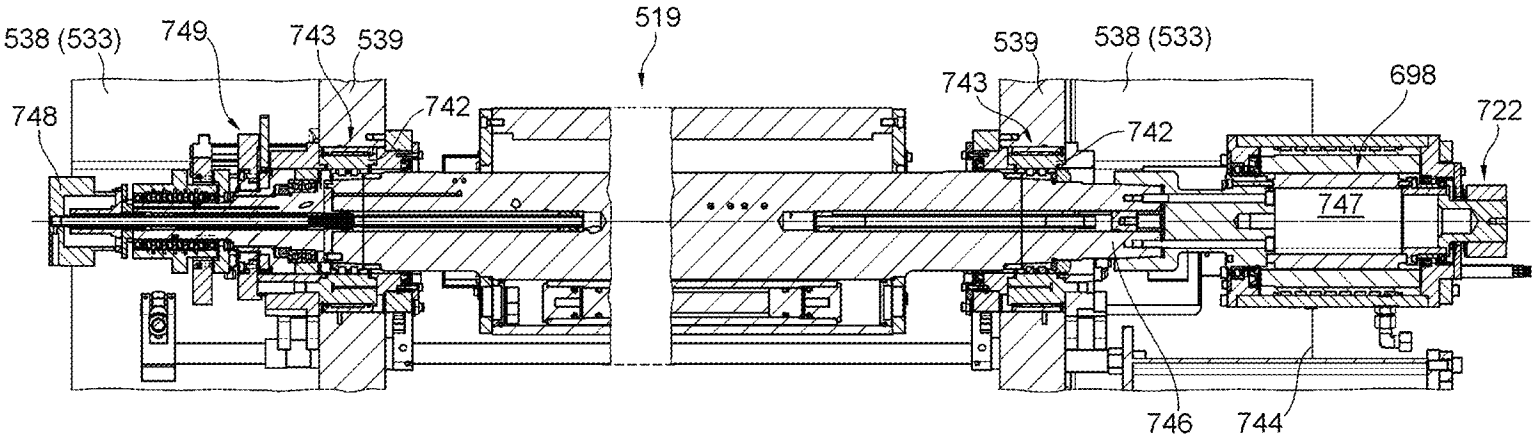
FIG. 36 a sectional view of an embodiment of a relief inking cylinder.

In an embodiment of the relief inking cylinder 519 in which it can be loaded with finite relief inking formes, it does not need to be removable for makeready purposes. It that case it is mounted on both sides such that it is radially positionable, for example, via radial bearings 743, e.g. in eccentric rings 742 preferably embodied as eccentric bushings 742 (see, e.g. FIG. 36). Here again, positioning can be effected by a corresponding drive means 783, e.g. an electric motor 783 (not shown in FIG. 35), or possibly by a pressure medium-actuated piston/cylinder system, e.g. pneumatic cylinder. Rotatory driving can generally be implemented via gearwheels by a downstream inking unit cylinder or printing unit cylinder 531; 503; 501, but is preferably provided by a dedicated drive motor 698. Said driving may be carried out via gearwheels, but is preferably carried out axially to the relief inking cylinder 519. For this purpose, the motor rotor is arranged for conjoint rotation, for example, directly on a single-part or multi-part shaft 747 that extends the cylinder journal 746. The motor stator may be supported by the internal motor bearing, but can be braced against rotation via a torque support 744 on the frame 533.

Generally independently of the embodiment specifically described here, but advantageously in conjunction with said embodiment or with one of the variants, the relief inking cylinder 519 may be embodied as temperature controllable, in particular such that temperature-control fluid can flow through it. For this purpose, it has an interface 748, in particular rotary feedthrough 748, on one of its end-face bearings, preferably on the side opposite the drive motor 698, along with a corresponding line routing into the relief inking cylinder 519, within said relief inking cylinder 519 for temperature control of the same, and out of it again.

The relief inking cylinder 519 is preferably movable axially via an axial drive 749, e.g. to correct the axial position of the relief inking cylinder 519, i.e. the lateral register. Said axial drive 734 comprises a drive means, e.g. a drive motor, by means of which a bushing connected in a tension-proof and compression-proof manner to the cylinder journal 746, or a ring is movable axially via a transmission, e.g. a transmission that converts rotation into linear movement. The transmission in this case comprises a screw drive, for example.

In the embodiment described here, the drive means 616; 698, e.g. drive motors 616; 698, of gravure inking cylinder and relief inking cylinder 512; 519 are provided on different sides of the frame.

As described above, in a preferred embodiment the gravure inking cylinder 512 can be rotationally driven by its own drive motor 616, which is mechanically independent from the drive of the other inking unit cylinders 519; 531 and/or printing unit cylinders 501; 503. Said drive motor and the drive configuration described in the following is generally independent of the specific position and/or specific configuration of the inking device 511, the embodiments and variants thereof and/or the embodiments, forms, and variants set out above for the nature of the arrangement of recesses 513 or engravings 513 on the gravure inking cylinder 512 and/or the means for assisting with the mounting of a sleeve 637, but advantageously in conjunction with one of the aforementioned embodiments, forms, and variants of the same.

In a first embodiment, the respective relief inking cylinder 519 can be driven in rotation via a mechanical coupling, for example via gearwheels, by the next printing unit cylinder or inking unit cylinder 503; 531 downstream, for example the forme cylinder 503 or the transfer cylinder 531 optionally provided therebetween, but preferably is or can be driven by its own dedicated drive motor 698, which is mechanically independent of the drive of the other inking unit cylinders 519; 531 and/or printing unit cylinders 501; 503.

In one variant, gravure inking cylinders and the associated relief inking cylinders 512; 519 are or can be driven jointly, coupled via gearwheels, for example, by means of a drive motor 698, which is mechanically independent of the drive of the other inking unit cylinders 531 and/or printing unit cylinders 501; 503.

Thus, the first inking unit cylinder 512, which comprises the recesses 513, is and/or can be driven during production operation preferably alone or optionally together with the second inking unit cylinder 519 by means of a drive 616, 711, which is mechanically independent of drive means that rotate the third inking unit cylinder 531 and/or the forme cylinder 503 during production operation, and the angular position of which is controllable.

If a transfer cylinder 531, in particular an ink collecting cylinder 531, is provided in the printing unit 500 between relief inking cylinder 519 and forme cylinder 503, in a first embodiment said transfer cylinder is or can be driven in rotation by the next printing unit cylinder 503 downstream, for example the forme cylinder 503, via a mechanical coupling, for example via gearwheels 701; 702 that mesh with one another at least during operation. In this embodiment, however, the transfer cylinder 531 is preferably assigned a drive motor 703, e.g. a so-called auxiliary motor or makeready motor 703, by means of which the transfer cylinder 531, which is separated mechanically from the drive of the forme cylinder 503, can be rotated at least during makeready operation and/or when the inking unit 508 is moved away from the printing unit part 509. In an alternative embodiment, on the optionally provided transfer cylinder 531, a drive motor 699, which may also be operated at operating speed V, is provided, which serves when the coupling is separated as a makeready drive, and which, e.g. during operation with an intact coupling, acts as an auxiliary drive to counteract a tooth flank change by applying a braking torque or drive torque to the transfer cylinder 531. In another, e.g. mechanically less complex embodiment, the drive motor 699 completely replaces the mechanical coupling to the forme cylinder 503 and rotates the transfer cylinder 531 operationally without further drive coupling to other printing unit cylinders or inking unit cylinders 501; 503; 512; 519; 531.

Although the forme cylinder 503 can also be driven separately by its own dedicated drive motor as described above, it preferably is or can be driven together with the impression cylinder 501, mechanically coupled thereto, e.g. via gearwheels 706; 707 that mesh during operation, by a drive motor 704, in particular provided axially or via a drive pinion 708 on the forme cylinder 503.

The drive motors 616; 698; 699; 704 for operationally driving the rotation of the inking unit cylinders and printing unit cylinders 512; 519; 531; 501; 503 individually or in groups, i.e. during production operation, are preferably configured as drive motors 616; 698; 699; 704 that are controllable with respect to angular position, or closed-loop angular position controlled, in particular as servo motors 616; 698; 699; 704, or preferably as closed-loop angular position controllable torque motors 616; 698; 699; 704. The aforementioned wiping cylinder 507 may be driven by the forme cylinder 503, or preferably is or can be driven by its own dedicated drive motor 709, which is preferably controllable at least with respect to its rotational speed, i.e. speed-controlled, e.g. likewise a servo motor or preferably a torque motor 709.

Each of the drive motors 616; 698; 699; 704 that is controllable with respect to angular position or at least with respect to speed is assigned a control device and/or regulating device 711; 712; 713; 714, e.g. a drive controller 711; 712; 713; 714, by means of which the relevant drive motor 616; 698; 699; 704 or the inking unit cylinder and printing unit cylinder 512; 519; 531; 501; 503 that is rotated by the same is or can be operated with closed loop angular position control. Assigned to the drive motor 709, which is controllable at least with respect to rotational speed, is a control and/or regulating device 716, e.g. a drive controller 716, by means of which the relevant drive motor 709 or the wiping cylinder 507 rotated by the same is or can be operated with respect to its rotational speed. A drive motor 616; 698; 699; 704; 709 that is controllable in a closed loop with respect to its angular position or at least with respect to its rotational speed, together with its drive controller 711; 712; 713; 714; 716, will also be referred to in the following as drive 616, 711; 698, 712; 699, 713; 704, 714 and 709, 716.

The drives 616, 711; 698, 712; 699, 713; 704, 714 that drive the inking unit cylinders and printing unit cylinders 512; 519; 531; 501; 503, individually or in groups, during operation receive an angular position $\Phi_L$, advancing during operation, of what is known as an electronic master axis L, which is given by the electronically transmitted angular position of a rotary encoder output provided on another unit of the printing press, or preferably by the angular position $\Phi_L$ of a virtual master axis L. The latter angular position may be generated by one of the drives 616, 711; 698, 712; 699, 713; 704, 714 itself in the manner of a master drive or in an additional controller 717, e.g. drive controller 717. A target speed $V_{target}$, which may be a target operating speed V for production, or production speed $V_P$ for short, for example, and/or the signal for starting up or stopping can be specified to the master axis L, for example via a press controller 718 from a press control console 719.

In a first embodiment, not shown here, the angular position $\Phi_L$ of the master axis L can be forwarded as a master signal to each of the closed-loop angular position controlled drives 616, 711; 698, 712; 699, 713; 704, 714 or 709, 716 involved in the drive system, in particular the drive controllers 711; 712; 713; 714; 716 thereof, on the input side via a signal connection, e.g. a network connection, which each of the closed-loop angular position controlled drives 616, 711; 698, 712; 699, 713; 704, 714 involved in the drive system, also referred to as "coupled" drives, then follow or must follow as a slave, if applicable taking into account drive-specific parameters {P} and/or rules V1; V2. A speed-controlled drive 709, 716, likewise optionally "coupled", receives a signal specifying the speed or likewise receives the angle signal, from which it derives the speed. The rule in that case may be a correlation between the target angular position $\Phi_S$ and the angular position $\Phi_M$ supplied as the master on the input side, or the time t.

In a preferred embodiment, however, at least the drive 616, 711; 698, 712 that drives the gravure inking cylinder 512 and/or the drive that drives the relief inking cylinder 519, rather than receiving the angular position $\Phi_L$ of the master axis signal as a master signal on the input side, receives as a master an angular position $\Phi_M$; $\Phi_M$ (512); $\Phi_M$ (519); $\Phi_M$ (531); $\Phi_M$ (503) that represents or correlates strongly to the actual angular position $\Phi_i$; $\Phi_i$ (531); $\Phi_i$ (501); $\Phi_i$ (503) of a downstream inking unit cylinder or printing unit cylinder 519; 531; 501; 503, in particular of the next inking unit cylinder or printing unit cylinder 519; 531; 503 downstream. Said drive 616, 711; 698, 712, acting as a slave, then follows the angular position signal determined by the angular position $\Phi_M$ of the downstream inking unit cylinder or printing unit cylinder 519; 531; 501; 503 in question, for example applying predefined rules. The term "downstream" refers here to the flow of ink in the printing unit or inking unit 500; 508.

The drive 616, 711; 698, 712 operated in this manner as a slave may be an aforementioned common drive 616, 711; 698, 712 for gravure inking cylinder and relief inking cylinder 512; 519, for example, which follows the actual angular position $\Phi_i$ (531); $\Phi_i$ (501); $\Phi_i$ (503) of a downstream inking unit cylinder or printing unit cylinder 531; 501; 503, preferably the next such cylinder downstream.

Preferably, however, the gravure inking cylinder 512 is provided with its own dedicated drive 616, 711 which, as a slave, follows the actual angular position $\Phi_i$ (519); $\Phi_i$ (531); $\Phi_i$ (503) of a downstream inking unit cylinder or printing unit cylinder 519; 531; 501; 503, preferably the next such cylinder downstream, in particular that of the relief inking cylinder 519. In a particularly advantageous embodiment, the relief inking cylinder 519 is also provided with its own dedicated drive 698, 712 which, as a slave, follows the actual angular position $\Phi_i$ (531); $\Phi_i$ (503) of a downstream inking unit cylinder or printing unit cylinder 531; 501; 503, preferably the next such cylinder downstream, in particular that of the forme cylinder 503 or that of the preferably provided transfer cylinder 531.

To form the respective drive control loop and/or to furnish a master signal for an upstream inking unit cylinder 531; 519; 512, a sensor system 721; 722; 723, e.g. an angular position sensor 721; 722; 723, or rotary encoder 721; 722; 723 for short, which indirectly or directly senses the actual angular position $\Phi_i$ (512); $\Phi_i$ (519); $\Phi_i$ (531); $\Phi_i$ (503) of the inking unit cylinder or printing unit cylinder 519; 531; 501; 503 is operatively connected to the inking unit cylinder or printing unit cylinder 519; 531; 501; 503 in question. This sensor system 721; 722; 723 may be formed by the rotary encoder 721; 722; 723 that is part of the drive control loop, e.g. as a rotary encoder internal to the motor, or as an encoder attachment that is connected, e.g. with its rotor for conjoint rotation to the relevant inking unit cylinder or printing unit cylinder 519; 531; 501; 503 or the motor shaft, or by an additional rotary encoder 721; 722; 723 that is functionally connected, e.g. with its rotor for conjoint rotation or positively co-rotating with the relevant inking unit cylinder or printing unit cylinder 519; 531; 501; 503 or the motor shaft.

An actual target angular position $\Phi_S$; $\Phi_S$ (512); $\Phi_S$ (519); $\Phi_S$ (531); $\Phi_S$ (503) that is to be followed by the respective inking unit cylinder or printing unit cylinder 512; 519; 531; 503 may be determined directly by the angular position $\Phi_M$ (L); $\Phi_M$ (519); $\Phi_M$ (531); $\Phi_M$ (503) provided in each case at the input as the master, which is formed for all "coupled" drives 616, 711; 698, 712; 699, 713; 704, 714, for example, by the angular position $\Phi_M$ (L) determined by the master axis L, or by the actual angular position $\Phi_i$ (519); $\Phi_i$ (531); $\Phi_i$ (503) that results in the manner described above from an actual angular position $\Phi_i$ (519); $\Phi_i$ (531); $\Phi_i$ (503) of a downstream inking unit cylinder or printing unit cylinder 519; 531; 503.

Figure 37:
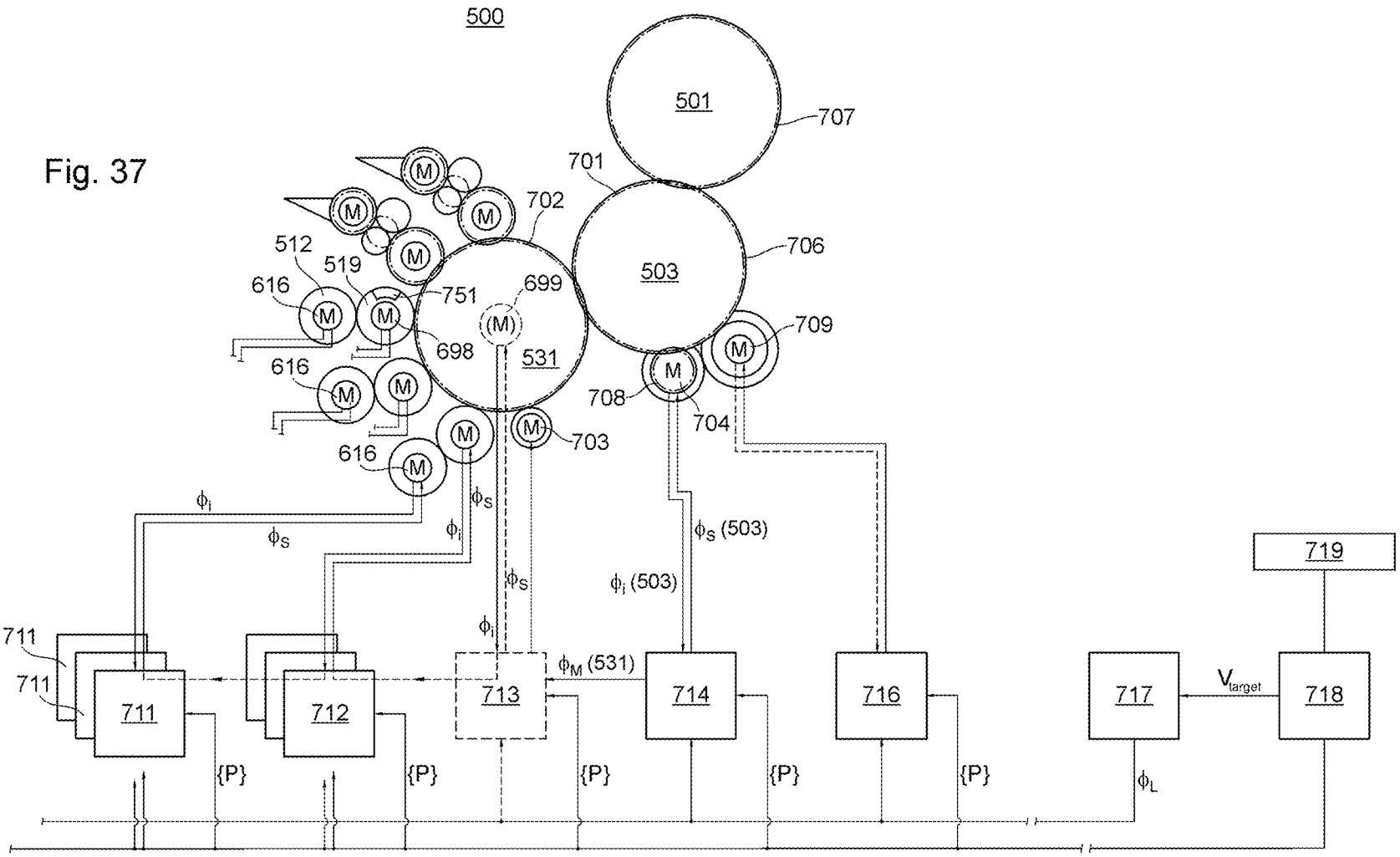
FIG. 37 a side view of a printing unit with schematically depicted drive means and with means for controlling and/or regulating the same.
Figure 38:
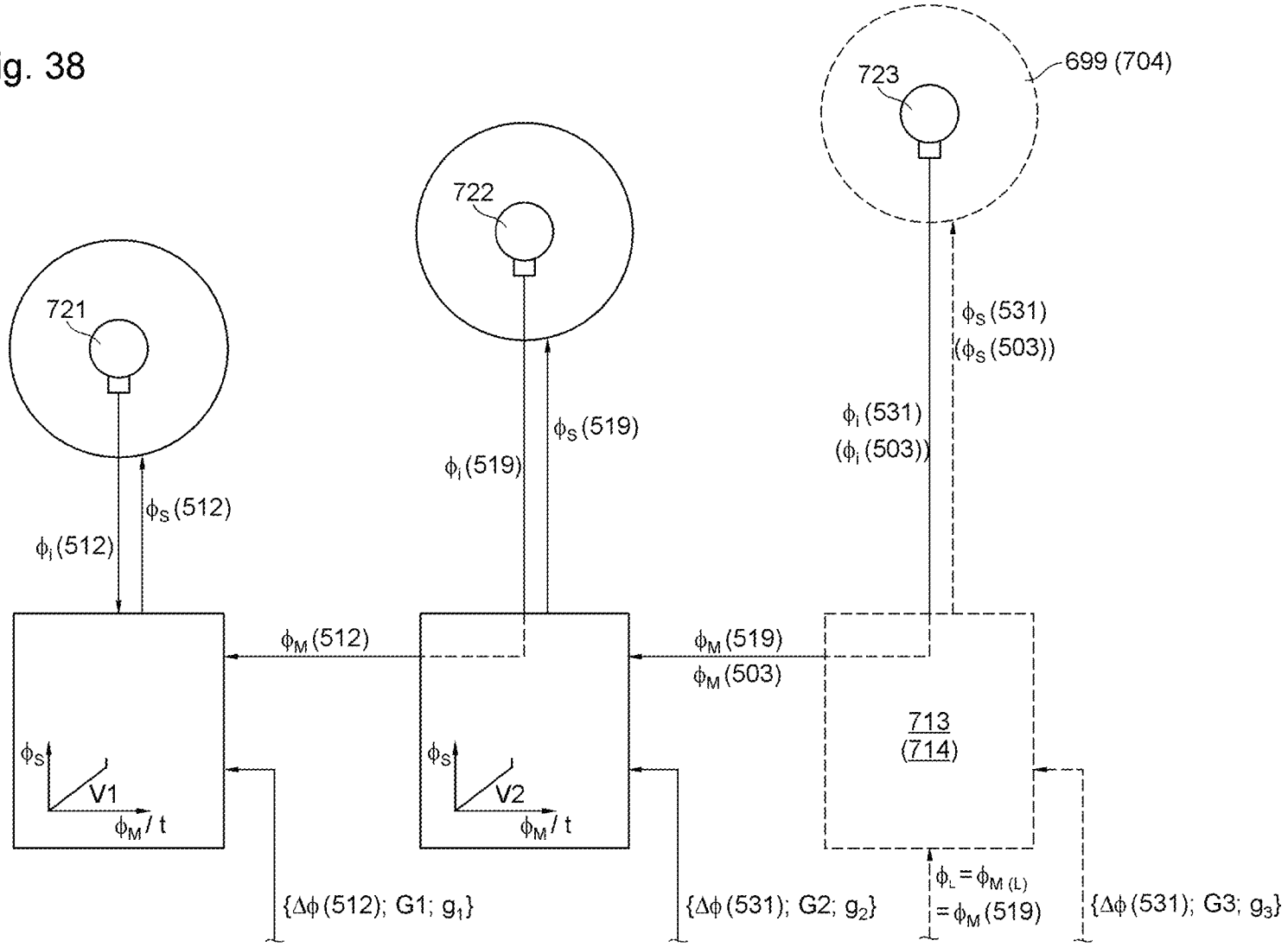
FIG. 38 a more detailed section from FIG. 37.

As indicated above, however, an actual target angular position $\Phi_S$ (512); $\Phi_S$ (519); $\Phi_S$ (503) can be adapted to circumstances in the press and/or varied to satisfy operating requirements by applying predetermined rules to the angular position $\Phi_M$ (L); $\Phi_M$ (519); $\Phi_M$ (531); $\Phi_M$ (503) supplied at the input as a master signal. For this purpose, corresponding parameters can be supplied, for example, which are denoted in their entirety in FIG. 37 by the symbol {P}.

Thus, parameters {P} that account for external conditions and/or relate to the operation of the drive 616, 711; 698, 712; 699, 713; 704, 714 or 709, 716 can be forwarded to the drives 616, 711; 698, 712; 699, 713; 704, 714 or 709, 716 involved in the drive system, in particular to the drive controllers 711; 712; 713; 714; 716, via the same first signal connection or via an additional signal connection, e.g. network connection. Such parameters {P} include, for example, information that may be required regarding a gear factor G1; G2; G3, which factors in e.g. the relative sizes of the respective inking unit cylinders or printing unit cylinders 519; 531; 501; 503 and/or the ratio between the rolling length of the inking unit cylinder or printing unit cylinder 519; 531; 501; 503 to be driven and the path length to be assumed for a full 360° rotation of the master axis L. In addition to or in place of this, a correction angle $\Delta\Phi$; $\Delta\Phi$ (512); $\Delta\Phi$ (519); $\Delta\Phi$ (531) may be included as a parameter, which is to be factored in, for example, as a correction of the circumferential register when forming the relevant target angular position $\Phi_S$ from the angular position $\Phi_M$ (L); $\Phi_M$ (519); $\Phi_M$ (531); $\Phi_M$ (503) supplied as the master.

In an advantageous embodiment, at least for the drive 616; 711 of the gravure inking cylinder 512, but particularly for the common or respective drive 616; 711; 698, 712 of the gravure inking cylinder 512 and of the relief inking cylinder 519, said drive is configured to compensate at least partially for a change in length of the printing forme 504 arranged on the forme cylinder 503 that occurs as a result of an at least temporary variation in the circumferential speed of the relevant inking unit cylinder 512; 519 in relation to the circumferential speed of the forme cylinder 503. Such elongations can typically result during a gravure printing production run, particularly in intaglio printing, due to the high contact forces acting in the printing couple.

For such a compensation, the drive 616; 711; 698, 712 is configured, for example, to drive the relevant inking unit cylinder 512; 519 based on a target angular position $\Phi_S$ (512); $\Phi_S$ (519) that has been cyclically modified in relation to the angular position $\Phi_M$ (L); $\Phi_M$ (519); $\Phi_M$ (531); $\Phi_M$ (503) supplied on the input side as the master. This modification is performed as described above, e.g. cyclically with the repeat length on the forme cylinder 503, i.e. with the circumference or with an $m^{th}$ part of the circumference on the forme cylinder 503.

Said modification is performed, for example, based on a rule V1; V2 that is stored and/or implemented in the relevant drive 616; 711; 698, 712 or particularly in its drive controller 711; 712, which rule can be parameterized, i.e. can in turn be varied, in terms of form and/or amplitude, for example, by using one or more variable parameters $g_1$; $g_2$, $g_3$, e.g. one or more parameters $g_1$; $g_2$, $g_3$ of a non-linear gearing function. A cycle length is determined, for example, by the $m^{th}$ part of a forme cylinder revolution, where m is equivalent to the number of print lengths or printing formes 504 provided one behind the other on the circumference of the forme cylinder 503, as explained above. The repeat length is calculated here e.g. from the starting point of printing of one printing length to the subsequent printing starting point and includes any gap to the next printing length that may exist, e.g. due to channels that may be provided for the printing forme ends on the forme cylinder 503 and/or for accommodating gripper bars on the impression cylinder 501.

Thus, in the drive controller 711 of the drive 711 that drives the first inking unit cylinder 512, a rule V1; V2 is implemented, by means of which a defined deviation from the situation without application of the rule V1; V2 is established, cyclically as viewed over a rolled-out length corresponding to one printing length of the first inking unit cylinder 512, from the target angular position $\Phi_S$ (512) resulting from the input-side master signal, and is returned to zero before the start of a new cycle. For example, through the modification as viewed over the printing length, an angle difference, e.g. a lag, in relation to the uncorrected synchronous angular position on the forme cylinder 503 is built up on the relevant inking unit cylinder 512; 519, in particular beginning at the starting point of printing and increasing steadily to the end point of printing, and said angle difference is corrected back to the synchronous angular position, e.g. forward, i.e. is returned to the synchronous relative position, e.g. by applying an excessive angular speed as compared with the printing speed, when the circumferential region that correlates to the cylinder channel on the forme cylinder 503 passes through the nip with the next inking unit cylinder or printing unit cylinder 519; 531; 503 downstream. In a preferred refinement, gravure inking cylinder 512 and forme cylinder 503 are in a synchronous relative position at the start of printing, however the angular speed is already at the slightly lower value for build-up of the lag.

A different process can also generally be provided for the modification. As an alternative, for example, an increasing lead beginning with the start of printing can be provided, which decreases to zero by the time a middle region of the printing length is reached, finally leading to an increasing lag. This deviation is returned to zero by the next printing start.

In an embodiment of the relief inking cylinder 519 in which said cylinder can be loaded with a finite relief inking forme, the ends of which are held in an axially extending channel 751 (in FIG. 37, for example, in the middle one of the five inking trains 529; 532, shown by way of example in FIG. 37), the aforementioned movement into the synchronous angular position to be maintained without the correction preferably takes place during the passage of this channel 751 through the nip that is formed between the two inking unit cylinders 512; 519 rolling against one another.

Generally independently of the specific position and/or specific configuration of the inking device 511, the embodiments and variants thereof, and/or the embodiments, forms, and variants set out above for the nature of the arrangement of the recesses 513 or engravings 513 on the gravure inking cylinder 512, the means to assist with the mounting of a sleeve 637 set out above, and/or the drive configuration set out above, but advantageously in conjunction with one of the aforementioned embodiments, forms, and variants of the same, a procedure for checking and/or adjusting and/or correcting the position, true to register with respect to the forme cylinder 503, of the gravure inking cylinder 512, in the following also to be used interchangeably in this context with the term the first inking unit cylinder 512, and/or of the relief inking cylinder 519, in the following also to be used interchangeably in this context with the term the first inking unit cylinder 512, is provided, and preferably is embodied as follows.

For checking and/or adjusting and/or correcting a relative position between the first inking unit cylinder 512 and the forme cylinder 503 in the circumferential direction and/or in the axial direction through the printing unit 500, at least one first image element 761; 762 that serves as a register mark is printed onto the substrate S. A checking and, if necessary, an adjustment and/or correction of the relative position between the first inking unit cylinder or gravure inking cylinder 512 and the forme cylinder 503, e.g. in the circumferential direction, in the axial direction, or preferably in both directions, is then carried out using the print result and/or the position of at least one first image element 761; 762 printed by the printing unit 500 onto the substrate S; S' and serving as a register mark.

Particularly preferably, the checking and automated adjustment and/or correction of a relative position in the circumferential direction and/or in the axial direction between the first and/or second inking unit cylinder 512 on the one hand and the forme cylinder 503 on the other hand and/or a checking of and compensation for a change in a print image length determined by the image-forming pattern on the forme cylinder 503, in particular an aforementioned elongation, is carried out using a first image element 761; 762; 766; 767 that is printed as a register mark onto the substrate by the printing unit 500. The drive 616, 711; 798 of the relevant inking unit cylinder 512; 519 is preferably configured for this purpose in accordance with an embodiment or variant set out above.

The first image element 761; 762 is or will be formed or printed, in particular with printing ink from a recess 514.1; 514.2 provided on the forme cylinder 503 in a defined position and location for checking the relative position, which recess overlaps on the forme cylinder 503 only partially with a projection, obtained by rolling, of one of at least two recesses 513.1; 513.3; 513.2; 513.4 provided in a defined position and location on the circumference of the first inking unit cylinder 512 for checking the relative position, and in this way is or has been inked only partially with printing ink.

The checking and/or adjustment and/or correction is preferably carried out using the aforementioned image element 761; 762 along with a second image element 763; 764 associated with the same test field $R_a$(512); $R_a'$(512); $R_a''$(512); $R_a'''$ (512); $R_a^*$(512); $R_u$(512); $R_u'$(512); $R_u''$(512); $R_u'''$(512); $R_u^*$(512) and serving as a reference mark, which second image element is printed onto the substrate S by the printing unit 500 and is formed by printing ink from a further recess 514.3; 514.4, which is provided on the forme cylinder 503 in a defined position and location for checking the relative position, and which overlaps on the forme cylinder 503 at least partially with a projection, obtained by rolling, of a second recess 513.1; 513.3; 513.2; 513.4 provided in a defined position and location on the circumference of the first inking unit cylinder 512 for checking the relative position, and in that way is or has been inked at least partially with printing ink. The checking and/or adjustment and/or correction is preferably carried out based on the at least one image element 761; 762 printed as test element 761; 762 and its position relative to the second image element 763; 764 associated with the same test field $R_a$(512); $R_a'$(512); $R_a''$(512); $R_a^*$(512); $R_u$(512); $R_u'$(512); $R_u''$(512); $R_u^*$(512) and likewise printed, as reference element 763; 764, onto the substrate S; S' by the same inking unit 508 and the forme cylinder 503 via the second recess 514.3; 514.4 on the forme cylinder 503.

Since they are used for checking or inspecting a relative position, the recesses 513.1; 513.3; 513.2; 513.4; 514.1; 514.3; 514.2; 514.4 provided for checking the relative position can also be referred to in this context, e.g. as inspection recesses 513.1; 513.3; 513.2; 513.4; 514.1; 514.3; 514.2; 514.4, to distinguish them from recesses 513; 514 that are involved (solely) in the print image.

In one embodiment, the test fields $R_a$(512); $R_a'$(512); $R_a''$(512); $R_a'''$(512); $R_a^*$(512); $R_u$(512); $R_u'$(512); $R_u''$(512); $R_u'''$(512); $R_u^*$(512) can be examined and evaluated by visual inspection, for example at a test console. In place of or in addition to this, the test fields can also be sensed via a sensor system 753, e.g. a camera 753, which is provided directly on the substrate path of the printing press for inline measurement or on the test console. An evaluation and optionally an output of a result, e.g. on a display device 754, e.g. a display or a screen, can then be implemented, for example, by means of software integrated into the sensor system 753 or into control means 756, e.g. a data processing device 756. In an advantageous refinement, an automatic correction of the relative position in the circumferential or the axial direction, also referred to above as a correction of the circumferential and the lateral register, can also be carried out via one or more corresponding signal connections 758 between data processing device 756 and the relevant drive means 616; 736. If the results are simply displayed, or if the inspection is carried out merely visually by a press operator, the press operator can perform the correction, e.g. via user interface 757 provided, e.g. at the control console, e.g. via mechanical or virtual buttons or keys.

The recesses 514.1; 514.3; 514.2; 514.4 provided on the forme cylinder 503 for checking the correct relative position may be integrated into the image-forming pattern of recesses 514 relating to the print image and defined there as such, or may also be outside of said region. In an embodiment that is advantageous in terms of the additional option of testing by visual inspection, said recesses 514.1; 514.3; 514.2; 514.4 provided on the forme cylinder 503 for checking the correct relative position lie within the printing width or substrate width, but outside of the region of those recesses 514 on the forme cylinder 503 that above are also combined by the image-forming pattern of recesses 514. In that case, the aforementioned image elements 761; 762; 763; 764 lie outside of the print image for the copy or copies $N_t$ to be printed, e.g. in columns and rows, in an edge region 752 of the substrate S.

The recesses 514.1; 514.3; 514.2; 514.4 provided on the forme cylinder 503 for checking the relative position each overlap at least partially with an aforementioned projection, obtained by rolling, of one of the at least two recesses 513.1; 513.3; 513.2; 513.4 provided on the circumference of the gravure inking cylinder 512 and designated for inspection.

The at least two recesses 514.1; 514.3; 514.2; 514.4 provided for inspection purposes on the forme cylinder 503 cooperate with the corresponding recesses 513.1; 513.3; 513.2; 513.4 on the first inking unit cylinder 512 to provide information as to the aforementioned relative position in the axial or the circumferential direction.

In the following, two particularly advantageous embodiments for this cooperation will be presented.

In the first embodiment, at least one linear, e.g. rectilinear when rolled out (i.e. rolled out on a plane), recess 514.1; 514.2, e.g. inspection recess 514.1; 514.2, extending on the circumference of the forme cylinder 503, e.g. outside of the image-forming pattern, and an associated linear or strip-like, e.g. rectilinear when rolled out, recess 513.1; 513.2, e.g. inspection recess 513.1; 513.2, extending on the circumference of the first inking unit cylinder 512 are provided such that a projection of the associated recess 513.1; 513.2 extending on the gravure inking cylinder 512, obtained on the forme cylinder 503 via the respective rolling in pairs of the inking unit cylinders 512; 519; 531 involved in ink transport, intersects with the recess 514.1; 514.2 extending on the forme cylinder 503 and is narrower, as viewed in the region of intersection or overlap in the direction of the linear recess 514.1; 514.2 on the forme cylinder 503, than the length of said recess 514.1; 514.2 on the forme cylinder 503. In a preferred, likewise linear embodiment of the recess 513.1; 513.2 provided on the gravure inking cylinder 512, the projection, obtained on the forme cylinder 503, of the recess 513.1; 513.2 extending on the gravure inking cylinder 512 extends at an angle relative to the recess 514.1; 514.2 extending on the forme cylinder 503 and intersects the same. The linear recesses 513.1; 513.2; 514.1; 514.2 and projections preferably extend perpendicular to one another as viewed in the rolled out state.

The recess 514.1; 514.2 on the forme cylinder 503 is significantly longer, e.g. at least twice as long as the width of the corresponding recess 513.1; 513.2 on the gravure inking cylinder 512 or the projection of the same.

In that case, an image element 761; 762 is formed as test element 761; 762 on the substrate S; S', e.g. by means of printing ink, which is picked up in the region of overlap or intersection of the recess 514.1; 514.2 extending linearly on the circumference of the forme cylinder 503 and the projection of a recess 513.1; 513.2 extending on the circumference of the first inking unit cylinder 512, obtained via the respective rolling in pairs of the inking unit cylinders 512; 519; 531 involved in ink transport, and is transferred to the substrate S; S' during printing. The recess 513.1; 513.2 on the first, i.e. the gravure inking cylinder 512 and the projection of said recess is preferably likewise linear e.g. rectilinear when rolled out, and extends at an angle to the recess 514.1; 514.2 on the forme cylinder 503.

The printing ink for the test elements 761, 762 can generally be transferred from the gravure inking cylinder 512 via a planar surface of a downstream inking unit cylinder, but preferably via elevations 524.1; 524.2 that correspond to the recesses 513.1; 513.2 or via one or more corresponding raised areas 522.1; 522.2 of a relief inking cylinder 519.

Where not explicitly otherwise specified, the term "linear" is understood to refer here to lines that have narrow line widths, but also to strip-like lines having greater line widths, with the length particularly being greater than the width in each case. Although in a preferred embodiment of the "linear" recess or elevation the thickness of the line is constant over its length, in the broadest sense this embodiment could also include wedge-like structures.

In that case, the checking and, if necessary, the adjustment and/or correction of the relative position between the gravure inking cylinder 512 and the forme cylinder 503 in the axial direction and/or in the circumferential direction is carried out based on at least one image element 761; 762 printed as test element 761; 762 in the aforementioned manner onto the substrate S; S' by means of the inking unit 508 and the forme cylinder 503 via a recess 514.1; 514.2 on the forme cylinder 503 and the position of said image element relative to an image element 763; 764 associated with the same test field $R_a$(512); $R_a$'(512); $R_a$"(512); $R_a$*(512); $R_u$(512); $R_u$'(512); $R_u$"(512); $R_u$*(512) and likewise printed, as reference element 763; 764, on the substrate S; S' by means of the inking unit 508 and the forme cylinder 503 via another recess 514.3; 514.4, e.g. reference recess 514.3; 514.4, on the forme cylinder 503 (see, e.g. FIGS. 39, 40, 41, 43, and 44).

Figure 39:
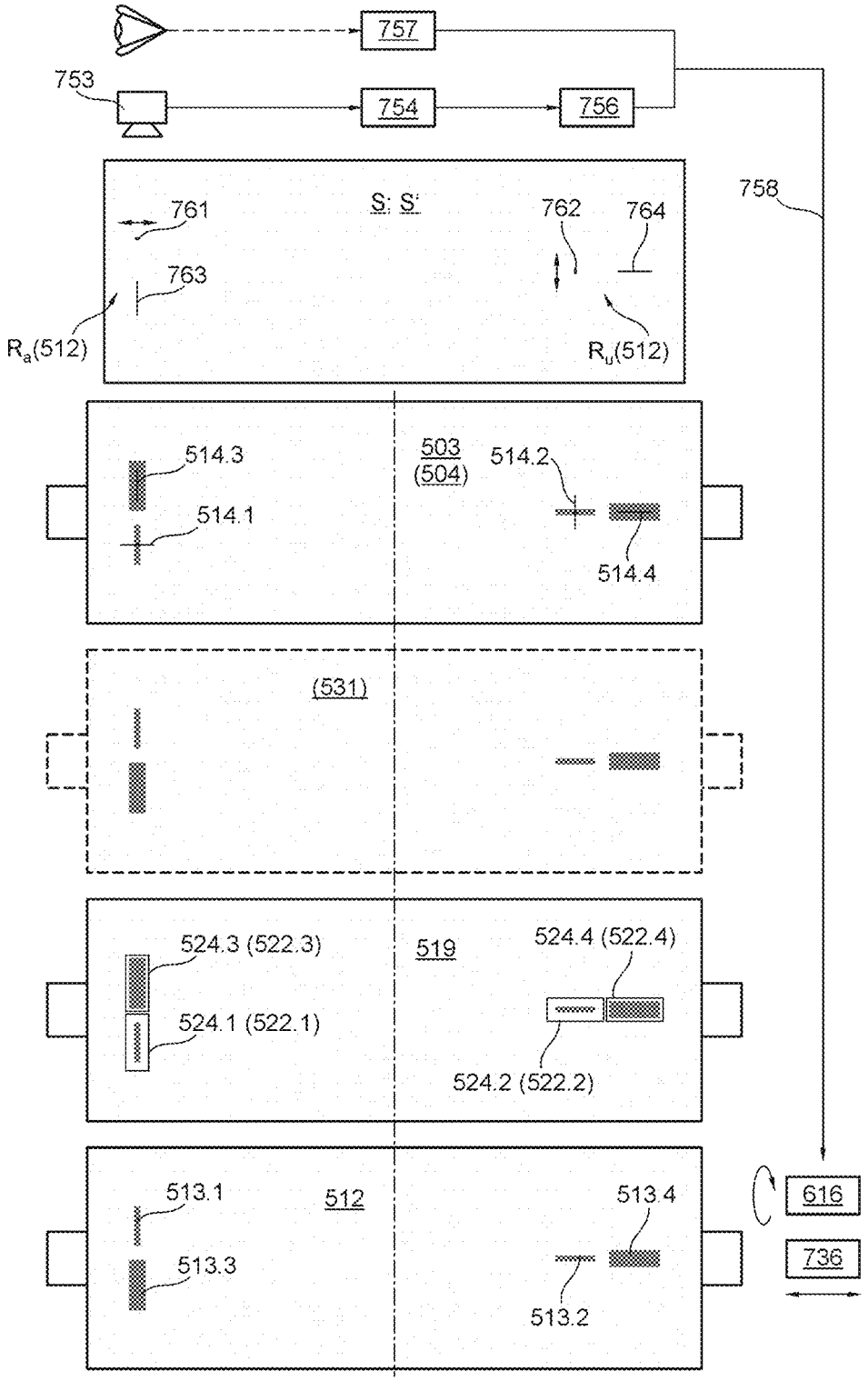
FIG. 39 a schematic illustration depicting the concept for checking and, if necessary, adjusting or correcting the relative position of gravure inking cylinder and forme cylinder.
Figure 40:
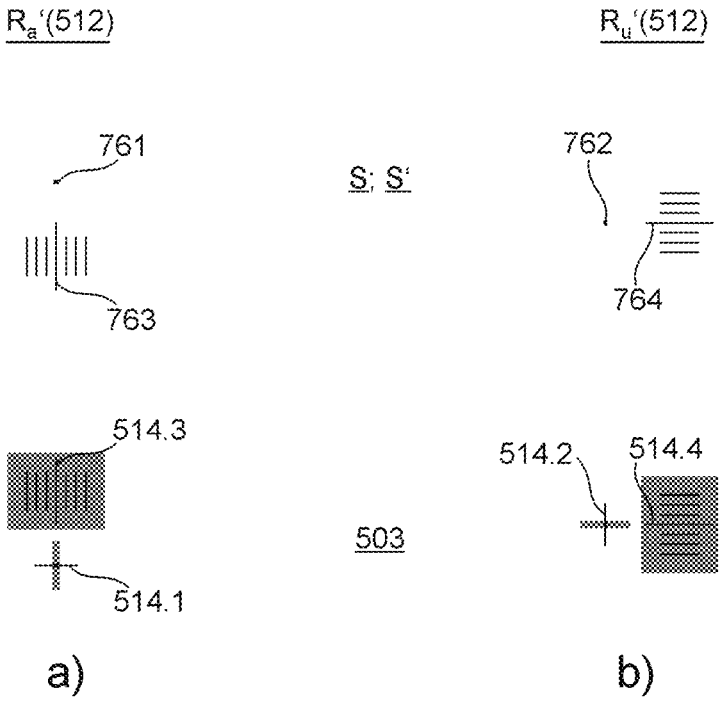
FIG. 40 a second configuration of test fields for checking and, if necessary, adjusting or correcting the relative position of gravure inking cylinder and forme cylinder, a) in the axial direction and b) in the circumferential direction.
Figure 41:
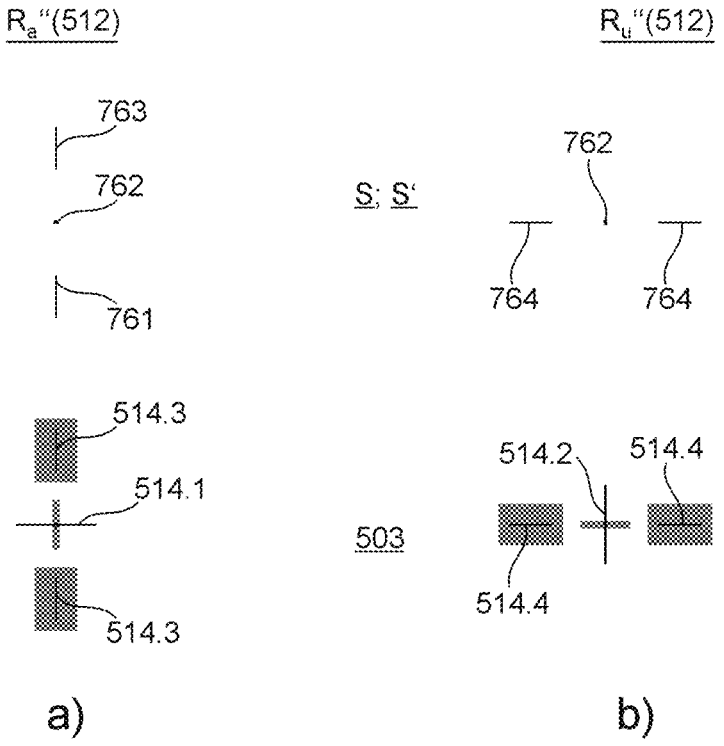
FIG. 41 a third configuration of test fields for checking and, if necessary, adjusting or correcting the relative position of gravure inking cylinder and forme cylinder, a) in the axial direction and b) in the circumferential direction.

In this first embodiment, the recess 514.1; 514.2 on the forme cylinder 503 and the projection of the corresponding recess 513.1; 513.2 on the gravure inking cylinder 512, which are associated with the test element 761; 762, thus overlap only partially, in particular at an intersection point or segment. The position of the overlap or the point of intersection supplies the information on the position of the gravure inking cylinder 512. In FIG. 39, the method of operation is depicted, e.g. schematically using the example of a printing unit 500 comprising an ink collecting cylinder 531, however this may be applied accordingly to a printing unit 500 without an ink collecting cylinder 531. In the latter case, the recesses 514.1; 514.2; 514.3, 514.4 and ink impressions on the forme cylinder 503, indicated schematically as each rolling off in pairs, and the image elements 761; 762; 763; 764 on the substrate S; S' would need to be provided mirrored horizontally to the illustration in FIG. 39.

In a variant that is advantageous in particular with respect to better measurement accuracy (see, e.g. the three-fold configuration in FIGS. 43 and 44), a group of test elements 761; 762 spaced a defined distance from one another in the same test field $R_a$(512); $R_a'$(512); $R_a''$(512); $R_a^*$(512); $R_u$(512); $R_u'$(512); $R_u''$(512); $R_u^*$(512) is or will be formed on the substrate S; S' by means of printing ink, which is picked up in the recess 514.1; 514.2 of the forme cylinder 503, in the area of intersection of a recess 514.1; 514.2 extending linearly on the circumference of the forme cylinder 503 and the projections, extending at an angle thereto, of a group of recesses 513.1; 513.2 preferably extending linearly on the circumference of the first inking unit cylinder 512, said projections being obtained on the forme cylinder 503 via the respective rolling in pairs of the inking unit cylinders 512; 519; 531 involved in the transport of ink, and which printing ink is transferred to the substrate S; S' during printing. Here again, the preferably linear projection preferably extends perpendicular to the recess 514.1, 514.2 on the forme cylinder 503, as viewed in the unrolled state.

The at least one test element 761; 762 along with the reference element 763; 764, which is different from said test element, in the same test field $R_a$(512); $R_a'$(512); $R_a''$(512); $R_a^*$(512); $R_u$(512); $R_u'$(512); $R_u''$(512); $R_u^*$(512) are preferably printed during production operation, together with the image motif or print image of the copy or copies $N_i$ to be printed, via the inking unit 508 and the forme cylinder 503, onto the substrate S; S', preferably outside of the copy or copies $N_i$ of the substrate S; S' to be produced, for example in a lateral edge region 752 surrounding the print image of the copy or copies $N_i$ on the leading side or the trailing side. This enables an inspection to be carried out during production operation, e.g. in a simplified manner by visual inspection.

In the particularly advantageous embodiment specifically described here (see, e.g. FIGS. 39, 40, 41, 43 and 44), a test element 761 relating to the axial relative position between the gravure inking cylinder 512 and the forme cylinder 503 is or will be formed by means of printing ink, which is picked up in the recess 514.1 of the forme cylinder 503, in the area of intersection of the recess 514.1 extending linearly in the axial direction on the circumference of the forme cylinder 503 and a projection of a recess 513.1 extending linearly in the circumferential direction on the circumference of the first inking unit cylinder 512, obtained on the forme cylinder 503 by the rolling in respective pairs of the inking unit cylinders 512; 519; 531 involved in the ink transport, which printing ink is then transferred during printing to the substrate S; S'. This can be applied accordingly to the embodiment having the projections of a plurality of recesses 513.1 extending linearly in the circumferential direction on the circumference of the first inking unit cylinder 512 for generating a plurality of test elements 761.

In the particularly advantageous embodiment specifically described here, a test element 762 relating to the relative position in the circumferential direction is or will be formed by means of printing ink, which is picked up in the recess 514.2 of the forme cylinder 503, in the area of intersection of the recess 514.2 extending linearly in the circumferential direction on the circumference of the forme cylinder 503 and a projection of a recess 513.1; 513.2 extending linearly in the axial direction on the circumference of the first inking unit cylinder 512, obtained on the forme cylinder 503 by the rolling in respective pairs of the inking unit cylinders 512; 519; 531 involved in the ink transport, which printing ink is then transferred during printing to the substrate S; S'. This can be applied accordingly to the embodiment having the projections of a plurality of recesses 513.2 extending linearly in the circumferential direction on the circumference of the first inking unit cylinder 512 for generating a plurality of test elements 762.

Figure 42:
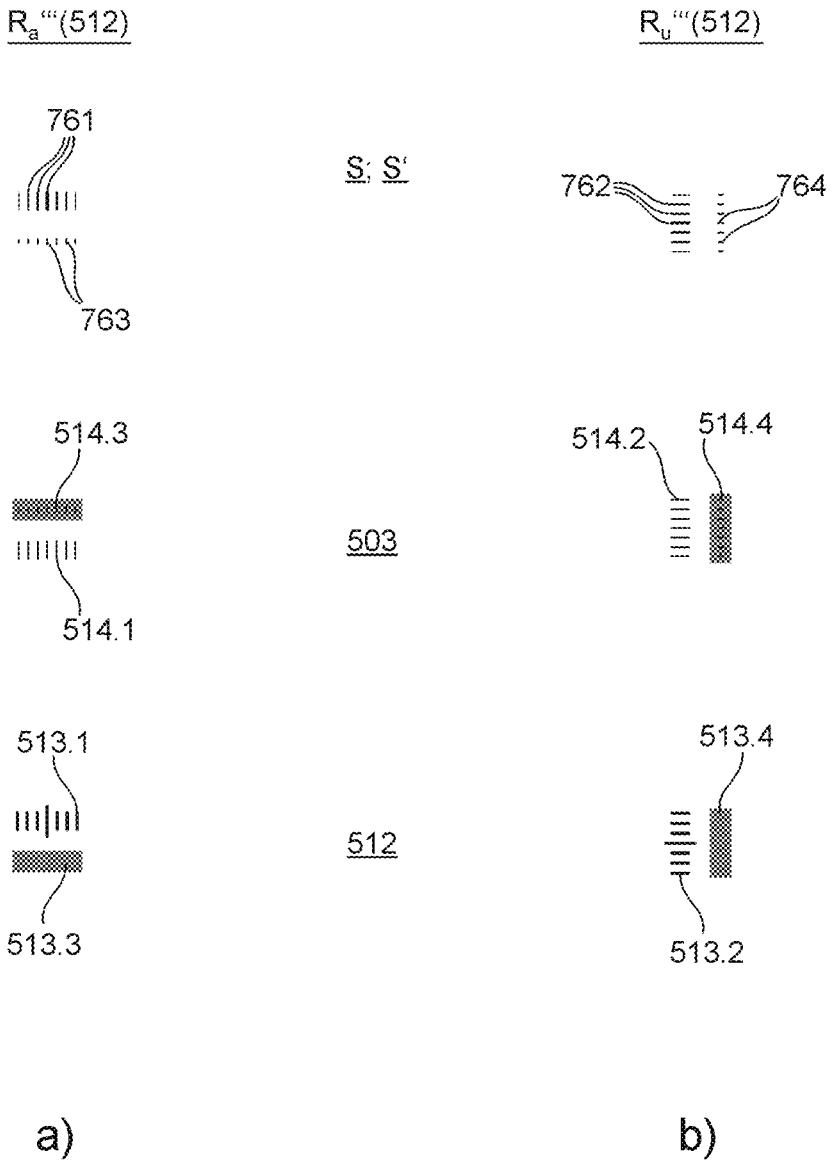
FIG. 42 a fourth configuration of test fields for checking and, if necessary, adjusting or correcting the relative position of gravure inking cylinder and forme cylinder, a) in the axial direction and b) in the circumferential direction.

In a second embodiment, on the forme cylinder 503 a group of linear recesses 514.1; 514.2, e.g. at least 10, in particular at least 20, side by side in the axial direction or in the circumferential direction and spaced evenly from one another by a first distance, are provided on the forme cylinder 503 outside of the image-forming pattern, and on the circumference of the gravure inking cylinder 512 a group of linear second recesses 513.1; 513.2, e.g. at least 10, in particular at least 20, spaced evenly from one another by a first distance, are provided such that the alignment of the linear recesses 514.1; 514.2; 513.1; 513.2 on the respective inking unit cylinder or forme cylinder 512; 503 is the same and/or such that the second distance between the adjacent recesses 513.1; 513.2 on the gravure inking cylinder 512 deviates from the first distance slightly, i.e. by less than a line width of the recesses 514.1; 514.2 on the forme cylinder 503, and/or in that projections of the recesses 513.1; 513.2 extending on the first inking unit cylinder 512, obtained on the forme cylinder 503 by the rolling in respective pairs of the inking unit cylinders 512; 519; 531 involved in the ink transport, overlap at least partially with recesses 514.1; 514.2 lying outside of the image-forming pattern on the forme cylinder 503 (see e.g. FIG. 42). In that case, the checking and, if necessary, the adjustment and/or correction is performed based on a print result from the first group of linear recesses 514.1; 514.2 on the forme cylinder 503, side by side in the axial direction or in the circumferential direction and spaced evenly from one another by a first distance, which overlap at least partially with the group of projections of the second group of linear recesses 513.1; 513.2 provided on the circumference of the gravure inking cylinder 512, which are obtained on the forme cylinder 503 by the rolling in respective pairs of the inking unit cylinders 512; 519; 531 involved in the ink transport.

In this second embodiment, the information about the relative position between the first inking unit cylinder 512 and the forme cylinder 503 is or will be determined from a varying intensity in the coloring of the linear image elements 761 printed by the recesses 514.1; 514.2 on the forme cylinder 503, which results from the varying overlap of these recesses 514.1; 514.2 with the projections of the recesses 513.1; 513.2 on the gravure inking cylinder 512. The correct relative position between the first inking unit cylinder 512 and the forme cylinder 503 is then fixed or determined at the position of a characteristic over the course of this fluctuating intensity, preferably at the position of a maximum or a minimum, relative to a reference element 763; 764 of the same test field $R_a'''$ (512); $R_u'''$(512) that is also printed. This second embodiment is based on an optical impression similar to the moiré effect, which makes moving maxima and minima of a long-period intensity modulation visible due to a changing overlap of two line rasters that have slightly different line spacing.

In one advantageous variant, the groups of first and second recesses 514.1; 514.2; 513.1; 513.2 are arranged relative to one another such that in the correct relative position of the forme cylinder and gravure inking cylinder 503; 512 in the axial or circumferential direction, a maximum overlap between the first recesses 514.1; 514.2 on the forme cylinder 503 and the projection of the second recesses 513.1; 513.2 lies in a middle region of the group, i.e. at least within the middle one-third of the respective group. With this variant, an assessment can be made without a reference using only the human eye and/or a defect area can be represented on both sides.

In the advantageous embodiment described here, the linear recesses 513.1; 513.2, 514.1; 514.2 of the first and second groups relating to the axial relative position are each arranged side by side in the axial direction and extend with their longitudinal extension in the circumferential direction. The linear recesses 513.1; 513.2, 514.1; 514.2 of the first and second groups relating to the relative position in the circumferential direction are each arranged side by side in the circumferential direction and extend with their longitudinal extension in the axial direction.

Independently of the specific arrangement of the pairs of recesses 513.1; 513.2, 514.1; 514.2 on which the test elements 761; 762 are based, a respective reference element 763; 764 is or will be formed on the substrate S; S' by means of printing ink, which is picked up in a recess 514.3; 514.4 provided at a defined location on the circumference of the forme cylinder 503 and is transferred to the substrate S; S' during printing, wherein the gravure inking cylinder 512 comprises a recess 513.3; 513.4, e.g. a reference recess 513.3; 513.4, the projection of which, obtained on the forme cylinder 503 via the rolling in respective pairs of the inking unit cylinders 512; 519; 531 involved in the ink transport, comes to rest over the recess 514.3; 514.4 that supplies the reference element 763; 764 on the forme cylinder 503. A recess 513.3 provided on the gravure inking cylinder 512 for checking the position in the axial direction and serving as a reference has an excess size, e.g. of more than 200 μm, as compared with the corresponding recess 514.3 on the forme cylinder 503 in the axial direction, and a recess 513.4 relating to the checking of the position in the circumferential direction has an excess size, e.g. of more than 200 μm, as compared with the corresponding recess 514.4 on the forme cylinder 503 in the circumferential direction. The respective excess size goes beyond an excess size of up to 200 μm, for example, optionally provided within the print image for the recess 513.3; 513.4 on the first inking unit cylinder 512, and is intended to ensure a reliable inking of the recess 514.3; 514.4 corresponding to the respective reference element 763; 764 on the forme cylinder 503 in the case of a faulty relative position to be corrected.

The printing ink for said reference elements 763, 764 can generally be transferred from the gravure inking cylinder 512 via a planar surface of a subsequent inking unit cylinder, but is preferably transferred via elevations 524.3; 524.4 corresponding to the recesses 513.3; 513.4 or via one or more corresponding raised areas 522.3; 522.4 of a relief inking cylinder 519.

Only a single reference element 763; 764 generated via a correspondingly configured recess 514.3; 514.4 on the forme cylinder 503 may be assigned to the respective test field $R_a$(512); $R_a$'(512); $R_a$"(512); $R_a$'"(512); $R_a$*(512); $R_u$(512); $R_u$'(512); $R_u$"(512); $R_u$'"(512); $R_u$*(512) (see, e.g., FIGS. 39 and 41). In another embodiment, which is advantageous in terms of an evaluation conducted, e.g. by visual inspection, a group of reference elements 761; 762, spaced a defined distance from one another and generated via corresponding, e.g. rectilinear, punctiform, or rectangular recesses 514.3; 514.4 on the forme cylinder 503, can be assigned as a type of scale to the test field $R_a$(512); $R_a$'(512); $R_a$"(512); $R_a$'"(512); $R_a$*(512); $R_u$(512); $R_u$'(512); $R_u$"(512); $R_u$'"(512); $R_u$*(512).

Preferably, both an aforementioned checking and, if necessary, adjustment and/or correction of an axial relative position via a first test field $R_a$(512; $R_a$'(512); $R_a$', (512); $R_a$"(512); $R_a$*(512) lying, in particular, in an edge region 752 outside of the copy or copies $N_i$ to be produced, and an aforementioned checking and, if necessary, adjustment and/or correction of a relative position in the circumferential direction via a second test field $R_u$ (512); $R_u$'(512); $R_u$"(512); $R_u$'"(512); $R_u$*(512) lying, in particular, in an edge region 752 outside of the copy or copies $N_i$ to be produced.

In a particularly advantageous refinement, a relative position in the circumferential direction is checked via two test fields $R_u$(512); $R_u$'(512); $R_u$"(512); $R_u$'"(512); $R_u$*(512) spaced apart in the direction of transport within a printing length on the substrate S; S'. In this way, e.g. with different positional deviations in the two test fields $R_u$(512); $R_u$'(512); $R_u$"(512); $R_u$'"(512); $R_u$*(512) a periodic variation of the circumferential speed of the first inking unit cylinder 512 compared to that of the forme cylinder 503 to compensate a change in length of a printing forme 504 provided on the forme cylinder 503, in particular in correlation to the extent of the difference, can be made from the respective target position. With a positional deviation in the two test fields $R_u$(512); $R_u$'(512); $R_u$"(512); $R_u$'"(512); $R_u$*(512) from the respective target position, a change can be made in the relative angular position between the first inking unit cylinder 512 and the forme cylinder 503, in particular in correlation to the dimensions of the same amount of deviation in two test fields $R_u$(512); $R_u$'(512); $R_u$"(512); $R_u$'"(512); $R_u$*(512).

For an embodiment of the printing unit 500 set out above having multiple inking trains 529; 532, in which partial print images inked simultaneously by the forme cylinder 503 via multiple gravure inking cylinders 512 are printed onto the substrate S; S', a test field $R_a$(512); $R_a$'(512); $R_a$"(512); $R_a$'"(512); $R_a$*(512); $R_u$(512); $R_u$'(512); $R_u$"(512); $R_u$'"(512); $R_u$*(512) relating to the axial or the circumferential direction preferably comprises, for each selective inking train 529, at least one image element 761; 761'; 762; 762' configured as a test element 761; 761'; 762; 762' or a group of multiple test elements 761; 761'; 762; 762' according, e.g., to the above first embodiment (see, e.g., FIGS. 43 and 44, in which, by way of example, only two of the five groups of test elements shown there are denoted as 761 and 761' or as 762 and 762'). For example, one test element 761; 761'; 762; 762' or a group of multiple test elements 761; 761'; 762; 762' is or will be printed by each of the provided, in particular selective inking trains 529; 532 or gravure inking cylinders 512 of a printing unit 500 configured, e.g. as a multicolor printing unit 500. The underlying recesses 513.1; 513.2; 514.1; 514.2 are preferably arranged on the gravure inking cylinders 512 and on the forme cylinder 503 in such a way that the test elements 761; 761' relating to the axial position are aligned with one another in the direction of the printing length when the gravure inking cylinders 512 are in the correct position relative to one another, and the test elements 762; 762' relating to the position in the circumferential direction are aligned with one another on the substrate S; S' in the direction of the printing width when the gravure inking cylinders 512 are in the correct position relative to one another. With respect to a viewing of the respective gravure inking cylinder 512 toward the forme cylinder 503, the test elements 761; 761'; 762; 762' act as a type of register mark 761; 761'; 762; 762', whereas in a consideration of the position of the gravure inking cylinders 512 relative to one another said test elements act as what are known as register marks 761; 761'; 762; 762', also referred to as color register marks 761; 761'; 762; 762'.

Thus, the position of the test elements 761; 761'; 762; 762' or groups of test elements 761; 761'; 762; 762' relative to one another in a test field $R_a$(512); $R_a$'(512); $R_a$"(512); $R_a$'"(512); $R_a$*(512); $R_u$(512); $R_u$'(512); $R_u$"(512); $R_u$'"(512); $R_u$*(512), which are inked via the various gravure inking cylinders 512, are used to check information about the register, i.e. the position of the gravure inking cylinders 512 relative to one another, and the relative position between at least one test element 761; 761'; 762; 762' inked via at least one assigned gravure inking cylinder 512 and at least one reference element 763; 764 to be associated with the same test field $R_a$(512); $R_a$'(512); $R_a$"(512); $R_a$'"(512); $R_a$*(512); $R_u$(512); $R_u$'(512); $R_u$"(512); $R_u$'"(512); $R_u$*(512) is used to check the relative position between the relevant gravure inking cylinder 512 and the forme cylinder 503.

For a test field $R_a$(512); $R_a$'(512); $R_a$"(512); $R_a$'"(512); $R_a$*(512); $R_u$(512); $R_u$'(512); $R_u$"(512); $R_u$'"(512); $R_u$*(512) that comprises the test elements 761; 761'; 762; 762' of multiple gravure inking cylinders 512, a single reference element 763; 764 may be provided. Preferably, however, multiple reference elements 763; 764 are provided, e.g. on different sides of the grouping of test elements 761; 761'; 762; 762', in particular at least one on each of the four sides of the grouping. The at least one reference element 763; 764 can then be applied via one of the gravure inking cylinders 512 involved.

Such a test field $R_a$(512); $R_a$'(512); $R_a$"(512); $R_a$'"(512); $R_a$*(512); $R_u$(512); $R_u$'(512); $R_u$"(512); $R_u$'"(512); $R_u$*(512) comprising multiple gravure inking cylinders 512 and including the reference element or elements 763; 764 can then have external dimensions that do not exceed a field of 6 mm×6 mm. In that case, the image elements 761; 761', 762, 762'; 763; 764 may be provided with line widths of 0.15 to 0.25 mm, preferably of approximately 0.20±0.01 mm, and/or distances between the test elements 761; 761'; 762; 762' of different gravure inking cylinders 512 of 0.45 to 0.55 mm, in particular of 0.5±0.01 mm.

Figure 45:
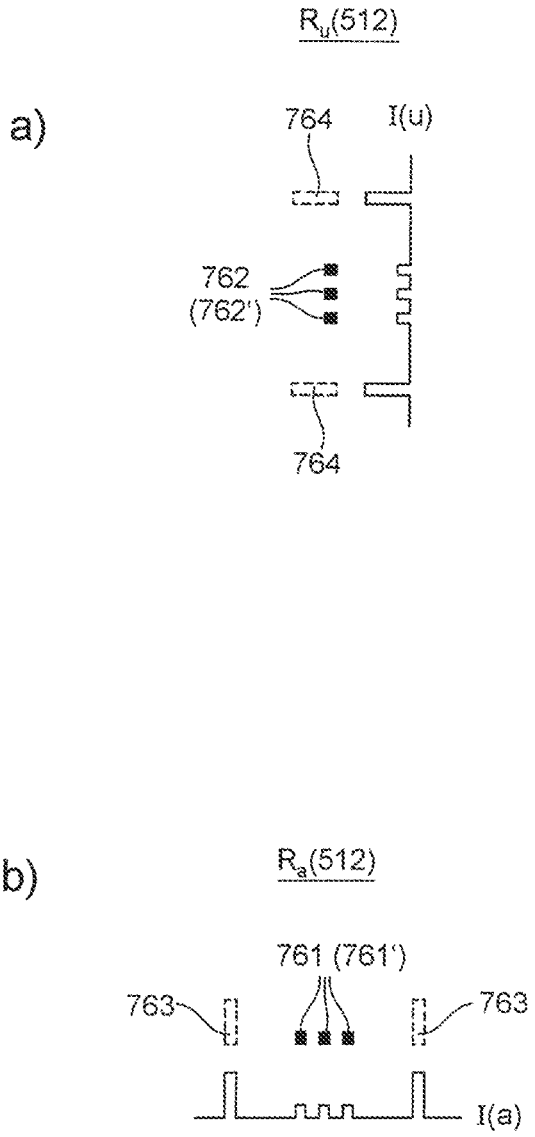
FIG. 45 a schematic representation of an intensity signal a) in the circumferential direction and b) in the axial direction.

By using a sensor system 753 operating inline in the press or offline at an inspection table, an intensity profile I(a); I(u), illustrated schematically by way of example in FIG. 45, is outlined via a group of test and reference elements 761; 761'; 762; 762' relating to the axial or the circumferential position.

In addition to the checking and/or adjustment and/or correction of the position of the gravure inking cylinder 512 set out above, a checking and/or adjustment and/or correction of a relative position between the second inking unit cylinder 519, i.e. the relief inking cylinder 519, and the forme cylinder 503 in the circumferential direction and/or in the axial direction is preferably also carried out. This is preferably conducted based on at least one image element 766; 767, printed as a test element 766; 767 onto the substrate S; S' via the inking unit 508 and the forme cylinder 503, and the position thereof relative to an image element 768; 769 associated with the same test field $R_a$(519); $R_a$*(519); $R_u$(519); $R_u$*(519) and likewise printed as a reference element 768; 769 on the substrate S; S' via the inking unit 508 and the forme cylinder 503 (see, e.g. FIG. 46).

The lower representations in FIGS. 40, 41, 42 and 43 each show a schematic depiction of the conditions before the excess ink is wiped off the non-engraved outer cylindrical surface.

In that case, e.g. the test element 766; 767 relating to the position of the second inking unit cylinder 519 is formed on the substrate S; S' by means of printing ink, which is picked up in a recess 514.6; 514.7 on the forme cylinder 503, in the area of overlap of said recess 514.6; 514.7 extending linearly on the circumference of the forme cylinder 503 with a projection of an area, inked by the gravure inking cylinders 512, of an elevation 524.6; 524.7 or raised area 522.6; 522.7 extending on the circumference of the second inking unit cylinder 519, which projection is shorter than said recess 514.6; 514.7 as viewed in its longitudinal direction and is obtained on the forme cylinder 503 via the rolling in respective pairs of the inking unit cylinders 512; 519; 531 involved in the ink transport, which printing ink is then transferred to the substrate S; S' during printing, wherein the elevation 524.6; 524.7 or the raised area 522.6; 522.7 is inked via a recess 513.6; 513.7 that is longer than the projection of said elevation 524.6; 524.7 or said raised area 522.6; 522.7 as viewed in the direction of the recess 514.6; 514.7 on the forme cylinder 503 (see, e.g. FIG. 46).

Here again, the at least one test element 766; 767 along with the reference element 768; 769 that is different from it are printed via the inking unit 508 and the forme cylinder 503 during production operation onto the substrate S; S', together with the image motif of the copy or copies $N_i$ to be printed.

The recess 514.6; 514.7 on the forme cylinder 503 that is associated with the test element 766; 767 and the projection of the corresponding elevation 524.6; 524.7 or raised area 522.6; 522.7 on the relief inking cylinder 519 overlap only partially, with the position of the overlap supplying the information about the position of the relief inking cylinder 519.

Since they are used for checking or inspecting a relative position, the elevations 524.6; 524.7; 524.8; 524.9 or raised areas 522.6; 522.7; 522.8; 522.9 provided for checking the relative position may also be referred to here, e.g., as test elevations 524.6; 524.7 or reference elevations 524.8; 524.9 or test areas 522.6; 522.7 or reference areas 522.8; 522.9 and also as inspection area 524.6; 524.7; 524.8; 524.9 or raised inspection areas 522.6; 522.7; 522.8; 522.9.

As already described for the test fields $R_a$(512); $R_a$'(512); $R_a$"(512); $R_a$'"(512); $R_a$*(512); $R_u$(512); $R_u$'(512); $R_u$"(512); $R_u$'"(512) relating to the gravure inking cylinder 512, in one embodiment the test fields $R_a$(519); $R_a$*(519); $R_u$(519); $R_u$*(519) can also be assessed and evaluated by visual inspection or detected by a sensor system 753, in the manner set out above, and forwarded to the display device and/or to a data processing device 754, from which resulting positioning commands can be forwarded via a signal connection 759 to corresponding drive means 698; 749 for automatic correction.

Here again, the elevations 524.6, 524.7, 524.8; 524.9 or areas 522.6, 522.7, 522.8; 522.9 provided for checking the correct relative position may lie within the print image width, but are preferably provided in an edge area 752 of the substrate S; S', outside of the region of the elevations 524 or areas 522 involved in the print image.

Figure 46:
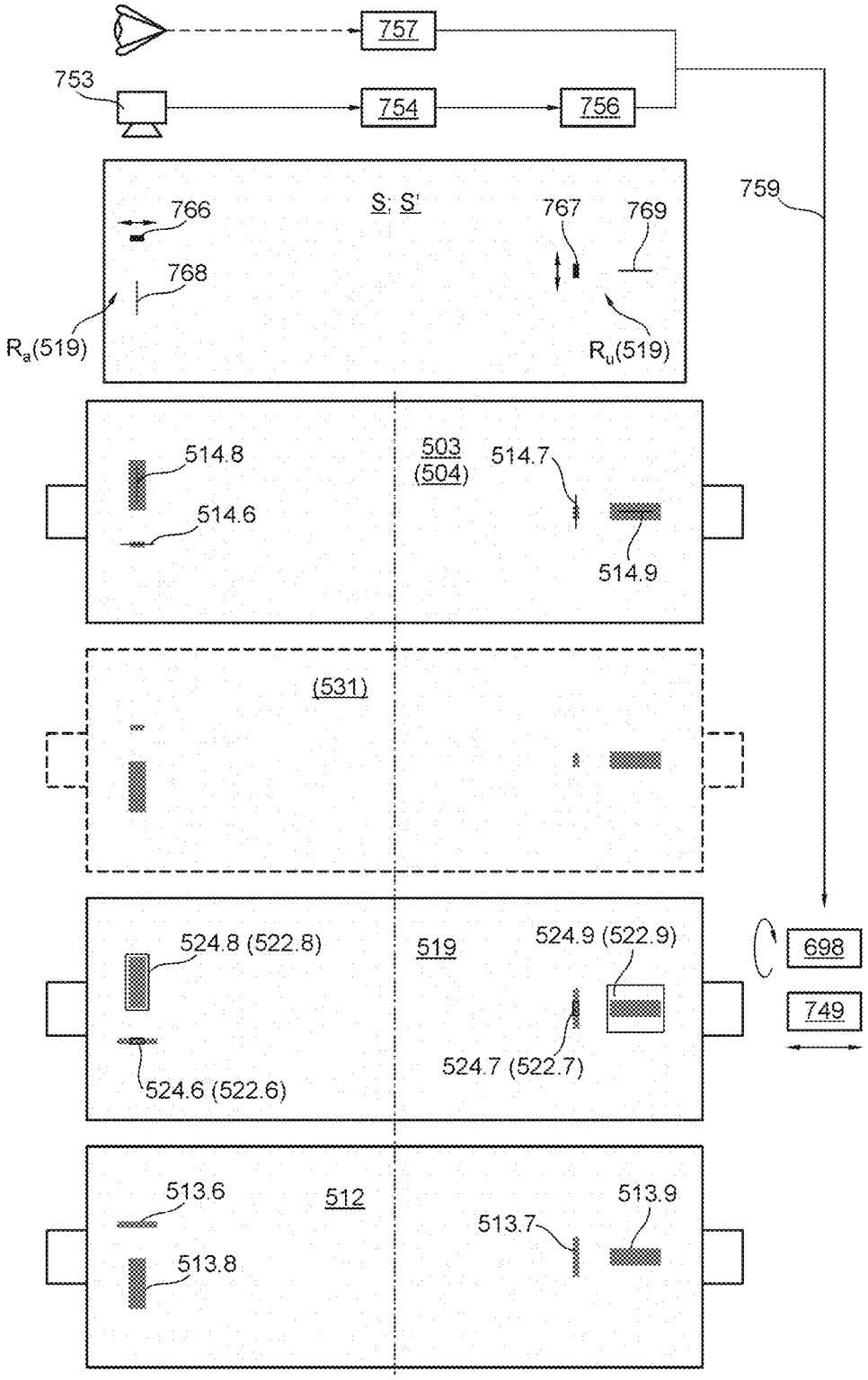
FIG. 46 a schematic illustration depicting the concept for checking and, if necessary, adjusting or correcting the relative position of relief inking cylinder and forme cylinder.

In the embodiment indicated schematically in FIG. 46, for each test field $R_a$(519); $R_u$(519) one test element 766; 767 relating to the axial direction and one test element relating to the circumferential direction are provided, along with a simple symbol assigned to each, for example in the form of a point, a line, or a rectangle, as a reference element 768; 769.

The respective elevations 524.8; 524.9 or raised area 522.8; 522.9 that serves a reference element 768; 769 is inked via a corresponding, preferably oversized recess 513.8; 513.9 on the gravure inking cylinder 512. The transfer to the substrate S; S' is carried out directly or indirectly by the same via corresponding recesses 514.8; 514.9 on the forme cylinder 503.

Figure 47:
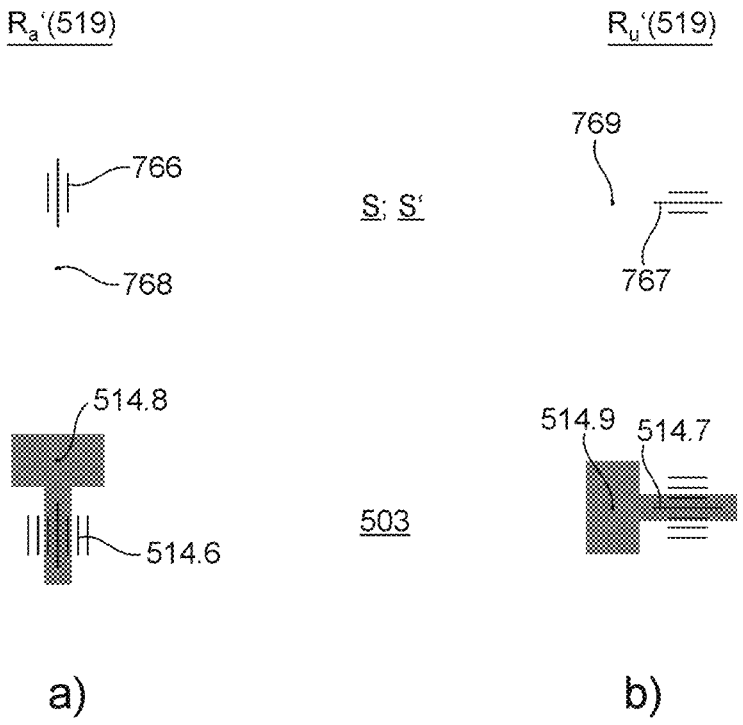
FIG. 47 a second configuration of test fields for checking and, if necessary, adjusting or correcting the relative position of gravure inking cylinder and forme cylinder, a) in the axial direction and b) in the circumferential direction.

In a second embodiment, which is advantageous in terms of the possibility of evaluation by visual inspection, a group of image elements 766; 767 spaced a defined distance from one another and generated via corresponding, e.g. rectilinear, punctiform, or rectangular first recesses 514.6; 514.7 on the forme cylinder 503, can be assigned to the test field $R_a$'(519); $R_u$'(519) as a type of scale (see, e.g. FIG. 47). To obtain information about the relative position, the scale or the group of recesses 514.6; 514.7 is or will be inked only in a section that is dependent on the position of the second inking unit cylinder 519, or depicted, after wiping, as a corresponding portion of the scale by a portion of the image elements 766; 767. In an embodiment that can be more readily automated, an image element 768; 769 that serves as a reference image element 768; 769 is simultaneously formed or printed via a corresponding recess 514.8; 514.9 on the forme cylinder 503. Said recess can be positioned, e.g. on the forme cylinder 503, opposite a target position lying, e.g. in the middle of the scale.

Figure 48:
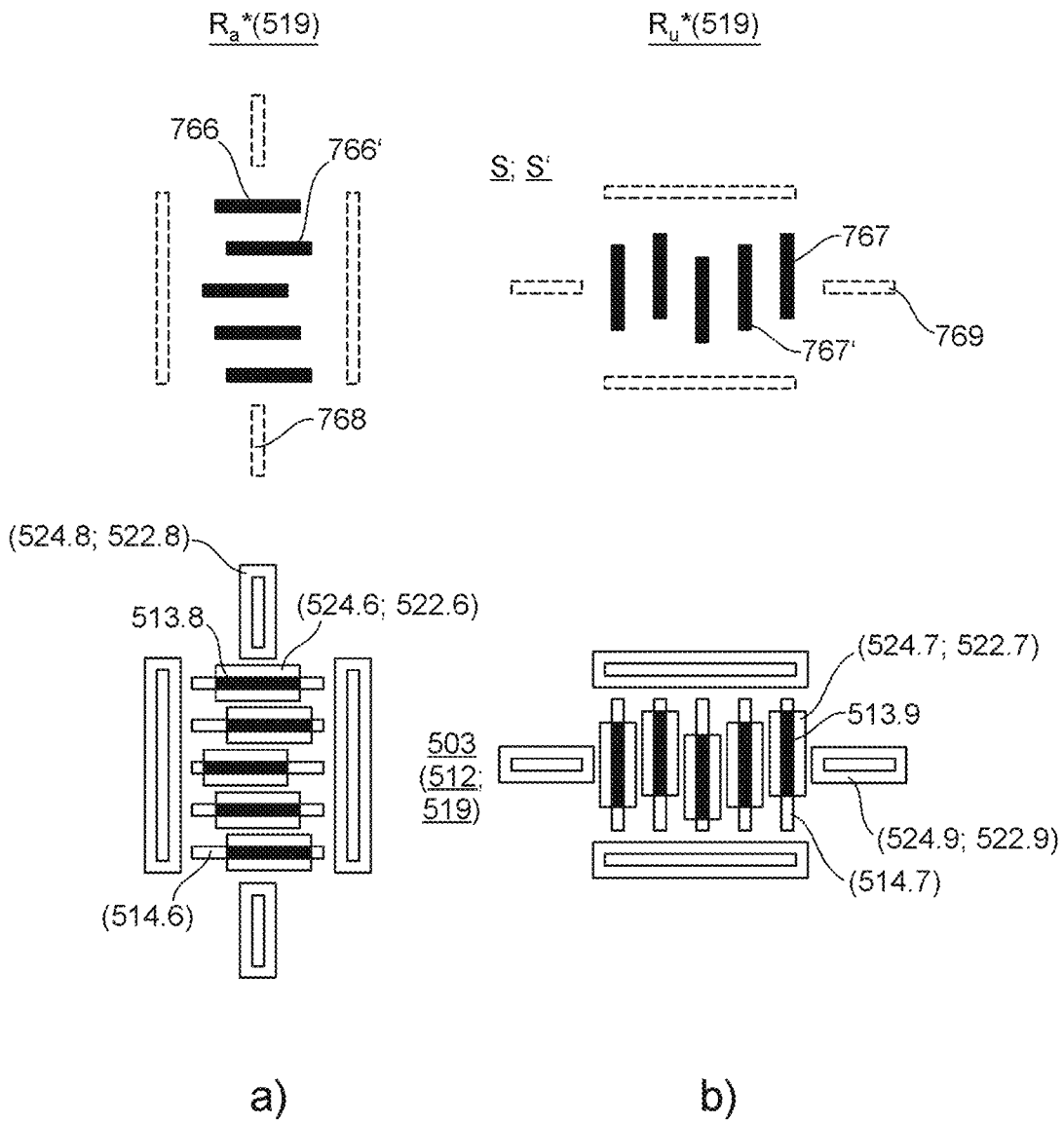
FIG. 48 a configuration of test fields for checking and, if necessary, adjusting or correcting the relative position of gravure inking cylinder and forme cylinder during printing via multiple inking trains a) in the axial direction and b) in the circumferential direction.
Figure 49:
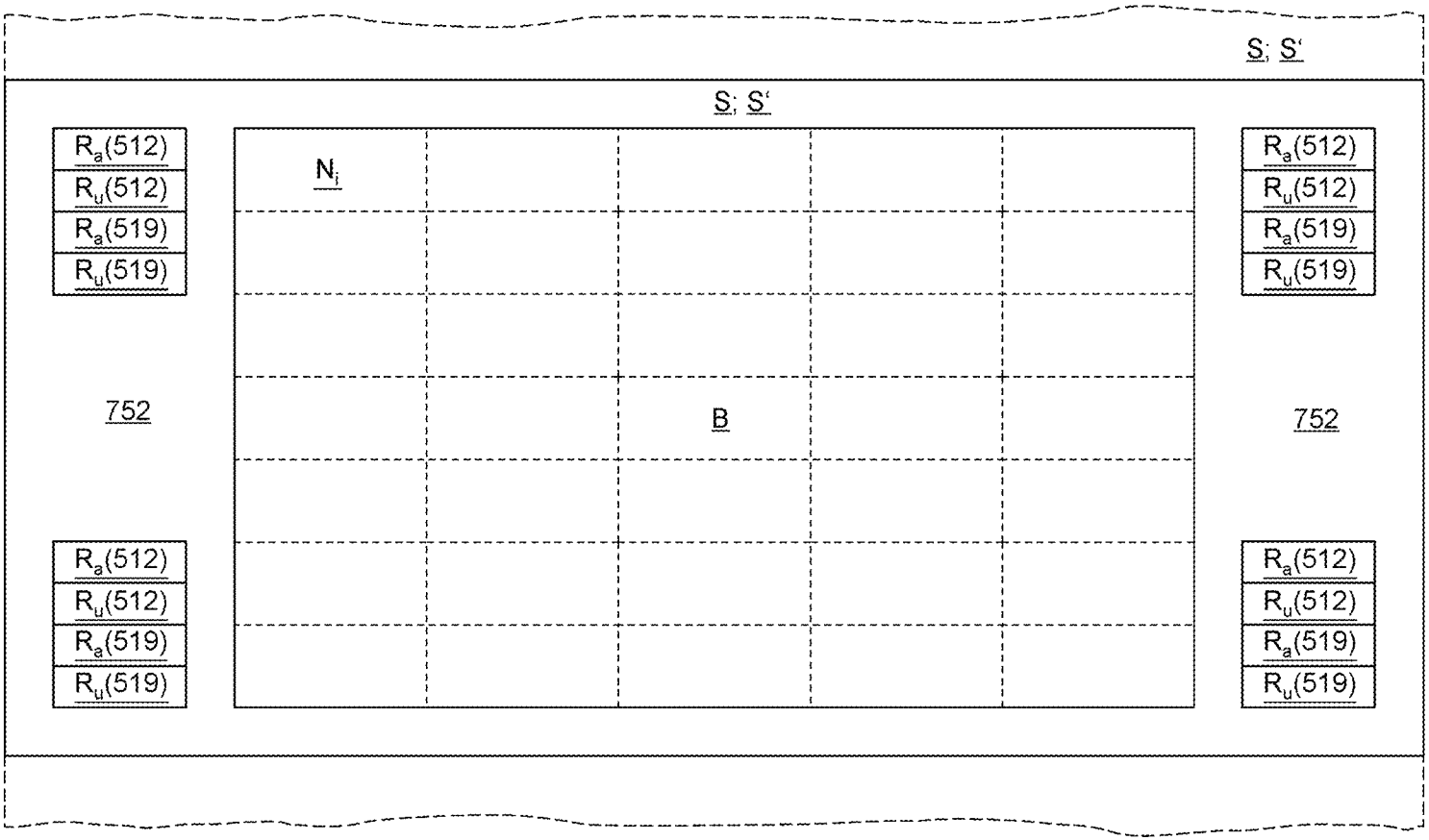
FIG. 49 a schematic representation of a section of substrate with test fields relating to the axial direction and circumferential direction of gravure inking cylinder and relief inking cylinder.

In an embodiment, comparable to the aforementioned configuration of the embodiment relating to the position of the gravure inking cylinder 512, of a Configuration relating to the position of multiple relief inking cylinders 519, e.g. five, as a test field $R_a$*(519); $R_u$*(519) of the printing unit 500, said test field preferably comprises at least one image element 766; 766'; 767; 767' configured as a test element 766; 766'; 767; 767' according, e.g. to the above first embodiment (see, e.g. FIG. 46), wherein in FIG. 48, by way of example, only two of the five groups of test elements depicted there are designated as 766 and 766' or as 767 and 767'. For example, one test element 766; 766'; 767; 767' will be or is printed by each of the provided inking trains 529; 532 or via each of the relief inking cylinders 519 comprised by these. The underlying elevations 524.6; 524.7 on the relief inking cylinders and the 519 recesses 514.6; 514.7 on the forme cylinder 512 are preferably arranged relative to one another such that the test elements 766; 766' relating to the axial position are aligned with one another on the substrate S; S' in the direction of the printing length, at least at one of their ends, when the gravure inking cylinders 512 are in the correct relative position, and the test elements 767; 767' relating to the position in the circumferential direction are aligned with one another on the substrate S; S' in the direction of the printing width, at least at one of their ends, when the relief inking cylinders 519 are in the correct relative position (see, e.g., FIG. 49). Here again, in terms of a viewing of the respective gravure inking cylinder 512 toward the forme cylinder 503, the test elements 766; 766'; 767; 767' act as a type of register marks 766; 766'; 767; 767', whereas in a consideration of the position of the gravure inking cylinders 512 relative to one another said test elements act as a type of register or color register marks 766; 766'; 767; 767'.

Thus, the position of the test elements 766; 766'; 767; 767' or groups of test elements 766; 766'; 767; 767' relative to one another in a test field $R_a$*(519); $R_u$*(519), which are inked via the various relief inking cylinders 519, is used to check information about the register, i.e. the position of the relief inking cylinders 519 relative to one another, and the relative position between at least one test element 766; 766'; 767; 767' that is inked via at least one associated relief inking cylinder 519, and at least one reference element 768; 769 to be associated with the same test field $R_a$*(519); $R_u$*(519) is used to check the relative position between the relevant gravure inking cylinder 512 and the forme cylinder 503.

For a test field $R_a$*(519); $R_u$*(519) that comprises the test elements 766; 766'; 767; 767' of multiple relief inking cylinders 519, a single reference element 768; 769 may be provided. Preferably, however, multiple reference elements 768; 769 are provided, e.g. on different sides of the grouping of test elements 766; 766'; 767; 767', in particular at least one on each of the four sides of the grouping. The at least one reference element 763; 764 can then be applied via one of the relief inking cylinders 512 involved.

A substrate section S; S', in particular configured for an aforementioned checking, which can generally be formed, e.g. by a web section S; S' having a repeat length that corresponds to a print length, or preferably by a printed substrate sheet S; S', comprises, e.g. in addition to a print image printed according to the gravure printing process, an arrangement of printed image elements 761; 762; 763; 764 of a test field $R_a$(512); $R_a'$(512); $R_a''$(512); $R_a'''$(512); $R_a$*(512); $R_u$(512); $R_u'$(512); $R_u''$(512); $R_u'''$(512); $R_u$*(512), the relative position and/or optical effect of which can be used to draw conclusions about the existence of a faulty relative position in the axial and/or the circumferential direction during the printing of the image elements 761; 762; 763; 764, between a forme cylinder 503, which has recesses 514.1; 514.2; 514.3; 514.4 on its circumference, and a first inking unit cylinder 512 of an inking unit 508, which inks the forme cylinder 503 and which has recesses 513.1; 513.2; 513.3; 513.4 corresponding to said former recesses on its circumference.

Said substrate section S; S' preferably comprises at least one test field $R_a$(512); $R_a'$(512); $R_a''$(512); $R_a'''$(512); $R_a$*(512) that characterizes the relative axial position and at least one test field $R_u$(512); $R_u'$(512); $R_u''$(512); $R_u'''$(512); $R_u$*(512) that characterizes the relative position in the circumferential direction.

In a refinement that enables a distinction between register errors and printing forme length, for example, the substrate section S; S' comprises, over a printing length, two test fields $R_u$(512); $R_u'$(512); $R_u''$(512); $R_u'''$(512); $R_u$*(512) spaced apart from one another and characterizing the relative position in the circumferential direction.

In an embodiment of the substrate section S; S' that corresponds to the first embodiment above, the test field $R_a$(512); $R_a'$(512); $R_a''$(512); $R_a'''$(512); $R_a$*(512); $R_u$(512); $R_u'$(512); $R_u''$(512); $R_u'''$(512); $R_u$*(512) comprises an image element 763; 764 printed as reference element 763; 764 and one printed as test element 761; 762, which carries in its position relative to the reference element 763; 764 the information regarding the relative position between the forme cylinder and the first inking unit cylinder (503; 512).

In an embodiment of the substrate section S; S' that corresponds to the second embodiment above, the test field $R_a$(512); $R_a'$(512); $R_a''$(512); $R_a'''$(512); $R_a$*(512); $R_u$(512); $R_u'$(512); $R_u''$(512); $R_u'''$(512); $R_u$*(512) comprises a group of evenly spaced linear image elements 761; 762 that vary in terms of the intensity of their coloring, and the intensity profile of said group of elements can be used to draw conclusions regarding the existence of a faulty relative position in the axial and/or the circumferential direction between the first inking unit cylinder 512 and the forme cylinder 503 during the printing of the image elements 761; 762.

The substrate section S; S' preferably comprises printed image elements 766; 767; 768; 769, particularly on the same side, of at least one other test field $R_a$(519); $R_a'$(519); $R_a$*(519); $R_u$(519); $R_u'$(519); $R_u$*(519), the relative position of which elements can be used to draw conclusions regarding the existence of a faulty relative position in the circumferential and/or the axial direction during the printing of the image elements 766; 767; 768; 769 between the forme cylinder 503, which has the image-forming recesses 514 on its circumference, and a second inking unit cylinder 519 of the inking unit 508 that inks the forme cylinder 503, i.e. the relief inking cylinder 519, which has on its circumference elevations 524 or raised areas 522 that correspond to said recesses.

Preferably, the substrate section S; S' comprises at least one test field $R_a$(519); $R_a$'(519); $R_a$*(519) that characterizes the relative axial position of the relief inking cylinder 519 and at least test field $R_u$(519); $R_u$'(512); $R_u$*(512) that characterizes the relative position of said relief inking cylinder in the circumferential direction.

In an advantageous refinement, the substrate section S; S' comprises over a printing length two test fields $R_u$(519); $R_u$'(519); $R_u$*(519) spaced apart from one another and characterizing the relative position in the circumferential direction.

Although they can generally also be incorporated into the region of the print image, the test fields $R_a$(512); $R_a$'(512); $R_a$"(512); $R_a$'"(512); $R_a$*(512); $R_u$(512); $R_u$'(512); $R_u$"(512); $R_u$'"(512); $R_u$*(512); $R_a$(519); $R_a$'(519); $R_a$*(519); $R_u$(519); $R_u$'(519); $R_u$*(519) provided on the substrate section S; S' are preferably provided here in an edge region 752 of the substrate section S; S', outside of the print image formed by one or more printed copies $N_i$.

In an embodiment of the substrate section S; S' that is adapted for the particularly precise adjustment of the relative positions, said substrate section comprises, in each lateral edge region 752, two groups of test fields $R_a$(512); $R_a$'(512); $R_a$"(512); $R_a$'"(512); $R_a$*(512); $R_u$(512); $R_u$'(512); $R_u$"(512); $R_u$'"(512); $R_u$*(512); $R_a$(519); $R_a$'(519); $R_a$*(519); $R_u$(519); $R_u$'(519); $R_u$*(519) spaced apart from one another in the printing length direction, each group being provided with one test field $R_a$(512); $R_a$'(512); $R_a$"(512); $R_a$'"(512); $R_a$*(512) relating to the axial position of the gravure inking cylinder 512, one test field $R_u$(512); $R_u$'(512); $R_u$"(512); $R_u$'"(512); $R_u$*(512) relating to the position of the gravure inking cylinder 512 in the circumferential direction, one test field $R_a$(519); $R_a$'(519); $R_a$*(519) relating to the axial position of the relief inking cylinder (519), and one test field $R_u$(512); $R_u$'(519); $R_u$*(519) relating to the position of the relief inking cylinder 519 in the circumferential direction (see, e.g. FIG. 49, in which the spaced apart groups of test fields $R_a$(512); $R_u$(512); $R_a$(519) $R_u$(519) are denoted by way of example in the lateral edge region 752 for one of the exemplary embodiments set out above).

A printing unit 500, in particular for carrying out an aforementioned method, by means of which substrate S; S' can be printed according to a gravure printing process, comprises a forme cylinder 503, which has on its circumference an image-forming pattern of recesses 514, and an inking unit 508 by means of which the pattern of recesses 514 provided on the forme cylinder 503 can be inked, wherein the forme cylinder 503 can be inked partially from an inking device 511 via a first inking unit cylinder 512, which has recesses 513 on its outer cylindrical surface 518 that correspond to recesses 514 on the forme cylinder 503, and via a second inking unit cylinder 519 to be partially inked by the first inking unit cylinder 512. For generating an image element 761; 762; 763; 764 to be used for checking a relative position between the forme cylinder and the first inking cylinder 503; 512, however, the forme cylinder 503 has, within the printing width, but outside of the image-forming pattern of recesses 514 that supplies the print image of one or more copies Ni lying in the circumferential region, at least one recess 514.1; 514.2, which overlaps on the forme cylinder 503 only partially with a projection of a recess 513.1; 513.3; 513.2; 513.4, obtained on the forme cylinder 503 via the rolling in respective pairs of the inking unit cylinders 512; 519; 531 involved in the ink transport, which recess is provided in a defined position and location on the circumference of the first inking unit cylinder 512 for checking the relative position.

A printing press that is suitable especially, e.g. for carrying out the above method and/or for producing a substrate section S; S' of this type, having a printing unit 500 by means of which substrate S; S' can be printed according to a gravure printing process, comprises, e.g. a forme cylinder 503, which comprises on its circumference an image-forming pattern of recesses 514, and an inking unit 508 by means of which the pattern of recesses 514 provided on the forme cylinder 503 can be inked, wherein the forme cylinder 503 can be inked partially from an inking device 511 via a gravure inking cylinder 512, which has recesses 513 in the region of its outer cylindrical surface 518 that correspond to recesses 514 on the forme cylinder 503, and via a relief inking cylinder 519 to be partially inked by the gravure inking cylinder 512.

For a preferably automated checking and correction, the forme cylinder 503 thus comprises, within the printing width but advantageously outside of a region forming an image-forming pattern of recesses 514 that supplies the print image of one of more copies, at least one first recess 514.1; 514.2; 514.3; 514.4 for printing at least one first image element 761; 762; 766; 767 to be used for checking a relative position between the forme cylinder 503 and the first or second inking unit cylinder 512; 519, wherein in the printing press, specifically in the substrate path or at the test console, a sensor system 753 is provided for detecting the first image element 761; 762; 766; 767, and evaluation means for evaluating the position of the first image element 761; 762; 766; 767 on the substrate S; S' and/or relative to a second image element 763; 764; 768; 769, and control and drive means 756; 616; 736; 698; 749 are provided for correcting a faulty relative position of the first or second inking unit cylinder 512; 519.

Software implemented in the sensor system 753 or in control means 756 connected thereto in terms of signals communication may be provided and/or configured in such a way that, using said software, based on the result of the evaluation of the position of the at least one image element 761; 762; 766; 767; 763; 764; 768; 769 of the same test field ($R_a$(512); $R_a$'(512); $R_a$"(512); $R_a$'"(512); $R_a$*(512); $R_u$(512); $R_u$'(512); $R_u$"(512); $R_u$'"(512); $R_u$*(512); ($R_a$(519); $R_a$*(519); $R_u$(519); $R_u$*(519), a correcting variable for the drive means (616; 736; 698; 749) affected by the correction of the position deviation can be output.

The at least one first recess 514.1; 514.2; 513.2; 513.4 overlaps only partially on the forme cylinder 503 with a projection, obtained on the forme cylinder 503 by rolling, by the rolling in respective pairs of the inking unit cylinders 512; 519; 531 involved in the ink transport, of one of at least two recesses 513.1; 513.3; 513.2; 513.4 provided in a defined position and location on the circumference of the first inking unit cylinder 512 for checking the relative position.

The forme cylinder 503 preferably has at least two recesses 514.1; 514.2; 514.3; 514.4, one of which overlaps only partially and the other of which overlaps at least partially with a projection, obtained by rolling, of one of at least two recesses 513.1; 513.3; 513.2; 513.4 provided in a defined manner on the circumference of each gravure inking cylinder 512.

In a first embodiment, a recess 514.1; 514.2 extending linearly can be provided on the circumference of the forme cylinder 503 outside of the image-forming pattern, and a recess 513.1; 513.2 preferably likewise extending linearly can be provided on the circumference of the gravure inking cylinder 512, such that a projection of the recess 513.1; 513.2 that extends on the gravure inking cylinder 512, obtained on the forme cylinder 503 via the rolling in respective pairs of the inking unit cylinders 512; 519; 531 involved in the ink transport, overlaps with the recess 514.1; 514.2, in an advantageously linear embodiment at an angle, in particular perpendicular when rolled out, to the recess 514.1; 514.2 extending on the forme cylinder 503.

In a second embodiment, e.g. on the forme cylinder 503, a first group of linear first recesses 514.1; 514.2, side by side in the axial direction or in the circumferential direction and spaced evenly from one another by a first distance, are provided outside of the image-forming pattern on the forme cylinder 503, and on the circumference of the gravure inking cylinder 512, a second group of linear second recesses 513.1; 513.2, spaced evenly from one another by a second distance, are provided such that the alignment of the first and second linear recesses 514.1; 514.2; 513.1; 513.2 on the forme cylinder or on the gravure inking cylinder 503; 512 is the same on the respective cylinder, in that the second distance deviates slightly from the first distance, i.e. by less than a line width of the first recesses 514.1; 514.2, and in that projections of the recesses 513.1; 513.2 extending on the gravure inking cylinder 512, which are obtained on the forme cylinder 503 via the rolling in respective pairs of the inking unit cylinders 512; 519; 531 involved in the transport of ink, overlap at least partially with recesses 514.1; 514.2 lying outside of the image-forming pattern on the forme cylinder 503.

In an advantageous embodiment, on the circumference of the forme cylinder 503 a recess 514.6; 514.7 extending linearly is provided on the circumference outside of the image-forming pattern, and on the gravure inking cylinder 512, an elevation 524.6; 524.7; 524.8; 524.9 extending on the circumference and shorter as viewed in its longitudinal direction than the former recess 514.1; 514.2 on the forme cylinder 503, or a shorter raised area 522.6; 522.7; 522.8; 522.9, are provided such that a projection of the elevation 524.6; 524.7; 524.8; 524.9 extending on the circumference of the second inking unit cylinder 512, which projection is obtained on the forme cylinder 503 via the rolling in respective pairs of the inking unit cylinders 512; 519; 531 involved in the ink transport, only partially overlaps the corresponding recess 514.6; 514.7 on the forme cylinder 503.

Generally independently of the specific position and/or specific configuration of the inking device 511, the embodiments and variants thereof, and/or the embodiments, forms, and variants set out above for the nature of the arrangement of the recesses 513 or engravings 513 on the gravure inking cylinder 512, the means to assist with the mounting of a sleeve 637 set out above, and/or the drive concept or the drive configuration set out above and/or an aforementioned checking and/or adjustment and/or correction of the relative position, but advantageously in conjunction with one of the aforementioned embodiments, forms, and variants of the same, a procedure and means for controlling the transfer of ink in the inking unit 508 or in the respective inking train 529; 532 are provided and preferably are embodied as set out below.

The transfer of ink via the inking unit cylinders and/or printing unit cylinders 512; 519; 531; 503 to the printing nip 502 is generally predetermined, in total and also for each print image section, for a certain production run on the intake side of the inking unit 508 by the pattern of recesses 513 on the gravure inking cylinder 512 and the volume thereof, with the methods described below being used to implement a variation of this essentially predefined size for the particular, print image-specific characteristics of the pattern. In the figures, which serve only to explain the principle in qualitative terms, therefore, a numerical indication of the volume of an ink transfer has been dispensed with. The axis relating to the transfer of ink has been generalized here and is referred to without a physical unit as the transfer rate TR. Such a transfer rate TR could refer, for example, to the mass transport over a multiple or a factor of a rollout length, e.g. of the gravure inking cylinder 512 and could take the entire usable outer cylindrical surface 518 or only a partial region thereof into account. The transfer of ink or the transfer rate TR on the path of the printing ink 517 from the inking device 511 to the printing nip 502 ultimately determines the coating of the substrate S; S' with printing ink 517, e.g. the ink density in the print image.

Figure 50:
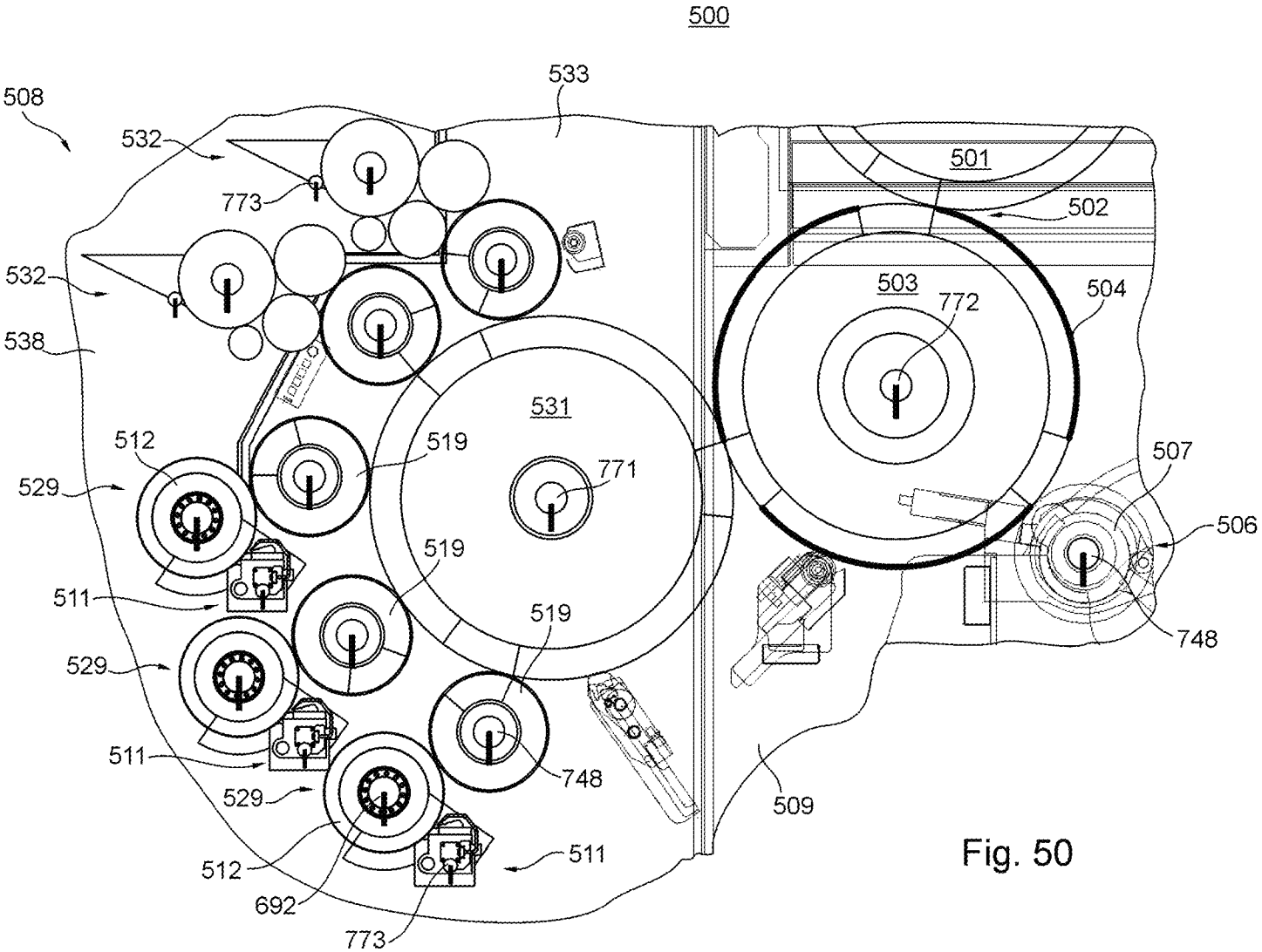
FIG. 50 a side view of a printing unit with temperature-controlled inking unit cylinders and printing unit cylinders.
Figure 51:
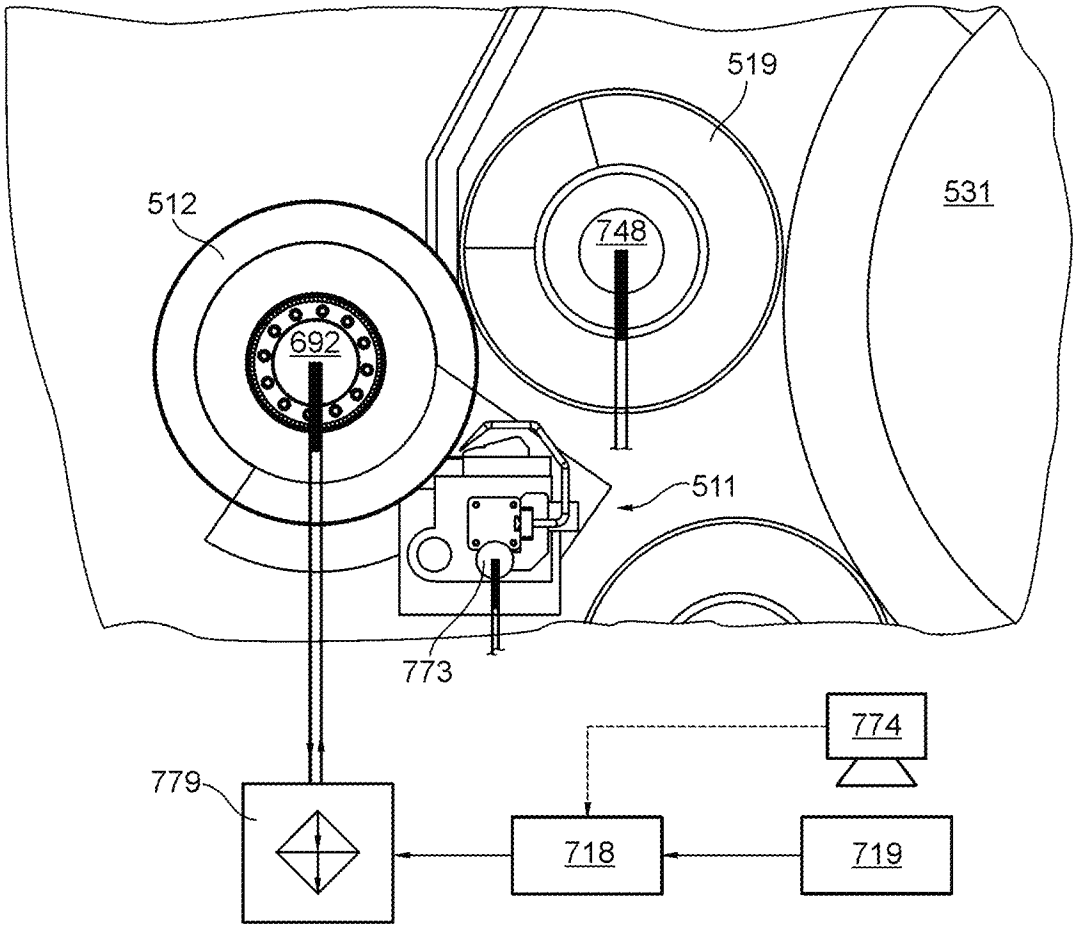
FIG. 51 an enlarged illustration of a detail from FIG. 50.

As set out above, in a preferred embodiment the gravure inking cylinder 512 can be temperature controlled, in particular it is configured such that temperature control fluid can flow through it. This takes place at the end face, for example, via a rotary feedthrough 692 (indicated only schematically in FIGS. 50 and 51, for example). In an advantageous refinement, the relief inking cylinder 519 can also be temperature controlled, with temperature control fluid flowing through it via the rotary feedthrough 748, for example, and/or the ink collecting cylinder 531, if provided, can be temperature controlled, with temperature control fluid flowing through it via an interface 771, for example, in particular rotary feedthrough 771, and/or the forme cylinder 503 can be temperature controlled, with temperature control fluid flowing through it via an interface 772, for example, in particular rotary feedthrough 772, and/or the wiping cylinder 507 can be temperature controlled, with temperature control fluid flowing through it via a rotary feedthrough 748, for example. The temperature control of the gravure inking cylinder and/or the relief inking cylinder 512; 519 is preferably provided for each of multiple selective inking trains 529, e.g. four or even five, of a multicolor printing unit.

The means for controlling the transfer of ink in the inking unit 508 preferably comprise, in addition to the temperature-controllable inking unit cylinder 512, control means via which the temperature on the inking unit cylinder 512 can also be varied during operation. Specifications can be provided to the control means manually, for example, via a user interface, or via a control circuit having a sensor system that evaluates the print image.

In an advantageous refinement of this first embodiment, the ink supply chamber 516 or the ink supply unit 571 can likewise be temperature-controlled, in particular with temperature control fluid flowing through it via a correspondingly provided interface 773, e.g. a fluid coupling 773.

In a printing unit 500 that has a mixed configuration of the inking trains 529; 531, e.g. having three selective and two conventional inking trains 529; 531, the duct roller and/or the ink fountain and/or the associated relief inking cylinder 519 of the conventionally configured inking train 531 can likewise be configured as temperature-controllable, in particular such that temperature control fluid can flow through it.

In a first application of the temperature control or temperature controllability of the inking unit cylinder(s) and/or printing unit cylinder(s) 512; 519; 531; 503 and/or of the ink supply chamber 516 or the ink supply unit 571, in particular at least of the gravure inking cylinder 512, the temperature control is used, in particular during stationary production printing at a constant operating speed V, to keep an operating temperature on the circumference of the relevant inking unit cylinder and/or printing unit cylinder 512; 519; 531; 503 or in the region of the contact surface of the ink supply chamber 516 or the ink supply unit 571 substantially constant, i.e. at most ±2° C., at a certain temperature value, e.g. a target temperature value $T_S$, thereby ensuring constant physical characteristics of the printing ink. Influences resulting, for example, from the introduction of heat from inking unit cylinders and/or printing unit cylinders 512; 519; 531; 503 rolling against one another and/or from a retaining means 526 that may be set against the gravure inking cylinder 512 are at least largely eliminated. In an advantageous embodiment, this target temperature value $T_S$ can be adjusted, so that for different printing conditions and/or printing ink compositions, different parameters for the desired target temperature value $T_S$ can be selected. The (respective) target temperature value $T_S$ can be set or modified via control means, which are integrated, for example, in the machine controller 718 or are implemented there as a software program or software program part, wherein parameters can be set via the user interface, e.g. of the press control console 719, for example. If multiple different inking unit cylinders and/or printing unit cylinders 512; 519; 531; 503 of the same inking unit 508 or inking train 529; 532 are temperature controlled, the same or different target temperature values $T_S$ may be specified or specifiable. The presetting of a target temperature value $T_S$ is understood here generally as the presetting of a target temperature value $T_S$ that represents the desired target temperature.

Figure 52:
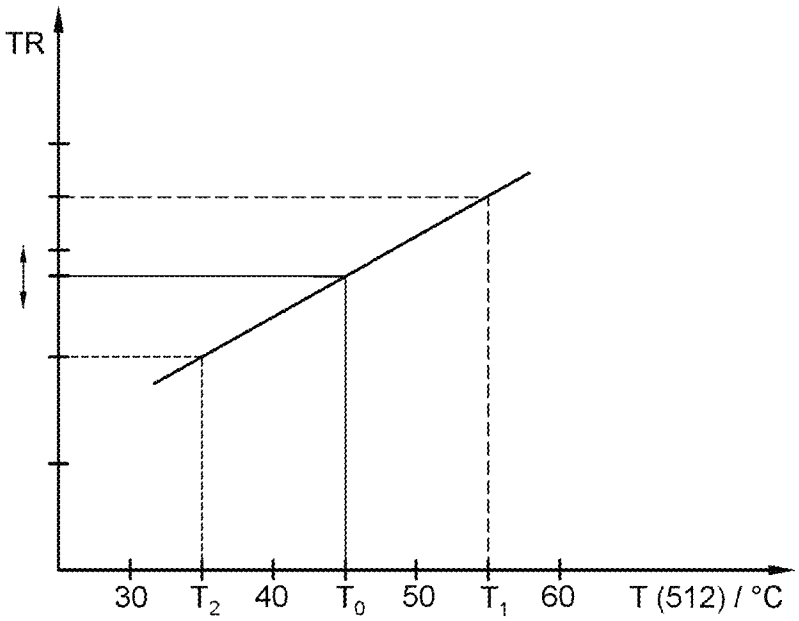
FIG. 52 a graph illustrating the curve of a transfer of ink in the printing unit as a function of the temperature on the circumference of the gravure inking cylinder.
Figure 53:
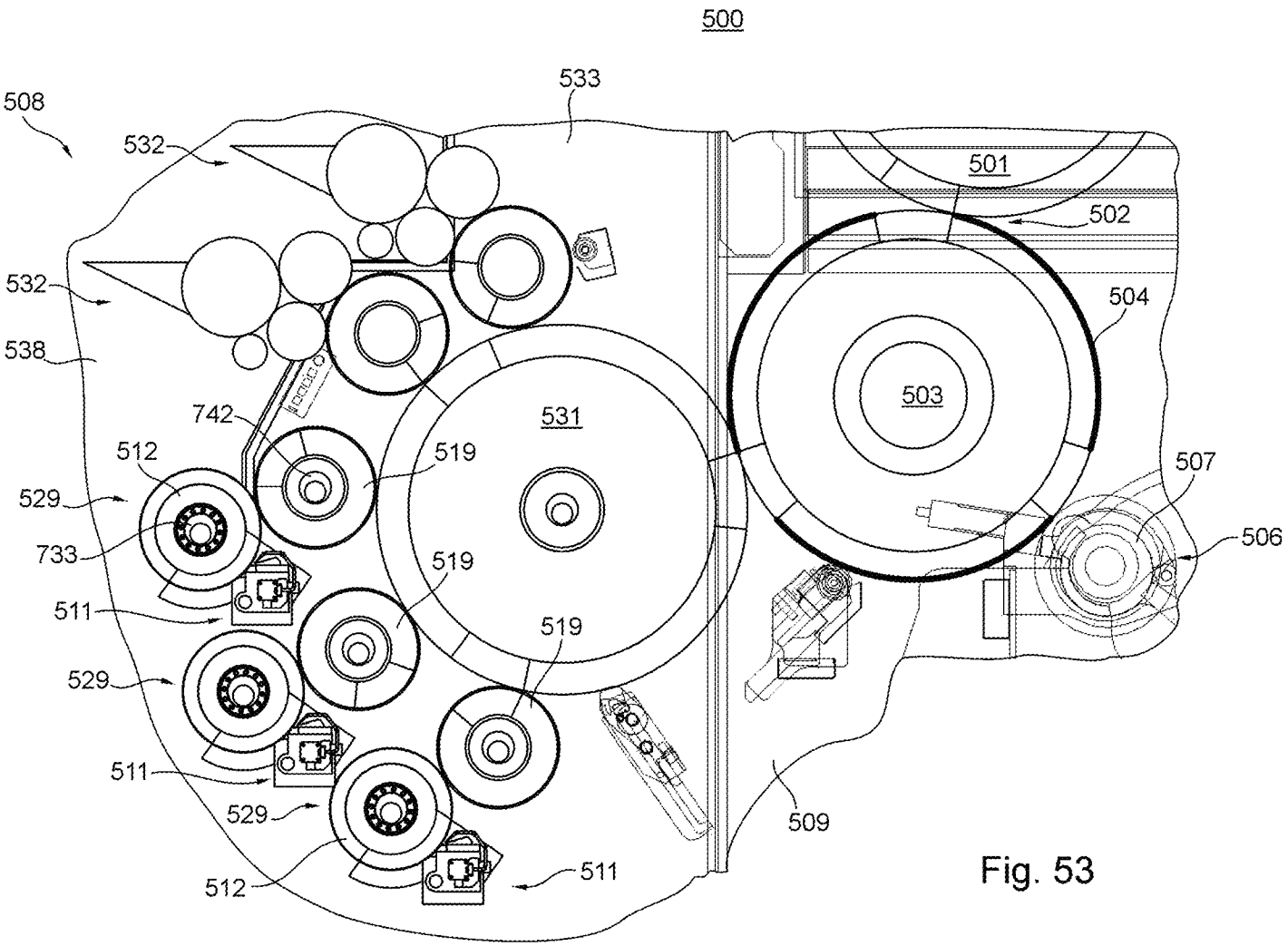
FIG. 53 a side view of a printing unit with radially displaceable inking unit cylinders and printing unit cylinders.
Figure 54:
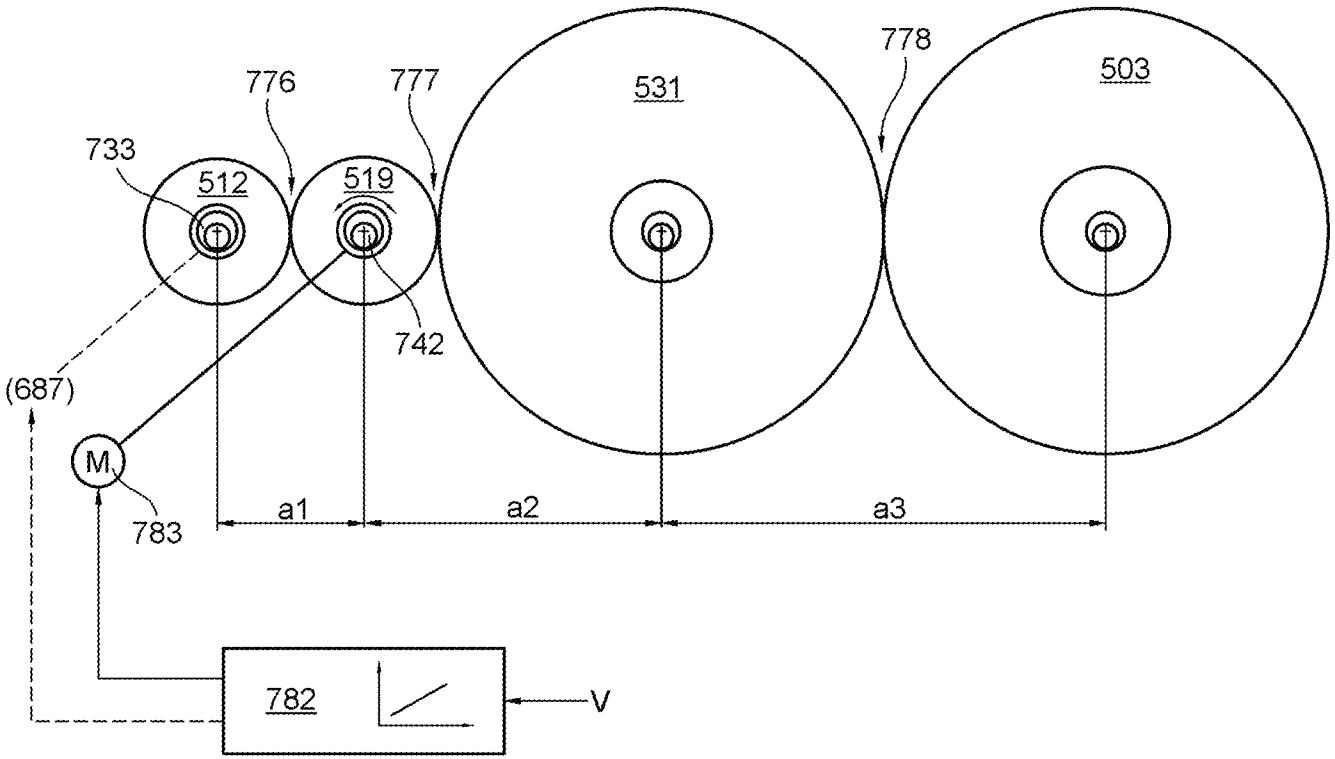
FIG. 54 a schematic illustration of a cylinder train with radially displaceable inking unit cylinders and printing unit cylinders.

In a second application of the temperature control or temperature controllability of the inking unit cylinder(s) and/or printing unit cylinder(s) 512; 519; 531; 503 and/or of the ink supply chamber 516 or the ink supply unit 571, in particular at least of the gravure inking cylinder 512, which second application is advantageous in place of or preferably in addition to the first application, to control and/or regulate the transfer of ink, the temperature of the relevant inking unit cylinder and/or printing unit cylinder 512; 519; 531; 503 or of the ink supply chamber 516 or of the ink supply unit 571 is controlled with a targeted change in the setting of the target temperature value $T_S$. A change in the target temperature value $T_S$ may be necessary and/or performed or introduced, for example, on the relevant inking unit cylinder and/or printing unit cylinder 512; 519; 531; 503, in particular e.g. on the gravure inking cylinder 512, when the relevant inking unit cylinder and/or printing unit cylinder 512; 519; 531; 503, in particular e.g. the gravure inking cylinder 512, is conveying too little or too much printing ink 517. The latter can be determined, for example, by the printer or by an optionally provided inspection system from insufficient or excess ink in the printed image, for example based on an ink density value that is too low or too high. If, for example, an insufficient amount of printing ink 517 is detected, the target temperature value $T_S$ for the relevant inking unit cylinder and/or printing unit cylinder 512; 519; 531; 503, in particular at least for the gravure inking cylinder 512 being used here for ink metering on the intake side, is increased. Conversely, if surplus printing ink 517 is detected, the target temperature value $T_S$ for the relevant inking unit cylinder and/or printing unit cylinder 512; 519; 531; 503, in particular at least for the gravure inking cylinder 512 used here for ink metering on the intake side, is decreased. The temperature at the gravure inking cylinder 512 can be varied in a targeted manner, for example, at least in the range between 35° C. and 55° C., or even between 25° C. and 60° C., via a corresponding variation of the target temperature value $T_S$. With a variation between 35° C. and 55° C. on the gravure inking cylinder 512, for example, particularly with otherwise constant conditions, a variation in the transfer of ink, i.e. the transfer rate TR for the printing ink 517, e.g. the transfer of ink to the printing nip 502, of e.g. 10%, in particular of 15% or more, can be achieved. If, for example at an initially set temperature, e.g. base temperature $T_0$, e.g. $T_0$=45° C., an insufficient amount of ink is detected in the printed image, the temperature at the gravure inking cylinder 512 will be set to a higher working temperature $T_1$, for example by changing the target temperature value $T_S$ accordingly. Conversely, if a surplus of ink is detected, the temperature at the gravure inking cylinder 512 will be adjusted to a lower working temperature $T_2$, for example by changing the target temperature value $T_S$ accordingly (see, e.g. schematically in FIG. 52). Preferably, a base temperature $T_0$ of, e.g. $T_0$=45° C. is used as the target temperature, with a control or regulation range of at least ±5° C., in particular ±10° C.

In addition to eliminating a deficiency or excess of printing ink 517 in the printed image, which may be necessary during the course of production, for example, adjusting the transfer of ink through the change in temperature may also be relevant to adapting the transfer of ink to changing external conditions, e.g. to differing physical properties of different printing inks 517 or to a certain operating speed V intended for production.

Although controlling the temperature to different target temperature values $T_S$ can generally be implemented in various ways, e.g. by controlling the temperature of the temperature control fluid to different temperatures, by varying the volumetric flow rate of the temperature control fluid, or by a combination of these, in this case a unit 779 that regulates the fluid temperature of at least the outgoing fluid to a setpoint value is preferably provided as the temperature control fluid source, e.g. a heating/cooling unit 779. The unit 779 can preferably be used to supply temperature control fluid at a selectable or adjustable temperature level.

If multiple inking units 529 are provided, the gravure inking cylinder 512 of each inking unit 529 is or can be temperature controlled individually and independently of the others to a target temperature value $T_S$. For this purpose, they are or will be temperature controlled independently of one another by their own dedicated temperature control means, in particular by their own dedicated temperature control fluid circuits that are adjustable with respect to the target temperature value $T_S$.

The evaluation of the print image and the adjustment or modification of the target temperature value $T_S$ can be carried out offline by the press operator, in particular by the printer. If an inspection system having, e.g. a sensor system 774 for examining the print image, in particular densitometrically, e.g. a densitometer 774 or a camera 774 capable of densitometric measurement, is provided, e.g. offline at an inspection table, e.g. at the press control console 719, or even inline in the substrate path, the adjustment or modification of the target temperature value $T_S$ based on the measurement result can be performed directly by the printer or, in place of this or alternatively, automatically in a control loop via a comparison with values from a reference image, e.g. judged as good or originating from the prepress stage.

Generally independently of the above adjustment, modification, or control of the transfer of ink effected by the targeted temperature control, but preferably in addition to this, the transfer of ink will be and/or is varied or controlled by varying the contact existing in the print-on position, i.e. the printing pressure δ; δ1; δ2; δ3, in at least one nip point 776; 777; 778 between two inking unit cylinders and/or printing unit cylinders 512; 519; 531; 503 involved in the transfer of ink between inking device 511 and printing point 502, in particular at least between gravure inking cylinder 512 and relief inking cylinder 519. This variation occurs in the print-on setting, i.e. while contact is maintained between the inking unit cylinders or printing unit cylinders 512; 519; 531; 503 involved. Print-on in this context refers to an operating state that is or can be provided for operation in which inking unit cylinders and/or printing unit cylinders 512; 519; 531; 503 are set against one another.

While the aforementioned adjustment or modification of the ink transfer or the transfer rate TR via temperature control is generally relatively sluggish, it can occur spontaneously via the aforementioned variation of the printing pressure. Thus, in a particularly advantageous embodiment, basic adjustments and longer-term adaptations to the transfer of ink are made through the aforementioned control and/or regulation of the temperature of at least one inking unit cylinder and/or printing unit cylinder 512; 519; 531; 503, in particular at least of the gravure inking cylinder 512, while dynamic changes in external conditions and/or short-term correction requirements are addressed by varying the contact, i.e. the printing pressure, in at least one nip point 776; 777; 778. Such changes or requirements may, for example, be the result of an event that alters the transfer of ink.

Here, the printing pressure δ; δ1; δ2; δ3 of two inking unit cylinders and/or printing unit cylinders 512; 519; 531; 503 that form a nip point 776; 777; 778 is characterized by the measure δ; δ1; δ2; δ3 by which the axial distance between the two inking unit cylinders and/or printing unit cylinders 512; 519; 531; 503 is smaller than an axial distance a1; a2; a3 that exists in the state of unstressed physical contact, i.e. physical contact without any contact force, thereby forming a contact strip in the region of the nip point 776; 777; 778 between the inking unit cylinders and/or printing unit cylinders 512; 519; 531; 503 involved at the nip point 776; 777; 778.

Figure 55:
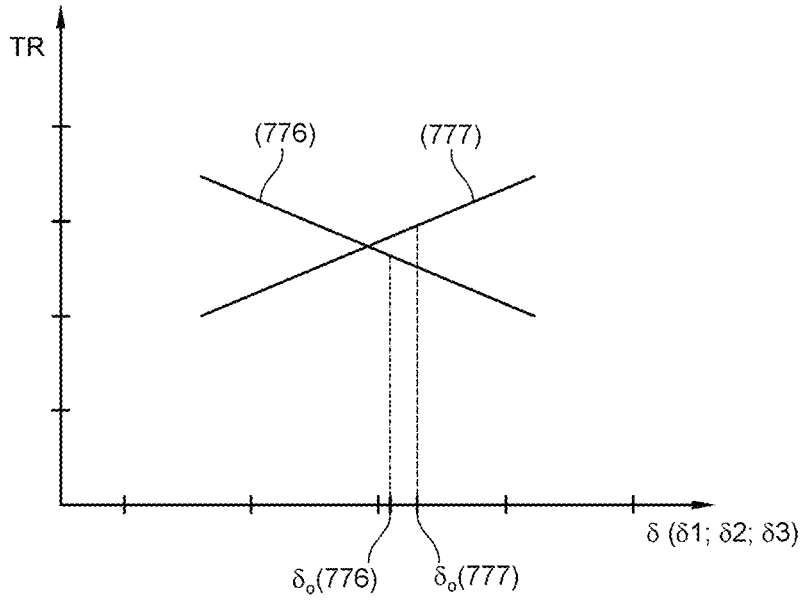
FIG. 55 a graphic illustration of an inverse dependency of ink transfer on the degree of printing pressure at a nip point with the involvement of a hard cylinder and/or a cylinder having engravings and at a nip point without the involvement of such a cylinder.

At a nip point 776; 778 in the cylinder train at which one of the inking unit cylinders or printing unit cylinders 512; 503 involved has a hard surface and/or recesses 513; 514 on its circumference, a variation in the printing pressure δ1; δ3 toward greater printing pressure δ1; δ3 will result in a decreasing transfer of ink, while a variation to less printing pressure δ1; δ3 will result in an increasing transfer of ink. This is true at least in a central working range of the printing pressure δ1; δ3 around a central operating setting (see, e.g. as plotted graphically in FIG. 55).

In contrast, at a nip point 777 in the cylinder train at which neither of the two inking unit cylinders or printing unit cylinders 519; 531 involved has a hard surface and/or recesses 513; 514 on its circumference, a variation in the printing pressure δ2 toward a greater printing pressure δ2 will result in an increasing transfer of ink, and a variation to less printing pressure δ2 will result in a decreasing transfer of ink.

This is true in each case at least in a mean working range of the printing pressure δ1; δ3, in each case around a mean operating setting for the printing pressure $\delta_0$(776); $\delta_0$(777) (see, e.g., the curves plotted schematically by way of example for the nip points 776 and 777 in FIG. 55).

Thus, the transfer of ink can be modified, in particular dynamically, by varying the printing pressure δ1; δ2; δ3 in at least one of the nip points 776; 777; 778, specifically the nip pint between gravure inking cylinder 512 and relief inking cylinder 519 and/or the nip point between relief inking cylinder 19 and the preferably provided transfer cylinder 531 and/or the nip point between the preferably provided transfer cylinder 531 and the forme cylinder 503, in each case in the appropriate direction. Advantageously, at least the printing pressure δ1 in the nip point 776 between gravure inking cylinder and relief inking cylinder 512; 519 is varied, but preferably both the printing pressure δ1 in the nip point 776 between gravure inking cylinder and relief inking cylinder 512; 519 and the printing pressure δ2 in the nip point 777 between and relief inking cylinder 519 and transfer cylinder 531 are varied simultaneously. Since the latter two nip points 776; 777 both include the relief inking cylinder 519 and changes to the printing pressure have opposite effects, to adjust or modify the transfer of ink using the means for modifying the printing pressure δ, only the relief inking cylinder 519 is moved, preferably such that the printing pressure δ1; δ2 between gravure inking cylinder and relief inking cylinder 512; 519 is increased, and at the same time such that the printing pressure between relief inking cylinder 519 and transfer cylinder 531 is reduced, or vice versa.

If a shortage of printing ink 517 is detected or anticipated, for example, the transfer of ink is increased by reducing the printing pressure δ1 in the nip point 776 between gravure inking cylinder and relief inking cylinder 512; 519 and/or by increasing the printing pressure δ2 in the nip point 777 between relief inking cylinder 519 and transfer cylinder 531. Conversely, in the case of an actual or anticipated surplus of printing ink 517, the transfer of ink is reduced by increasing the printing pressure δ1 in the nip point 776 between gravure inking cylinder and relief inking cylinder 512; 519 and/or by reducing the printing pressure δ2 in the nip point 777 between relief inking cylinder 519 and transfer cylinder 531.

The adjustment or modification of the transfer of ink by varying at least one printing pressure δ; δ1; δ2; δ3 is particularly suitable for corrections or modifications of the transfer of ink that are necessitated by changes occurring in the near term or by rapidly changing profiles of changes in the existing conditions that influence the transfer of ink. If such events or changes are predictable, in an advantageous application the adjustment or modification of the transfer of ink by varying at least one printing pressure δ; δ1; δ2; δ3 can also be used for advance control. In that case, e.g. at least one printing pressure δ; δ1; δ2; δ3 is varied in fixed correlation to the onset and/or profile of a change in the conditions prevailing during operation and influencing the transfer of ink.

Figure 56:
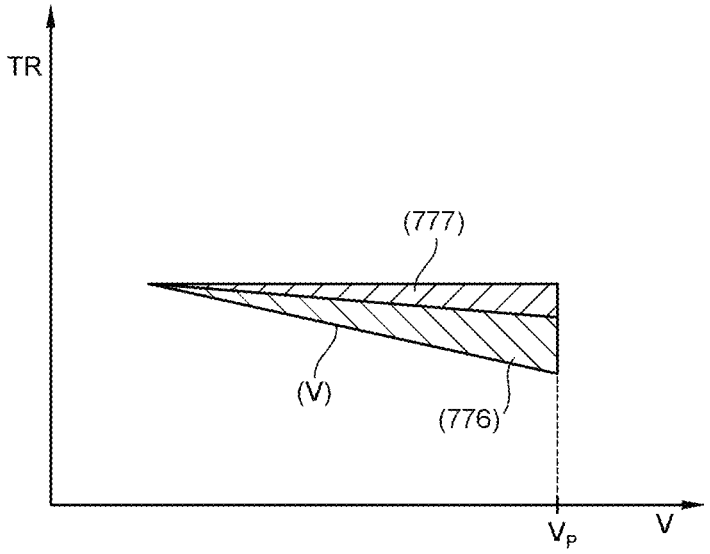
FIG. 56 a graphic illustration of a dependency of ink transfer on the operating speed without any compensation, with partially compensating superimposition of a variation in the printing pressure at a first nip point, and with superimposition of a variation in the printing pressure at two nip points.
Figure 57:
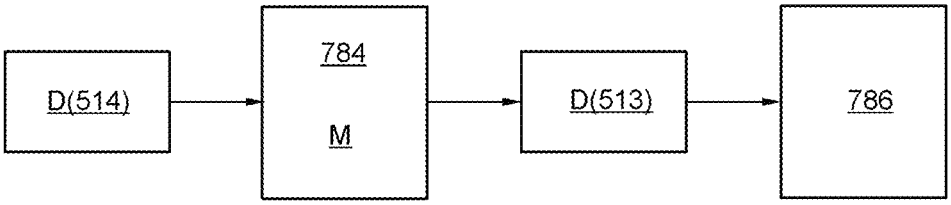
FIG. 57 a schematic representation of a process for producing the engravings for the gravure inking cylinder.

Experience has shown, for example, that the transfer of ink varies with the operating speed V such that the transfer of ink decreases as operating speed V increases and increases as operating speed V decreases (see, e.g., the lowermost curve plotted in FIG. 56).

If the above dependency or dependencies are utilized and if the profile of the respective printing pressure δ; δ1; δ2; δ3 correlates with the operating speed V, then when operating speed V varies, as occurs with the start-up and the shutdown of the printing press, for example, a change in the transfer of ink that would otherwise occur accordingly can be offset at least partially (see, e.g. the middle and upper curves in FIG. 56 with the schematically plotted correction amounts, which raise the curve, from the printing pressures δ1; δ2 in nip points 776 and 777, which are varied in correlation with the speed profile).

Preferably, as operating speed V increases, the printing pressure δ1 in the nip point 776 between gravure inking cylinder and relief inking cylinder 512; 519 is decreased and/or the printing pressure δ2 in the nip point 777 between relief inking cylinder 519 and transfer cylinder 531 is increased. Conversely, as operating speed V decreases, the printing pressure δ1 in the nip point 776 between gravure inking cylinder and relief inking cylinder 512; 519 is increased and/or the printing pressure δ2 in the nip point 777 between relief inking cylinder 519 and transfer cylinder 531 is decreased. The increase or decrease preferably relates in each case to a setpoint value for the printing pressure δ that is used as a target value once the steady production speed $V_P$ (i.e., $V=V_P$) is reached. Thus, e.g. the starting value for the printing pressure δ1 between gravure inking cylinder and relief inking cylinder 512; 519 at low speeds lies above the desired printing pressure δ1 for stationary production operation, while the starting value for the printing pressure δ2 between relief inking cylinder 519 and transfer cylinder 531 at low speeds lies below the desired printing pressure δ2 for stationary production operation.

In controller 782, which is included in the press controller 718 or connected thereto, a corresponding functional or tabular correlation is preferably stored or implemented, which assigns a default value for a variable representing the printing pressure δ1 between gravure inking cylinder and relief inking cylinder 512; 519 and/or the printing pressure δ2 between relief inking cylinder 519 and transfer cylinder 531 to a current operating speed V. This variable representing the respective printing pressure δ1; δ2 may be a position value to be assumed by a sensor system that supplies a cylinder position, an adjustment value for a positioning drive, which can be controlled in the positioning path, for example, or any other variable that uniquely characterizes the relevant printing pressure δ1. For implementing the printing pressure δ1; δ2 assigned, e.g. via the relevant variable, corresponding control means and positioning drives are provided. If the gravure inking cylinder 512 is to be adjusted for this purpose, said positioning drives may be the aforementioned drive means 687 that effect the throwing-on/throwing-off of the gravure inking cylinder 512 or additional drive means for performing a fine adjustment, together with control means for controlling the same. In the preferred case that the relief inking cylinder 519, particularly only the relief inking cylinder, is to be adjusted for this purpose, said positioning drives may be drive means 783, in particular electromotive drive means, for throwing-on/throwing-off the relief inking cylinder 519, for example, which acts on the positioning mechanism of said cylinder, e.g. on the eccentric bushing that supports the relief inking cylinder 519. Alternatively, said positioning drives may be drive means that act on a stop means, with the stop means defining the thrown-on position, print-on, and being adjusted by means of the drive means to vary the printing pressure δ1; δ2.

In an advantageous combination of the two procedures, for example, as a result of a visual inspection or as a result of a discrepancy in the coloring, e.g. of a reference image, detected by a sensor system 774, both a rapid correction can be performed via an aforementioned variation of the printing pressure δ1; δ2 and the target temperature value $T_S$ can be modified. With the changing temperature and the accompanying change in the transfer of ink, the correction can then be reversed again, e.g. gradually, by varying the printing pressure δ1; δ2.

Generally independently of the specific position and/or specific configuration of the inking device 511, the embodiments and variants thereof, and/or the embodiments, forms, and variants set out above for the nature of the arrangement of the recesses 513 or engravings 513 on the gravure inking cylinder 512, the means to assist with the mounting of a sleeve 637 set out above, and/or the drive concept or the drive configuration set out above and/or an aforementioned checking and/or adjustment and/or correction of the relative position and/or an aforementioned measure or combination of measures for controlling the transfer of ink, but advantageously in conjunction with one of the aforementioned embodiments, forms, and variants of these, a procedure and means for the computer-assisted and/or computer-based transformation of image-forming recesses 514 present or to be provided on the forme cylinder 503 into specifications for corresponding recesses 513 to be provided on the gravure inking cylinder 512 and/or a procedure and means for the computer-assisted and/or computer-based variation of the coloring by means of recesses 514 to be provided or already present on the forme cylinder 503 are provided and are preferably embodied as set out below.

Once an objective and/or data-based pattern of the image-forming engravings 514 on the forme cylinder 503 or on the printing forme 504 to be arranged on the same has been created, specifications for the positioning and/or shaping of the corresponding recesses 513 on the gravure inking cylinder 512 are prepared based on the pattern of the image-forming recesses 514, and in particular for multicolor image motifs, taking into account the color separations involved. For this purpose, data processing means 784 are provided, by means of which data D(514), which are digitally available and/or which are or can be supplied, for describing a pattern of engravings 514 that are or will be provided on the forme cylinder 503 or on the printing forme 504 to be arranged on the same, e.g. regarding the location, shape and/or depth z (514) thereof, can be transformed into digital data D(513) for describing corresponding engravings 514 to be provided on the gravure inking cylinder 512. In producing the recesses 513 for the gravure inking cylinder 512, e.g. fixedly on the outer cylindrical surface 631 of the cylinder body 628 or on an outermost layer 633 of a detachable ink transfer forme 637, as set out above, these transformed data D(513) serve as specifications for the shape and/or depth z (513) of said recesses.

Figure 58:
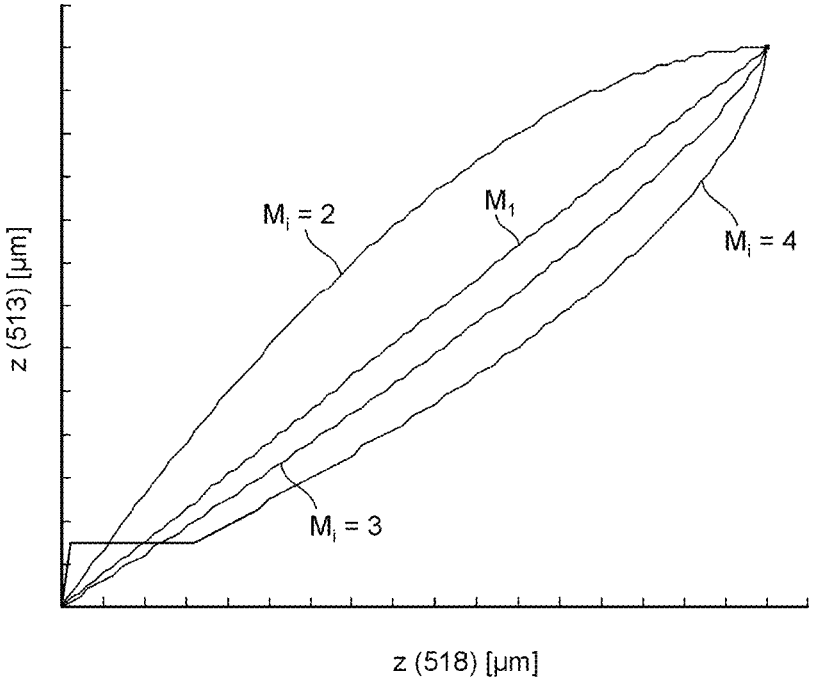
FIG. 58 examples of transformation rule curves.

The transformation is based at least on a first transformation rule M, e.g. a so-called mapping curve M; $M_i$, which assigns a depth z (513) of an engraving 513 to be produced on the gravure inking cylinder 512 to a value for a depth z (514) of an engraving 514 on the forme cylinder 503. Generally, such a transformation rule M; $M_i$ may be provided in various forms, e.g. as a table or preferably as a functional correlation (see e.g. FIG. 58), and may be stored or implemented in the data processing means 784. For a range of depths z (514) of the recesses 514 on the forme cylinder 503 of 10 μm to 100 μm, for example, a factor for a respective scaling of the depth lies between 1.2 and 1.8, for example, preferably between 1.4 and 1.6. The same scaling factor may be present over the entire range, in which case the resulting mapping curve $M=M_1$ is a straight line. However, for at least one application, for example for correcting and/or influencing a color effect, a mapping curve other than a straight line $M_1$; $M_2$; $M_3$ having a descending slope ($M_1$), an ascending slope ($M_2$; $M_{13}$), or even a turning point may be provided.

In an advantageous refinement, multiple such mapping curves M; $M_i$ may be provided or implemented or stored so that, after the image-forming pattern of recesses 514 on the forme cylinder 503 has been completed, for example, it is still possible to influence the coloring by selecting one of multiple different mapping curves $M_i$ for producing the recesses 513 on the gravure inking cylinder 513. Alternatively, the stored or implemented mapping curves $M_i$ may also be parameterizable, to allow an optimal curve shape, for example, to be selected or generated from the multitude of possibilities. If during the course of production or proofing, a need to change the coloring is identified, the printing outcome can optionally be influenced, e.g. improved, by replacing the pattern of recesses 513 on the gravure inking cylinder 512 with a pattern of recesses 513 produced according to a different mapping curve $M_i$.

The aforementioned data processing means 684 and optionally a means for engraving 786 ink transfer formes 686, e.g. an engraving device 786, which implements the engraving specifications supplied by said resulting data processing means, are located, for example, in the area of forme production, which is associated spatially with the print shop or with a prepress zone of the printing press, or may also be provided elsewhere.

While preferred embodiments of gravure printing units for printing on a substrate by a gravure printing method, in accordance with the present invention, have been set forth fully and completely herein above, it will be apparent to one of ordinary skill in the art that various changes could be made thereto, without departing from the true spirit and scope of the present invention, which is accordingly to be limited only by the appended claims.

The invention claimed is:

1. A gravure printing unit for printing onto substrate in a gravure printing method, the gravure printing unit comprising:

a forme cylinder, which forme cylinder has, on a circumference of the forme cylinder, image-forming forme cylinder recesses;

an inking unit for inking the image-forming forme cylinder recesses, the inking unit including a gravure inking cylinder, which gravure inking cylinder has, in a region of an outer cylindrical surface, gravure inking cylinder recesses that correspond to individual ones of the image-forming forme cylinder recesses;

an inking device, by the use of which inking device the gravure inking cylinder recesses can be inked at an application point located on a circumference of the gravure inking cylinder, the inking device including an ink supply chamber;

a second, relief inking cylinder, which cooperates with the gravure inking cylinder and which has, in a region of an outer cylindrical surface, ones of second, relief inking cylinder elevations, which ones of the second, relief inking cylinder elevations correspond to individual ones of the image-forming forme cylinder recesses on the circumference of the forme cylinder, and to the gravure inking cylinder recesses and raised areas, which ones of the raised areas correspond to areas of the image-forming forme cylinder recesses on the circumference of the forme cylinder;

a retaining device on the inking device, the retaining device being located on at least a downstream side of the application point, in an operating direction of rotation of the gravure inking cylinder that comprises the gravure inking cylinder recesses, the retaining device being configured as a doctor blade, which doctor blade is located on a downstream side, in an operating direction of rotation of the gravure inking cylinder, of the ink supply chamber, which doctor blade, in an operating position of the inking device, is in physical contact with the outer cylindrical surface of the gravure inking cylinder, and by the use of the doctor blade, printing ink one of lying on, and previously applied to non-engraved regions of the outer cylindrical surface of the gravure inking cylinder at the application point, and before contact of the gravure inking cylinder with the second, relief inking cylinder can be removed;

an inking unit frame, the inking unit frame having a first inking unit frame section including first inking unit frame section side parts, the gravure inking cylinder, the inking device for the gravure inking cylinder and the ink retaining device being connected to the first inking unit frame section side parts of the first inking unit frame section;

one of a printing unit frame and a second inking unit frame section of the inking unit frame, the first inking unit frame section being movably mounted with respect to one of the printing unit frame and the second inking unit frame section and being positioned by a first positioning drive, the inking device being mounted, coupled to the gravure inking cylinder in the first inking unit frame section wherein, when the gravure inking cylinder is moved radially, by movement of the first inking unit frame section with respect to the one of the printing unit frame and the second inking unit frame section, the inking device is moved along with the gravure inking cylinder and whereby a radial relative position between the gravure inking cylinder and the retaining device is maintained; and at least one of wherein the gravure inking cylinder, and the first inking unit frame section side parts of the first inking unit frame section that supports the inking device are arranged, on both sides on bearing rings, which bearing rings are supported eccentrically in one of the printing unit frame or the second inking unit frame section, and wherein the first inking unit frame section side parts carrying the gravure inking cylinder are mounted for linear movement with respect to one of the printing unit frame or the second inking unit frame section, and wherein joint movement of the first inking unit frame section side parts can be brought about by the first positioning drive embodied as one of an electric motor or a pressurized medium-actuated piston/cylinder system, and wherein an adjustable stop, that limits movement in a throwing-on direction of the first inking unit frame section is provided.

2. The gravure printing unit according to claim 1, wherein the second, relief inking cylinder comprises, on an outer cylindrical surface of the second, relief inking cylinder, the at least ones of second, relief inking cylinder ink-transferring individual elevations, corresponding to individual ones of the recesses of the image-forming forme cylinder recesses, at least have one of a maximum width of 1.0 mm in a region of their smallest diameter, and each have a width that is not more than 0.8 mm greater than a width of the corresponding ones of the image-forming forme cylinder recesses, and which match the ones of the image-forming forme cylinder recesses with a width that is one of not more than ten times greater, and which individually match individual ones of the image-forming forme cylinder recesses that are spaced by 1000 μm or less from one another, and have areas that one of have at least five non-contiguous elevations over a surface area of 10 $cm^2$, and have at least two non-contiguous elevations, each of which is spaced not more than 1000 μm from an adjacent elevation.

3. The gravure printing unit according to claim 1, wherein between the second, relief inking cylinder, which has the elevations, and the forme cylinder, a third inking unit cylinder is provided.

4. The gravure printing unit according to claim 1, wherein on the circumference of the gravure inking cylinder, downstream of the doctor blade, as viewed in an operating direction of rotation, a removal device is provided, by the use of which removal device, printing ink that one of collects on a downstream side of the doctor blade, as viewed in a direction of rotation of the gravure inking cylinder, is removed from an edge of the doctor blade, and printing ink that has collected on the downstream side of the doctor blade, as viewed in the direction of rotation of the gravure inking cylinder, and has been carried along on the gravure inking cylinder, is prevented from entering a nip point with the second, relief inking unit cylinder.

5. The gravure printing unit according to claim 1, wherein a second positioning drive, including a remotely actuatable drive means, is provided, by the use of which second positioning drive, one of the doctor blade, an ink supply unit that includes the doctor blade, and at least one of an ink supply chamber and the inking device, one of can be set against and moved away from the outer cylindrical surface of the gravure inking cylinder and can be varied, in terms of a force with which the doctor blade is set against the outer circumferential surface of the gravure inking cylinder, and which second positioning drive repositions one of the doctor blade, the ink supply unit, and the inking device, when an operative end of the doctor blade becomes shortened due to wear.

6. The gravure printing unit according to claim 1, wherein one of at least the retaining device and an ink supply unit that supports the retaining device and which one of the at least retaining device and the ink supply unit that supports the retaining device is mounted for axial movement in the inking device, can be one of moved axially and can be oscillated during operation by a drive in terms of its axial position relative to the gravure inking cylinder.

7. The gravure printing unit according to claim 1, wherein the gravure inking cylinder one of can be temperature controlled and is configured such that a temperature control medium can flow through the gravure inking cylinder.

8. The gravure printing unit according to claim 1, wherein the ink supply chamber, which ink supply chamber, on a side of the ink supply chamber facing the gravure inking cylinder, is delimited, at least partially, by the outer cylindrical surface of the gravure inking cylinder and one of forms and comprises the application point.

9. The gravure printing unit according to claim 1, wherein one of the inking device or the retaining device for removing printing ink from the outer cylindrical surface of the gravure inking cylinder cooperates with the gravure inking cylinder, on a side of the gravure inking cylinder facing the second, relief inking cylinder, as viewed relative to a vertical plane extending through a rotational axis of the gravure inking cylinder.

10. The gravure printing unit according to claim 1, one of wherein the gravure inking cylinder is mounted one of in and on the first inking unit frame section, which first inking unit frame section can be moved away from the one of the printing unit frame and the second inking unit frame section that supports at least the forme cylinder and wherein the inking unit is configured as being separable between the gravure inking cylinder and the second, relief inking unit cylinders.

11. The gravure printing unit according to claim 1, wherein the gravure inking cylinder comprises a cylinder body, which cylinder body one of is and can be mounted rotatably in the inking unit and on which cylinder body a circumferentially closed ink transfer forme sheath bearing the gravure inking unit cylinder, recesses on its outwardly facing surface, one of is and can be detachably arranged.

12. The gravure printing unit according to claim 1, wherein the forme cylinder has, on a circumference of the forme cylinder, and within a printing width and a printing length of the circumference of the forme cylinder to be inked, and outside of a region having the image-forming forme cylinder recesses that supply a printed image of one or more copies (Ni), at least one first linear recess for printing at least one first image element to be used for checking a relative position between the forme cylinder and the gravure inking cylinder, the at least one first linear recess overlapping, on the circumference of the forme cylinder, only partially with a projection, obtained by rolling, of a linear recess provided in a defined position and location on the circumference of the gravure inking cylinder for checking the relative position between the forme cylinder and the gravure inking cylinder.

13. The gravure printing unit according to claim 1, one of wherein the gravure inking cylinder can be driven, during production operation, individually by a separate gravure inking cylinder drive that is mechanically independent of a drive of the second, relief inking unit cylinder and of the forme cylinder, or wherein the gravure inking cylinder can be driven, together with the second, relief inking cylinder, by a drive that is mechanically independent of a drive means for rotating the forme cylinder during production operation.

* * * * *